US006206745B1

(12) United States Patent
Gabai et al.

(10) Patent No.: US 6,206,745 B1
(45) Date of Patent: Mar. 27, 2001

(54) PROGRAMMABLE ASSEMBLY TOY

(75) Inventors: Oz Gabai; Jacob Gabai, both of Tel Aviv; Nimrod Sandlerman, Ramat Gan, all of (IL)

(73) Assignee: Creator Ltd., Givat Shmuel (IL)

( * ) Notice: Subject to any disclaimer, the term of this patent is extended or adjusted under 35 U.S.C. 154(b) by 0 days.

(21) Appl. No.: 09/062,579

(22) Filed: Apr. 17, 1998

(30) Foreign Application Priority Data

May 19, 1997 (IL) ..... 120857

(51) Int. Cl.[7] ..... A63H 33/04; A63H 30/00; A63H 3/28

(52) U.S. Cl. ..... 446/91; 446/175; 446/299; 446/477

(58) Field of Search ..... 446/85, 91, 95, 446/175, 268, 299, 330, 332, 456, 476, 477, 478

(56) References Cited

U.S. PATENT DOCUMENTS

| | | | |
|---|---|---|---|
| 2,931,130 | 4/1960 | Rietz . | |
| 4,139,967 | 2/1979 | Kuna et al. . | |
| 4,660,033 | 4/1987 | Brandt | 446/299 X |
| 4,712,184 | 12/1987 | Haugerud . | |
| 4,717,364 | 1/1988 | Furukawa . | |
| 4,840,602 | 6/1989 | Rose . | |
| 4,894,040 | 1/1990 | Bach et al. . | |
| 4,923,428 | 5/1990 | Curran | 446/299 X |
| 4,938,483 | 7/1990 | Yavetz . | |
| 4,959,037 | 9/1990 | Garfinkel | 446/299 |
| 5,013,276 | 5/1991 | Garfinkel | 446/175 X |
| 5,021,878 | 6/1991 | Lang . | |
| 5,109,222 | 4/1992 | Welty . | |
| 5,142,803 | 9/1992 | Lang . | |
| 5,191,615 | 3/1993 | Aldava et al. . | |
| 5,195,920 | 3/1993 | Collier . | |
| 5,201,660 | 4/1993 | Copen et al. . | |
| 5,270,480 | 12/1993 | Hikawa . | |
| 5,289,273 | 2/1994 | Lang . | |
| 5,316,516 | 5/1994 | Saitoh | 446/175 |
| 5,388,493 | 2/1995 | Curletto . | |
| 5,435,769 | 7/1995 | Bertrand . | |
| 5,655,945 | 8/1997 | Jani | 446/175 |
| 5,752,880 * | 5/1998 | Gabai et al. | 446/298 X |
| 5,865,661 | 3/1999 | Cyrus et al. | 446/444 X |

FOREIGN PATENT DOCUMENTS

| | | |
|---|---|---|
| 3009040 | 9/1981 | (DE) . |
| 2224217 | 5/1990 | (GB) . |

* cited by examiner

*Primary Examiner*—D. Neal Muir
(74) *Attorney, Agent, or Firm*—Abelman, Frayne & Schwab

(57) ABSTRACT

A programmable assembly toy including a multiplicity of toy elements which are joinable to define a player selectable structure including a plurality of controllable toy elements which are joinable by a player with the selectable structure, and a player programmable control system for controlling the operation of the plurality of controllable toy elements.

27 Claims, 171 Drawing Sheets

280
1
7
6
8
VDD
C5
0.1μF
3
4
1 DIGITAL
R2
2
U4
MC33174
1K
C6
0.1μF
R3
10K
K1
220
J2
280
J4
SPEAKER OUT
RELAY DPDT
SPEAKER OUT
9
K2
230
J3
J5
LINE IN
RELAY DPDT
LINE IN
8
K3
230
J6
J7
LINE OUT
RELAY DPDT
LINE OUT

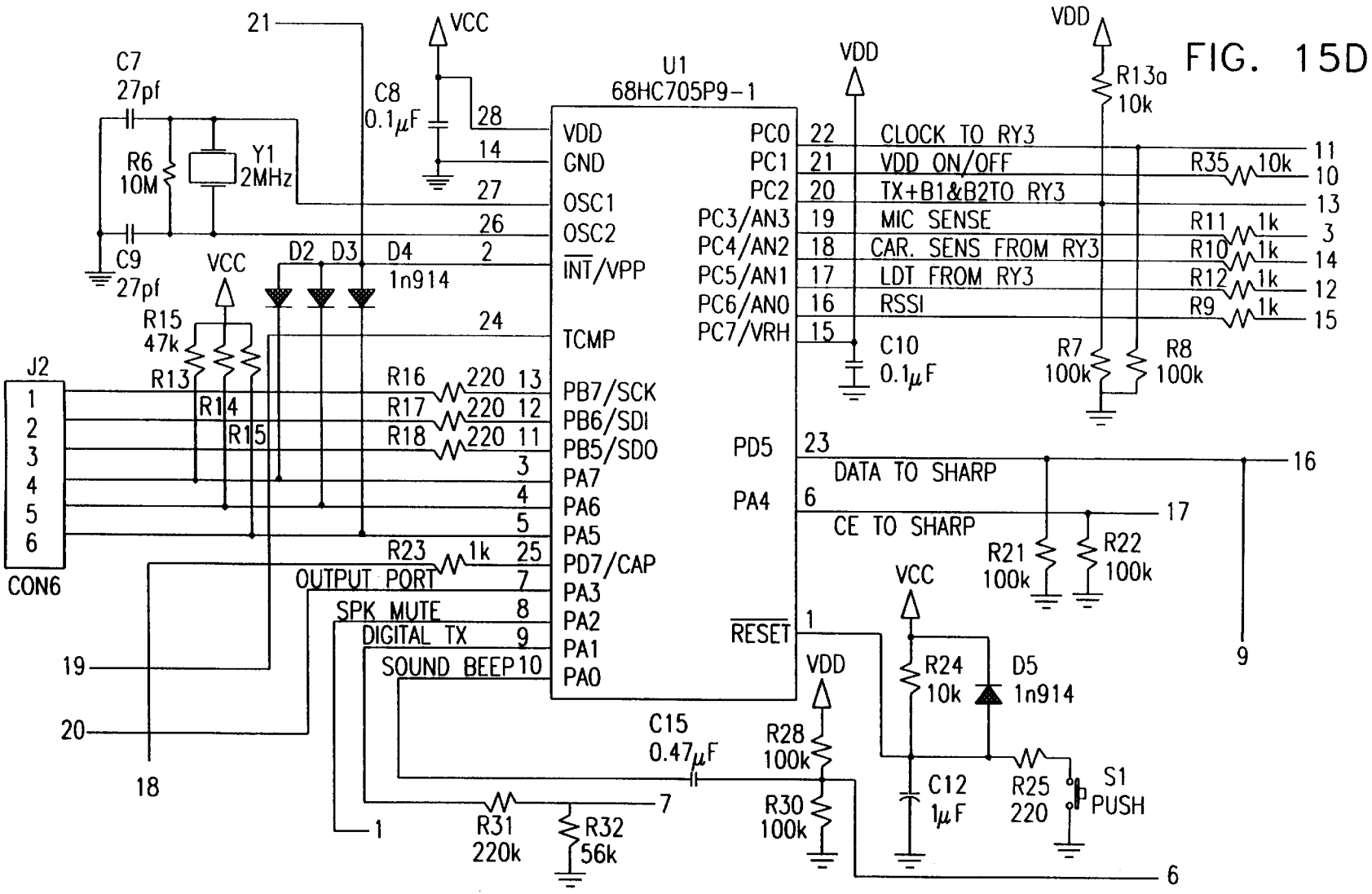
FIG. 15D
U1
68HC705P9-1
VDD
GND
OSC1
OSC2
INT/VPP
TCMP
PB7/SCK
PB6/SDI
PB5/SDO
PA7
PA6
PA5
PD7/CAP
PA3
PA2
PA1
PA0
PC0
PC1
PC2
PC3/AN3
PC4/AN2
PC5/AN1
PC6/AN0
PC7/VRH
PD5
PA4
RESET
CLOCK TO RY3
VDD ON/OFF
TX+B1&B2TO RY3
MIC SENSE
CAR. SENS FROM RY3
LDT FROM RY3
RSSI
DATA TO SHARP
CE TO SHARP
OUTPUT PORT
SPK MUTE
DIGITAL TX
SOUND BEEP
R13a 10k
R35 10k
R11 1k
R10 1k
R12 1k
R9 1k
R8 100k
R7 100k
C10 0.1μF
R22 100k
R21 100k
D5 1n914
R24 10k
R25 220
S1 PUSH
C12 1μF
R28 100k
R30 100k
C15 0.47μF
R32 56k
R31 220k
R16 220
R17 220
R18 220
R23 1k
D4 1n914
D3
D2
R14
R15
R13
R15 47k
C8 0.1μF
Y1 2MHz
C7 27pf
R6 10M
C9 27pf
J2
CON6
VCC
VDD 280
1
7
6
8
VDD
C5
0.1μF
3
4
1 DIGITAL
R2
1K
2
U4
MC33174
C6
0.1μF
R3
10K
K1
220
J2
SPEAKER OUT
280
J4
RELAY DPDT
SPEAKER OUT
9
K2
230
J3
J5
LINE IN
RELAY DPDT
LINE IN
8
K3
230
J6
J7
LINE OUT
RELAY DPDT
LINE OUT VDD
D2
1N4005
P1
210
MIDI INPUT
MIDI OUTPUT
8
15
7
14
6
13
5
12
4
11
3
10
2
9
1
MIDI CONNECTOR
4
5
2
8
9
3
VDD
R4
10k
C7
0.1μF
Q1
MPSA14
VDD
R5
10k
C8
0.1μF
Q2
MPSA14

PROGRAMMABLE ASSEMBLY TOY

FIELD OF THE INVENTION

The present invention relates to interlocking building block apparatus.

BACKGROUND OF THE INVENTION

Interlocking toy building blocks, such as Lego™, are well known.

Also well known in the art are toys which are remotely controlled by wireless communication and which are not used in conjunction with a computer system. Typically, such toys include vehicles whose motion is controlled by a human user via a remote control device.

U.S. Pat. No. 4,712,184 to Haugerud describes a computer controlled educational toy, the construction of which teaches the user computer terminology and programming and robotic technology. Haugerud describes computer control of a toy via a wired connection, wherein the user of the computer typically writes a simple program to control movement of a robot.

U.S. Pat. No. 4,840,602 to Rose describes a talking doll responsive to an external signal, in which the doll has a vocabulary stored in digital data in a memory which may be accessed to cause a speech synthesizer in the doll to simulate speech.

U.S. Pat. No. 5,021,878 to Lang describes an animated character system with real-time control.

U.S. Pat. No. 5,142,803 to Lang describes an animated character system with real-time control.

U.S. Pat. No. 5,191,615 to Aldava et al. describes an interrelational audio kinetic entertainment system in which movable and audible toys and other animated devices spaced apart from a television screen are provided with program synchronized audio and control data to interact with the program viewer in relationship to the television program.

U.S. Pat. No. 5,195,920 to Collier describes a radio controlled toy vehicle which generates realistic sound effects on board the vehicle. Communications with a remote computer allows an operator to modify and add new sound effects.

U.S. Pat. No. 5,270,480 to Hikawa describes a toy acting in response to a MIDI signal, wherein an instrument-playing toy performs simulated instrument playing movements.

U.S. Pat. No. 5,289,273 to Lang describes a system for remotely controlling an animated character. The system uses radio signals to transfer audio, video and other control signals to the animated character to provide speech, hearing vision and movement in real-time.

U.S. Pat. No. 5,388,493 describes a system for a housing for a vertical dual keyboard MIDI wireless controller for accordionists. The system may be used with either a conventional MIDI cable connection or by a wireless MIDI transmission system.

German Patent DE 3009-040 to Neuhierl describes a device for adding the capability to transmit sound from a remote control to a controlled model vehicle The sound is generated by means of a microphone or a tape recorder and transmitted to the controlled model vehicle by means of radio communications. The model vehicle is equipped with a speaker that emits the received sounds.

The disclosures of all publications mentioned in the specification and of the publications cited therein are hereby incorporated by reference.

SUMMARY OF THE INVENTION

The present invention seeks to provide improved interlocking toy elements and computerized interlocking toys.

There is thus provided, in accordance with a preferred embodiment of the present invention, a programmable assembly toy including a multiplicity of toy elements which may be joined together to define a player selectable structure including a plurality of controllable toy elements which may be associated by a player with the selectable structure, and a player programmable control system for controlling the operation of the plurality of controllable toy elements.

Further in accordance with a preferred embodiment of the present invention, the programmable toy also includes a toy application generator useful with the player programmable control system for enabling a player to program the player programmable control system.

Still further in accordance with a preferred embodiment of the present invention, the toy application generator provides multiple levels of programming ease so as to be suitable for use by players of different ages and skill levels.

Still further in accordance with a preferred embodiment of the present invention, the multiplicity of toy elements includes interlocking building blocks.

Also provided, in accordance with another preferred embodiment of the present invention, is an assembly toy including a multiplicity of interlocking bricks, and a stand configured to interlock with an individual one of the multiplicity of interlocking bricks, and at least one model figure fixedly mounted on the stand.

Further in accordance with a preferred embodiment of the present invention, the model figure includes a human model figure or an animal model figure. The model figure may be rigid and preferably is not configured to interlock with the interlocking bricks.

Also provided, in accordance with another preferred embodiment of the present invention, is an assembleable toy house including a multiplicity of interlocking bricks for building a structure of a house, a plurality of stands each configured to interlock with an individual one of the multiplicity of interlocking bricks, and a plurality of interior household item models fixedly mounted on the plurality of stands respectively.

Further in accordance with a preferred embodiment of the present invention, the plurality of interior household item models includes at least one of the following group: an article of furniture, a household appliance.

Still further in accordance with a preferred embodiment of the present invention, each interior household item model is not configured to interlock with the interlocking bricks.

Additionally in accordance with a preferred embodiment of the present invention, the player programmable control system is wirelessly associated with at least one of the multiplicity of toy elements.

Further in accordance with a preferred embodiment of the present invention, the player programmable control system includes a computer, and wherein the multiplicity of toy elements includes a first toy element having a radio transceiver/controller, and a second toy element associated by wire with the computer and including a radio transceiver operative to provide radio communication between the computer and the first toy element, and a controller operative to control the second toy element.

Moreover in accordance with a preferred embodiment of the present invention, the player programmable control system includes a computer, a computer radio interface communicating commands to the player selectable structure, a sound board device having at least one audio channel and transmitting commands from the computer to the computer radio interface over the at least one audio channel.

Additionally in accordance with a preferred embodiment of the present invention, wherein the at least one audio channel also comprises an audio channel from the computer radio interface to the sound board device over which digital information arriving from the player selectable structure is transmitted to the computer.

Further in accordance with a preferred embodiment of the present invention, the multiplicity of toy elements comprise at least one microphone and the control system comprises a speech recognition unit operative to recognize speech sensed by the at least one microphone and a speech-driven operation controller for controlling the operation of the plurality of controllable toy elements at least partly in accordance with contents of said speech.

Also provided, in accordance with another preferred embodiment of the present invention, is a toy control method comprising providing a multiplicity of toy elements joinable to define a player selectable structure including a plurality of controllable toy elements, programming a computer to control the operation of the plurality of controllable toy elements; and using the computer, once programmed, to control the operation of the plurality of controllable toy elements.

Further provided, in accordance with another preferred embodiment of the present invention, is a method for manufacturing assembly toys comprising providing a multiplicity of interlocking toy elements and providing a stand configured to interlock with at least one of the multiplicity of interlocking toy elements, said stand having at least one model figure fixedly mounted thereupon.

There is also provided in accordance with a preferred embodiment of the present invention a wireless computer controlled toy system including a computer system operative to transmit a first transmission via a first wireless transmitter and at least one toy including a first wireless receiver, the toy receiving the first transmission via the first wireless receiver and operative to carry out at least one action based on the first transmission.

The computer system may include a computer game. The toy may include a plurality of toys, and the at least one action may include a plurality of actions.

The first transmission may include a digital signal. The first transmission includes an analog signal and the analog signal may include sound.

Additionally in accordance with a preferred embodiment of the present invention the computer system includes a computer having a MIDI port and wherein the computer may be operative to transmit the digital signal by way of the MIDI port.

Additionally in accordance with a preferred embodiment of the present invention the sound includes music, a prerecorded sound and/or speech. The speech may include recorded speech and synthesized speech.

Further in accordance with a preferred embodiment of the present invention the at least one toy has a plurality of states including at least a sleep state and an awake state, and the first transmission includes a state transition command, and the at least one action includes transitioning between the sleep state and the awake state.

A sleep state may typically include a state in which the toy consumes a reduced amount of energy and/or in which the toy is largely inactive, while an awake state is typically a state of normal operation.

Still further in accordance with a preferred embodiment of the present invention the first transmission includes a control command chosen from a plurality of available control commands based, at least in part, on a result of operation of the computer game.

Additionally in accordance with a preferred embodiment of the present invention the computer system includes a plurality of computers.

Additionally in accordance with a preferred embodiment of the present invention the first transmission includes computer identification data and the second transmission includes computer identification data.

Additionally in accordance with a preferred embodiment of the present invention the at least one toy is operative to transmit a second transmission via a second wireless transmitter and the computer system is operative to receive the second transmission via a second wireless receiver.

Moreover in accordance with a preferred embodiment of the present invention the system includes at least one input device and the second transmission includes a status of the at least one input device.

Additionally in accordance with a preferred embodiment of the invention the at least one toy includes at least a first toy and a second toy, and wherein the first toy is operative to transmit a toy-to-toy transmission to the second toy via the second wireless transmitter, and wherein the second toy is operative to carry out at least one action based on the toy-to-toy transmission.

Further in accordance with a preferred embodiment of the present invention operation of the computer system is controlled, at least in part, by the second transmission.

Moreover in accordance with a preferred embodiment of the present invention the computer system includes a computer game, and wherein operation of the game is controlled, at least in part, by the second transmission.

The second transmission may include a digital signal and/or an analog signal.

Still further in accordance with a preferred embodiment of the present invention the computer system has a plurality of states including at least a sleep state and an awake state, and the second transmission include a state transition command, and the computer is operative, upon receiving the second transmission, to transition between the sleep state and the awake state.

Still further in accordance with a preferred embodiment of the present invention at least one toy includes sound input apparatus, and the second transmission includes a sound signal which represents a sound input via the sound input apparatus.

Additionally in accordance with a preferred embodiment of the present invention the computer system is also operative to perform at least one of the following actions: manipulate the sound signal; and play the sound signal.

Additionally in accordance with a preferred embodiment of the present invention the sound includes speech, and the computer system is operative to perform a speech recognition operation on the speech.

Further in accordance with a preferred embodiment of the present invention the second transmission includes toy identification data, and the computer system is operative to identify the at least one toy based, at least in part, on the toy identification data.

Still further in accordance with a preferred embodiment of the present invention the first transmission includes toy identification data. The computer system may adapt a mode of operation thereof based, at least in part, on the toy identification data.

Still further in accordance with a preferred embodiment of the present invention the at least one action may include movement of the toy, movement of a part of the toy and/or an output of a sound. The sound may be transmitted using a MIDI protocol.

There is also provided in accordance with another preferred embodiment of the present invention a game system including a computer system operative to control a computer game and having a display operative to display at least one display object, and at least one toy in wireless communication with the computer system, the computer game including a plurality of game objects, and the plurality of game objects includes the at least one display object and the at least one toy.

Further in accordance with a preferred embodiment of the present invention the at least one toy is operative to transmit toy identification data to the computer system, and the computer system is operative to adapt a mode of operation of the computer game based, at least in part, on the toy identification data.

The computer system may include a plurality of computers.

Additionally in accordance with a preferred embodiment of the present invention the first transmission includes computer identification data and the second transmission includes computer identification data.

There is also provided in accordance with a preferred embodiment of the present invention a data transmission apparatus including first wireless apparatus including musical instrument data interface (MIDI) apparatus operative to receive and transmit MIDI data between a first wireless and a first MIDI device and second wireless apparatus including MIDI apparatus operative to receive and transmit MIDI data between a second wireless and a second MIDI device, the first wireless apparatus is operative to transmit MIDI data including data received from the first MIDI device to the second wireless apparatus, and to transmit MIDI data including data received from the second wireless apparatus to the first MIDI device, and the second wireless apparatus is operative to transmit MIDI data including data received from the second MIDI device to the first wireless apparatus, and to transmit MIDI data including data received from the first wireless apparatus to the second MIDI device.

Further in accordance with a preferred embodiment of the present invention the second wireless apparatus includes a plurality of wirelesses each respectively associated with one of the plurality of MIDI devices, and each of the second plurality of wirelesses is operative to transmit MIDI data including data received from the associated MIDI device to the first wireless apparatus, and to transmit MIDI data including data received from the first wireless apparatus to the associated MIDI device.

The first MIDI device may include a computer, while the second MIDI device may include a toy.

Additionally in accordance with a preferred embodiment of the present invention the first wireless apparatus also includes analog interface apparatus operative to receive and transmit analog signals between the first wireless and a first analog device, and the second wireless apparatus also includes analog interface apparatus operative to receive and transmit analog signals between the second wireless and a second analog device, and the first wireless apparatus is also operative to transmit analog signals including signals received from the first analog device to the second wireless apparatus, and to transmit analog signal including signals received from the second wireless apparatus to the first analog device, and the second wireless apparatus is also operative to transmit analog signals including signals received from the second analog device to the first wireless apparatus, and to transmit analog signals including data received from the first wireless apparatus to the second analog device.

There is also provided in accordance with another preferred embodiment of the present invention a method for generating control instructions for a computer controlled toy system, the method includes selecting a toy, selecting at least one command from among a plurality of commands associated with the toy, and generating control instructions for the toy including the at least one command.

Further in accordance with a preferred embodiment of the present invention the step of selecting at least one command includes choosing a command, and specifying at least one control parameter associated with the chosen command.

Still further in accordance with a preferred embodiment of the present invention the at least one control parameter includes at least one condition depending on a result of a previous command.

Additionally in accordance with a preferred embodiment of the present invention at least one of the steps of selecting a toy and the step of selecting at least one command includes utilizing a graphical user interface.

Still further in accordance with a preferred embodiment of the present invention the previous command includes a previous command associated with a second toy.

Additionally in accordance with a preferred embodiment of the present invention the at least one control parameter includes an execution condition controlling execution of the command.

The execution condition may include a time at which to perform the command and/or a time at which to cease performing the command. The execution condition may also include a status of the toy.

Additionally in accordance with a preferred embodiment of the present invention the at least one control parameter includes a command modifier modifying execution of the command.

Still further in accordance with a preferred embodiment of the present invention the at least one control parameter includes a condition dependent on a future event.

Additionally in accordance with a preferred embodiment of the present invention the at least one command includes a command to cancel a previous command.

There is also provided for in accordance with a preferred embodiment of the present invention a signal transmission apparatus for use in conjunction with a computer, the apparatus including wireless transmission apparatus; and signal processing apparatus including at least one of the following analog/digital sound conversion apparatus operative to convert analog sound signals to digital sound signals, to convert digital sound signals to analog sound signals, and to transmit the signals between the computer and a sound device using the wireless transmission apparatus; a peripheral control interface operative to transmit control signals between the computer and a peripheral device using the wireless transmission apparatus; and a MIDI interface operative to transmit MIDI signals between the computer and a MDI device using the wireless transmission apparatus.

There is also provided in accordance with another preferred embodiment of the present invention a computer system including a computer, and a sound card operatively attached to the computer and having a MIDI connector and at least one analog connector, wherein the computer is operative to transmit digital signals by means of the MIDI connector and to transmit analog signals by means of the at least one analog connector.

Further in accordance with a preferred embodiment of the present invention the computer is also operative to receive digital signals by means of the MIDI connector and to receive analog signals by means of the at least one analog connector.

It is noted that throughout the specification and claims the term "radio" includes all forms of "wireless" communication.

BRIEF DESCRIPTION OF THE DRAWINGS

The present invention will be understood and appreciated from the following detailed description, taken in conjunction with the drawings in which:

FIGS. 1–32C illustrate a toy system for use in conjunction with a computer system wherein:

FIG. 3 is a simplified block diagram of a preferred implementation of the computer radio interface 110 of FIG. 1A;

FIG. 4 is a more detailed block diagram of the computer radio interface 110 of FIG. 3;

FIG. 6 is a simplified block diagram of a preferred implementation of the toy control device 130 of FIG. 1A;

FIG. 11 is a simplified flowchart illustration of a preferred method for generating control instructions for the apparatus of FIG. 1A;

FIG. 13 is a block diagram of a first sub-unit of a multi-port multi-channel implementation of the computer radio interface 110 of FIG. 1A, which sub-unit resides within computer 100 of FIG. 1A;

FIG. 14 is a block diagram of a second sub-unit of a multi-port multi-channel implementation of the computer radio interface 110 of FIG. 1A, which sub-unit complements the apparatus of FIG. 13 and resides exteriorly to computer 100 of FIG. 1A;

FIGS. 15A–15E, taken together, form a detailed electronic schematic diagram of the toy control device of FIG. 6, suitable for the multi-channel implementation of FIGS. 13 and 14;

FIG. 16 is a simplified flowchart illustration of a preferred method by which a computer selects a control channel pair in anticipation of a toy becoming available and starts a game-defining communication over the control channel each time both a toy and a transceiver of the computer radio interface are available;

FIG. 17 is a simplified flowchart illustration of a preferred method for implementing the "select control channel pair" step of FIG. 16;

FIG. 19 is a simplified flowchart illustration of a preferred method of operation of the toy control device 130;

FIG. 20 is a simplified illustration of a remote game server in association with a wireless computer controlled toy system which may include a network computer;

FIG. 21 is a simplified flowchart illustration of the operation of the computer or of the network computer of FIG. 20, when operating in conjunction with the remote server;

FIG. 22 is a simplified flowchart illustration of the operation of the remote game server of FIG. 20;

FIG. 23 is a semi-pictorial semi-block diagram illustration of a wireless computer controlled toy system including a proximity detection subsystem operative to detect proximity between the toy and the computer;

FIGS. 25A–25F, taken together, form a detailed schematic illustration of a computer radio interface which connects to a serial port of a computer rather than to the sound board of the computer;

FIG. 30 is a partly pictorial, partly block diagram illustration of a computer control system including a toy, constructed and operative in accordance with a further preferred embodiment of the present invention;

FIG. 31 is a block diagram is a simplified block diagram illustrating the combination of the computer radio interface and the toy control device as used in the embodiment of FIG. 30; and FIGS. 32A, 32B and 32C taken together form a simplified block diagram of the EPLD chip of FIG. 28H; and FIGS. 33–62 illustrates embodiments of the toy system of FIGS. 1–32C wherein:

FIG. 34 is a pictorial illustration of a programmable assembly toy in assembled form including a modular electric control unit interlocking with an effect producer and an integral unit including a modular electric control unit integrally formed with an effect producer;

FIG. 35 is a simplified block diagram of the interface between the computer radio interface of FIGS. 33A–34 and an associated sound card interfacing the computer;

FIG. 36 is a simplified block diagram of the computer radio interface of FIG. 35;

FIG. 38 is a simplified block diagram of the transceiver/controller 2100 of FIG. 33 which is associatable with one or more player selectable structures, typically with motors or actuators of these structures, via a wire;

FIG. 40 is a simplified detailed illustration of one of the player selectable structures of FIG. 33 which is associatable with the transceiver/controller of FIG. 33 via wire;

FIG. 43 is a pictorial illustration of a human model figure fixedly mounted on an integrally formed interlocking stand configured to interlock with interlocking toy elements;

FIG. 44 is a pictorial illustration of an interior household item having -an integrally formed interlocking stand which is not part of its inherent structure;

FIG. 45 is a pictorial illustration of an integrally formed combination of a human model figure and a interior household item both fixedly mounted onto an integrally formed interlocking stand;

FIG. 46 is a pictorial illustration of an animal model figure fixedly mounted on an integrally formed interlocking stand configured to interlock with interlocking toy elements;

FIG. 47 is a flowchart illustration of a preferred mode of interaction between a user and the computer;

FIG. 48 is a pictorial illustration of a screen display for the computer of FIGS. 33A–34 which enables a user to combine toy elements into a combined structure by providing a non-hierarchical non-pictorial display of toy elements to participate in a scheme;

FIG. 49 is a pictorial illustration of a screen display for the computer of FIGS. 33A–34 providing a non-hierarchical pictorial display of toy elements;

FIG. 50 is a pictorial illustration of a screen display for the computer of FIGS. 33A–34 providing a hierarchical pictorial display of toy elements;

FIG. 51 is a screen display enabling a user-defined toy structure to be associated with a particular connector-pair of a particular transceiver/controller;

FIG. 52 is a screen display in which the user is presented with each of the possible states of each multi-state toy element in the selected toy structure;

FIG. 53 is a screen display enabling a user to associate an action of a particular actuator with a particular condition of a particular state in a current state machine for a game in which the actuator is participating;

FIG. 54 is a screen display enabling the user to associate a condition on a particular sensor with a particular state (or with a particular action or next-state of that particular state) in a current state machine for a game in which the sensor is participating;

FIG. 55 is a screen display enabling a user to define parameters for parametric actions;

FIG. 56 is a simplified block diagram of the computer radio interface controller of FIG. 33B;

FIG. 57 is a simplified diagram of the interface between the computer radio interface and the soundboard;

FIG. 58 is a simplified block diagram of the computer interface;

FIG. 59 is a simplified flowchart of a preferred method allowing one of the computer radio interface and the computer to receive commands over the audio channel;

FIG. 60 is a diagram of the analog and digital representation of the SYNC, SQ, zero-valued bit and one-valued bit signals;

FIG. 62 is a pictorial illustration of an assembleable toy house, built from interlocking bricks and including interior household item models fixedly mounted on stands which interlock with the structure of the house.

Figure 8A:
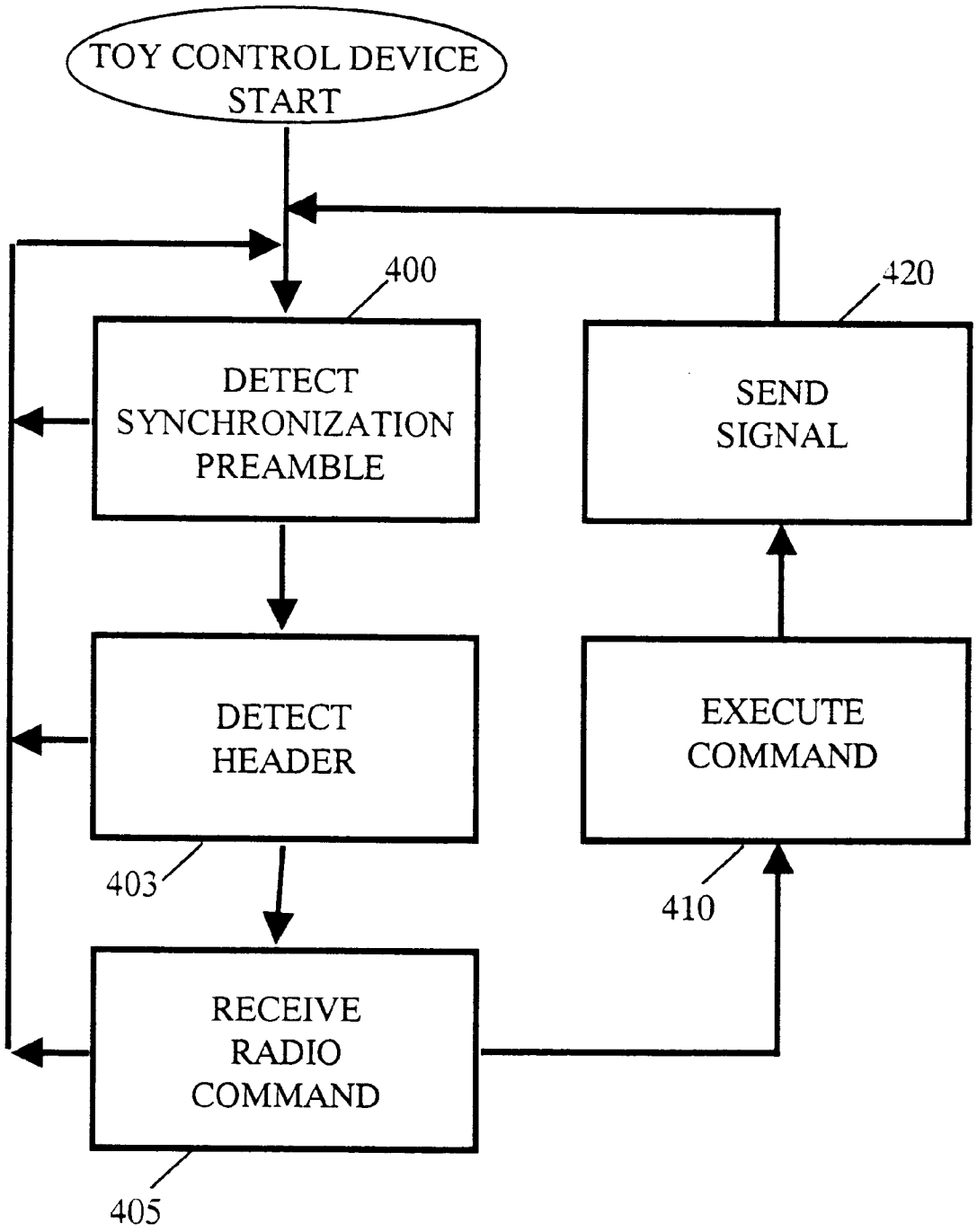
FIG. 8A is a simplified flowchart illustration of a preferred method for receiving radio signals, executing commands comprised therein, and sending radio signals, within the toy control device 130 of FIG. 1A.
Figure 8B:
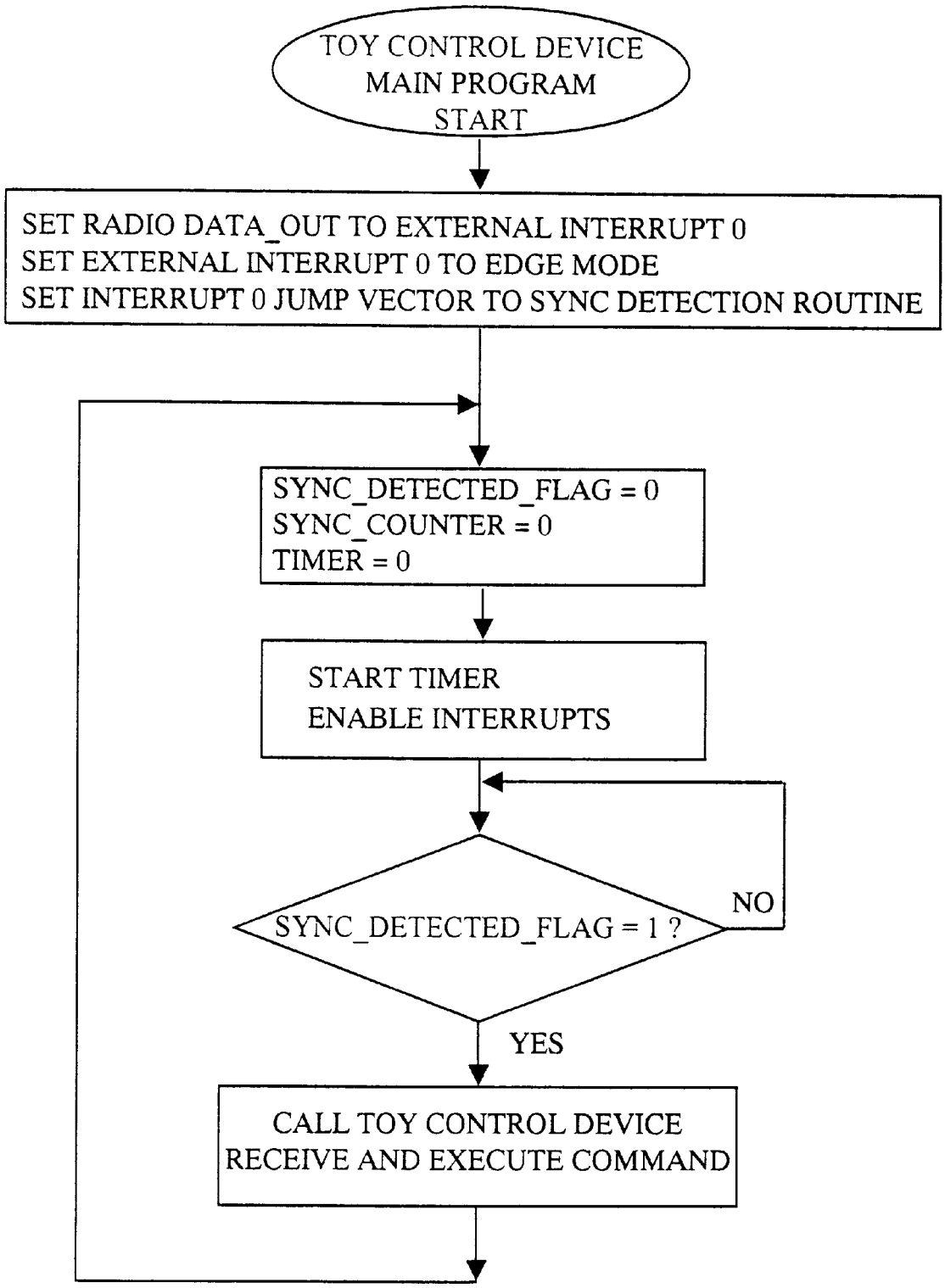
FIGS. 8B–8T, taken together, comprise a simplified flowchart illustration of a preferred implementation of the method of FIG. 8A.
Figure 8C:
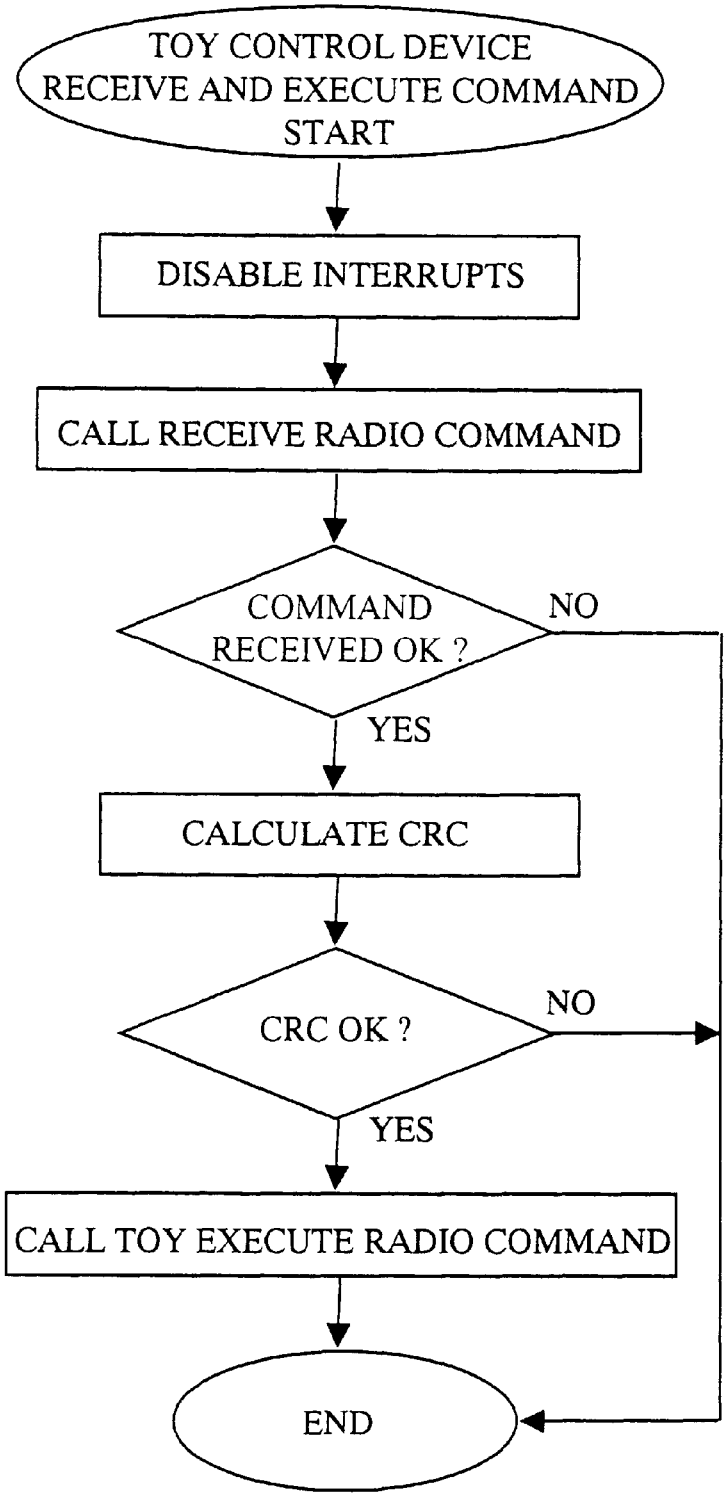
Figure 8D:
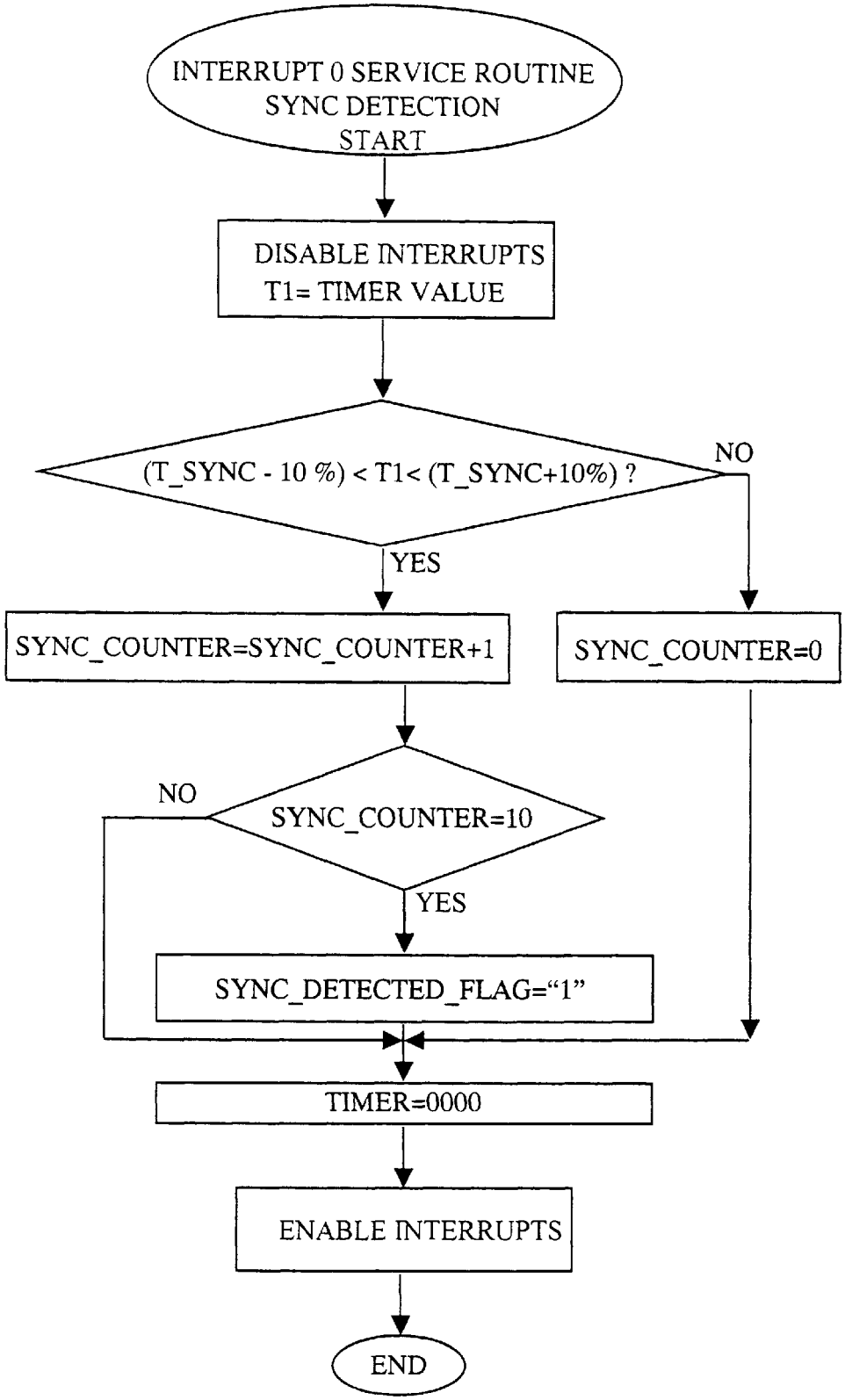
Figure 8E:
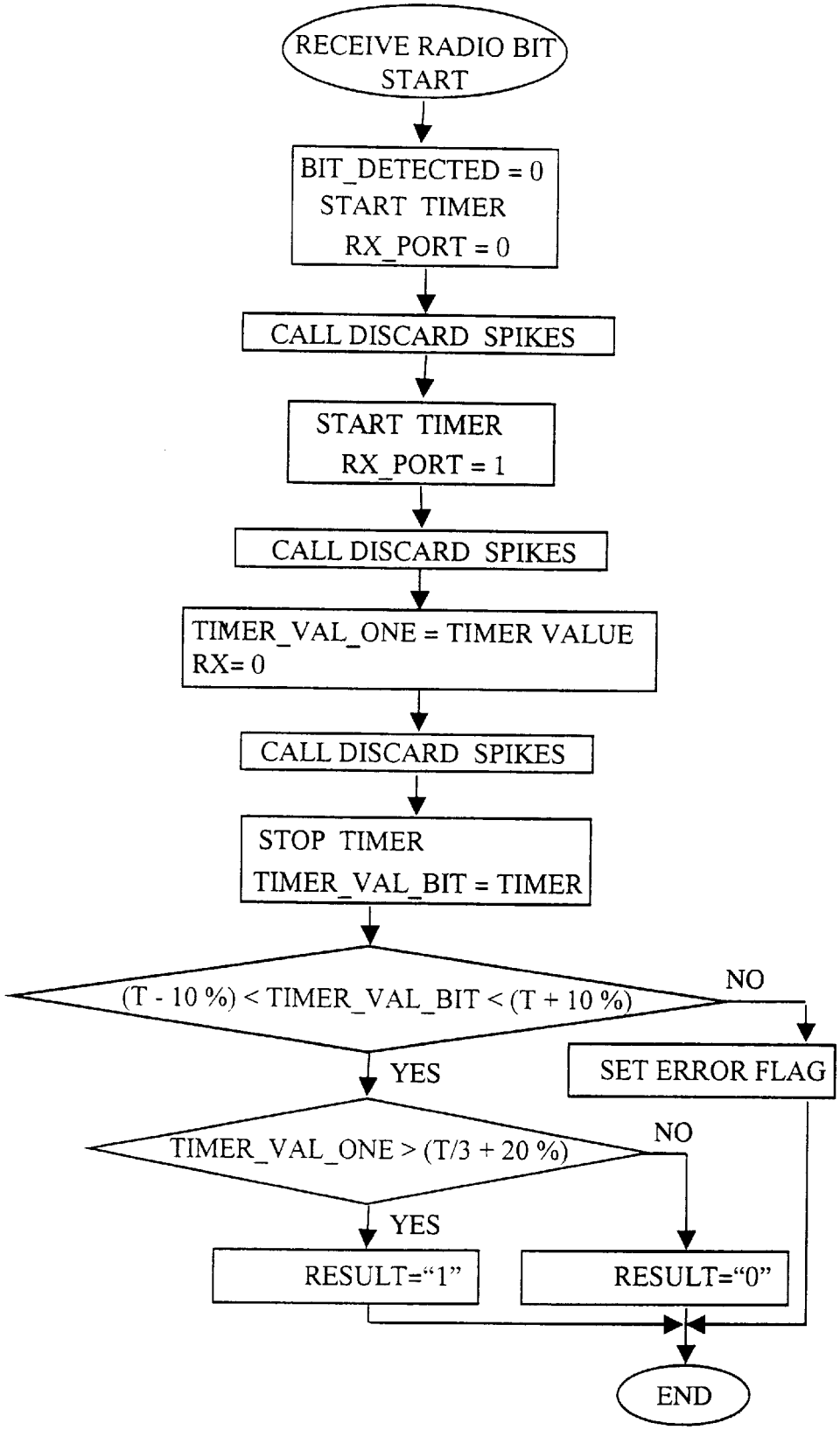
Figure 8F:
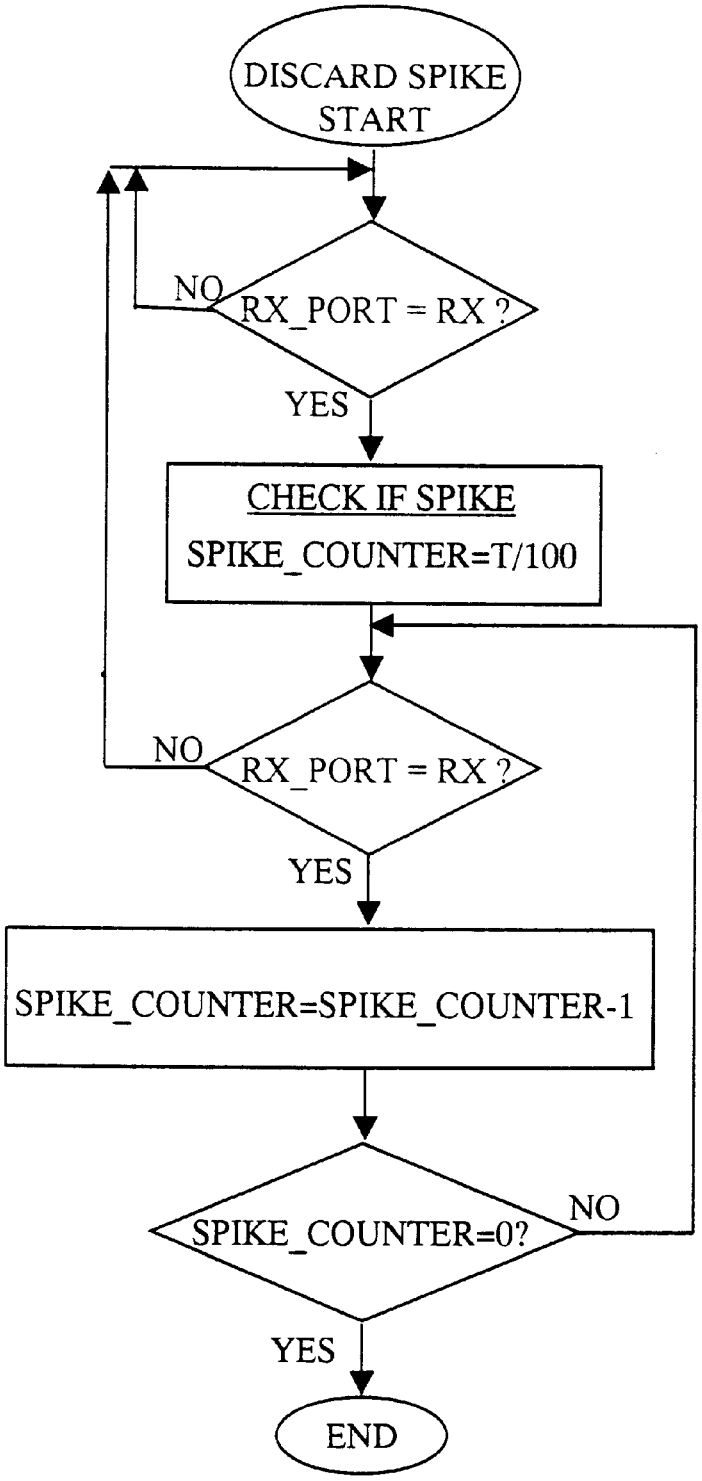
Figure 8G:
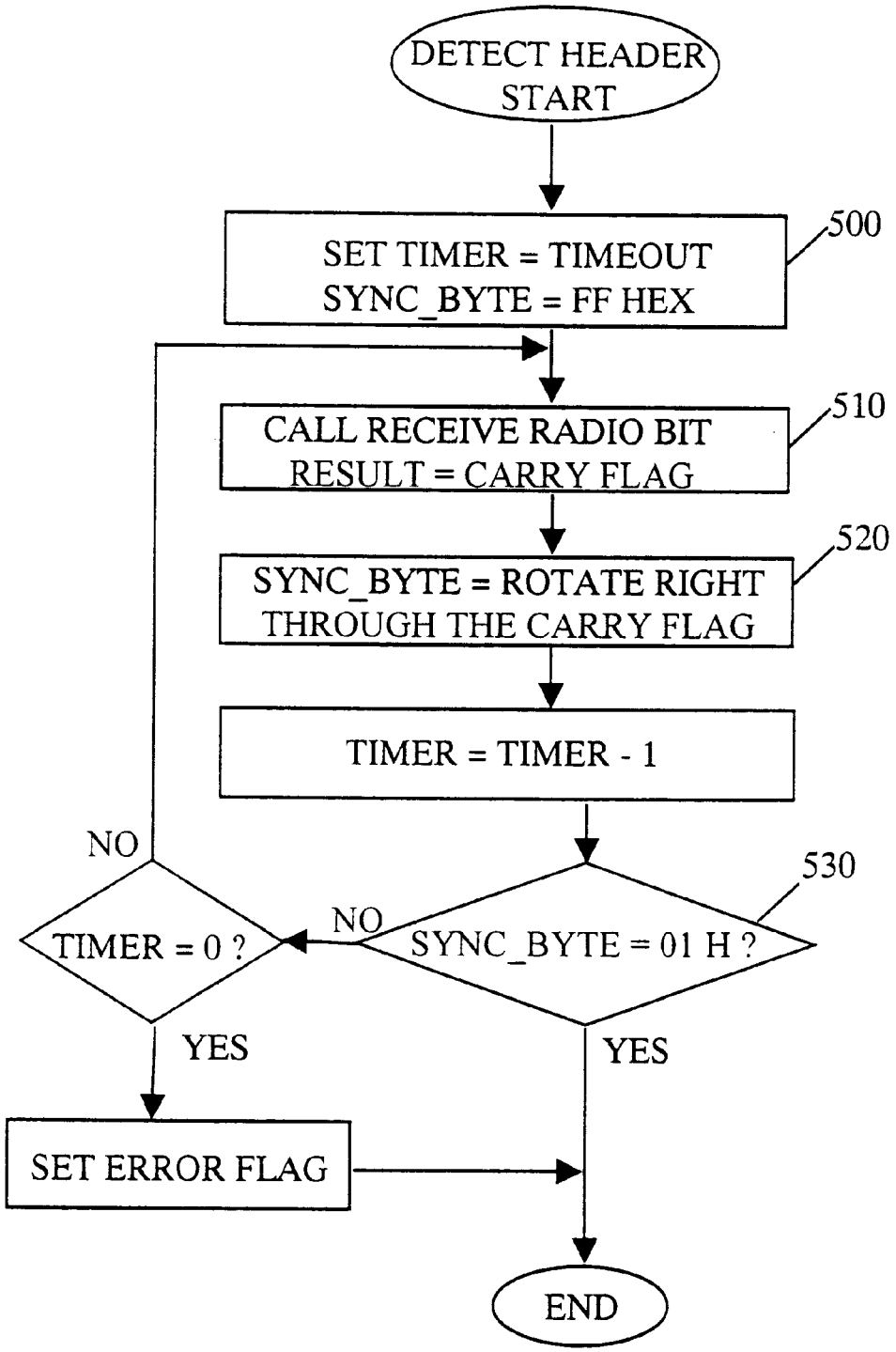
Figure 8H:
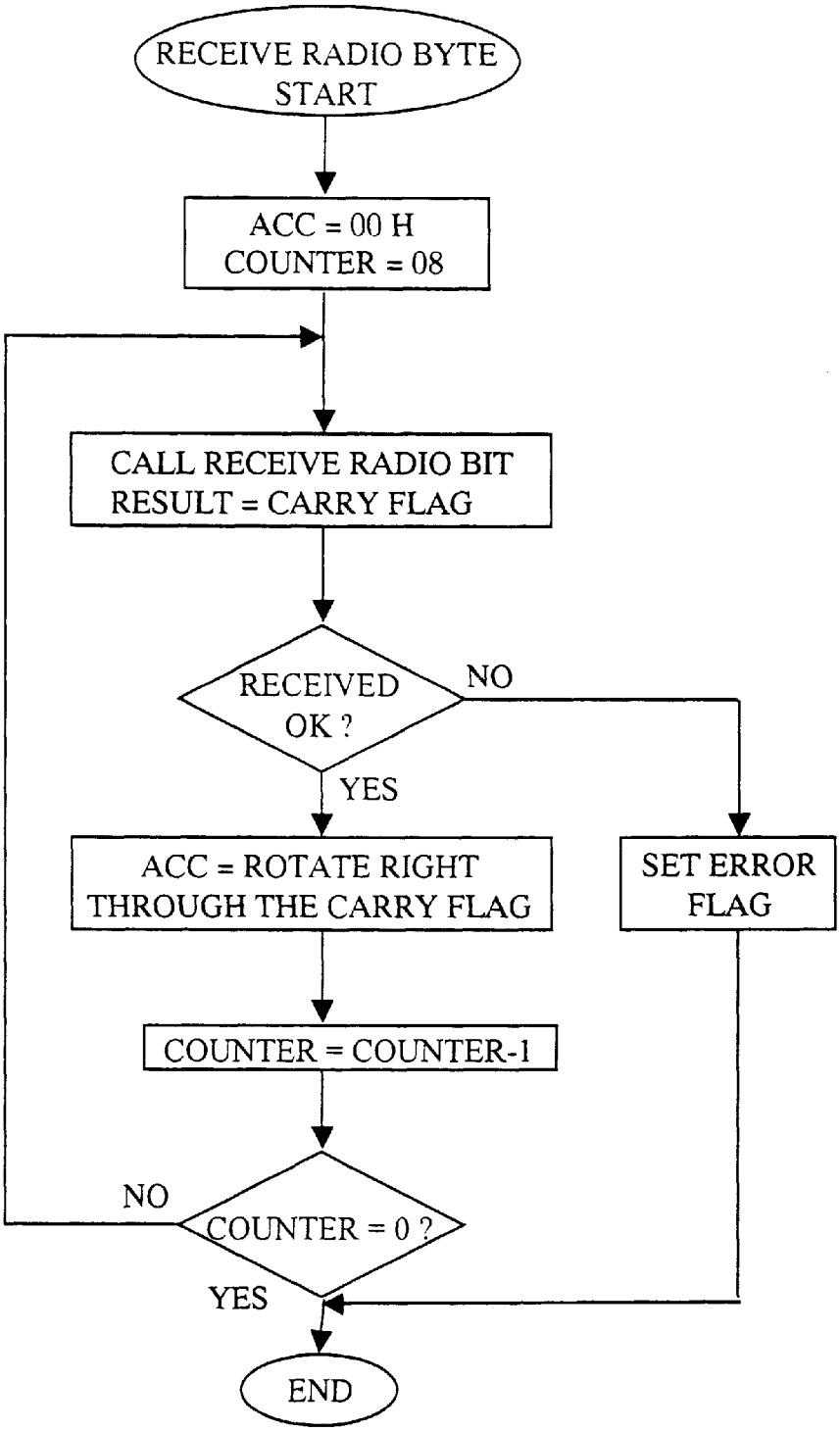
Figure 8I:
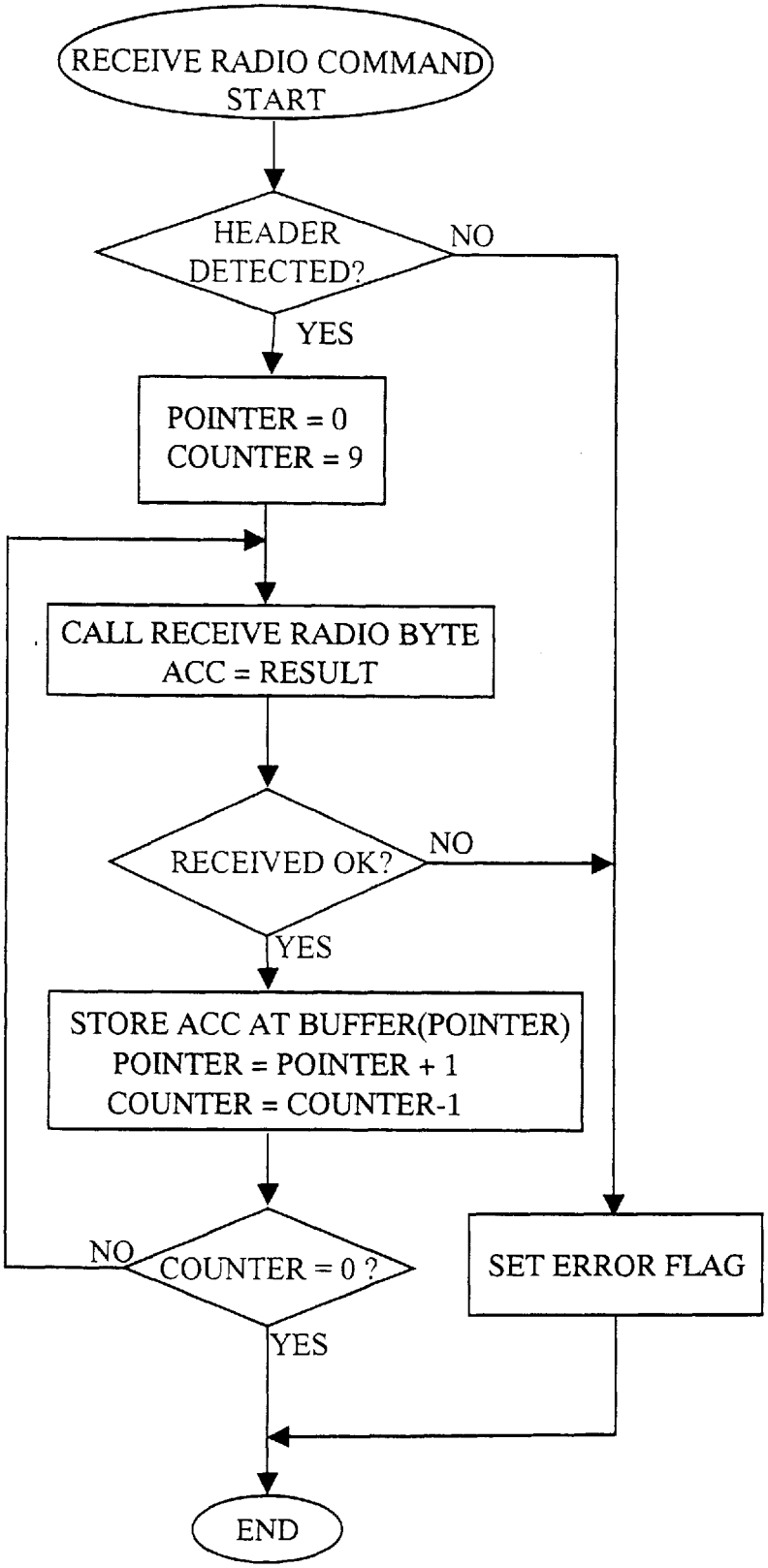
Figure 8J:
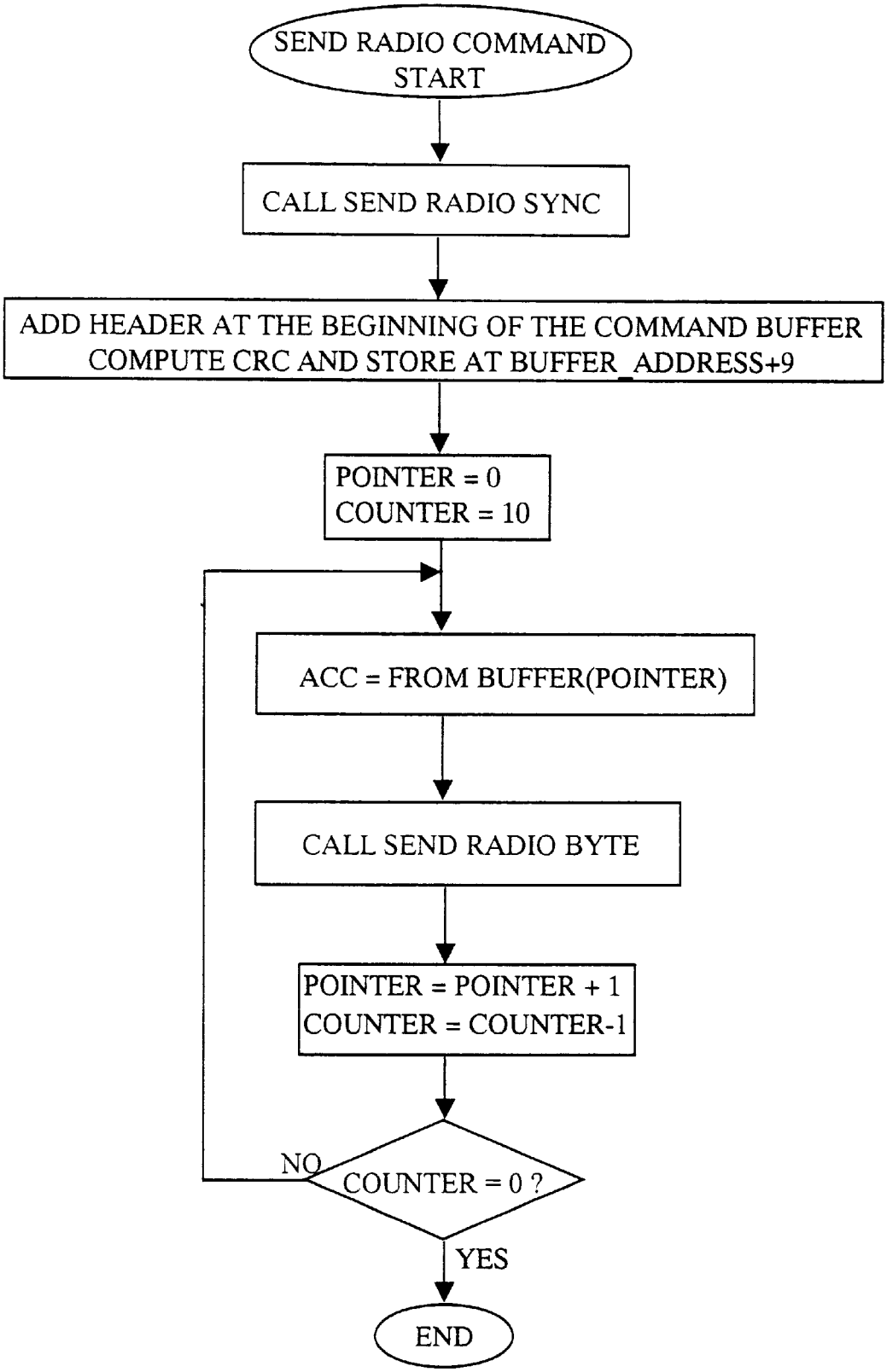
Figure 8K:
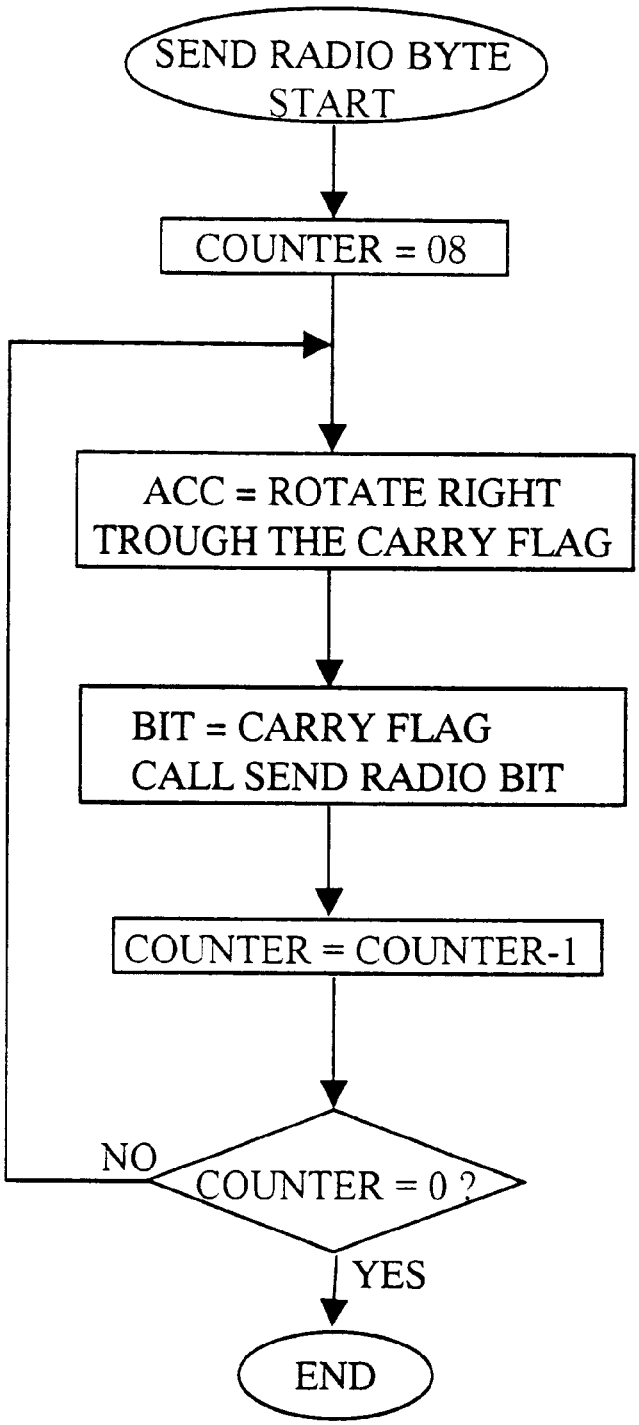
Figure 8L:
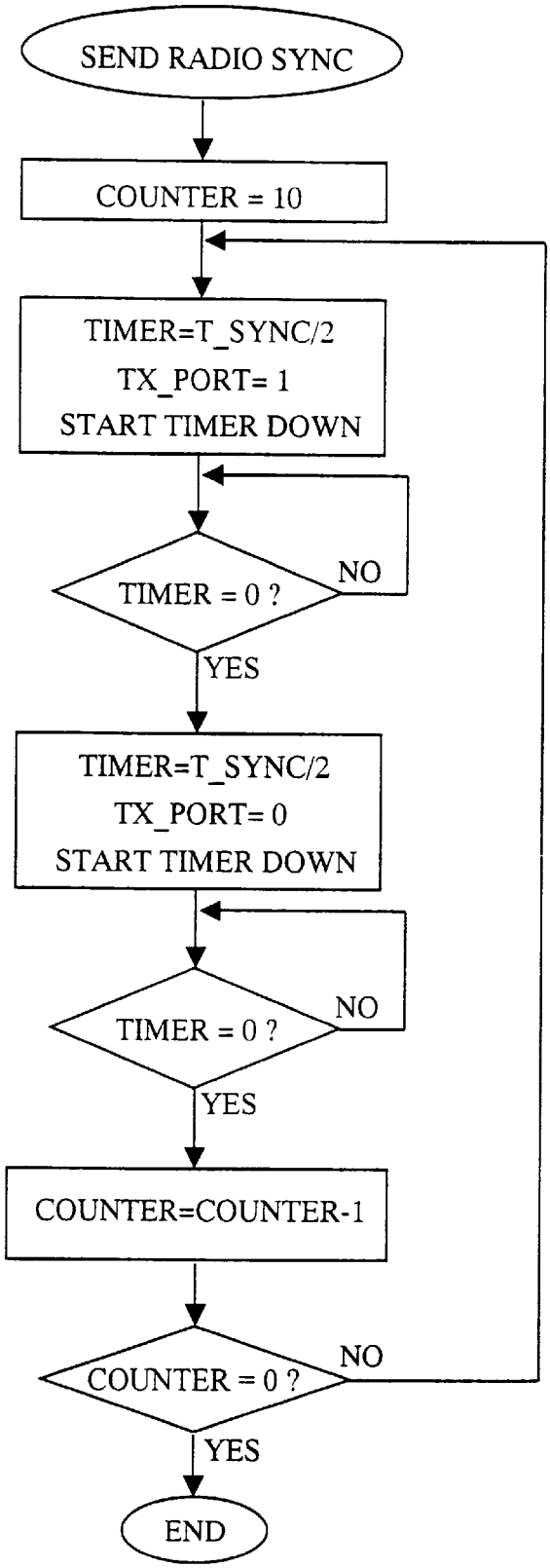
Figure 8M:
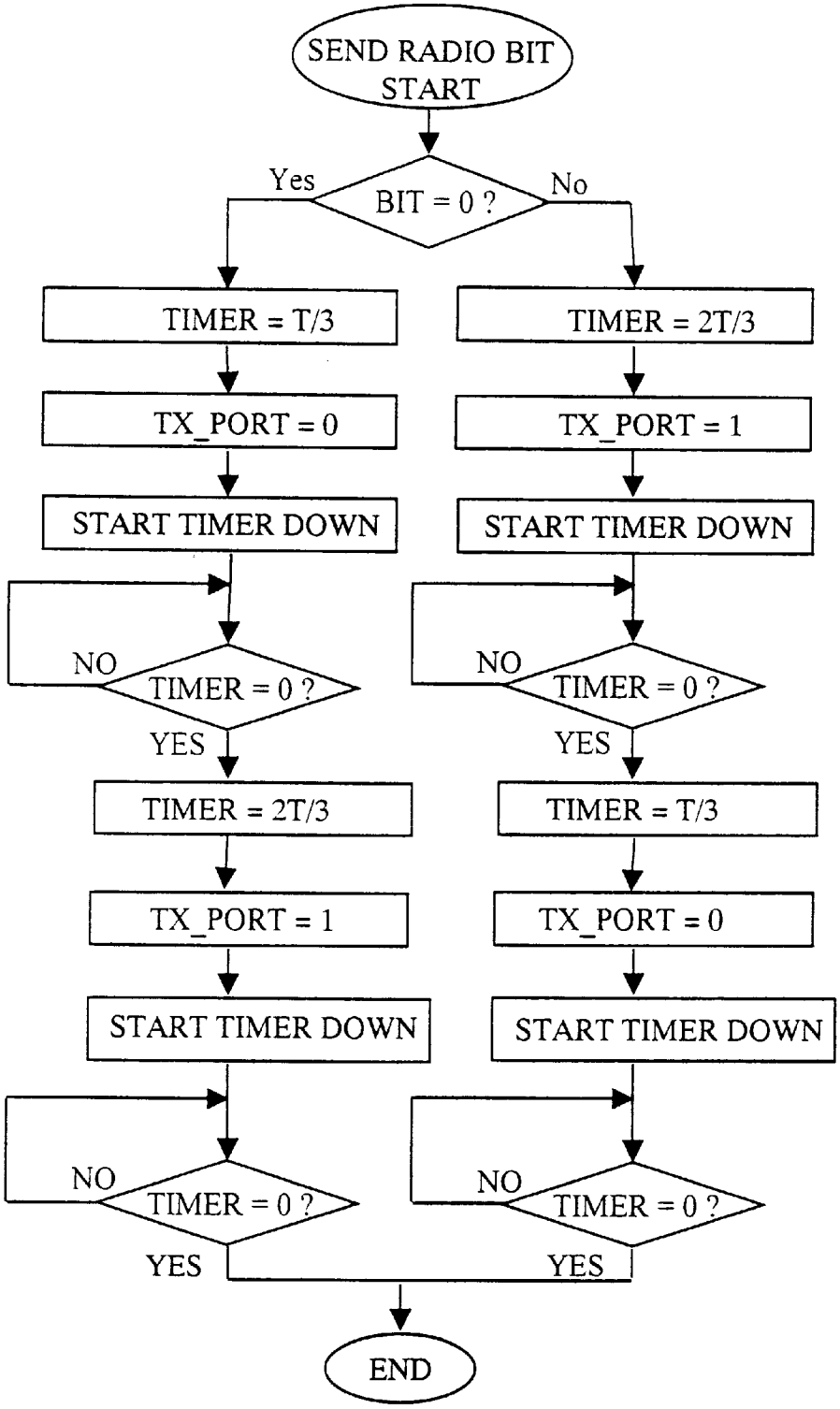
Figure 8N:
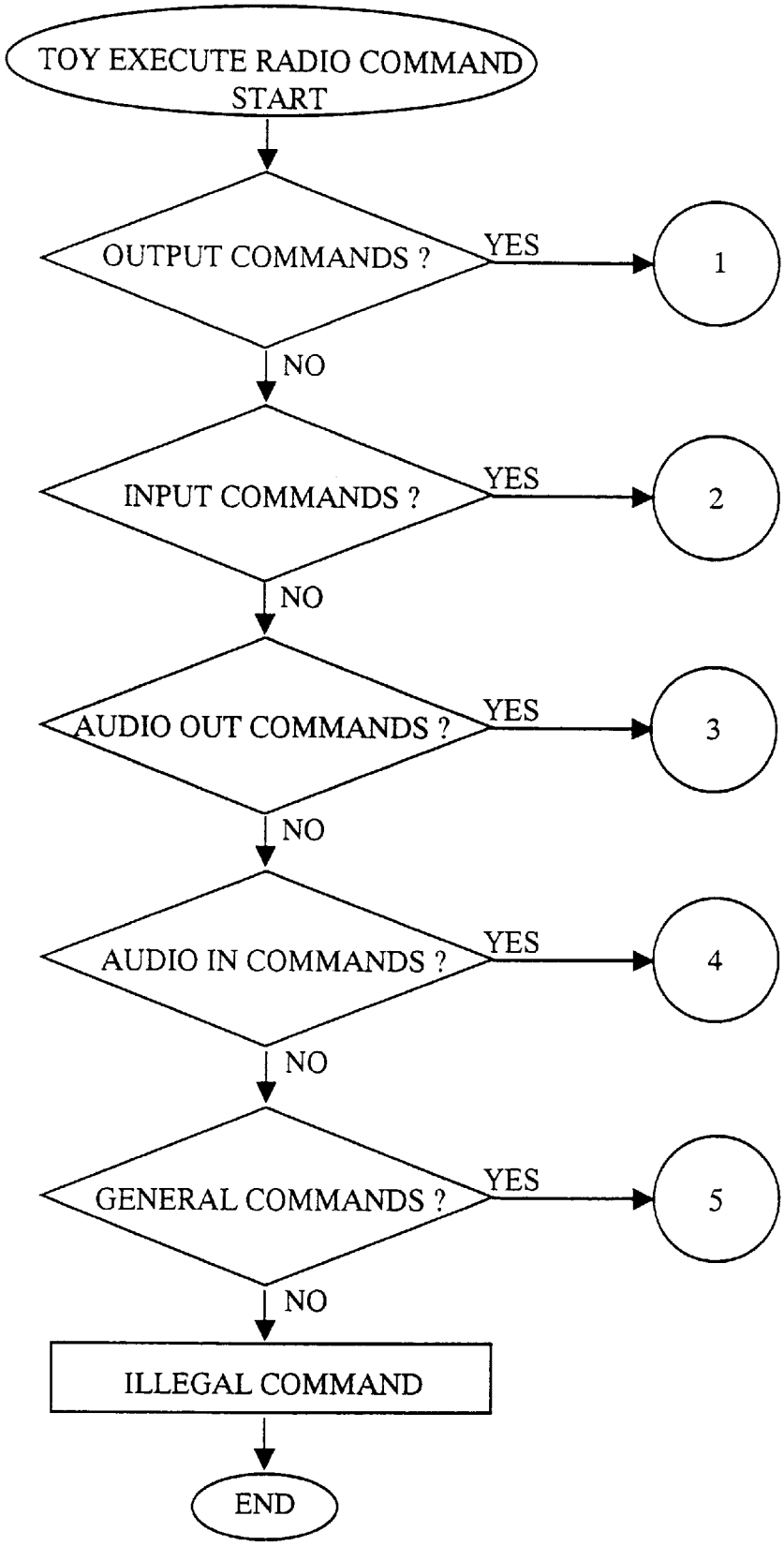
Figure 8O:
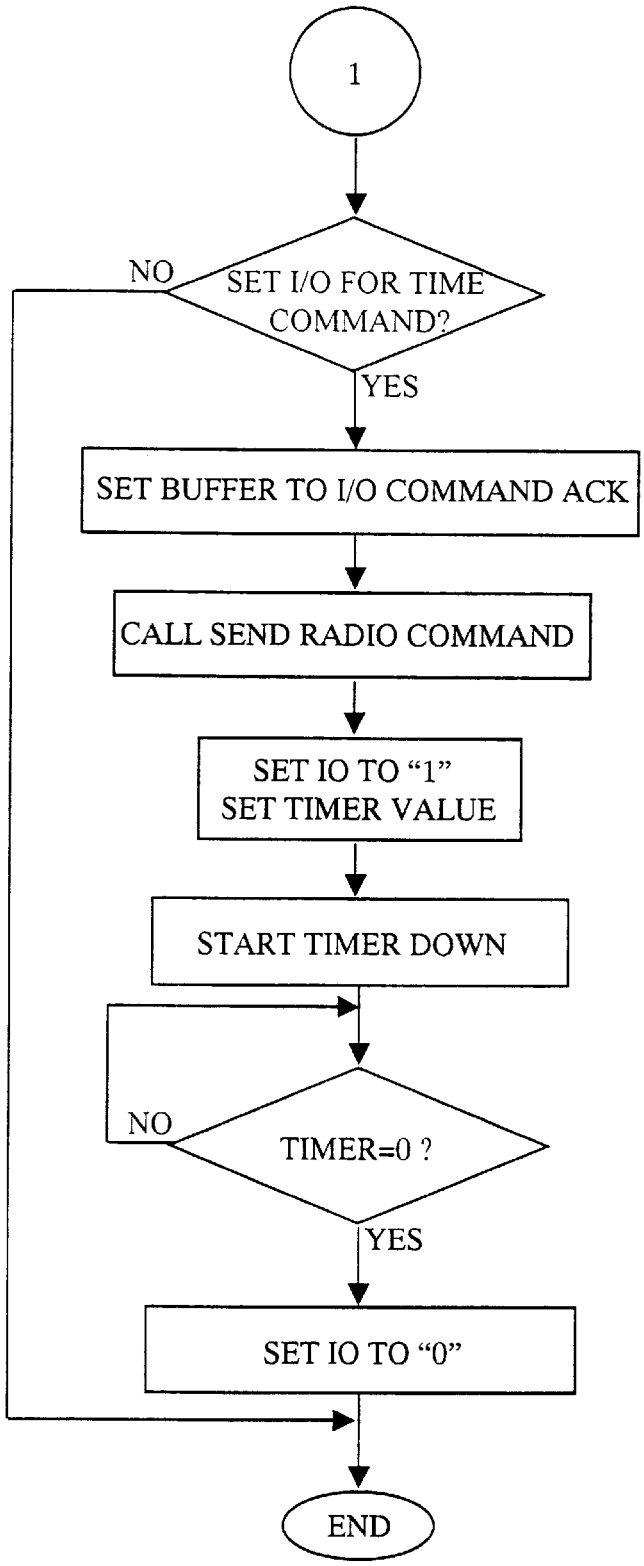
Figure 8P:
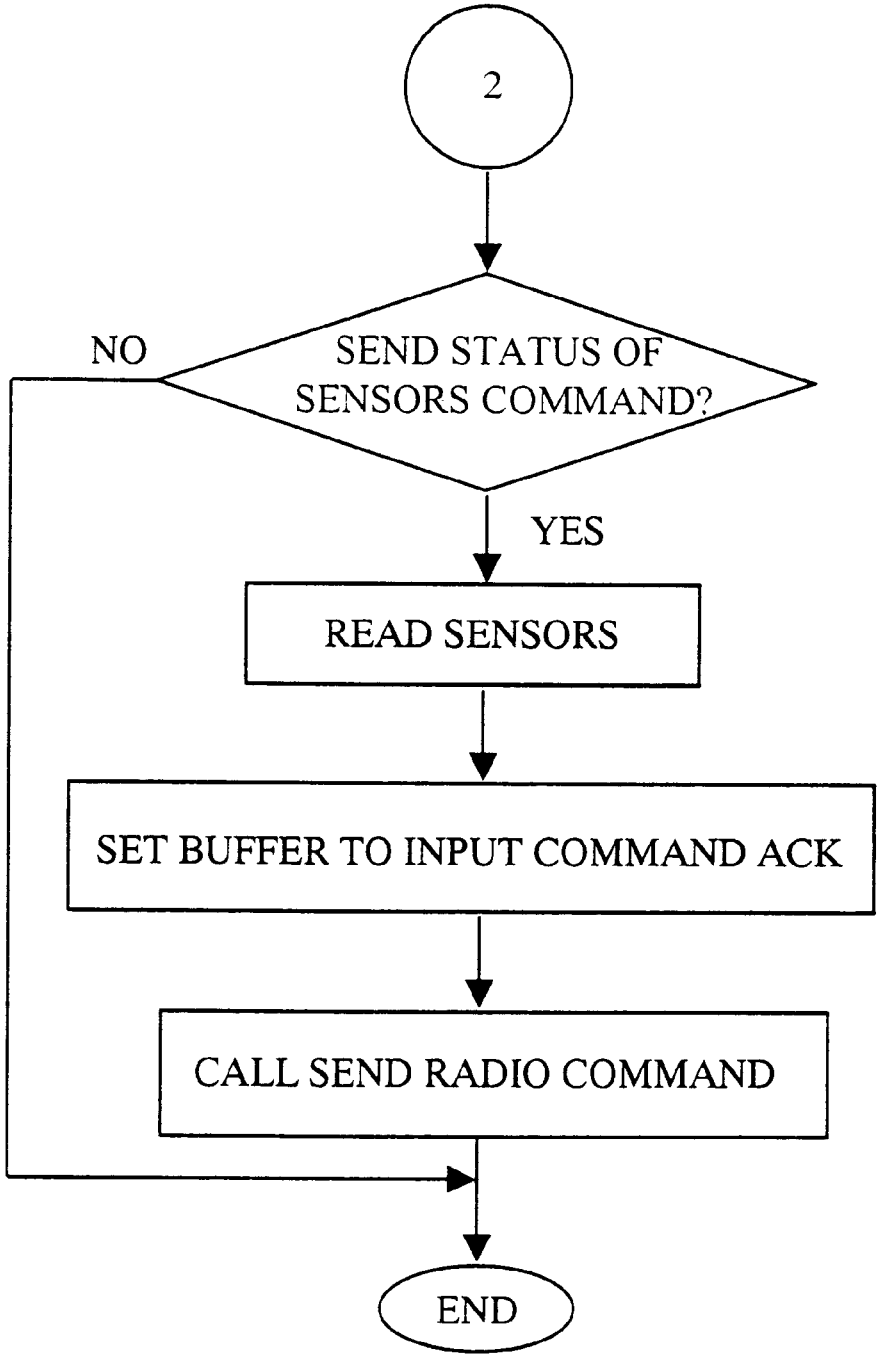
Figure 8Q:
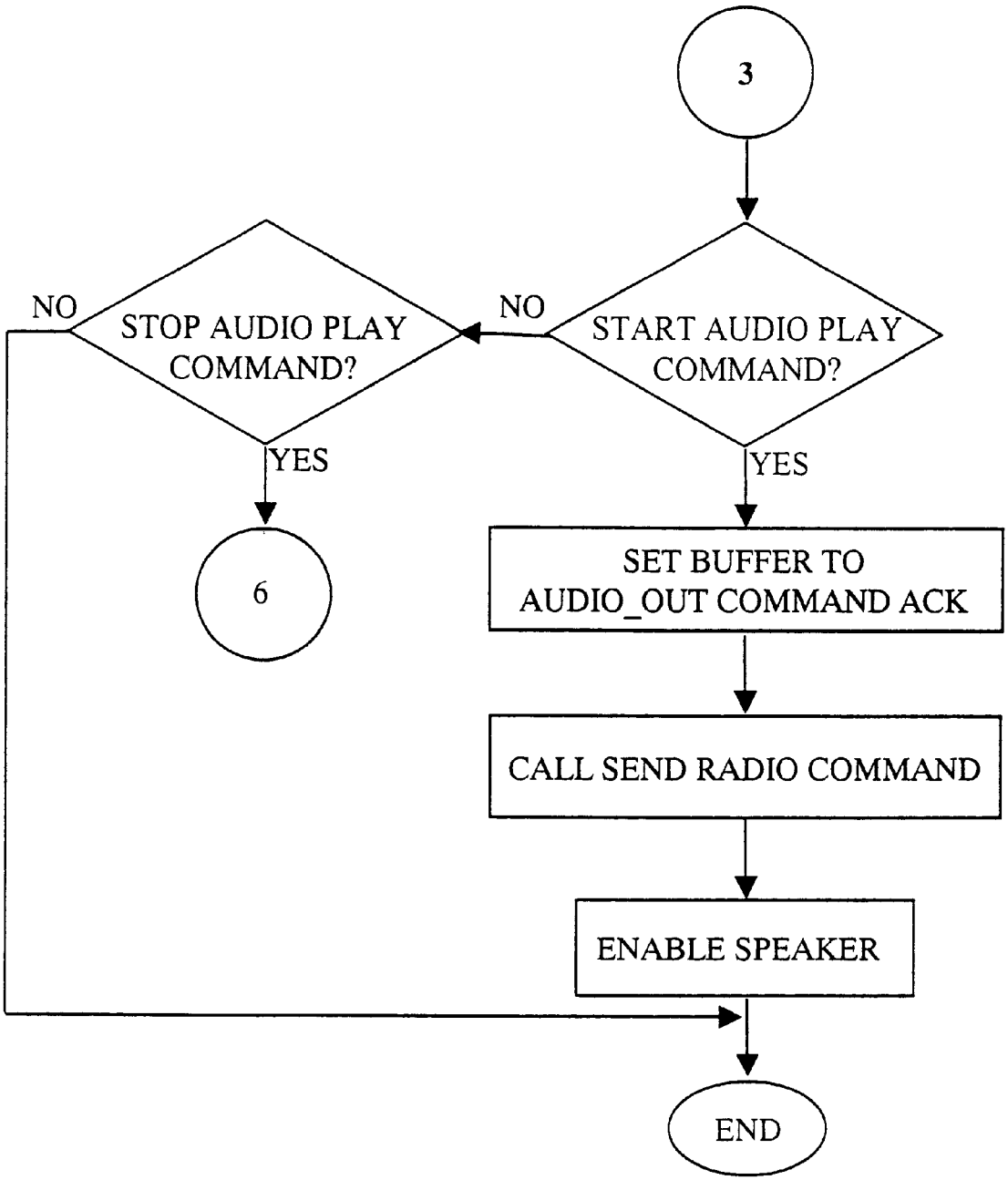
Figure 8R:
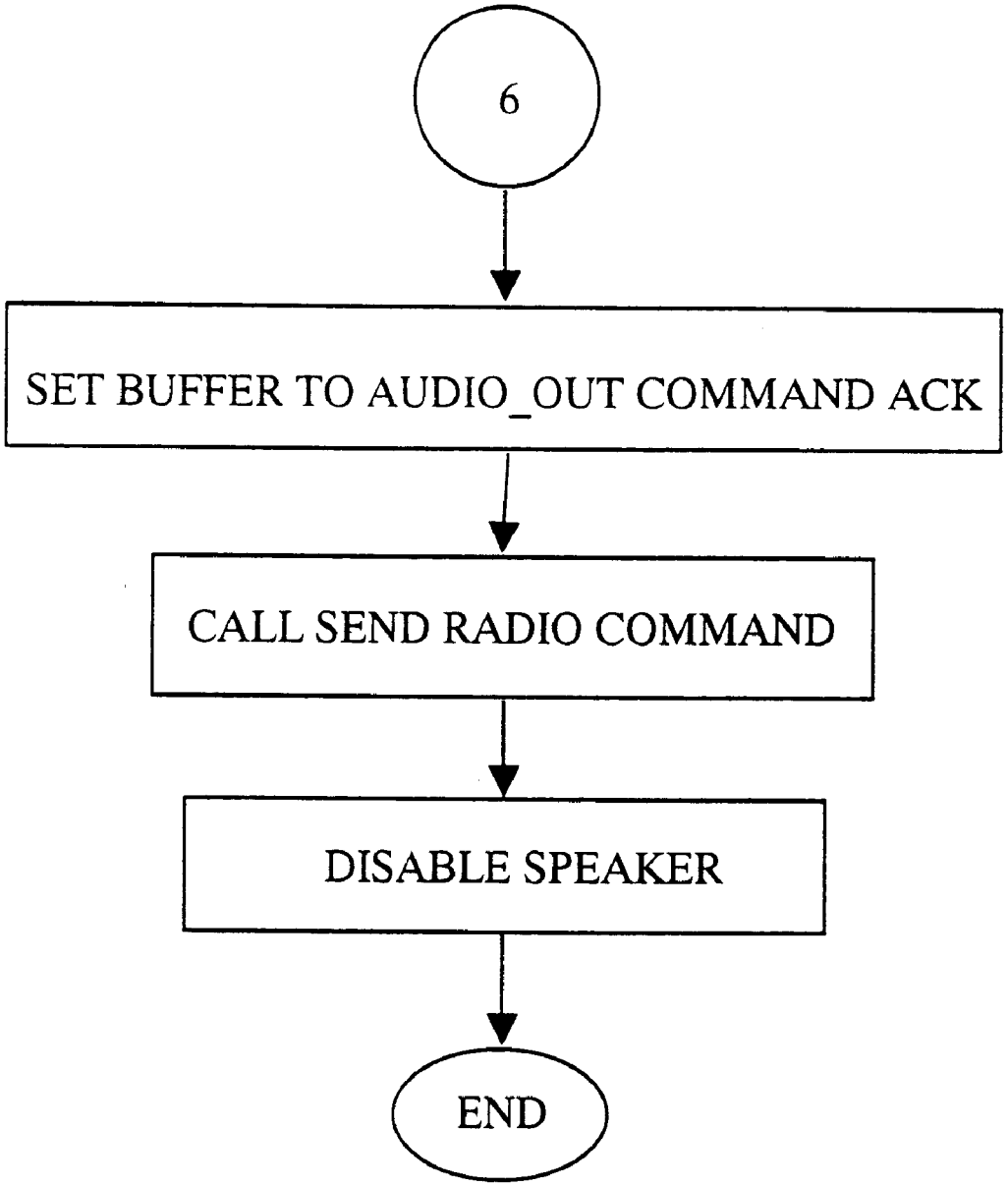
Figure 8S:
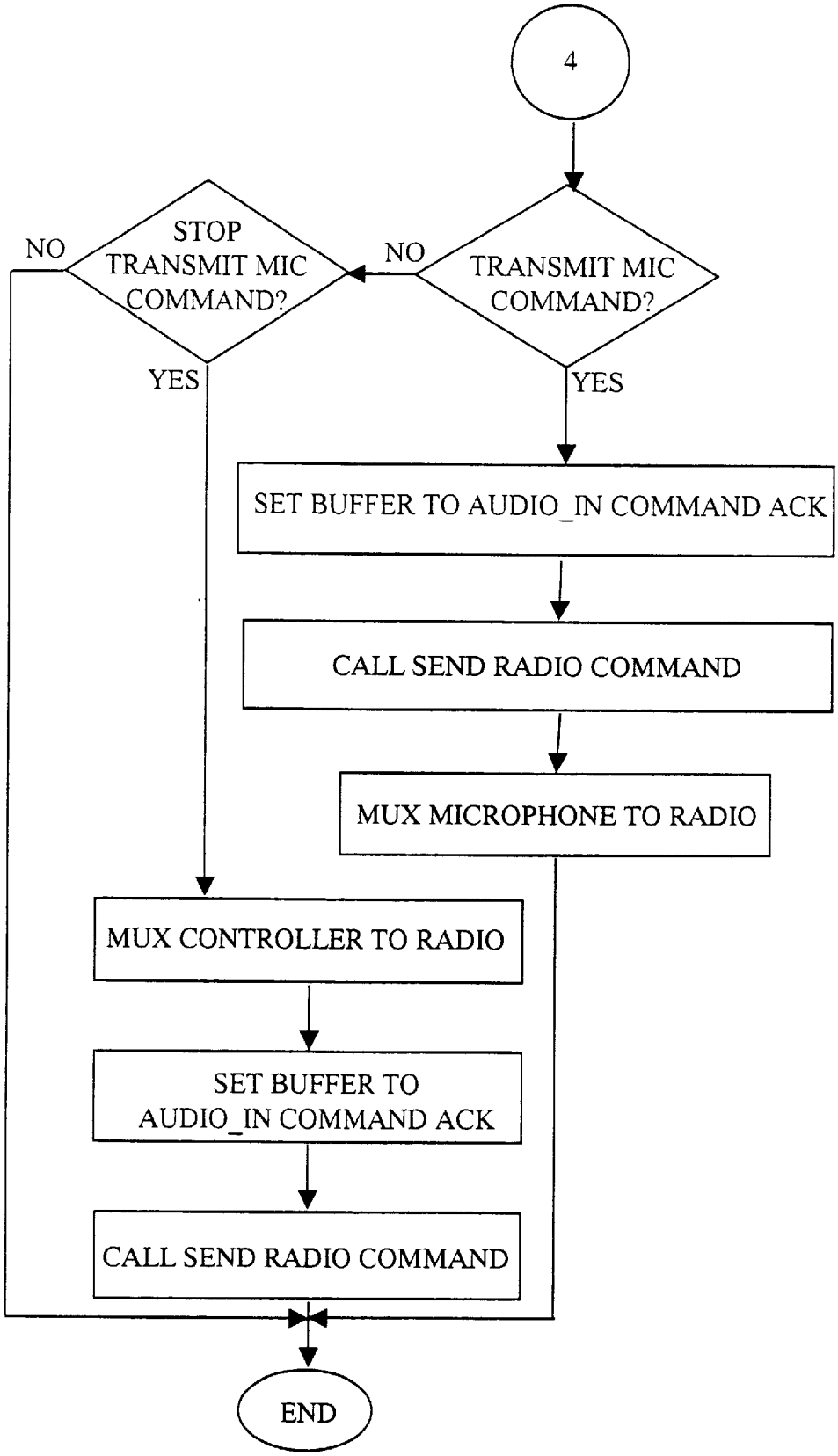
Figure 8T:
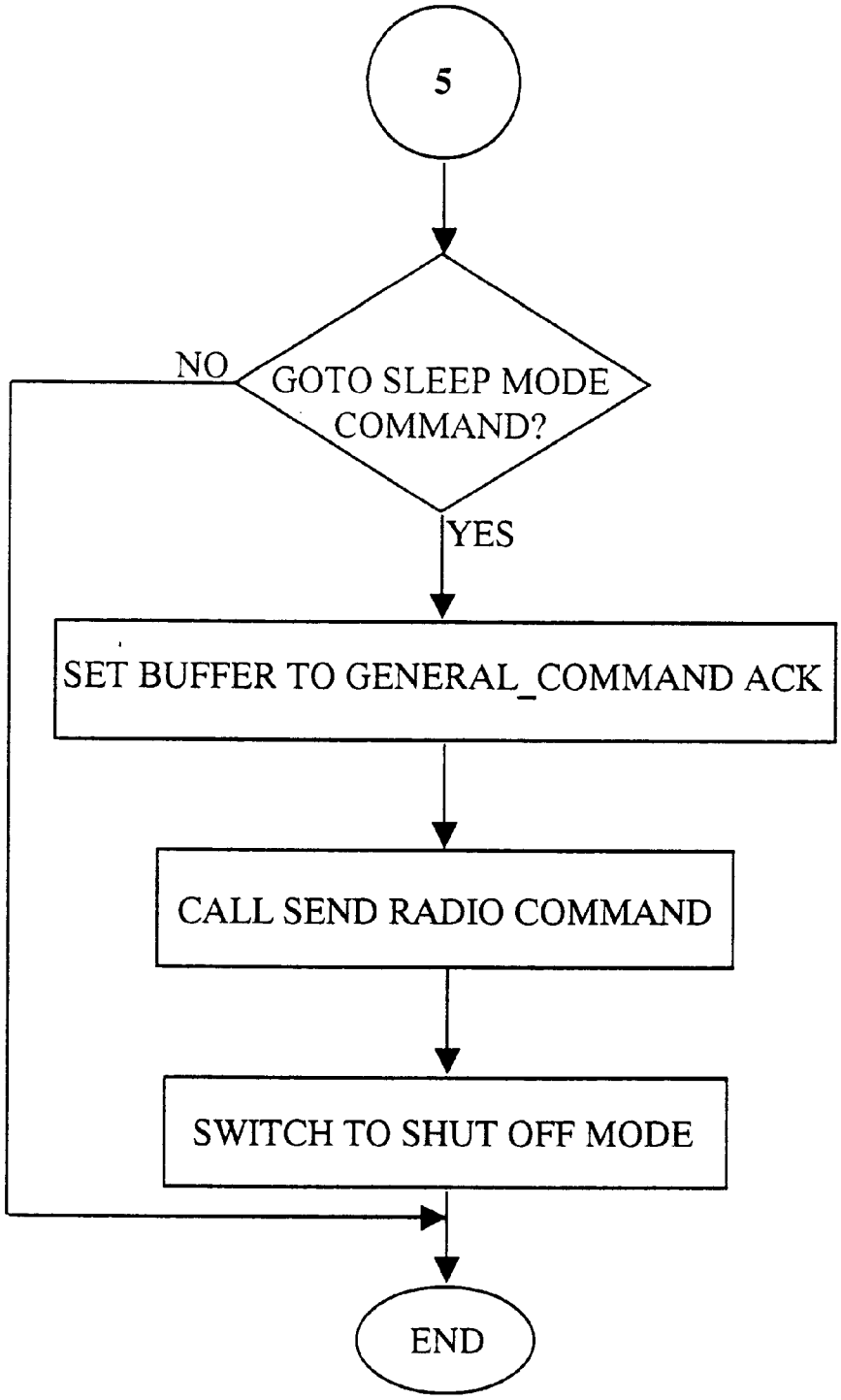
Figure 9A:
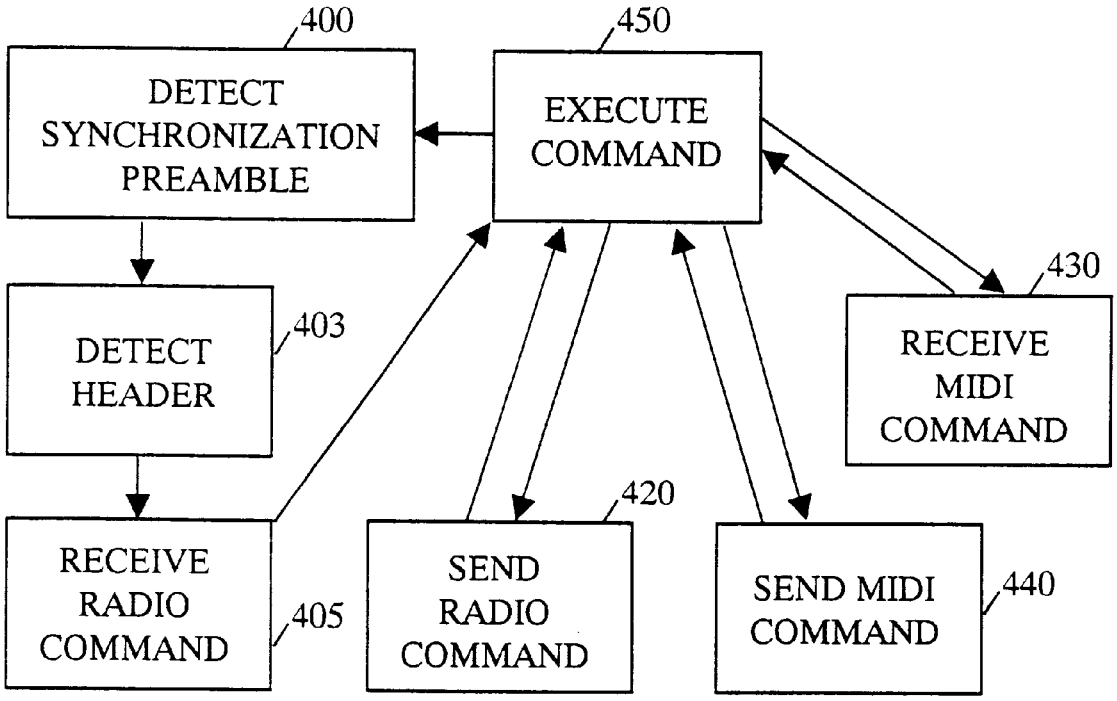
FIG. 9A is a simplified flowchart illustration of a preferred method for receiving MIDI signals, receiving radio signals, executing commands comprised therein, sending radio signals, and sending MIDI signals, within the computer radio interface 110 of FIG. 1A.
Figure 9B:
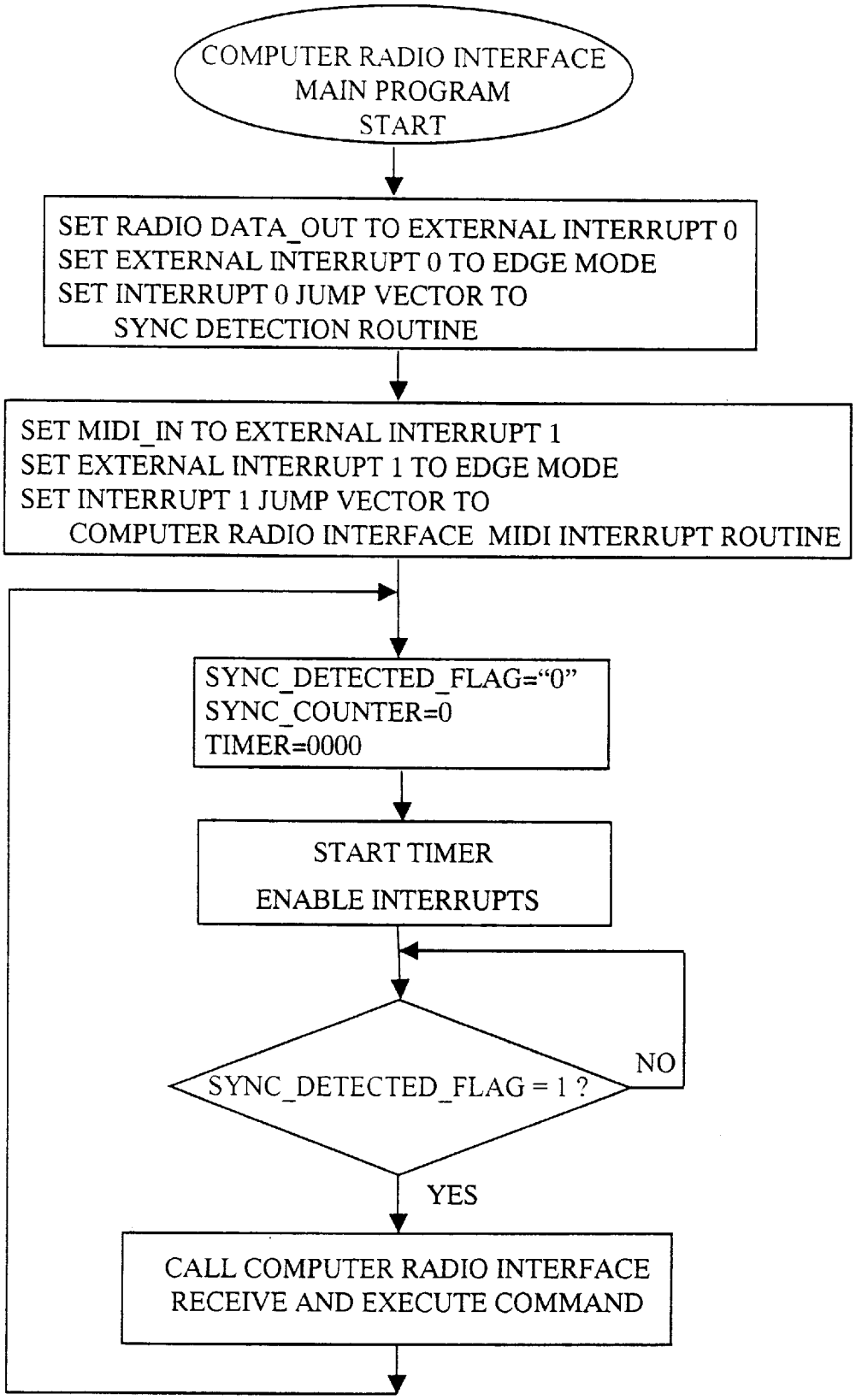
FIGS. 9B–9N, taken together with FIGS. 8D–8M, comprise a simplified flowchart illustration of a preferred implementation of the method of FIG. 9A.
Figure 9C:
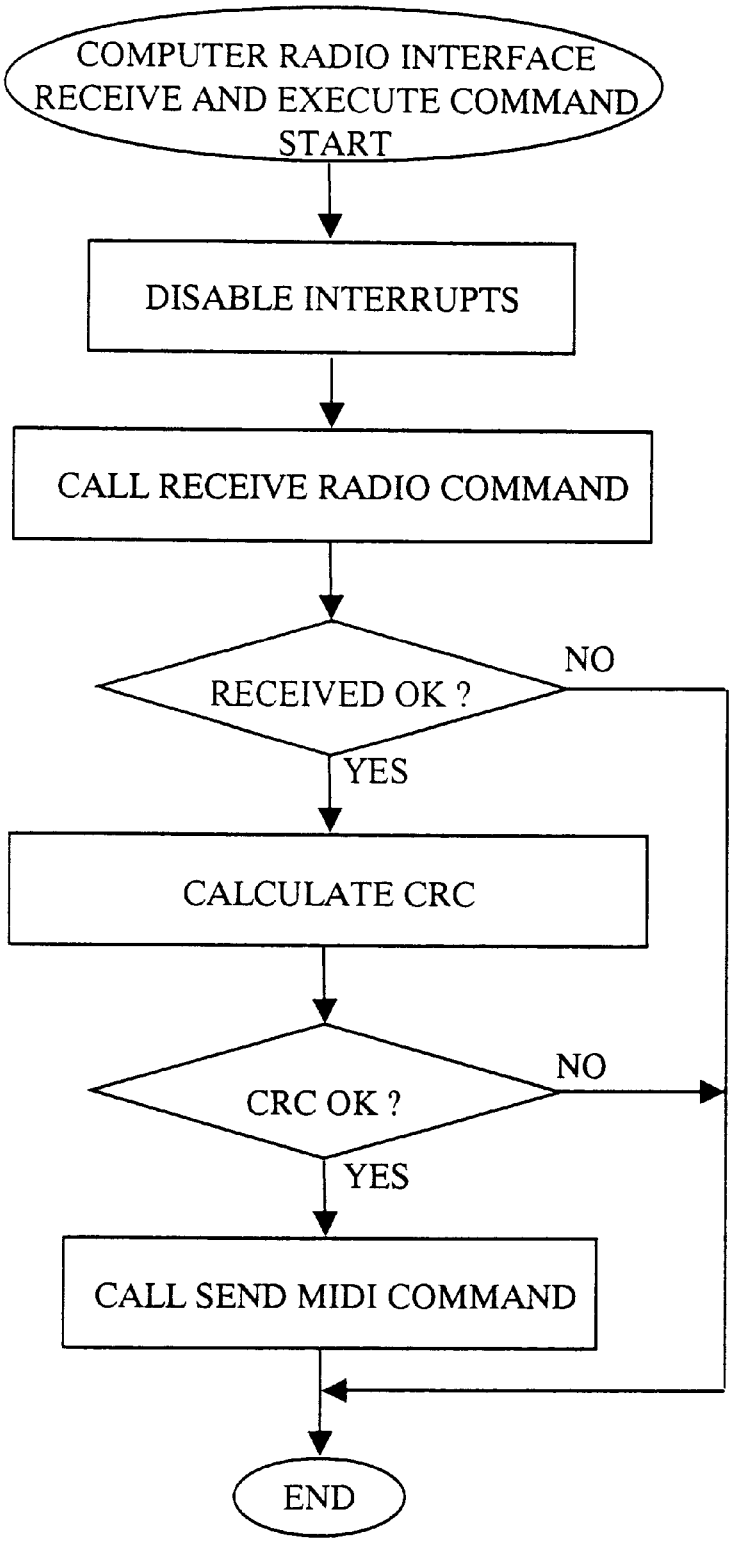
Figure 9D:
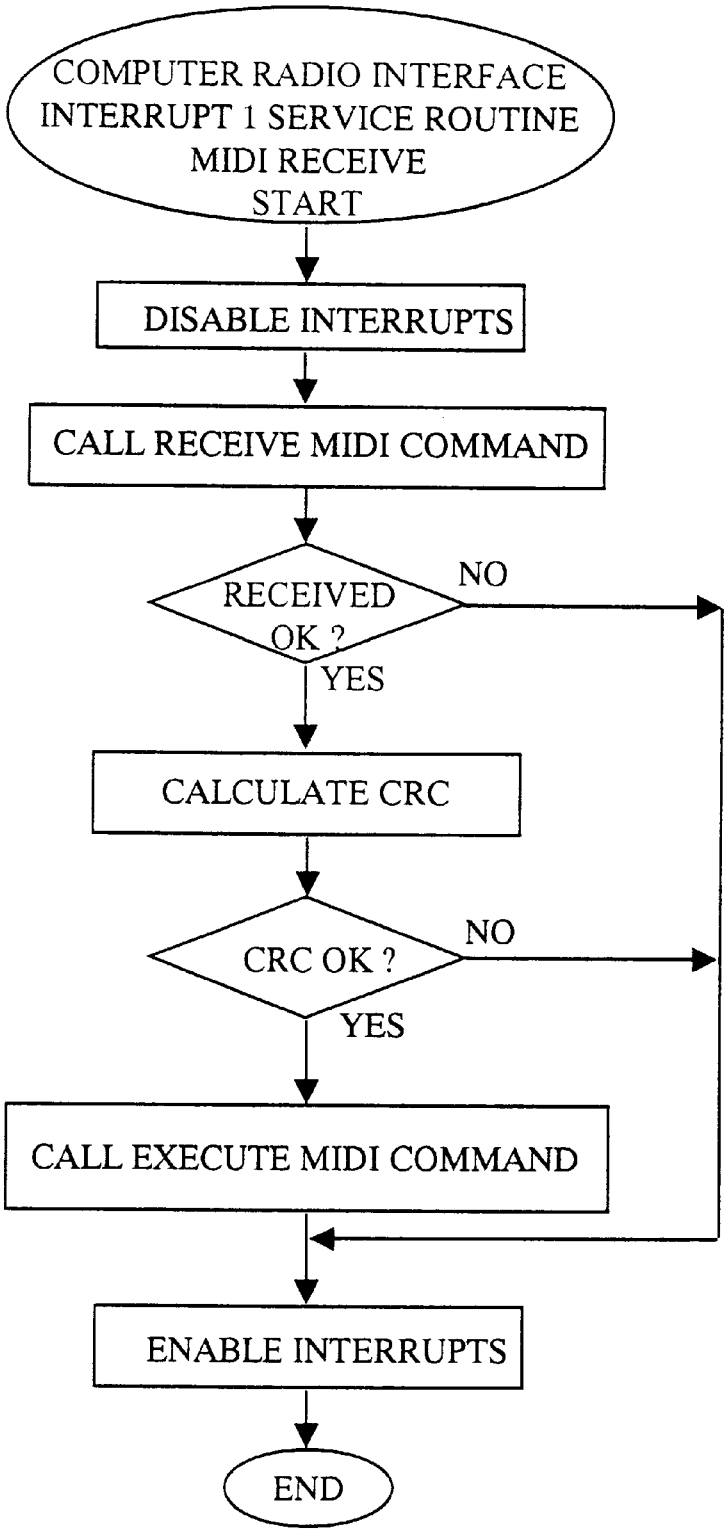
Figure 9E:
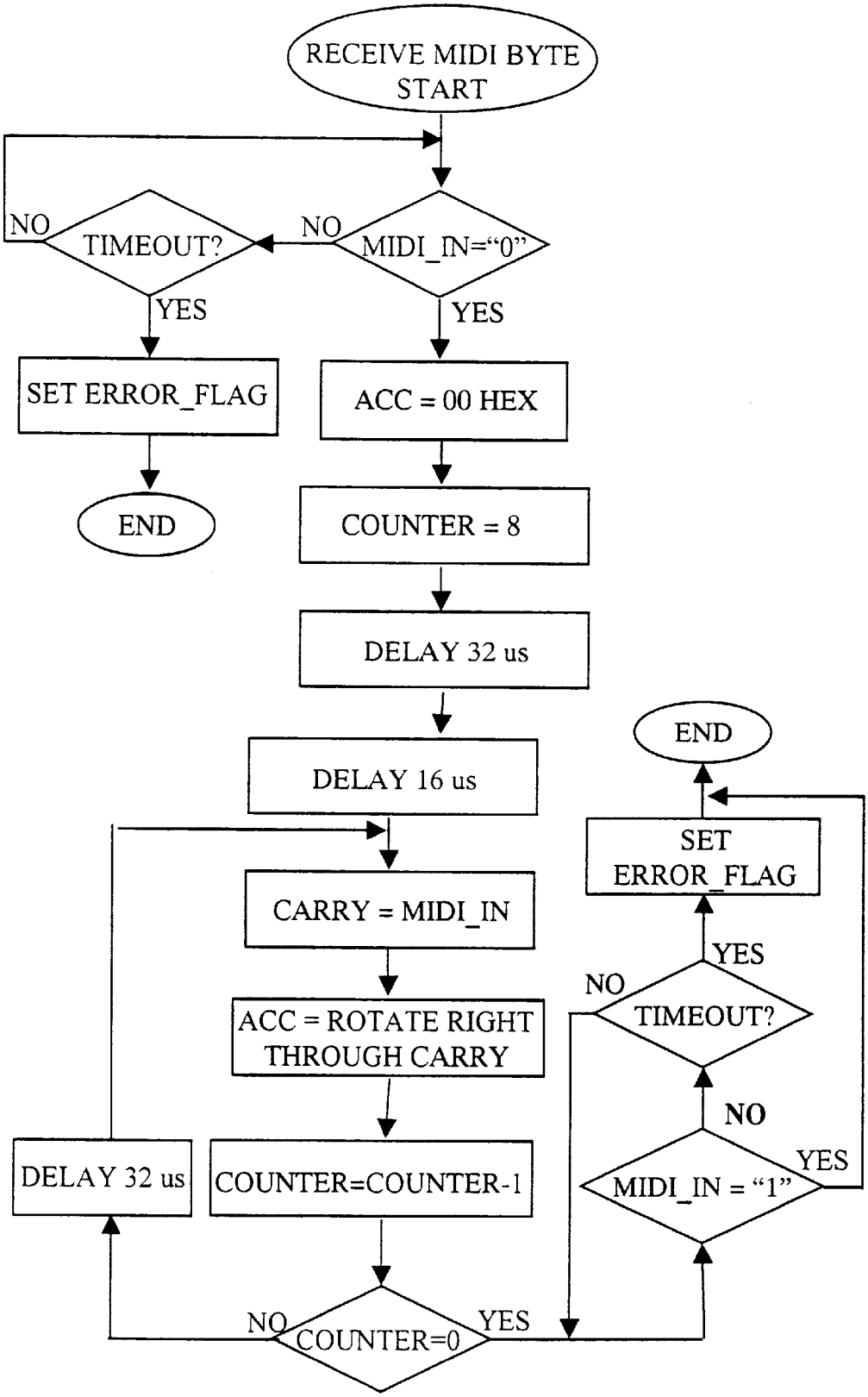
Figure 9F:
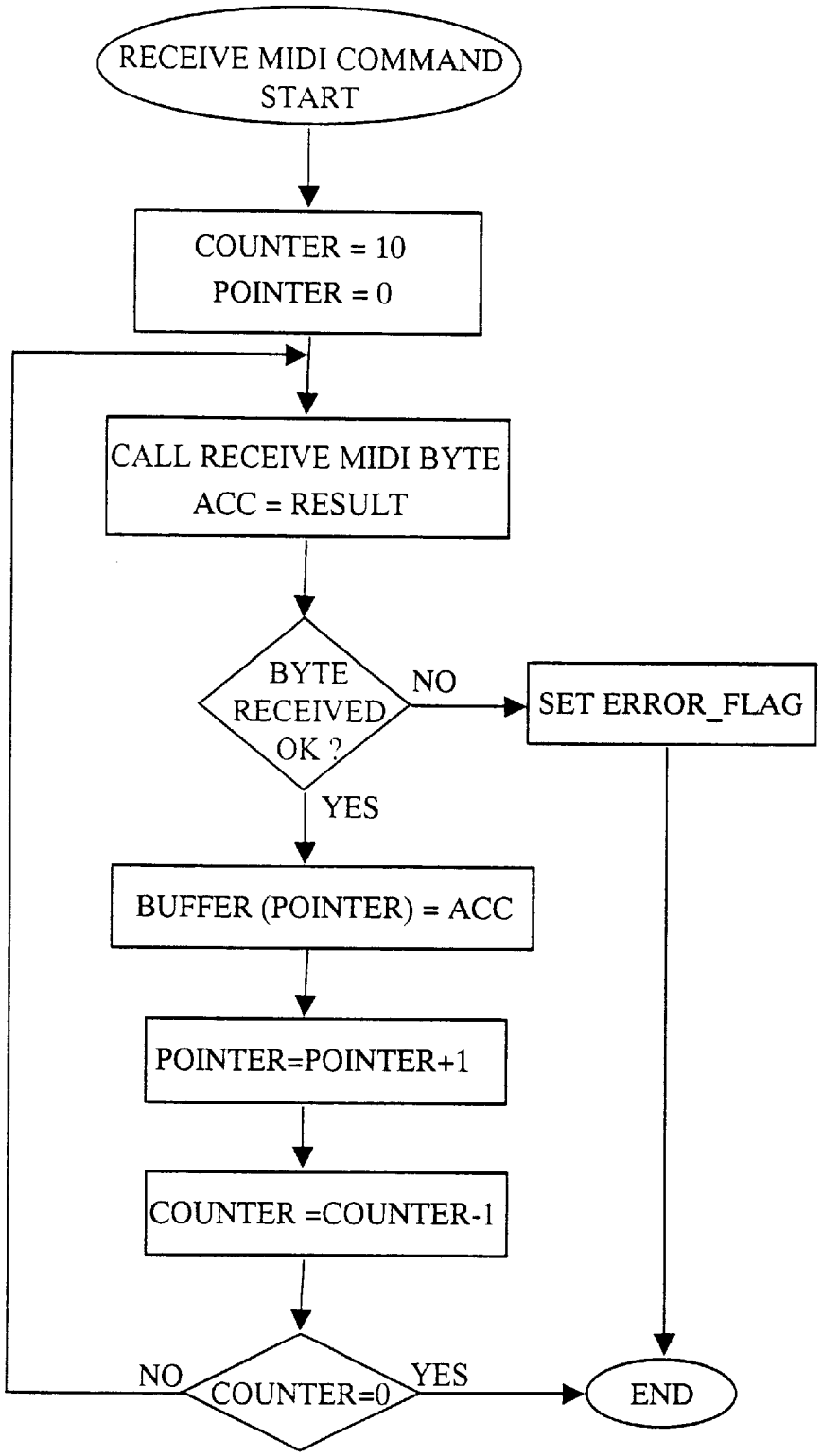
Figure 9G:
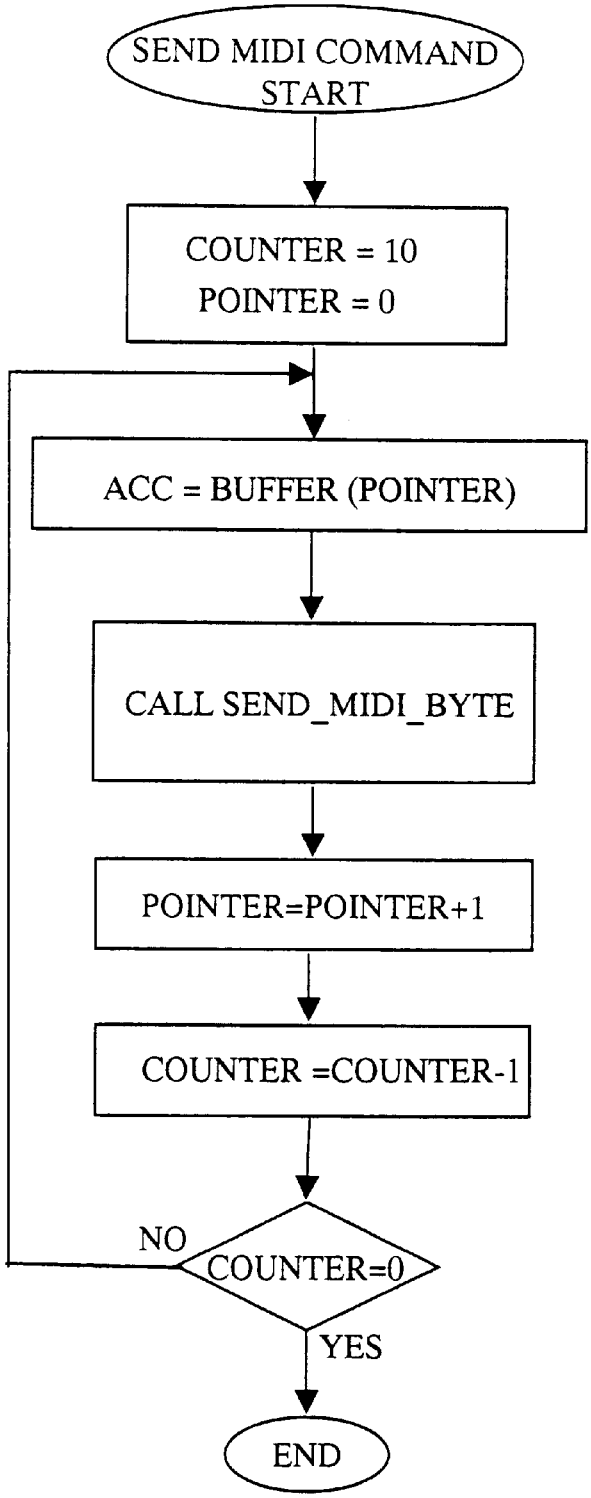
Figure 9H:
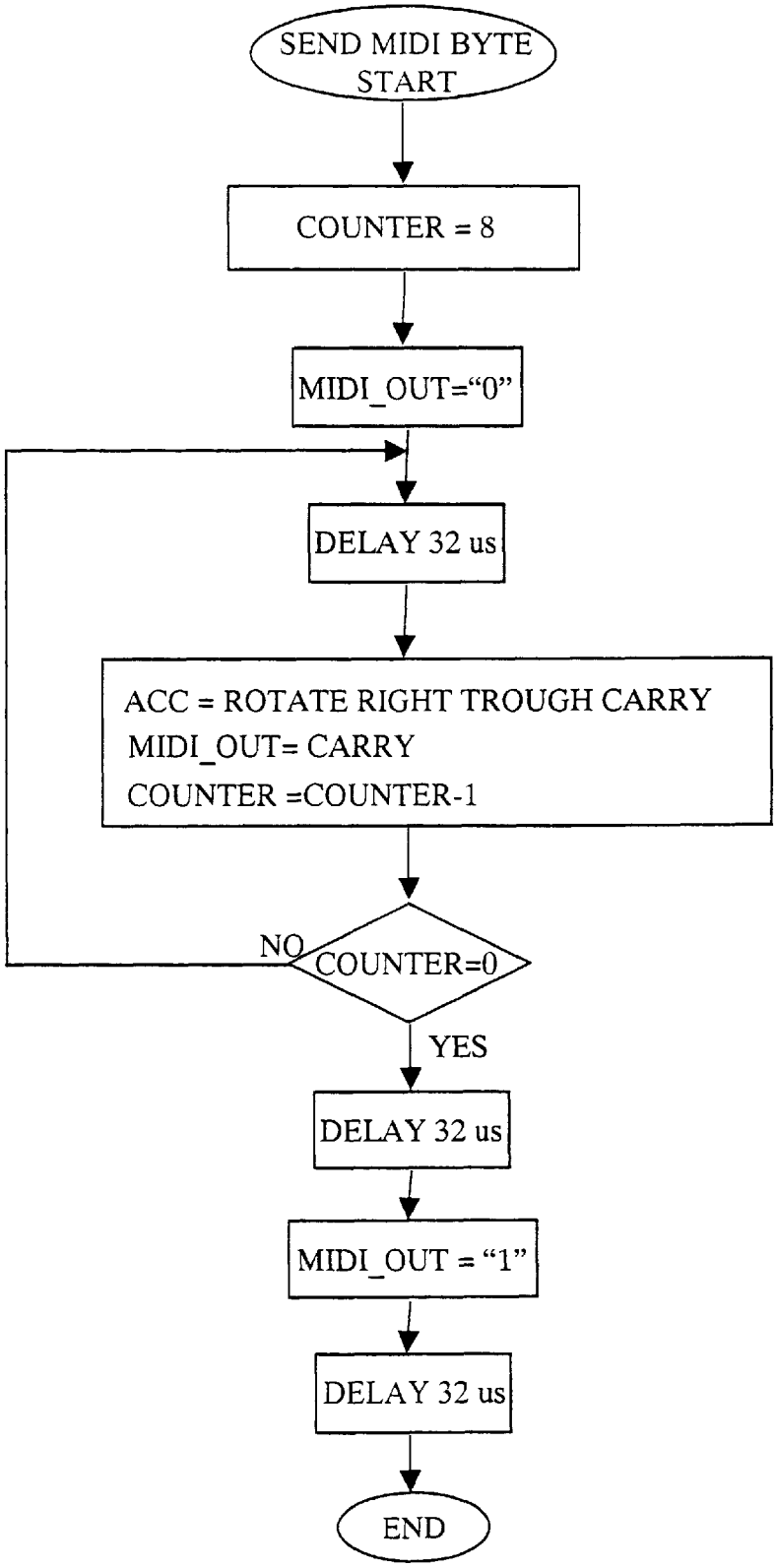
Figure 9I:
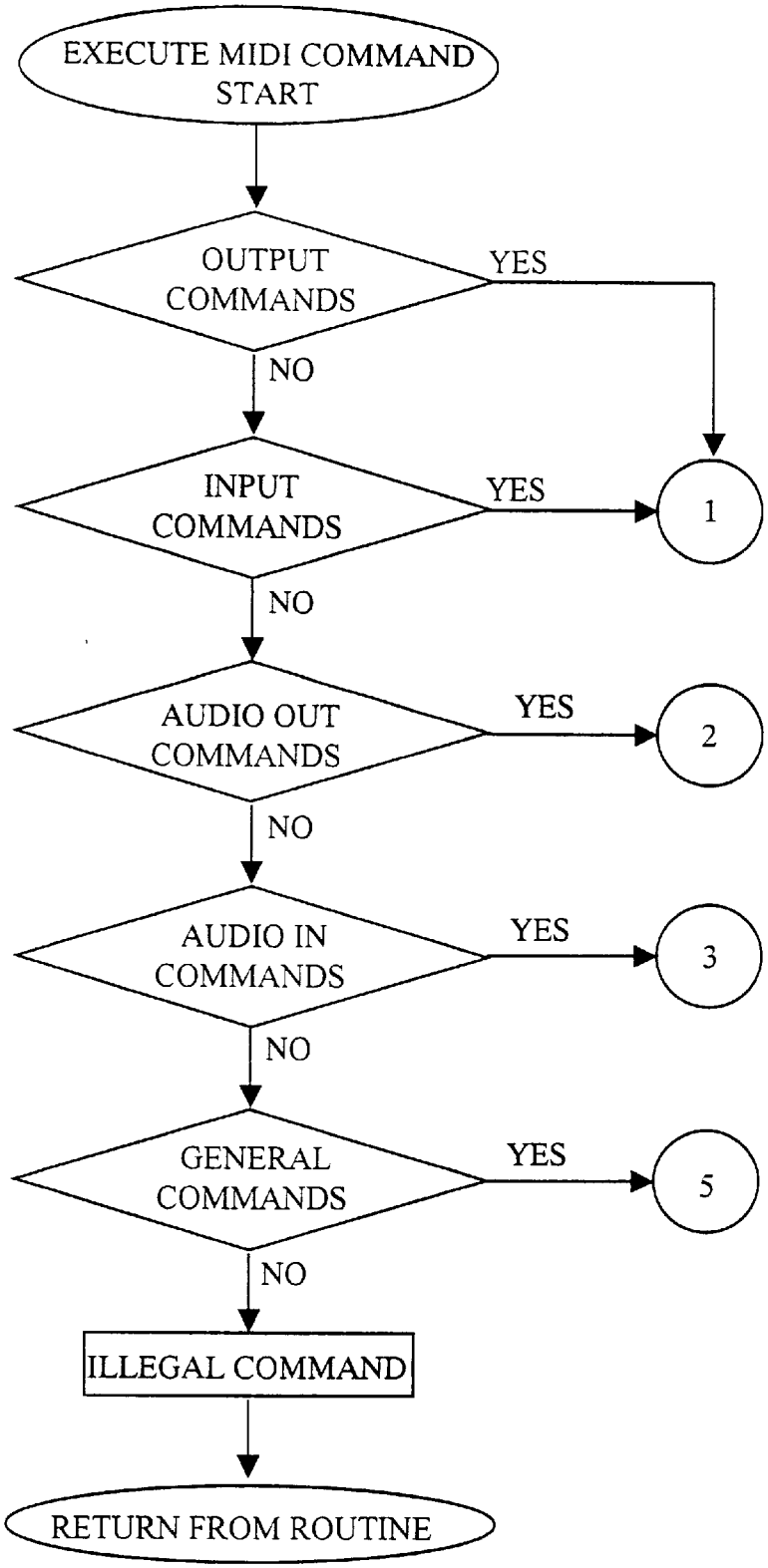
Figure 9J:
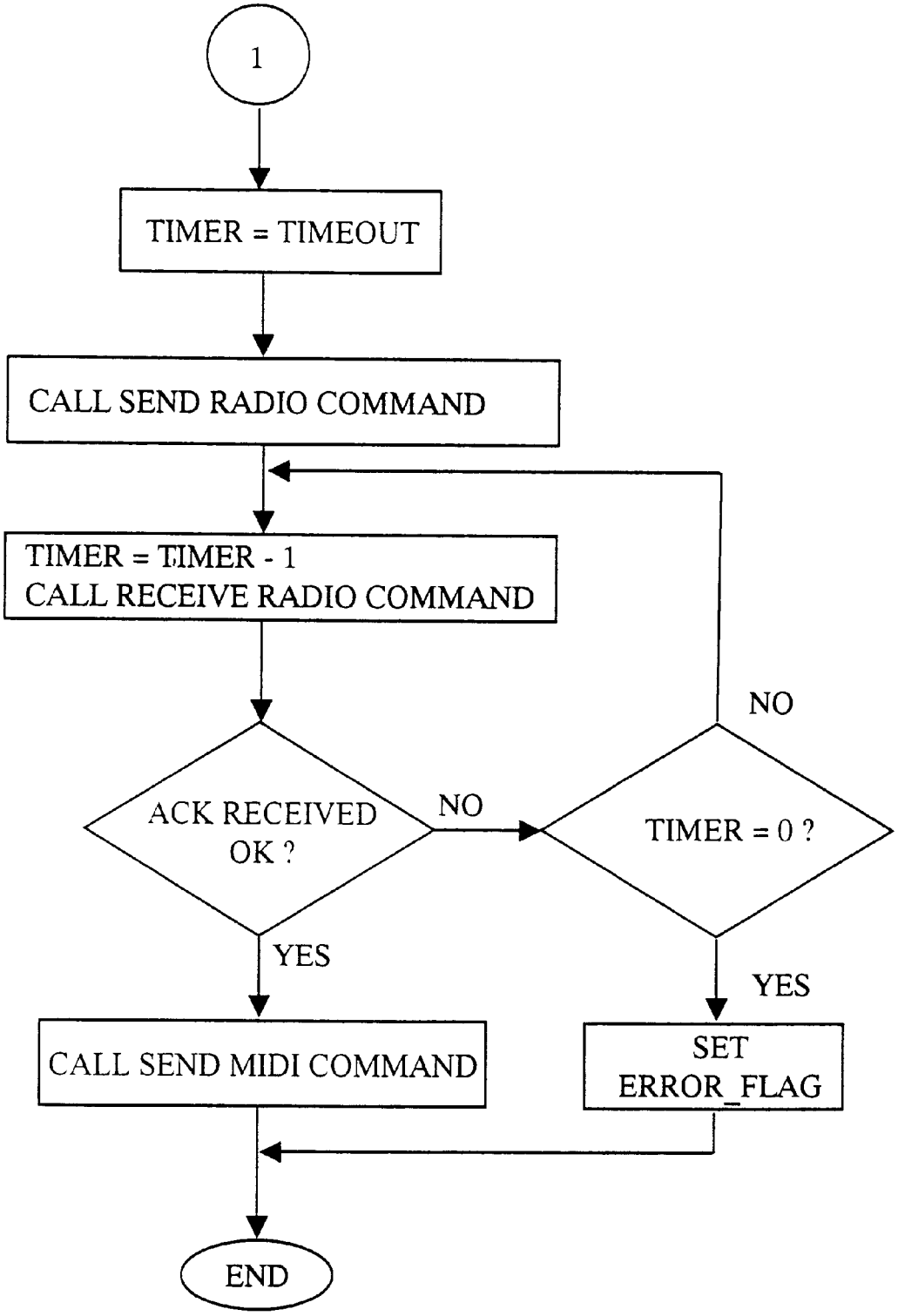
Figure 9K:
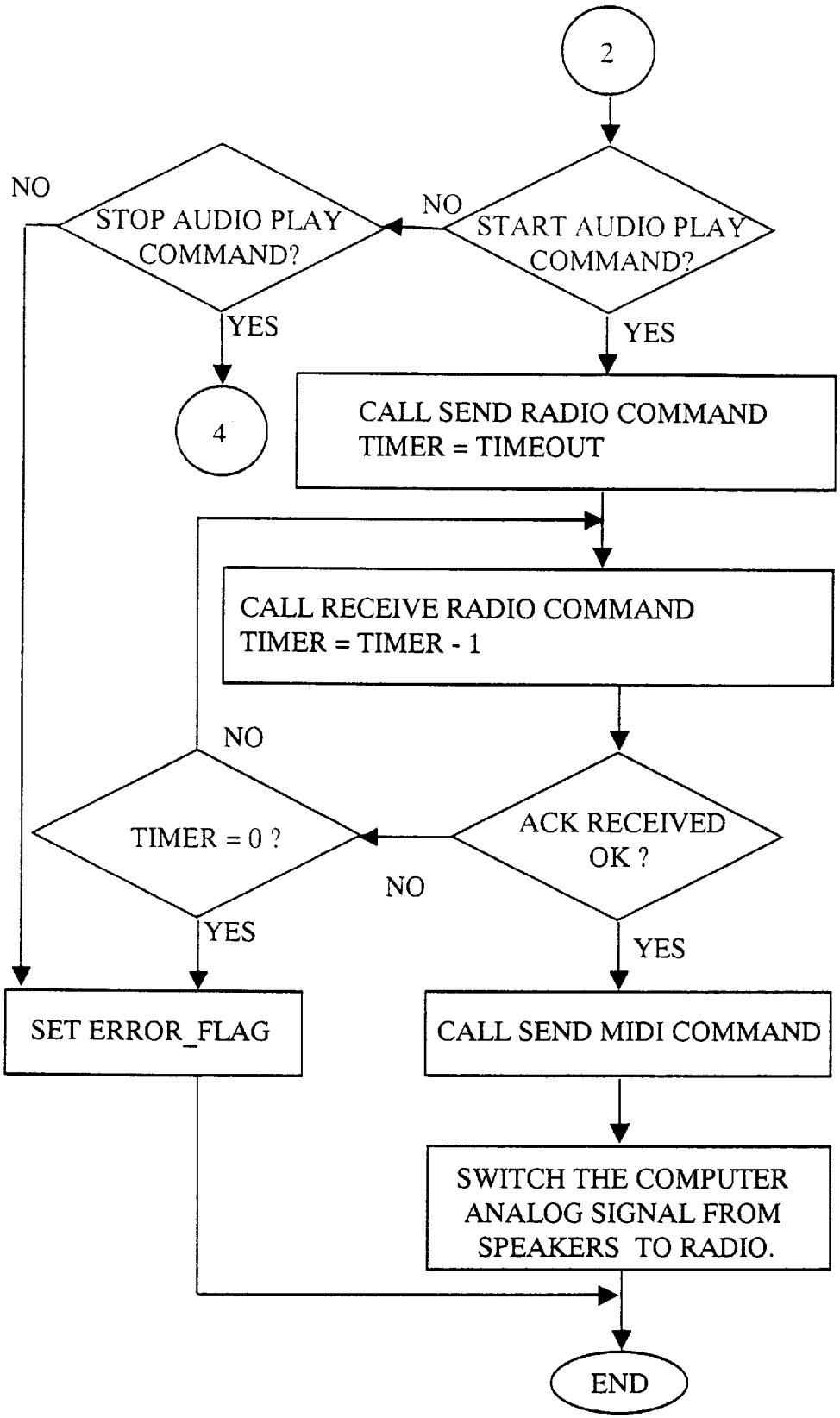
Figure 9L:
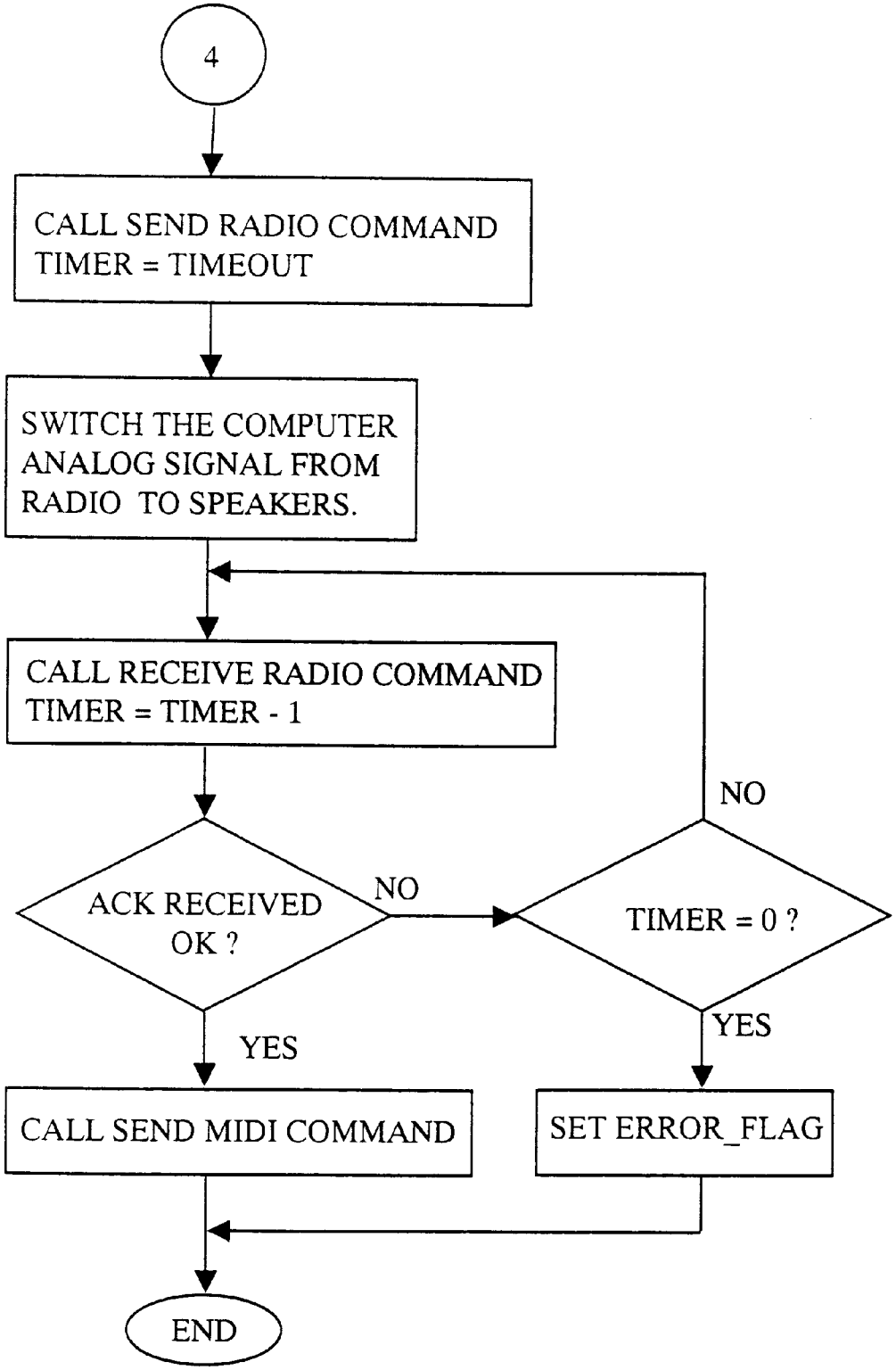
Figure 9M:
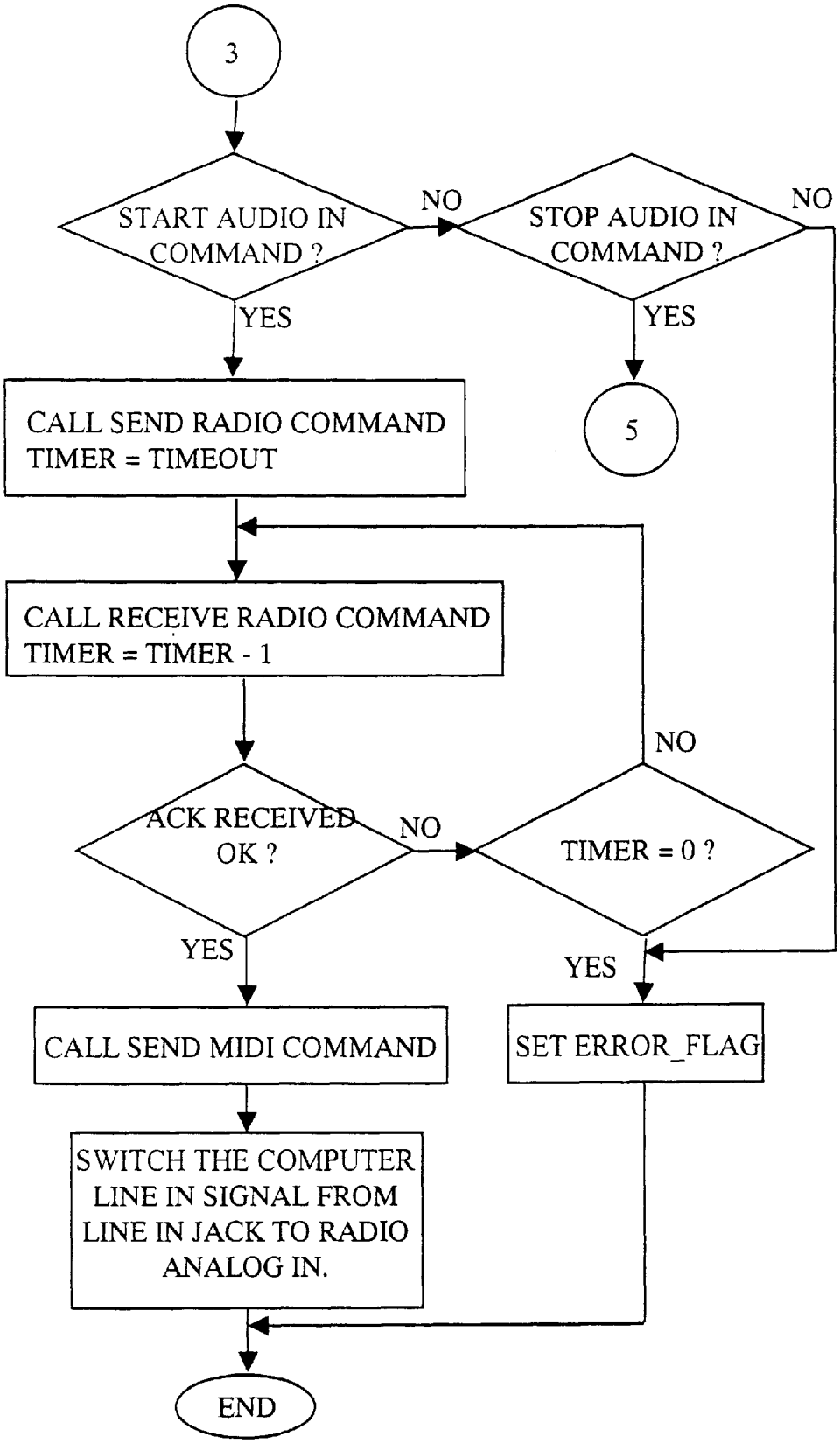
Figure 9N:
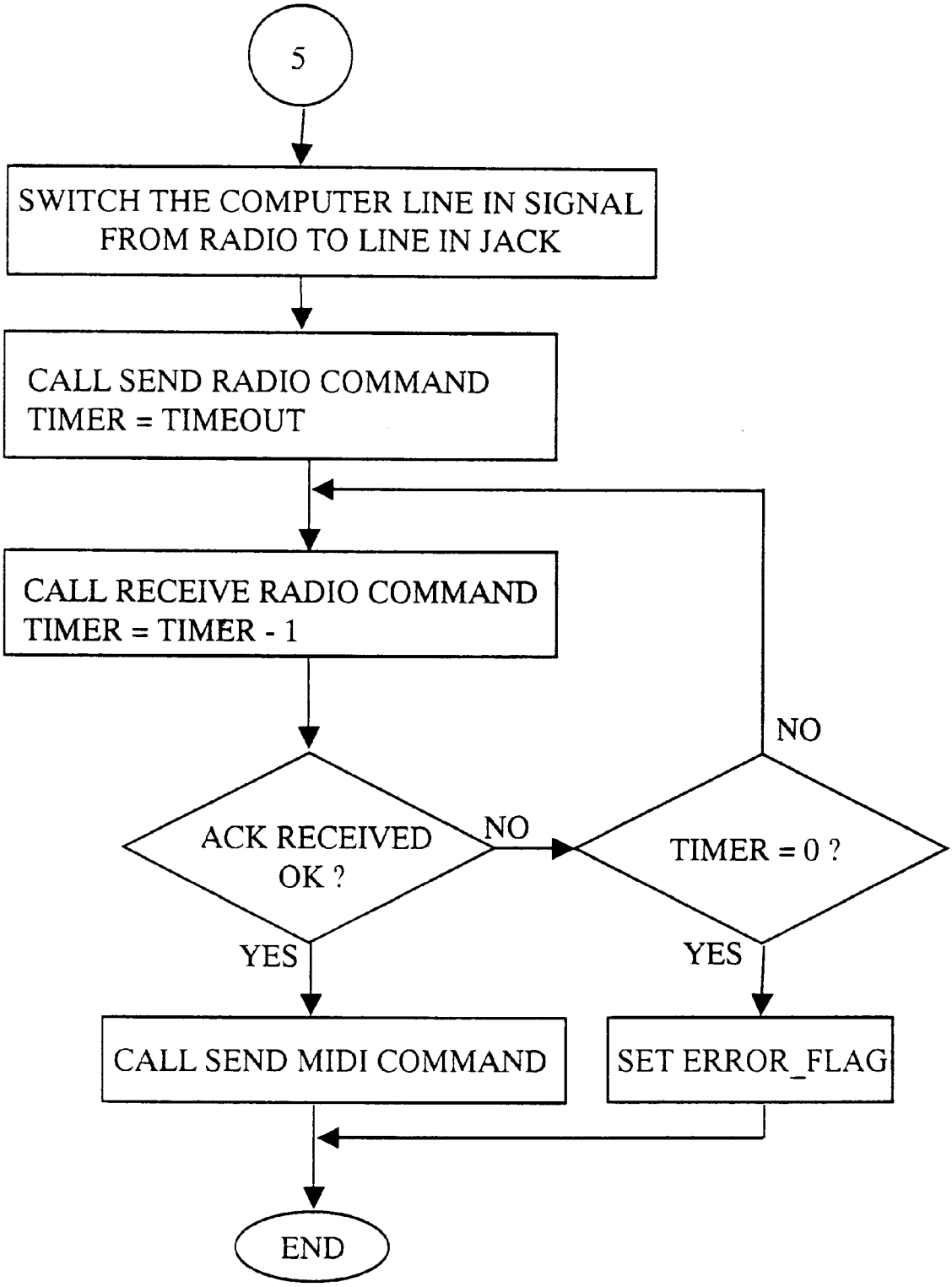

Attached herewith is a microfiche appendix labeled "1 of 2," "2 of 2," "1 of 4," "2 of 4," "3 of 4," and "4 of 4" and comprising appendices A–W wherein:

Appendix A is a computer listing of a preferred software implementation of the method of FIGS. 9A–9N, together with the method of FIGS. 8D–8M;

Appendix B is a computer listing of a preferred software implementation of the method of FIGS. 8A–8T;

Appendix C is a computer listing of a preferred software implementation of an example of a computer game for use in the computer 100 of FIG. 1;

Appendix D is a computer listing of a preferred software implementation of the method of FIGS. 11 and FIGS. 12A–12C;

Appendices E–H, taken together, are computer listings from which a first, DLL-compatible, functions library may be constructed;

Appendices I–O, taken together, are computer listings of a second functions library which may be used to generate a variety of games for any of the computer control systems shown and described herein; and Appendices P–W, taken together, are computer listings of another preferred software implementation, alternative to the implementation of Appendices A–O.

DETAILED DESCRIPTION OF PREFERRED EMBODIMENTS

Figure 1A:
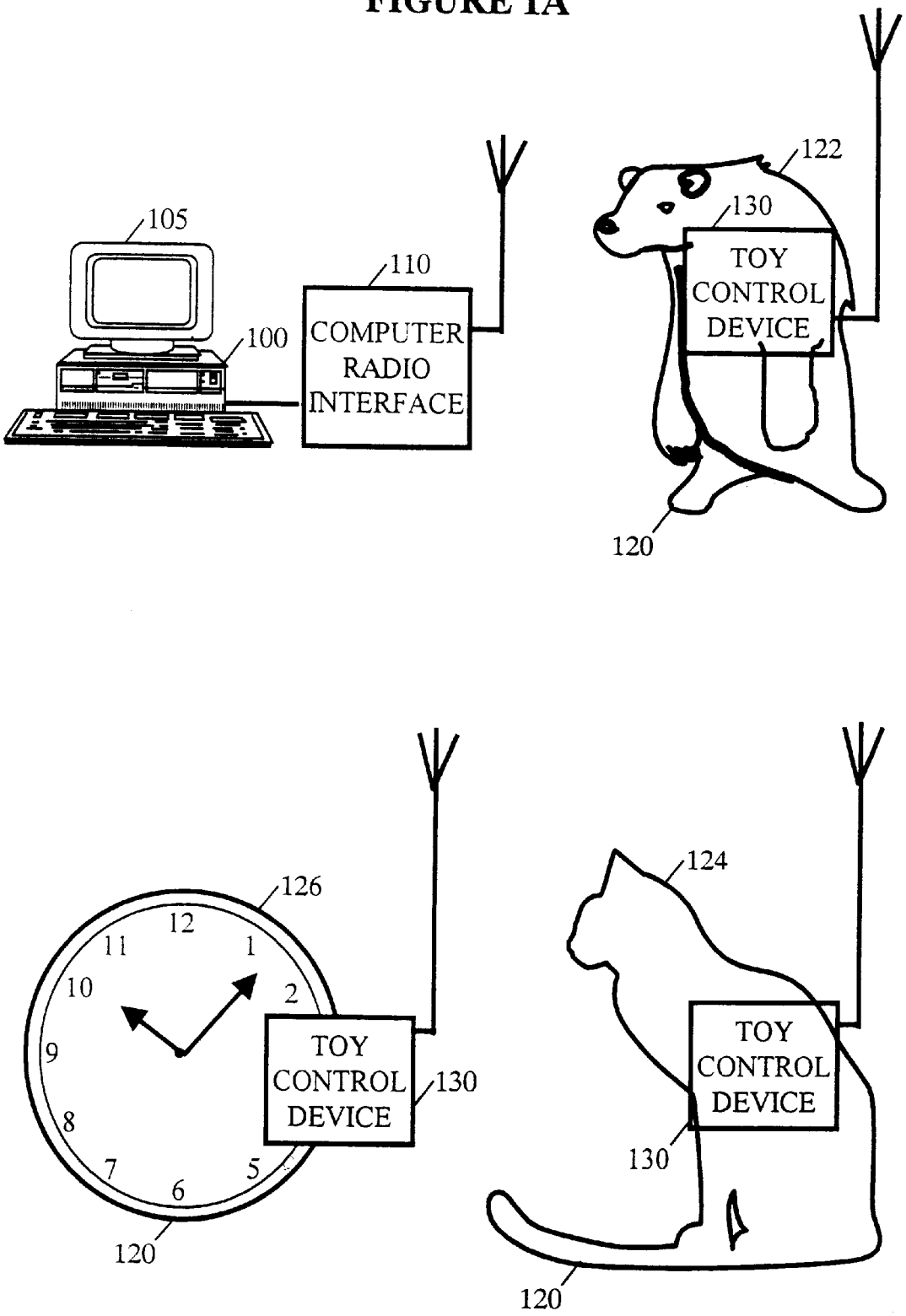
FIG. 1A is a partly pictorial, partly block diagram illustration of a computer control system including a toy, constructed and operative in accordance with a preferred embodiment of the present invention.

Reference is now made to FIG. 1A which is a partly pictorial, partly block diagram illustration of a computer control system including a toy, constructed and operative in accordance with a preferred embodiment of the present invention. The system of FIG. 1A comprises a computer 100, which may be any suitable computer such as, for example, an IBM-compatible personal computer. The computer 100 is equipped with a screen 105. The computer 100 is preferably equipped with a sound card such as, for example, a Sound Blaster Pro card commercially available from Creative Labs, Inc., 1901 McCarthy Boulevard, Milpitas Calif. 95035 or from Creative Technology Ltd., 67 Ayer Rajah Crescent #03-18, Singapore, 0513; a hard disk; and, optionally, a CD-ROM drive.

The computer 100 is equipped with a computer radio interface 110 operative to transmit signals via wireless transmission based on commands received from the computer 100 and, in a preferred embodiment of the present invention, also to receive signals transmitted elsewhere via wireless transmission and to deliver the signals to the computer 100. Typically, commands transmitted from the computer 100 to the computer radio interface 110 are transmitted via both analog signals and digital signals, with the digital signals typically being transmitted by way of a MIDI port. Transmission of the analog and digital signals is described below with reference to FIG. 3.

The transmitted signal may be an analog signal or a digital signal. The received signal may also be an analog signal or a digital signal. Each signal typically comprises a message. A preferred implementation of the computer radio interface 110 is described below with reference to FIG. 3.

The system of FIG. 1A also comprises one or more toys 120. The system of FIG. 1A comprises a plurality of toys, namely three toys 122, 124, and 126 but it is appreciated that, alternatively, either one toy only or a large plurality of toys may be used.

Figure 1B:
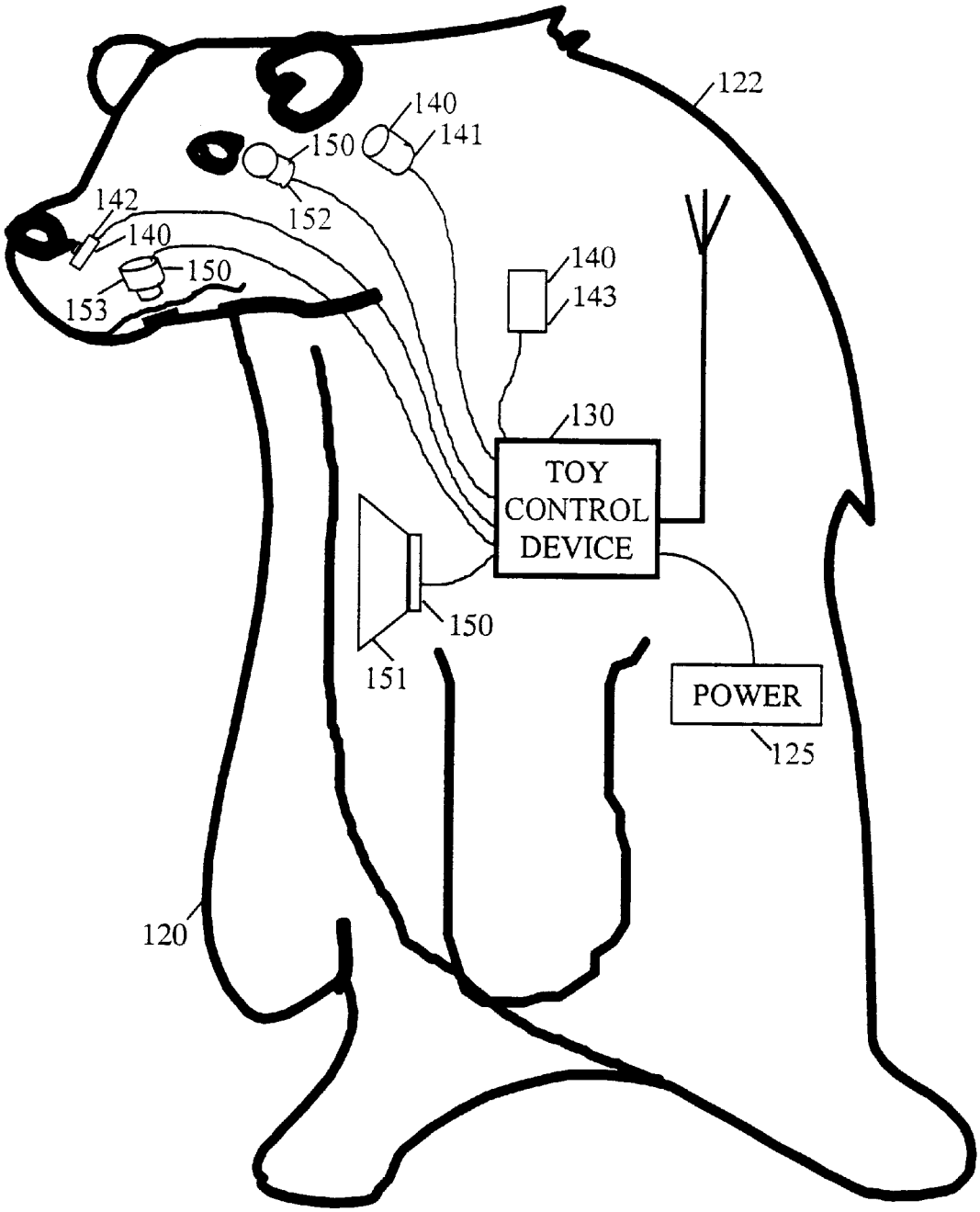
FIG. 1B is a partly pictorial, partly block diagram illustration a preferred implementation of the toy 122 of FIG. 1A.

Reference is now additionally made to FIG. 1B, which is a partly pictorial, partly block diagram illustration of the toy 122 of FIG. 1A.

Each toy 120 comprises a power source 125, such as a battery or a connection to line power. Each toy 120 also comprises a toy control device 130, operative to receive a wireless signal transmitted by the computer 100 and to cause each toy 120 to perform an action based on the received signal. The received signal may be, as explained above, an analog signal or a digital signal. A preferred implementation of the toy control device 130 is described below with reference to FIG. 6.

Each toy 120 preferably comprises a plurality of input devices 140 and output devices 150, as seen in FIG. 1B. The input devices 140 may comprise, for example on or more of the following: a microphone 141; a microswitch sensor 142; a touch sensor (not shown in FIG. 1B); a light sensor (not shown in FIG. 1B); a movement sensor 143, which may be, for example, a tilt sensor or an acceleration sensor. Appropriate commercially available input devices include the following: position sensors available from Hamlin Inc., 612 East Lake Street, Lake Mills, Wis. 53551, USA; motion and vibration sensors available from Comus International, 263 Hillside Avenue, Nutley, N.J. 07110, USA; temperature, shock, and magnetic sensors available from Murata Electronics Ltd., Hampshire, England; and switches available from C & K Components Inc., 15 Riverdale Avenue, Newton, Mass. 02058-1082, USA or from Micro Switch Inc., a division of Honeywell, USA. The output devices 150 may comprise, for example, one or more of the following: a speaker 151; a light 152; a solenoid 153 which may be operative to move a portion of the toy; a motor, such as a stepping motor, operative to move a portion of the toy or all of the toy (not shown in FIG. 1B). Appropriate commercially available output devices include the following: DC motors available from Alkatel (dunkermotoren), Postfach 1240, D-7823, Bonndorf/Schwarzald, Germany; stepping motors and miniature motors available from Haydon Switch and Instruments, Inc. (HSI), 1500 Meriden Road, Waterbury, Conn., USA; and DC solenoids available from Communications Instruments, Inc., P.O. Box 520, Fairview, N.C. 28730, USA.

Examples of actions which the toy may perform include the following: move a portion of the toy; move the entire toy; or produce a sound, which may comprise one or more of the following: a recorded sound, a synthesized sound, music including recorded music or synthesized music, speech including recorded speech or synthesized speech.

The received signal may comprise a condition governing the action as, for example, the duration of the action, or the number of repetitions of the action.

Typically, the portion of the received signal comprising a message comprising a command to perform a specific action as, for example, to produce a sound with a given duration, comprises a digital signal. The portion of the received signal comprising a sound, for example, typically comprises an analog signal. Alternatively, in a preferred embodiment of the present invention, the portion of the received signal comprising a sound, including music, may comprise a digital signal, typically a signal comprising MIDI data.

The action the toy may perform also includes reacting to signals transmitted by another toy, such as, for example, playing sound that the other toy is monitoring and transmitting.

In a preferred embodiment of the present invention, the toy control device 130 is also operative to transmit a signal intended for the computer 100, to be received by the computer radio interface 110. In this embodiment, the computer radio interface 110 is preferably also operative to poll the toy control device 130, that is, transmit a signal comprising a request that the toy control device 130 transmit a signal to the computer radio interface 110. It is appreciated that polling is particularly preferred in the case where there are a plurality of toys having a plurality of toy control devices 130.

The signal transmitted by the toy control device 130 may comprise one or more of the following: sound, typically sound captured by a microphone input device 141; status of sensor input devices 140 as, for example, light sensors or micro switch; an indication of low power in the power source 125; or information identifying the toy.

It is appreciated that a sound signal transmitted by the device 130 may also include speech. The computer system is operative to perform a speech recognition operation on the speech signals.

Appropriate commercially available software for speech recognition is available from companies such as: Stylus Innovation Inc., One Kendall Square, Building 300, Cambridge, Mass. 02139, USA; A&G Graphics Interface, USA, Telephone No. (617) 492-0120, Telefax No. (617) 427-3625; "Dragon Dictate For Windows", available from Dragon Systems Inc., 320 Nevada Street, Mass. 02160, USA, and "SDK" available from Lemout & Hausple Speech Products, Sint-Krispijnstraat 7, 8900 Leper, Belgium.

The signal from the radio control interface 110 may also comprise, for example, one or more of the following: a request to ignore input from one or more input devices 140; a request to activate one or more input devices 140 or to stop ignoring input from one or more input devices 140; a request to report the status of one or more input devices 140; a request to store data received from one or more input devices 140, typically by latching a transition in the state of one or more input devices 140, until a future time when another signal from the radio control interface 110 requests the toy control device 130 to transmit a signal comprising the stored data received from the one or more input devices 140; or a request to transmit analog data, typically comprising sound, typically for a specified period of time.

Typically all signals transmitted in both directions between the computer radio interface 110 and the toy control device 130 include information identifying the toy.

Figure 1C:
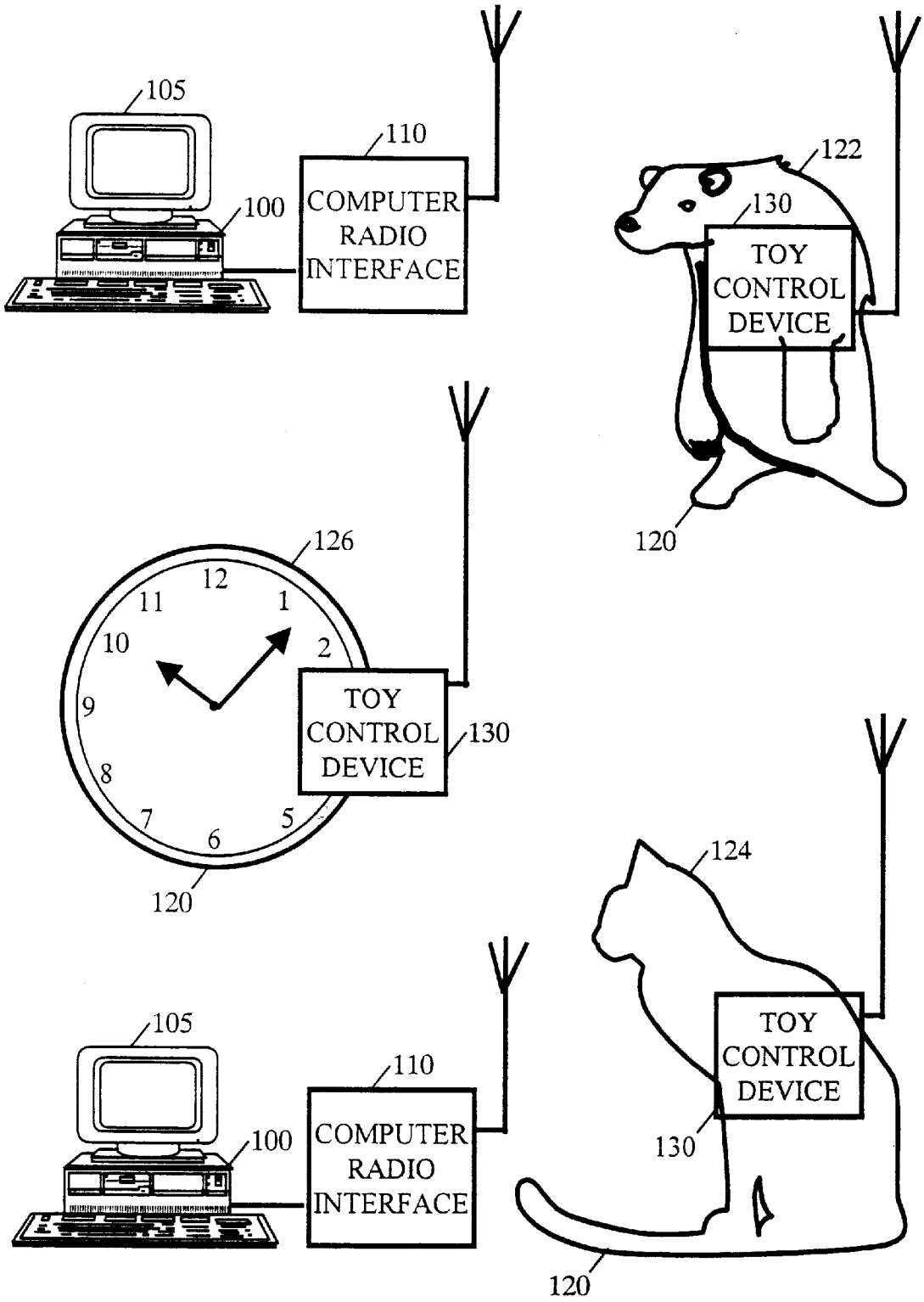
FIG. 1C is a partly pictorial, partly block diagram illustration of a computer control system including a toy, constructed and operative in accordance with an alternative preferred embodiment of the present invention.

Reference is now made to FIG. 1C, which is a partly pictorial, partly block diagram illustration of a computer control system including a toy, constructed and operative in accordance with an alternative preferred embodiment of the present invention. The system of FIG. 1C comprises two computers 100. It is appreciated that, in general, a plurality of computers 100 may be used. In the implementation of FIG. 1C, all signals transmitted in both directions between the computer radio interface 110 and the toy control device 130 typically include information identifying the computer.

The operation of the system of FIG. 1A is now briefly described. Typically, the computer 100 runs software comprising a computer game, typically a game including at least one animated character. Alternatively, the software may comprise educational software or any other interactive software including at least one animated object. As used herein, the term "animated object" includes any object which may be depicted on the computer screen 105 and which interacts with the user of the computer via input to and output from the computer. An animated object may be any object depicted on the screen such as, for example: a doll; an action figure; a toy, such as, for example, an activity toy, a vehicle, or a ride-on vehicle; a drawing board or sketch board; or a household object such as, for example, a clock, a lamp, a chamber pot, or an item of furniture.

Figure 2A:
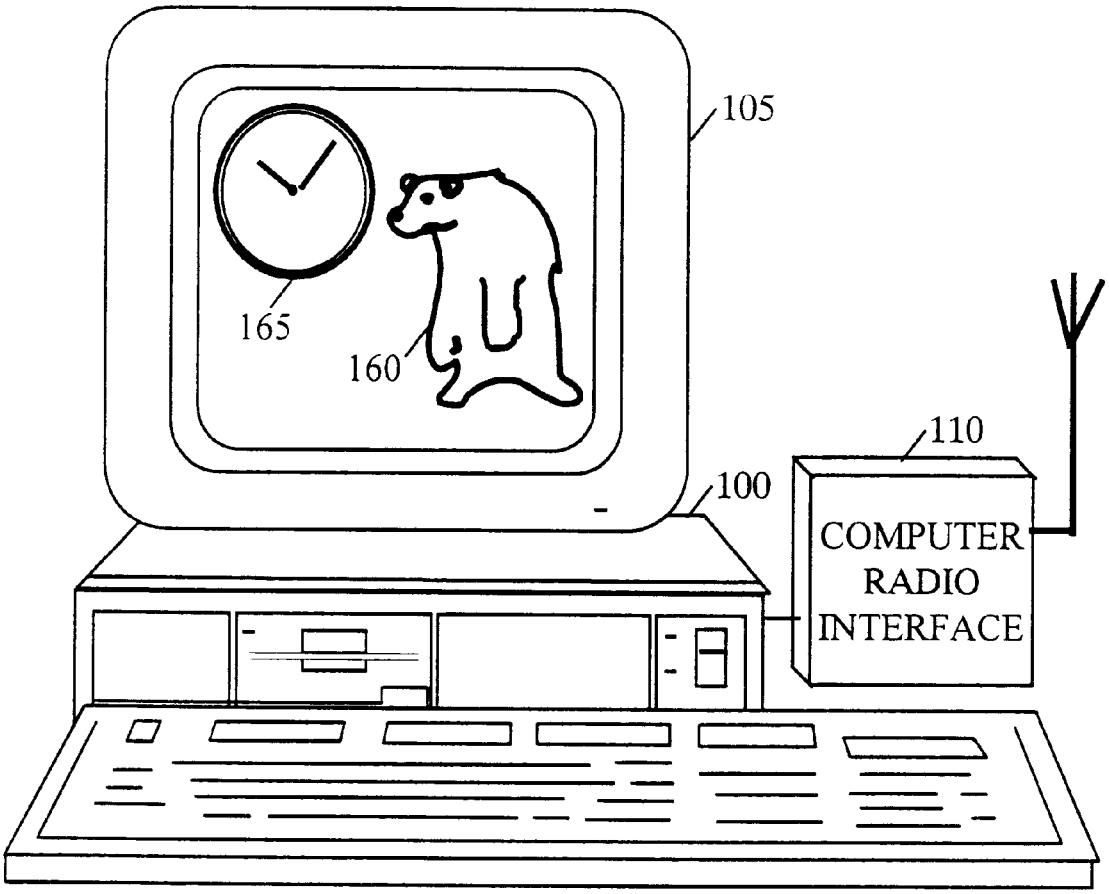
FIGS. 2A–2C are simplified pictorial illustrations of a portion of the system of FIG. 1A in use.
Figure 2B:
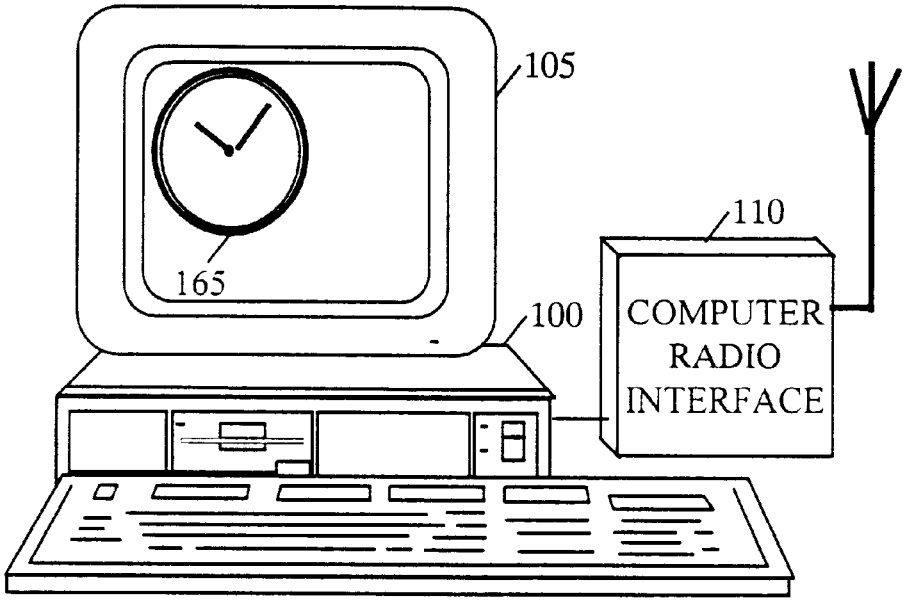
Figure 2B:
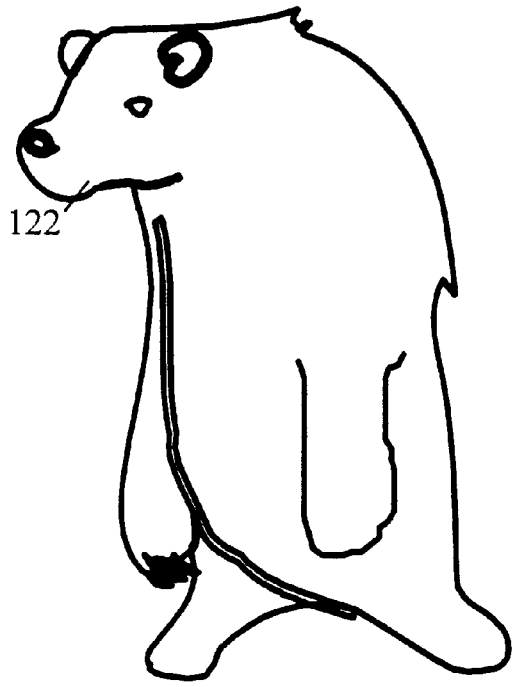
Figure 2C:
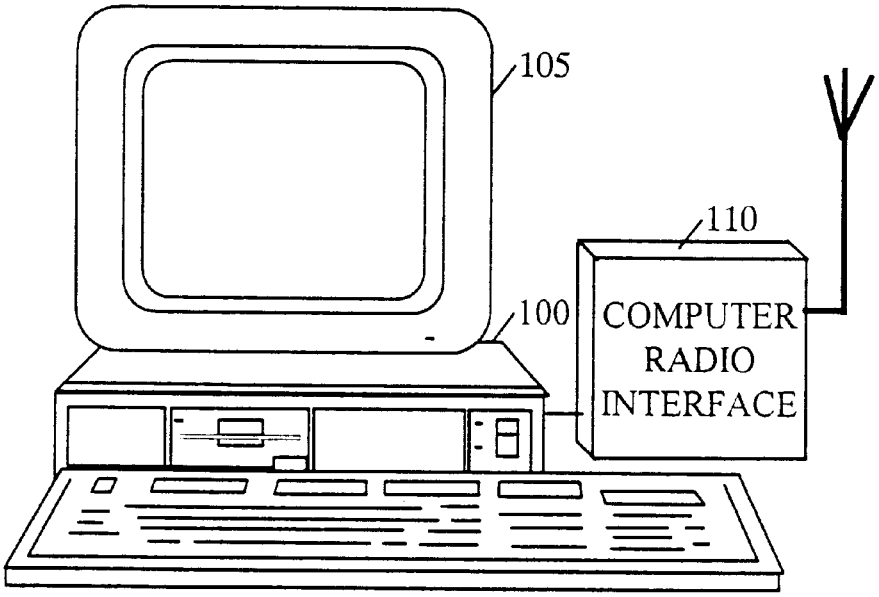
Figure 2C:
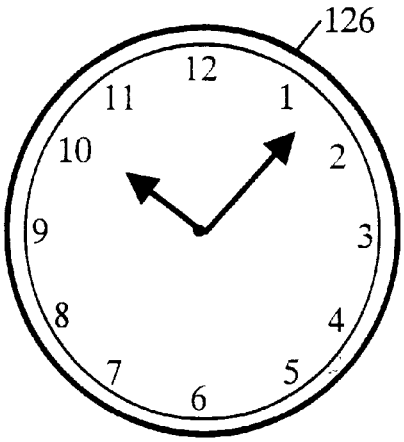
Figure 2C:
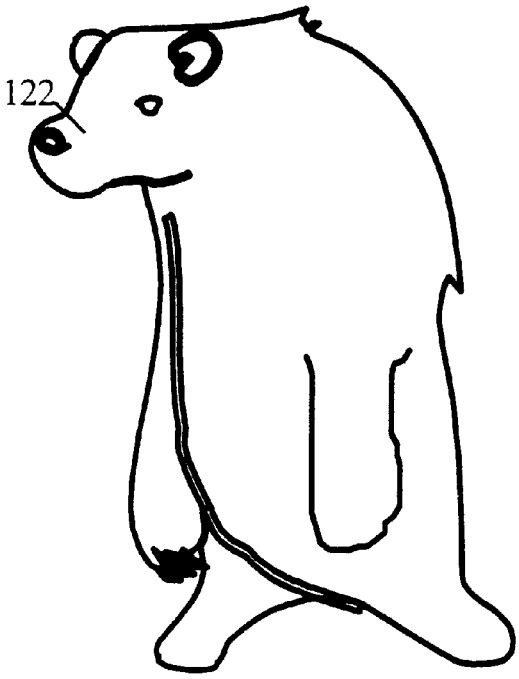

Reference is now additionally made to FIGS. 2A–2C, which depict a portion of the system of FIG. 1A in use. The apparatus of FIG. 2A comprises the computer screen 105 of FIG. 1A. On the computer screen are depicted animated objects 160 and 165.

FIG. 2B depicts the situation after the toy 122 has been brought into range of the computer radio interface 110 of FIG. 1A, typically into the same room therewith. Preferably, the toy 122 corresponds to the animated object 160. For example, in FIG. 2B the toy 122 and the animated object 160, shown in FIG. 2A, are both a teddy bear. The apparatus of FIG. 2B comprises the computer screen 105, on which is depicted the animated object 165. The apparatus of FIG. 2B also comprises the toy 122. The computer 100, having received a message via the computer radio interface 110, from the toy 122, no longer displays the animated object 160 corresponding to the toy 122. The functions of the animated object 160 are now performed through the toy 122, under control of the computer 100 through the computer radio interface 110 and the toy control device 130.

FIG. 2C depicts the situation after the toy 126 has also been brought into range of the computer radio interface 110 of FIG. 1A, typically into the same room therewith. Preferably, the toy 126 corresponds to the animated object 165. For example, in FIG. 2C the toy 126 and the animated object 165, shown in FIGS. 2A and 2B, are both a clock. The apparatus of FIG. 2C comprises the computer screen 105, on which no animated objects are depicted.

The apparatus of FIG. 2C also comprises the toy 126. The computer 100, having received a message via the computer radio interface 110 from the toy 126, no longer displays the animated object 165 corresponding to the toy 126. The functions of the animated object 165 are now performed through the toy 126, under control of the computer 100 through the computer radio interface 110 and the toy control device 130.

In FIG. 2A, the user interacts with the animated objects 160 and 165 on the computer screen, typically using conventional methods. In FIG. 2B the user also interacts with the toy 122, and in FIG. 2C typically with the toys 122 and 126, instead of interacting with the animated objects 160 and 165 respectively. It is appreciated that the user may interact with the toys 122 and 126 by moving the toys or parts of the toys; by speaking to the toys; by responding to movement of the toys which movement occurs in response to a signal received from the computer 100; by responding to a sound produced by the toys, which sound is produced in response to a signal received from the computer 100 and which may comprise music, speech, or another sound; or otherwise.

Figure 3:
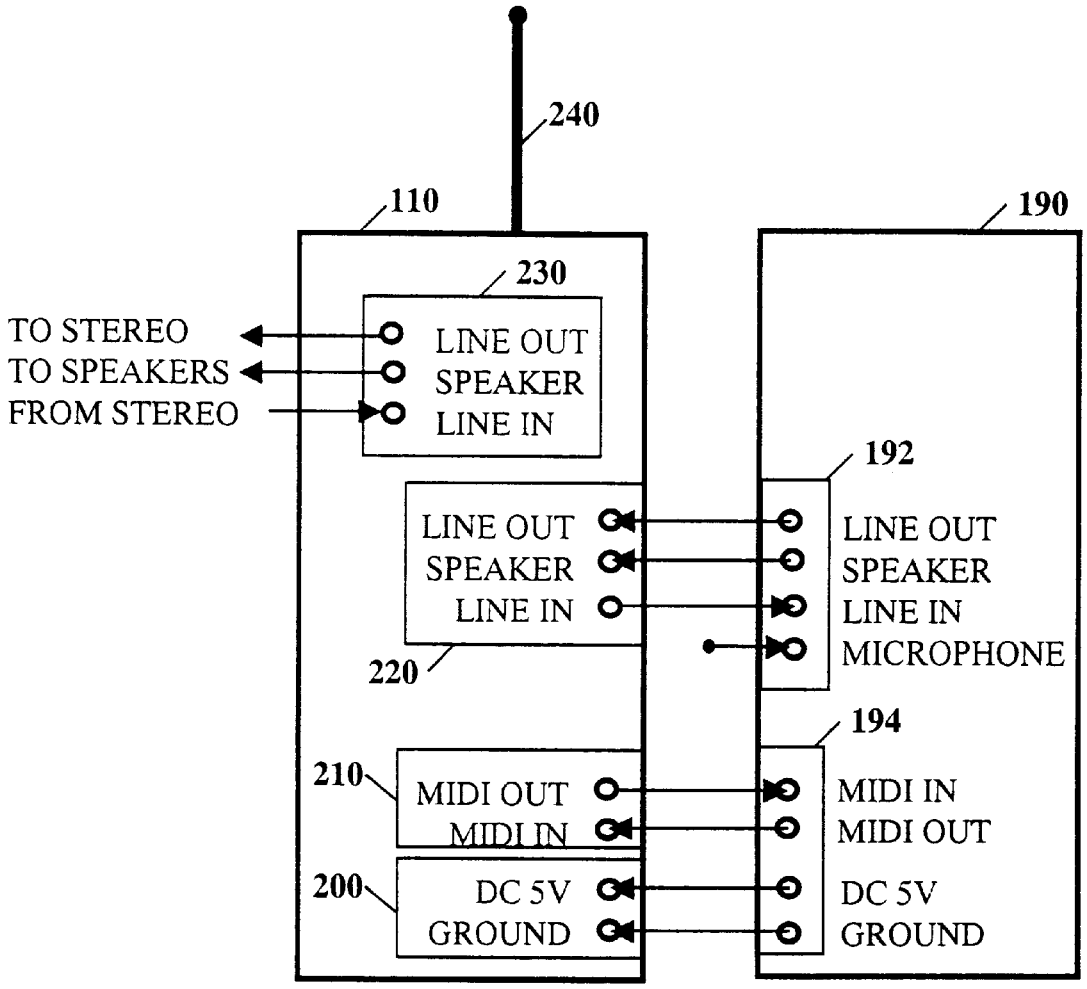

Reference is now made to FIG. 3 which is a simplified block diagram of a preferred embodiment of the computer radio interface 110 of FIG. 1A. The apparatus of FIG. 3 comprises the computer radio interface 110. The apparatus of FIG. 3 also comprises a sound card 190, as described above with reference to FIG. 1A. In FIG. 3, the connections between the computer radio interface 110 and the sound card 190 are shown.

The computer radio interface 110 comprises a DC unit 200 which is fed with power through a MIDI interface 210 from a sound card MIDI interface 194, and the following interfaces: a MIDI interface 210 which connects to the sound card MIDI interface 194, an audio interface 220 which connects to an audio interface 192 of the sound card 190; and a secondary audio interface 230 which preferably connects to a stereo sound system for producing high quality sound under control of software running on the computer 100 (not shown).

The apparatus of FIG. 3 also comprises an antenna 240, which is operative to send and receive signals between the computer radio interface 110 and one or more toy control devices 130.

Figure 4:
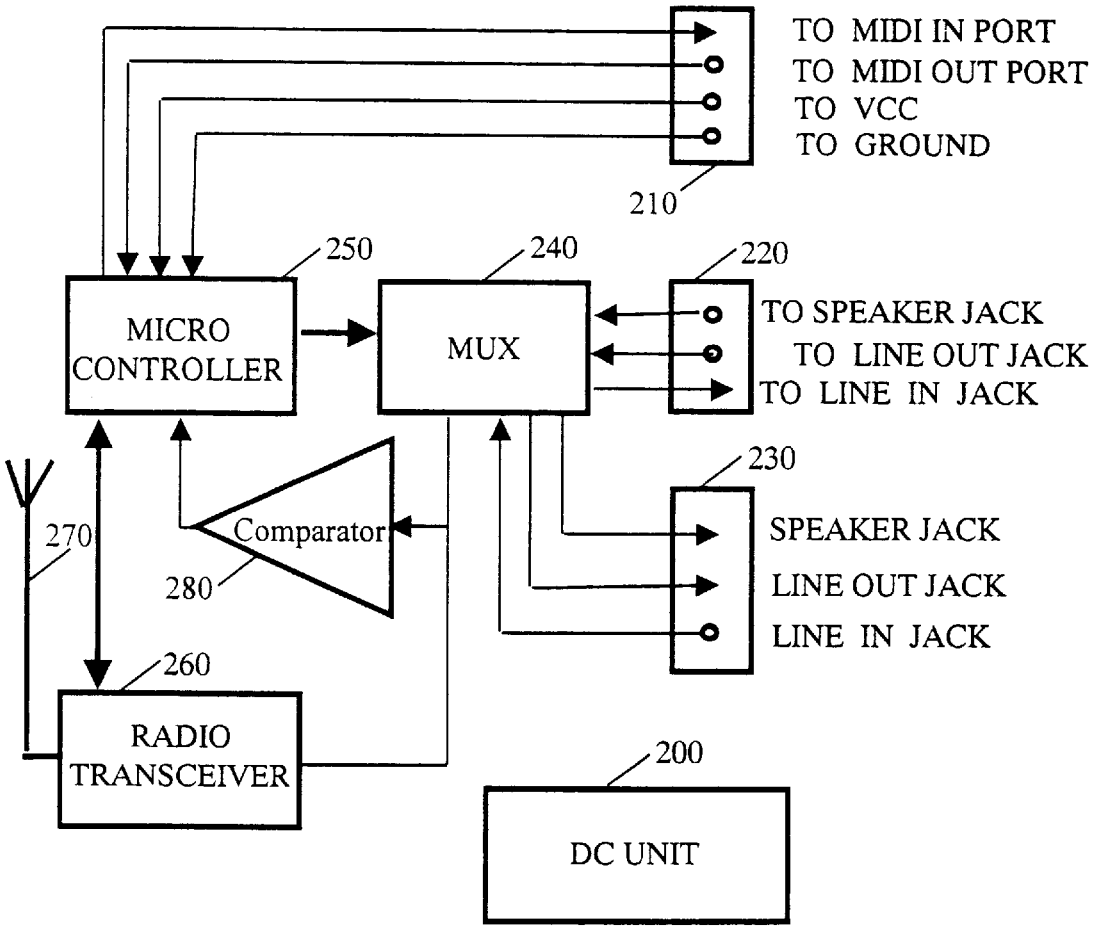

FIG. 4 is a more detailed block diagram of the computer radio interface 110 of FIG. 3. The apparatus of FIG. 4 comprises the DC unit 200, the MIDI interface 210, the audio interface 220, and the secondary audio interface 230. The apparatus of FIG. 4 also comprises a multiplexer 240, a micro controller 250, a radio transceiver 260, a connection unit 270 connecting the radio transceiver 260 to the micro controller 250, and a comparator 280.

Reference is now made to FIGS. 5A–5D, which taken together comprise a schematic diagram of the apparatus of FIG. 4.

Figure 5A:
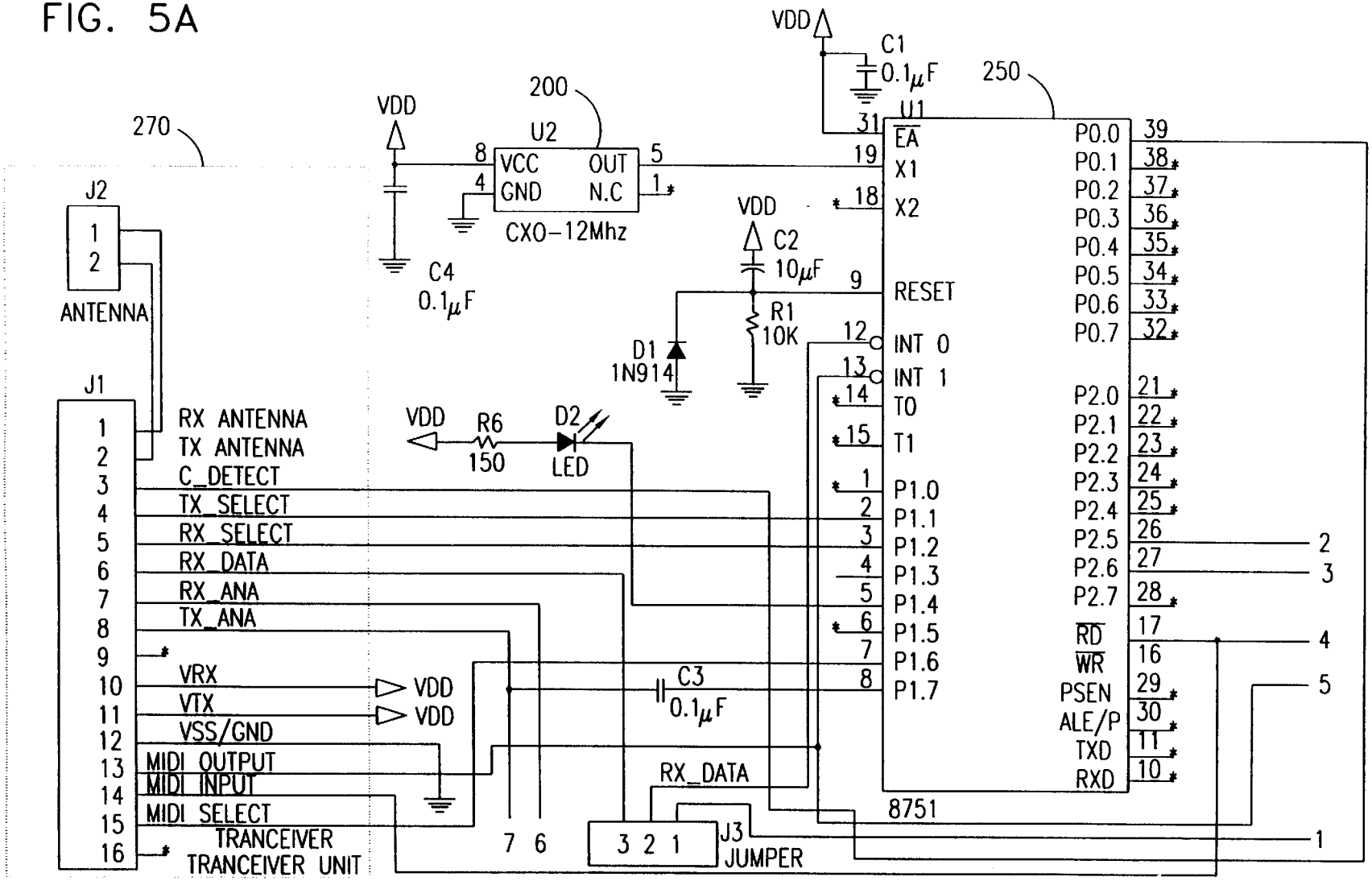
FIGS. 5A–5D taken together comprise a schematic diagram of the apparatus of FIG. 4.
Figure 5B:
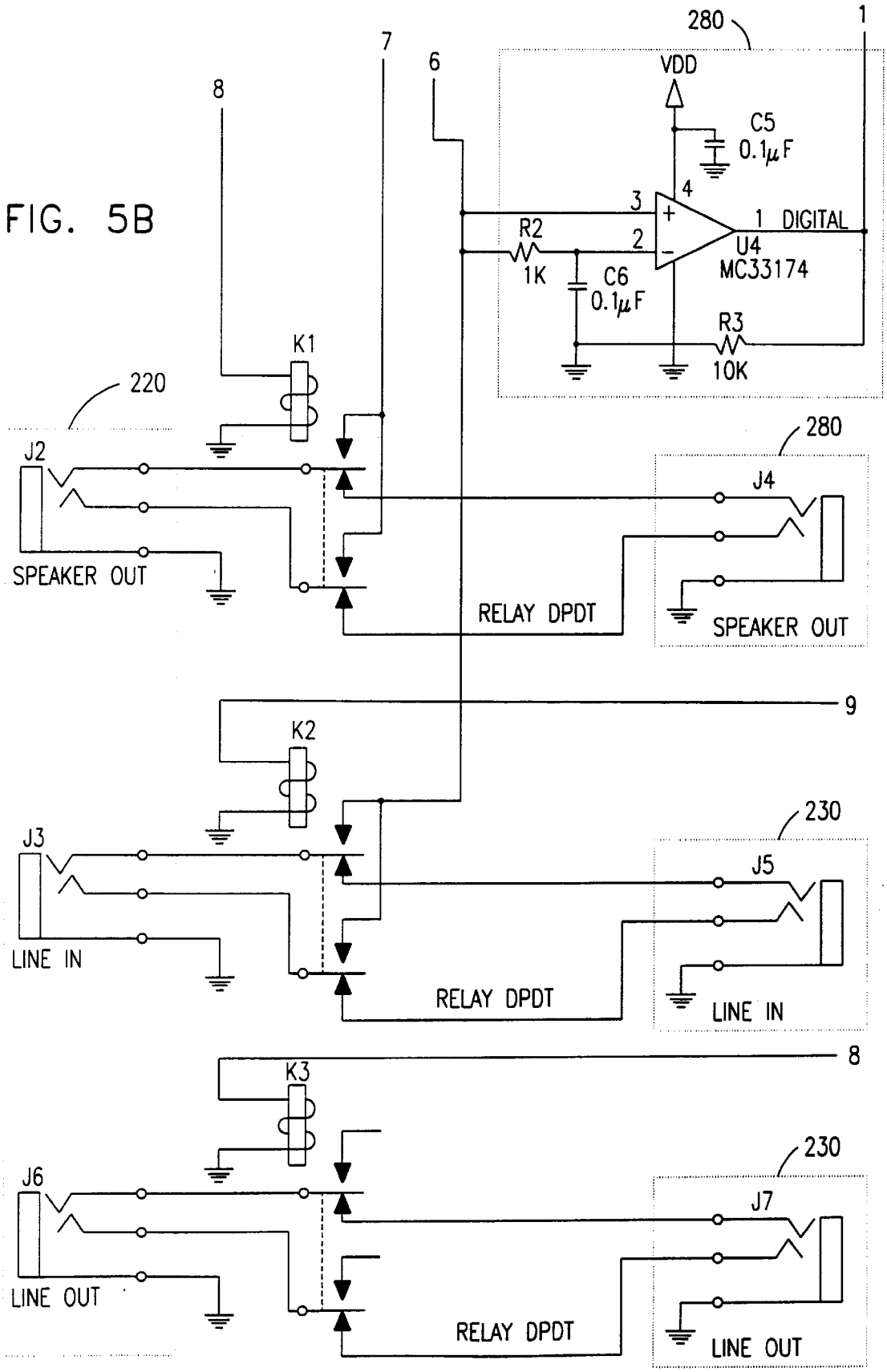
Figure 5C:
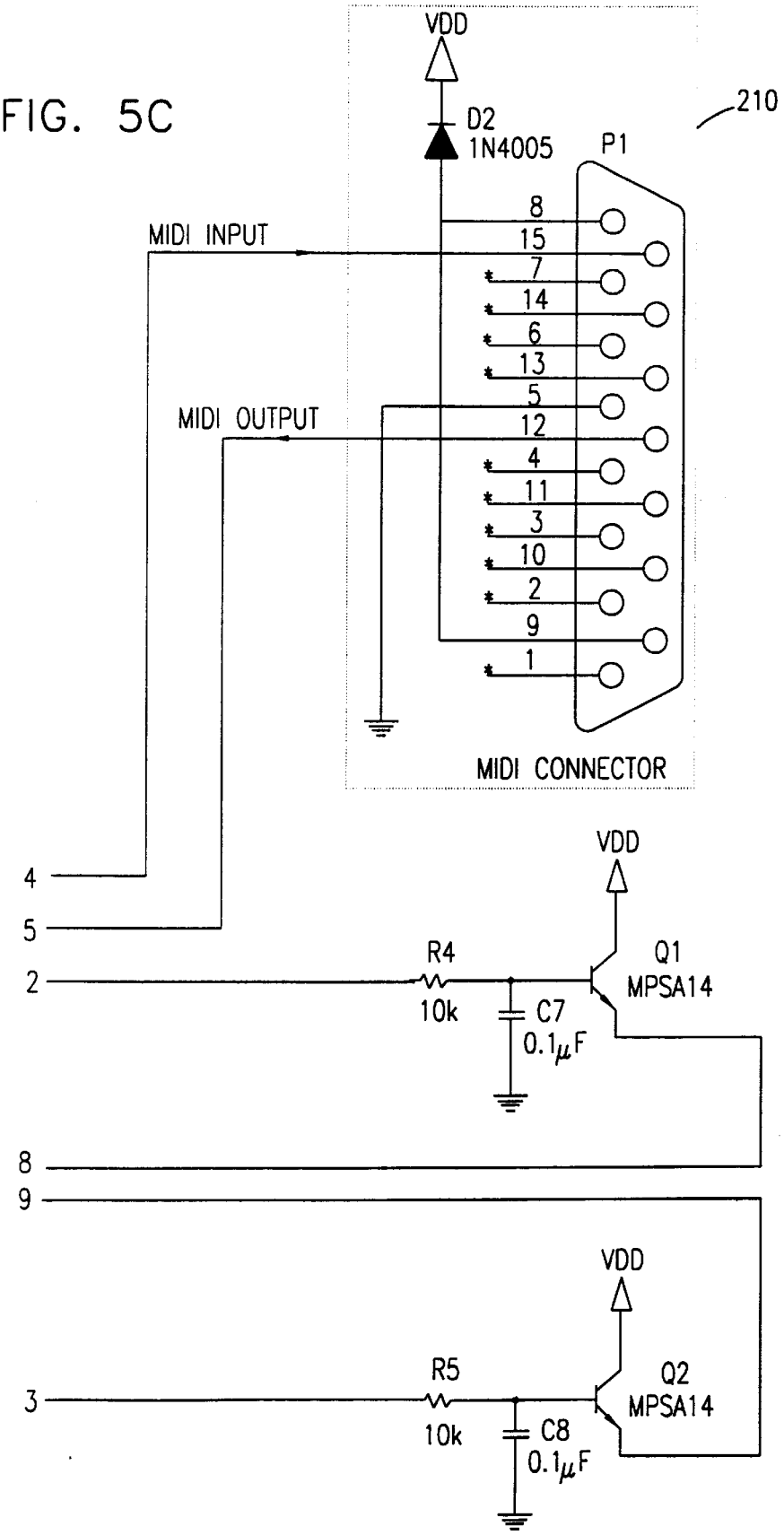

The following is a preferred parts list for the apparatus of FIGS. 5A–5C:

1. K1 Relay Dept, Idec, 1213 Elco Drive, Sunnyvale, Calif. 94089-2211, USA.

2. U1 8751 microcontroller, Intel Corporation, San Tomas 4, 2700 San Tomas Expressway, 2nd Floor, Santa Clara 95051, Calif. USA.

3. U2 CXO-12 MHZ (crystal oscillator), Raltron, 2315 N.W. 107th Avenue, Miami Fla. 33172, USA.

4. U4 MC33174, Motorola, Phoenix, Ariz., USA., Tel. No. (602) 897-5056.

5. Diodes 1N914, Motorola, Phoenix, Ariz., USA. Tel. No. (602)897-5056.

6. Transistors 2N2222 and MPSA14, Motorola, Phoenix, Ariz., USA. Tel. No. (602)897-5056.

Figure 5D:
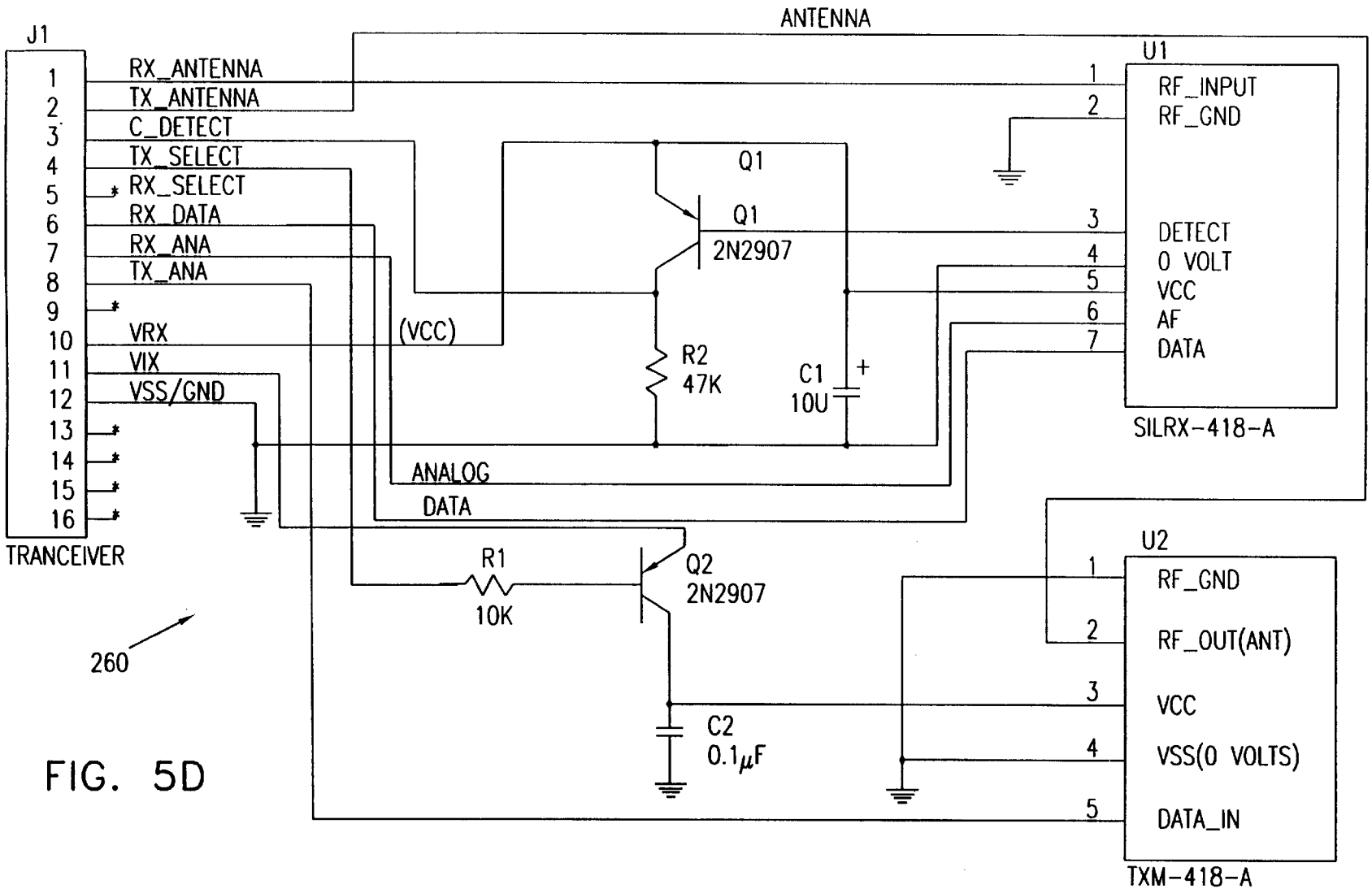

The following is a preferred parts list for the apparatus of FIG. 5D:

1. U1 SILRAX-418-A UHF radio telemetry receive module, Ginsburg Electronic GmbH, Am Moosfeld 85, D-81829, Munchen, Germany.

Alternatively, U1 of FIG. 5D may be replaced by:

U1 433.92 MHz Receive Module Part No. 0927, available from CEL SALES LTD., Cel House, Unit 2, Block 6, Shenstone Trading Estate, Bromsgrove, Halesowen, West Midlands B36 3XB, UK.

2. U2 TXM-418-A low power UHF radio telemetry transmit module, Ginsburg Electronic GmbH, Am Moosfeld 85, D-1829, Munchen, Germany.

Alternatively, U2 of FIG. 5D may be replaced by:

U2 433.92 SIL FM Transmitter Module Part No, 5229, available from CEL SALES LTD., Cel House, Unit 2, Block 6, Shenstone Trading Estate, Bromsgrove, Halesowen, West Midlands B36 3XB UK.

Figure 5E:
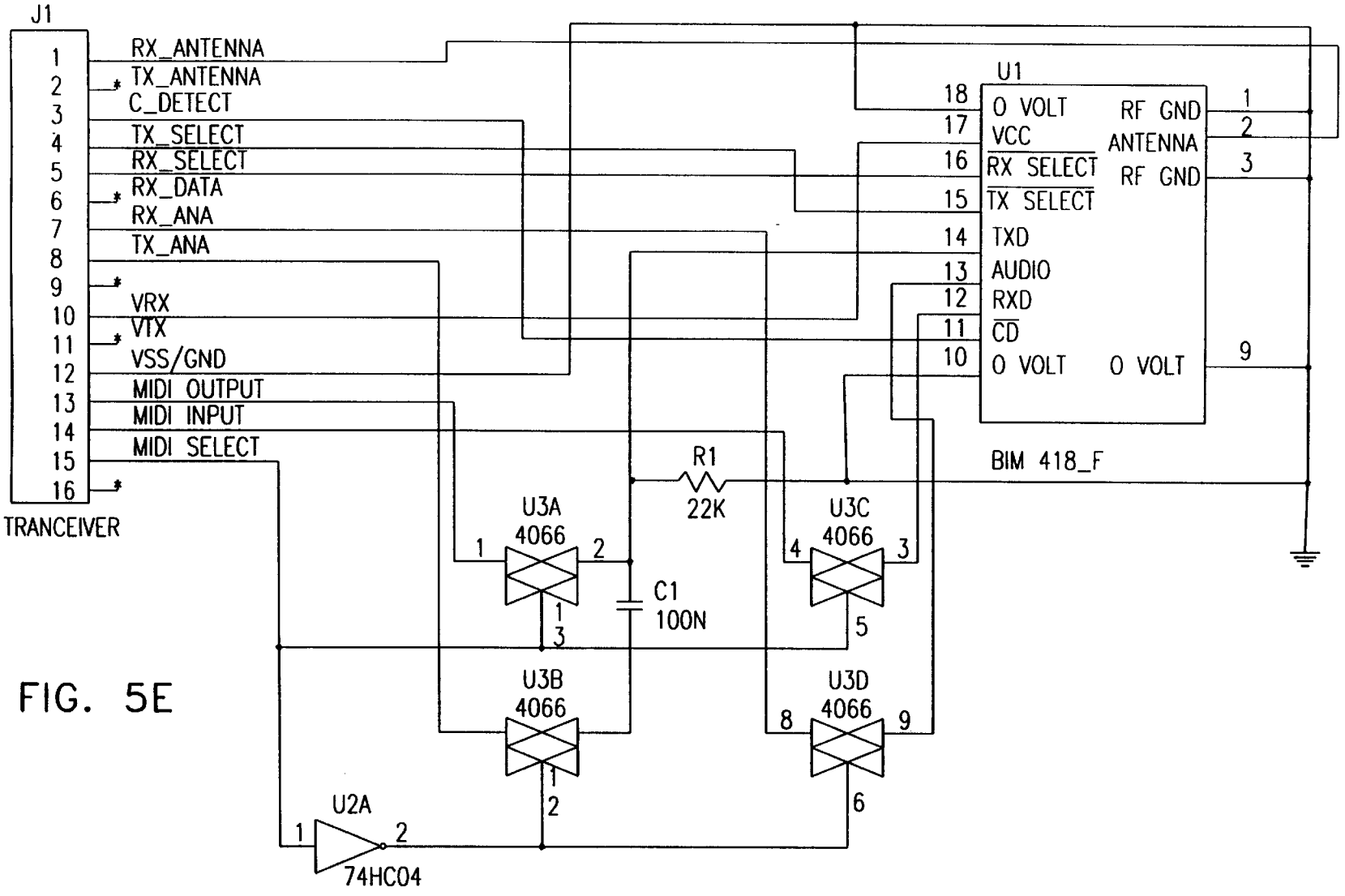
FIG. 5E is an schematic diagram of an alternative implementation of the apparatus of FIG. 5D.

Reference is now additionally made to FIG. 5E, which is a schematic diagram of an alternative implementation of the apparatus of FIG. 5D. The following is a preferred parts list for the apparatus of FIG. 5E:

1. U1 BIM-418-F low power UHF data transceiver module, Ginsburg Electronic GmbH, Am Moosfeld 85, D-81829, Munchen, Germany.

Alternate 1. U1 S20043 spread spectrum full duplex transceiver, AMI Semiconductors-American Microsystems, Inc., Id., USA.

Alternate 1. U1 SDT-300 synthesized transceiver, Circuit Design, Inc., Japan.

Alternatively, U1 may be replaced by:

U1 RY3GB021 RF 900 Mhz units, available from SHARP ELECTRONIC COMPONENTS GROUP, 5700 Northwest, Pacific Rim Boulevard #20, Camas, Wash., USA.

U1 RY3GB100 RF Units For DECT, available from SHARP ELECTRONIC COMPONENTS GROUP 5700 Northwest, Pacific Rim Boulevard #20, Camas, Wash., USA.

In the parts list for FIG. 5E, one of item 1 or either of the alternate items 1 may be used for U1.

It is appreciated that the appropriate changes will have to be made to all the circuit boards for alternate embodiments of the apparatus.

The apparatus of FIG. 5E has similar functionality to the apparatus of FIG. 5D, but has higher bit rate transmission and reception capacity and is, for example, preferred when MIDI data is transmitted and received.

FIGS. 5A–5E are self-explanatory with regard to the above parts lists.

Figure 6:
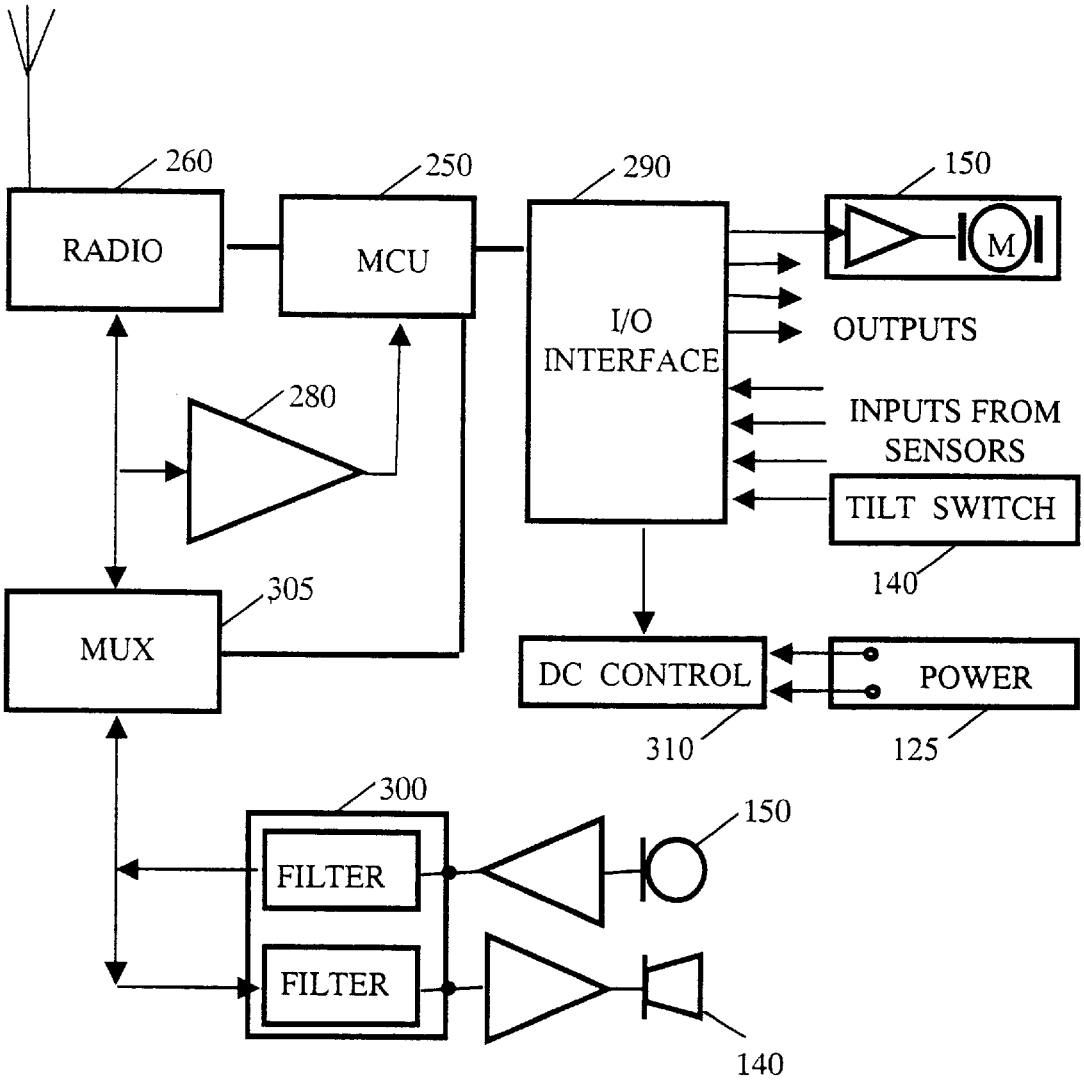
Figure 7A:
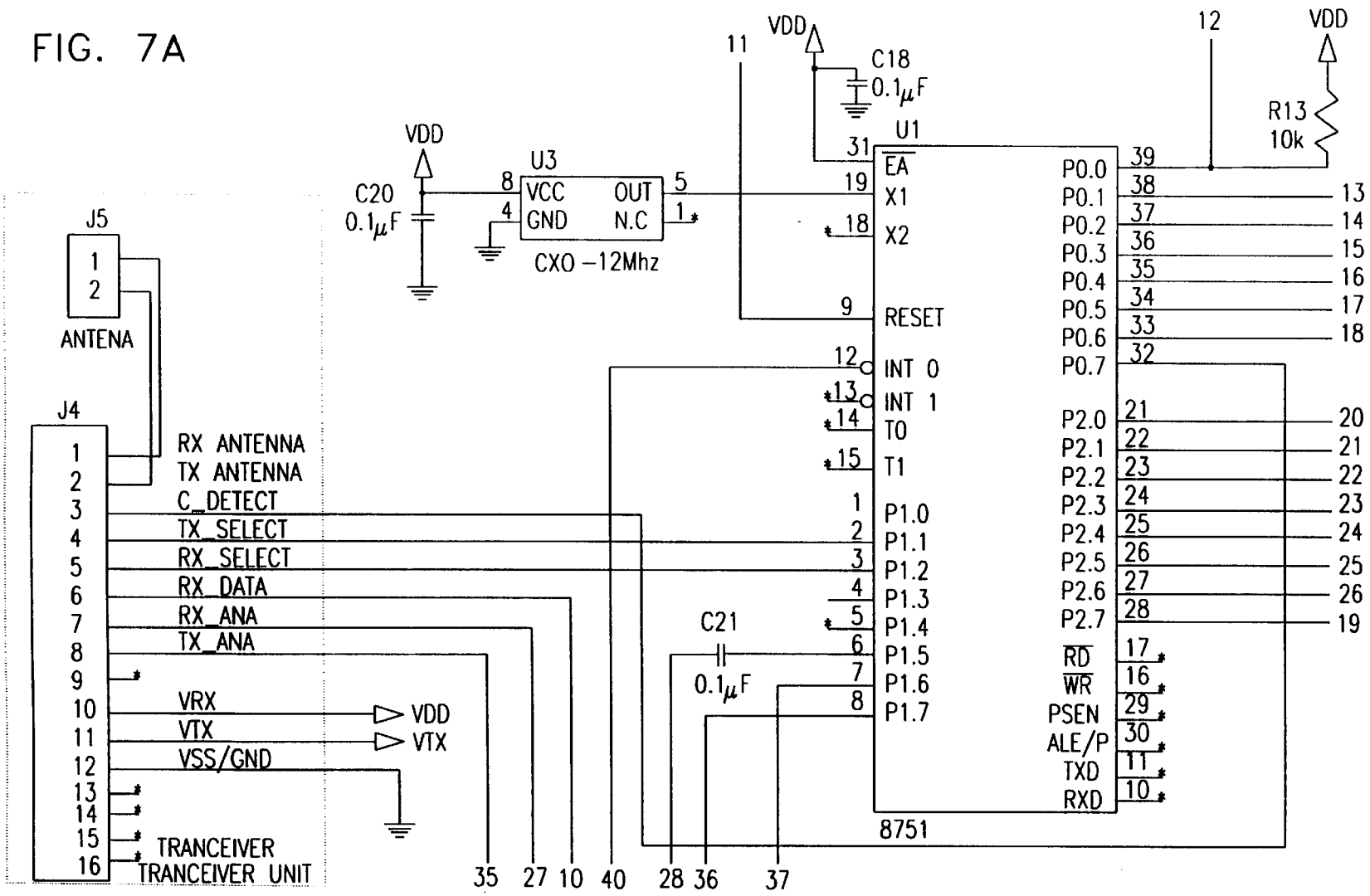
FIGS. 7A–7F, taken together with either FIG. 5D or FIG. 5E, comprise a schematic diagram of the apparatus of FIG. 6.
Figure 7B:
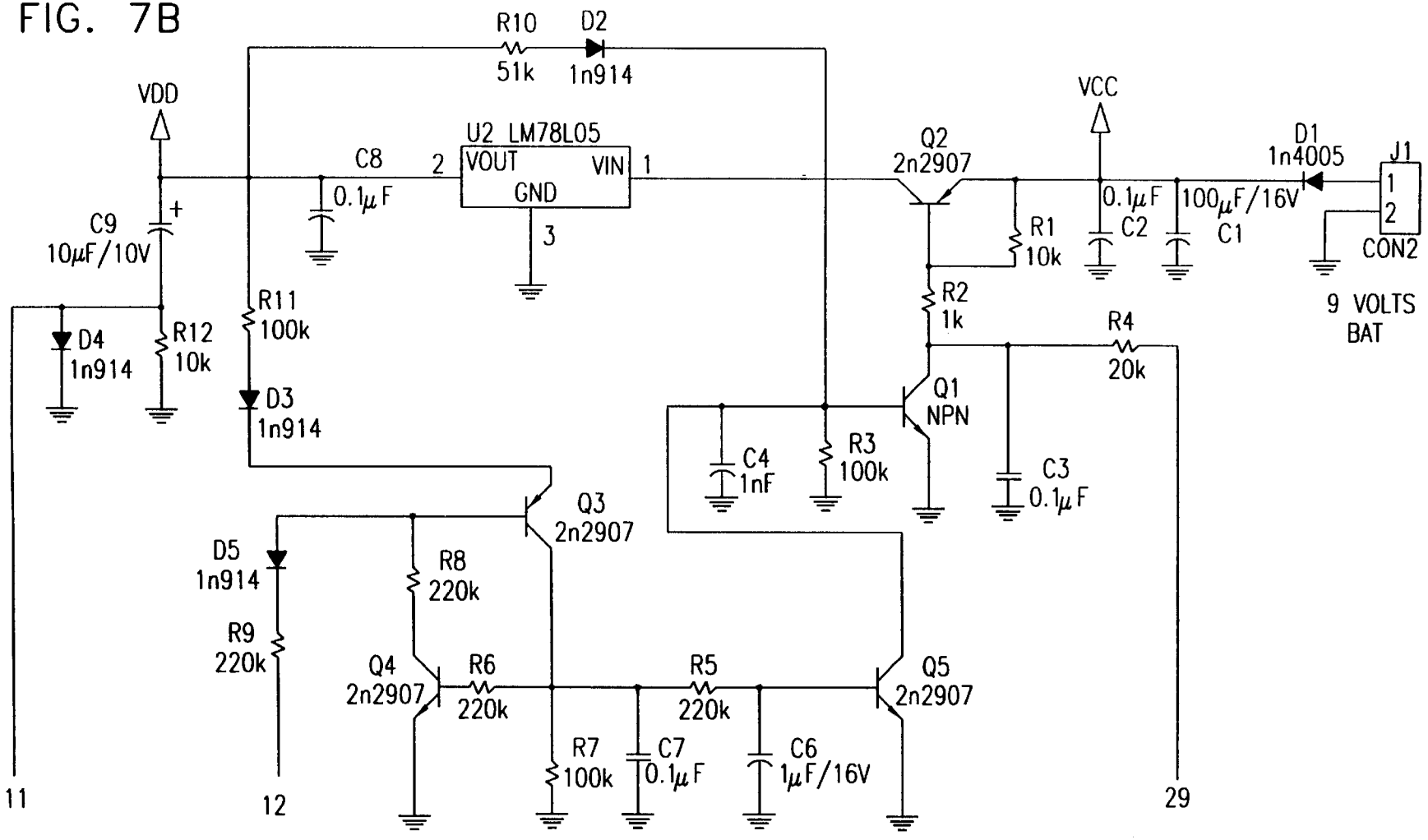
Figure 7C:
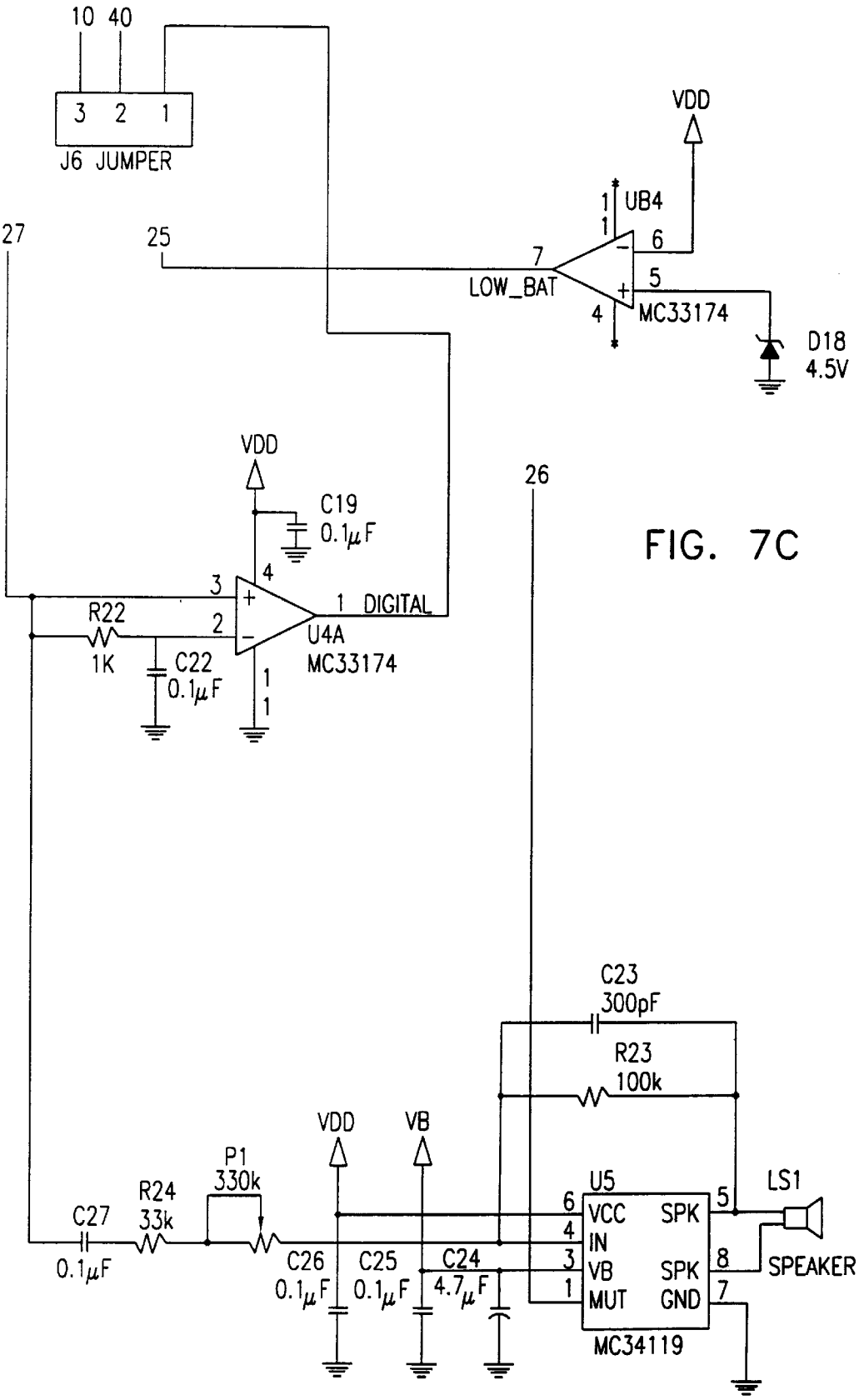
Figure 7D:
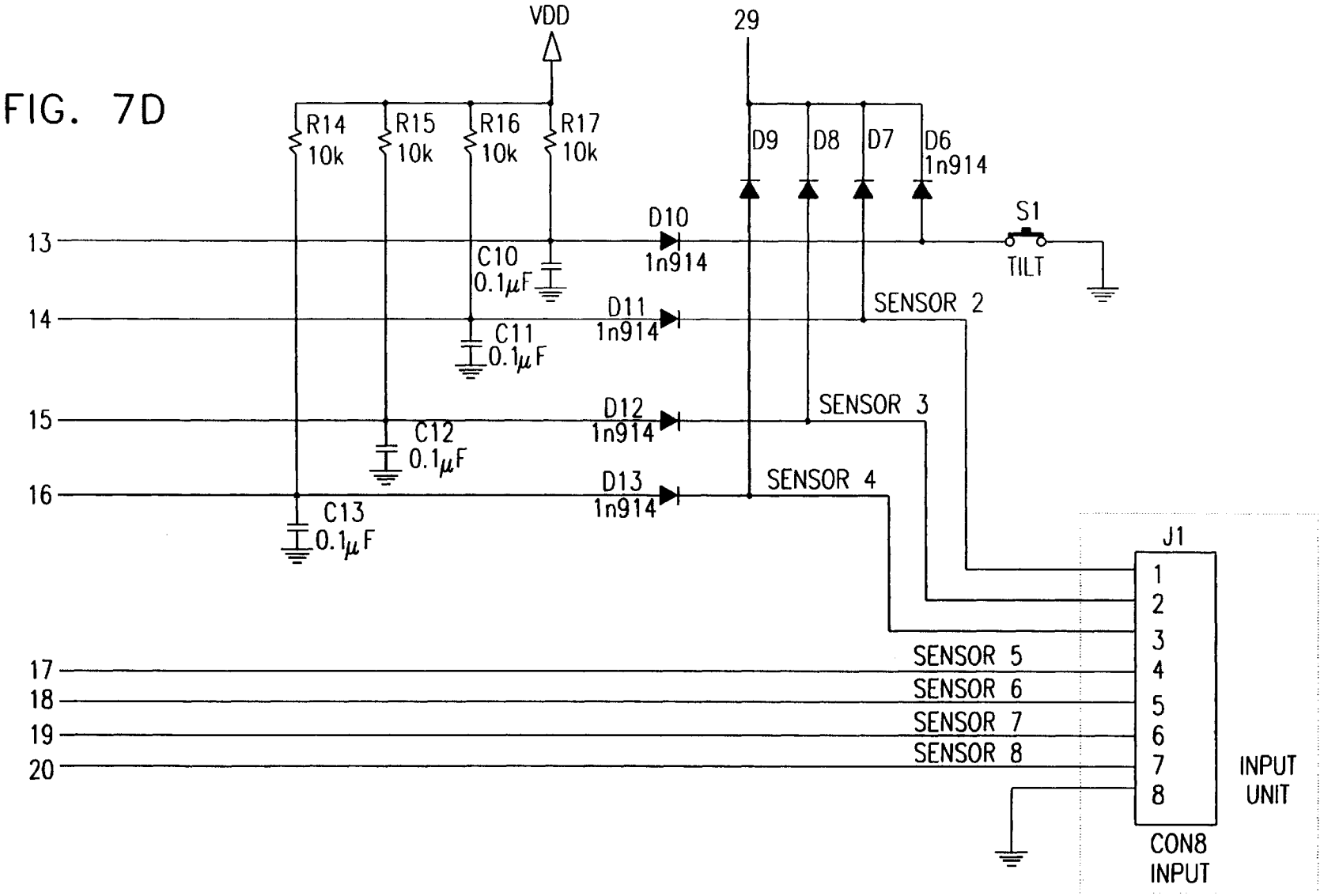
Figure 7E:
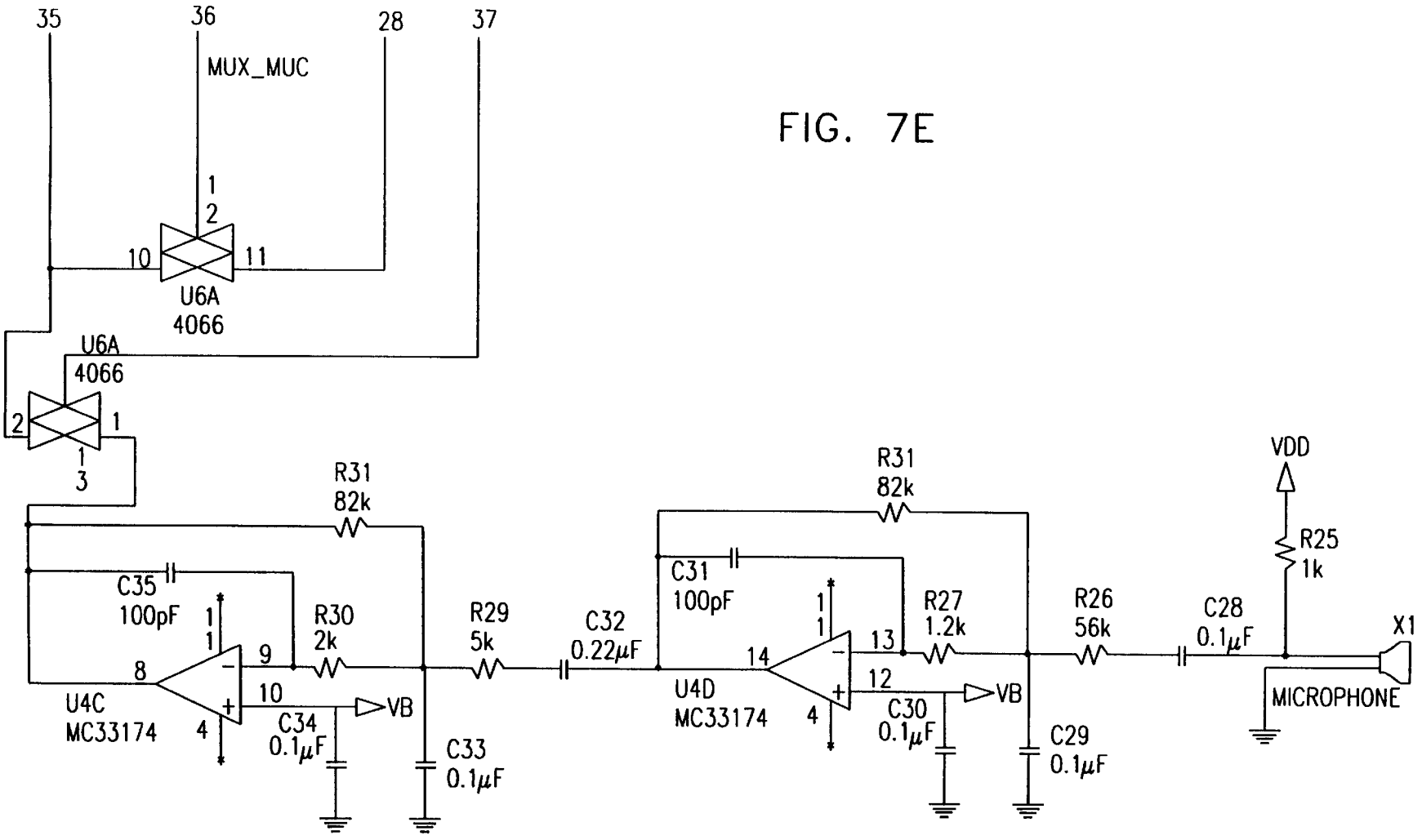
Figure 7F:
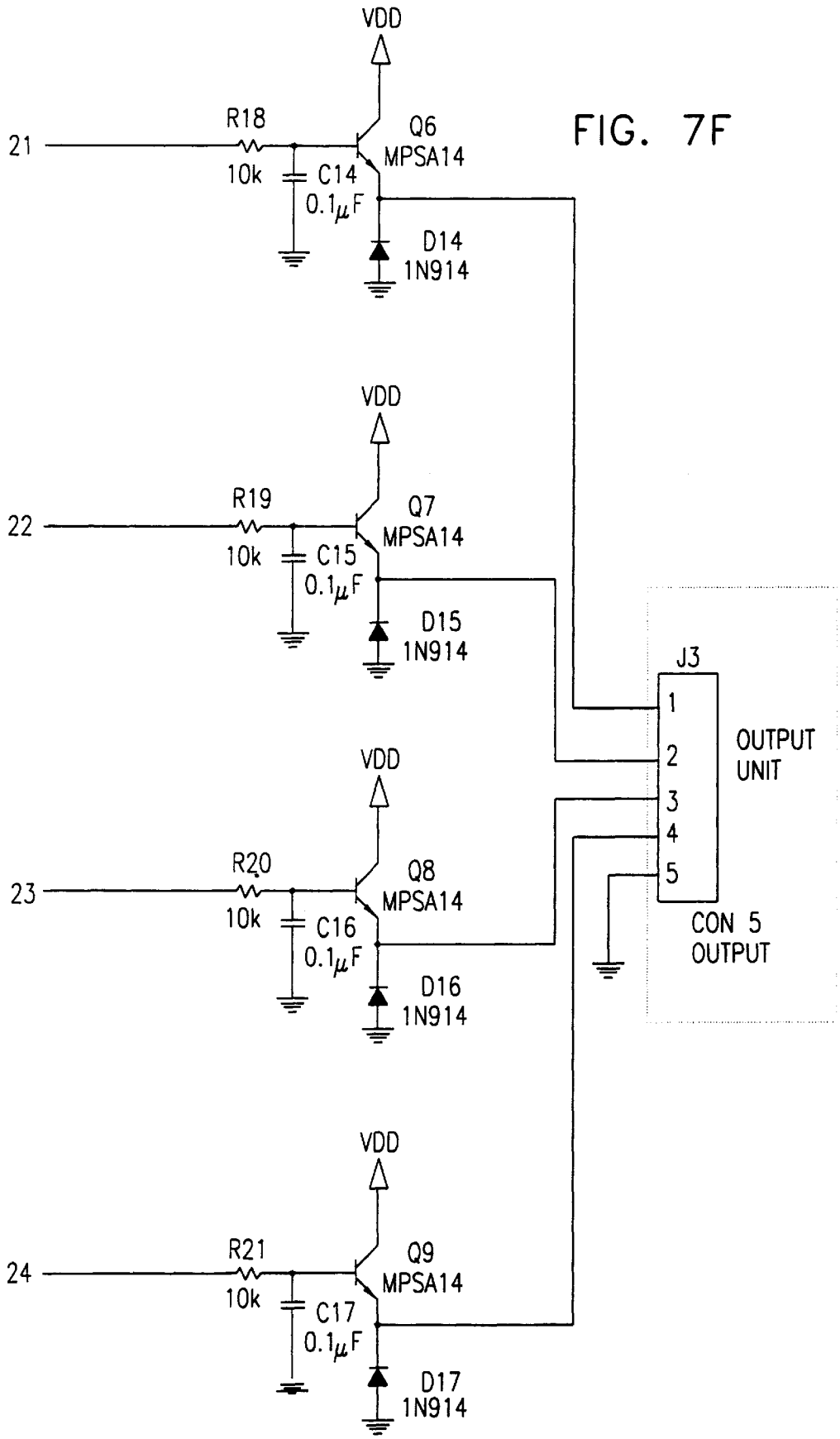

Reference is now made to FIG. 6 which is a simplified block diagram of a preferred embodiment of the toy control device 130 of FIG. 1A. The apparatus of FIG. 6 comprises a radio transceiver 260, similar to the radio transceiver 260 of FIG. 4. The apparatus of FIG. 6 also comprises a microcontroller 250 similar to the microcontroller 250 of FIG. 4.

The apparatus of FIG. 6 also comprises a digital input/output interface (digital I/O interface) 290, which is operative to provide an interface between the microcontroller 250 and a plurality of input and output devices which may be connected thereto such as, for example, four input device and four output devices. A preferred implementation of the digital I/O interface 290 is described in more detail below with reference to FIG. 7A–7F.

The apparatus of FIG. 6 also comprises an analog input/output interface (analog I/O interface) 300 operatively connected to the radio transceiver 260, and operative to receive signals therefrom and to send signals thereto.

The apparatus of FIG. 6 also comprises a multiplexer 305 which is operative, in response to a signal from the microcontroller 250, to provide output to the analog I/O interface 300 only when analog signals are being transmitted by the radio transceiver 260, and to pass input from the analog I/O interface 300 only when such input is desired.

The apparatus of FIG. 6 also comprises input devices 140 and output devices 150. In FIG. 6, the input devices 140 comprise, by way of example, a tilt switch operatively connected to the digital I/O interface 290, and a microphone operatively connected to the analog I/O interface 300. It is appreciated that a wide variety of input devices 140 may be used.

In FIG. 6, the output devices 150 comprise, by way of example, a DC motor operatively connected to the digital I/O interface 290, and a speaker operatively connected to the analog I/O interface 300. It is appreciated that a wide variety of output devices 150 may be used.

The apparatus of FIG. 6 also comprises a DC control 310, a preferred implementation of which is described in more detail below with reference to FIGS. 7A–7F.

The apparatus of FIG. 6 also comprises a comparator 280, similar to the comparator 280 of FIG. 4.

The apparatus of FIG. 6 also comprises a power source 125, shown in FIG. 6 by way of example as batteries, operative to provide electrical power to the apparatus of FIG. 6 via the DC control 310.

Reference is now made to FIGS. 7A–7F which, taken together with either FIG. 5D or SE, comprise a schematic diagram of the toy control device of FIG. 6. If the schematics of FIG. 5E is employed to implement the computer radio interface of FIG. 4, using RY3GB021 as U1 of FIG. 5E, then the same schematics of FIG. 5E are preferably employed to implement the toy control device of FIG. 6 except that RY3GH021 is used to implement U1 rather than RY3GB021.

The following is a preferred parts list for the apparatus of FIGS. 7A–7F:

1. U1 8751 microcontroller, Intel Corporation, San Tomas 4, 2700 San Tomas Expressway, 2nd Floor, Santa Clara 95051, Calif. USA.

2. U2 LM78L05, National Semiconductor, 2900 Semiconductor Drive, Santa Clara, Calif. 95052, USA.

3. U3 CXO-12 MHz (crystal oscillator), Raltron, 2315 N.W. 107th Avenue, Miami, Fla. 33172, USA.

4. U4 MC33174, Motorola, Phoenix, Ariz., USA. Tel. No. (602) 897-5056.

5. U5 MC34119, Motorola, Phoenix, Ariz., USA. Tel. No. (602) 897-5056.

6. U6 4066, Motorola, Phoenix, Ariz., USA. Tel. No. (602) 897-5056.

7. Diode 1N914, 1N4005, Motorola, Phoenix, Ariz., USA. Tel. No. (602) 897-5056.

8. Transistor 2N2222, 2N3906, Motorola, Phoenix, Ariz., USA. Tel. No. (602) 897-5056.

9. Transistors 2N2907 and MPSA14, Motorola, Phoenix, Ariz., USA. Tel. No. (602) 897-5056.

FIGS. 7A–7F are self-explanatory with reference to the above parts list.

As stated above with reference to FIG. 1A, the signals transmitted between the computer radio interface 110 and the toy control device 130 may be either analog signals or digital signals. It the case of digital signals, the digital signals preferably comprise a plurality of predefined messages, known to both the computer 100 and to the toy control device 130.

Each message sent by the computer radio interface 110 to the toy control device 130 comprises an indication of the intended recipient of the message. Each message sent by the toy control device 130 to the computer radio interface 110 comprises an indication of the sender of the message.

In the embodiment of FIG. 1C described above, messages also comprise the following:

each message sent by the computer radio interface 110 to the toy control device 130 comprises an indication of the sender of the message; and each message sent by the toy control device 130 to the computer radio interface 110 comprises an indication of the intended recipient of the message.

A preferred set of predefined messages is as follows:

COMMAND STRUCTURE

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |

COMMANDS LIST
From the Computer to the Toy control device.
A. OUTPUT COMMANDS
SET_IO_TO_DATA

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | A | 00 | 01 | 00 | IO | 00 | D | x | x | |

Set Toy control device output pin to a digital level D.

| | | |
|---|---|---|
| P: | Computer address | 00–03 H |
| A: | unit address - | 00–FF H |
| IO: | i/o number - | 00–03 H |
| D: | Data - | 00–01 H |

Example

-continued 1. 01 00 00 05 00 01 03 01 00 00 set io 3 to "1"
2. 01 00 00 05 00 01 03 00 00 00 set io 3 to "0"

CHANGE_IO_FOR_TIME

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | A | 00 | 02 | 00 | IO | 00 | D | T1 | T2 | |

Change Toy control device output pin to D for a period of time and then return to previous state.
P: Computer address 00–03 H
A: unit address - 00–FF H
IO: i/o number - 00–03 H
T1,T2: time - 00–FF H
D: Data - 00–01 H
example:
1. 01 00 00 05 00 02 03 05 00 00 set io 3 to "1" for 5 seconds

B. INPUT COMMANDS
SEND_STATUS_OF_SENSORS

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | A | **01** | **00** | x | x | x | x | x | x | |

send the Toy control device status of all sensors.
P: Computer address 00–03 H
A: unit address - 00–FF H
example:
1. 01 00 00 05 01 00 00 00 00 00 send current status of sensors

SENSORS_SCAN_MODE_ON

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | A | **01** | **01** | x | x | x | x | x | x | |

Start scanning the Toy control device sensors, and if one of them is closed (pressed to '0'), send back an ack.
P: Computer address 00–03 H
A: unit address - 00–FF H
example:
1. 01 00 00 05 01 01 00 00 00 00 scan mode of sensors ON

SENSORS_SCAN_MODE_ON_ONCE

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | A | **01** | **02** | x | x | x | x | x | x | |

Start scanning the Toy control device sensors, and if one of them is closed (pressed to '0'), send back an ack, then disable scanning the sensors.
P: Computer address 00–03 H
A: unit address - 00–FF H
1. 01 00 00 05 01 02 00 00 00 00 scan mode of sensors ON once

SENSORS_SCAN_MODE_OFF

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | A | **01** | **03** | x | x | x | x | x | x | |

Stop scanning the Toy control device sensors.
P: Computer address 00–03 H
A: unit address - 00–FF H
example:
1. 01 00 00 05 01 03 00 00 00 00 scan mode of sensors OFF

C. AUDIO OUT COMMANDS
START_AUDIO_PLAY

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | A | **02** | **00** | x | x | x | x | xx | xx | |

Start playing an audio in a speaker of the Toy control device The Audio is sent to the Toy control device by the computer sound card and the Computer radio interface.
P: Computer address 00–03 H
A: unit address - 00–FF H
1. 01 00 00 05 02 00 00 00 00 00 Start audio-play

STOP_AUDIO_PLAY

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | A | **02** | **01** | x | x | x | x | x | x | |

Stop playing an audio in a speaker of the Toy control device.
P: Computer address 00–03 H
A: unit address - 00–FF H
1. 01 00 00 05 02 01 00 00 00 00 Stop audio-play

D. AUDIO IN COMMANDS
TRANSMIT_MIC_FOR_TIME

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | A | **03** | **00** | T1 | T2 | x | x | x | x | |

Requests the Toy control device to Transmit microphone audio from the Toy control device to the Computer radio interface and to the sound card of the computer for time T.

P: Computer address 00–03 H
A: unit address - 00–FF H
T1,T2: TIME 00–FF H (SEC)
example:
1. 01 00 00 05 03 00 0A 00 00 00 start mic mode for 10 seconds

START_AUDIO_AND_IO_PLAY_FOR_TIME

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | A | **02** | **04** | T1 | T2 | T0 | td | SC | IO | |

Start playing an audio in a speaker of the Toy control device and set an io pin to '1'. After time T, stop audio and set IO to '0'. start this command after a delay td*100 ms. if SC = "1" then after the execution of this command, start the input command SCAN_SENSORS_ON_ONCE (if any sensor is pressed, even during the audio play, send a message to the computer).

P: Computer address 00–03 H
A: unit address - 00–FF H
IO: i/o number - 0–3 H (if IO > 3 then don't set IO)
T0,T1,T2: TIME 000–FFF H (*100 ms) (T0 = MMSB, T1 = MSB T0 = LSB)
td: delay time before execute 0–F H (*100 ms)
1. 01 00 00 05 02 04 80 2A 03 00 Start audio-play and IO # 3 for 6.4 second
640 = 280 H
delay before execution = 10*100 ms = 1 sec
2. 01 00 00 05 02 04 80 2A 13 00 Start audio-play and IO # 3 for 6.4 second and
set scan sensors on once mode.
delay before execution = 10*100 ms = 1 sec

45

E. GENERAL TOY COMMANDS
GOTO_SLEEP_MODE

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | A | **04** | **01** | x | x | x | x | x | x | |

Requests the Toy control device to go into power save mode (sleep).

P: Computer address 00–03 H
A: unit address - 00–FF H
1. 01 00 00 05 04 01 00 00 00 00 switch the Toy control device into sleep mode.

GOTO_AWAKE_MODE

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | A | **04** | **02** | x | x | x | x | x | x | |

Requests the Toy control device to go into an awake mode.
P: Computer address 00–03 H
A: unit address - 00–FF H
1. 01 00 00 05 04 02 00 00 00 00 switch the Toy control device into awake mode.

TOY_RESET

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | A | **04** | **0F** | x | x | x | x | x | x | |

Requests the Toy control device to perform RESET
P: Computer address 00–03 H
A: unit address - 00–FF H
1. 01 00 00 05 04 0F 00 00 00 00 Toy reset

TOY_USE_NEW_RF_CHANNELS

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | A | **04** | **0A** | CH1 | CH2 | x | x | x | x | |

Requests the Toy control device to switch to new RF transmit and receive channels.
P: Computer address 00–03 H
A: unit address - 00–FF H
CH1: Transmit RF channel number 0–F H
CH2: Receive RF Channel number 0–F H
1. 01 00 00 05 04 0A 12 00 00 00 Switch to new RX and TX RF channels
Note:
This command is available only with enhanced radio modules (alternate U1 of FIG. 5E) or with the modules described if FIG. 15A–15E and 24A–24E.

F. TELEMETRY

Information sent by the Toy control device, as an ACK to the command received from the Computer radio interface.

OK_ACK

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | A | **0A** | **00** | cmd1 | cmd2 | cmd3 | cmd4 | sen1 | sen2 | |

Send back an ACK about the command that was received ok.
P: Computer address 00–03 H
A: unit address - 00–FF H
cmd 1,2: Received command MSB ok ack. 00–FF H -continued

| | | |
|---|---|---|
| cmd 3,4: | Received command LSB ok ack. | 00–FF H |
| sen 1,2 | Sensors 0–7 status | 00–FF H |
| 1. | 01 60 00 05 **0A 00** 01 01 FF 00 | OK ack for 0101 command. (sensors scan mode on command). status: all sensors are not pressed (FF). |
| 2. | 01 60 00 05 **0A 00** 01 01 FE 00 | OK ack for 0101 command. (sensors scan mode on command). status: sensor #8 is pressed (FE) the computer_radio_interface number is 6. |

G. REQUESTS

Requests sent by the Toy control device, after an event.

TOY_IS_AWAKE_REQ

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | A | **0A** | **00** | c1 | c2 | x | x | x | x | |

Send a message to the Computer radio interface if the Toy control device goes from sleep mode to awake mode.

| | | |
|---|---|---|
| P: | Computer address | 00–03 H |
| A: | unit address - | 00–FF H |
| c1,c2: | status command | AB H |
| 1. | 01 60 00 05 **0A 00** AB 00 FF 00 | Toy is awake message. |

H. CRI (Computer Radio Interface)- commands

Commands that are sent only to the Computer radio interface.

SWITCH_AUDIO_OUT_TO_RADIO_&_TRANSMIT

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | x | **0C** | **00** | x | x | x | x | x | x | |

Requests the Computer radio interface to switch audio_out from the computer sound card to the radio wireless transceiver and transmit.

P: Computer address 00–03 H

SWITCH_AUDIO_OUT_TO_JACK_&_STOP_TRANSMIT

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | x | **0C** | **01** | x | x | x | x | x | x | |

Requests the Computer radio interface to switch audio_out from the radio RF wireless transceiver to the speakers jack and to stop transmit.

P: Computer address 00–03 H

MUTE_RADIO

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | x | **0C** | **02** | x | x | x | x | x | x | |

Mute the radio transmit.
P: Computer address 00–03 H

UN-MUTE_RADIO

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | 00 | 00 | 00 | x | **0C** | **03** | x | x | x | x | x | x | |

UN-Mute the radio transmit.

CRI_RESET

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | x | **0C** | **0F** | x | x | x | x | x | x | |

Perform software reset on the Computer radio interface unit.
P: Computer address 00–03 H I. CRI - ACK
ACK sent only to the Computer by the Computer radio interface, only after CRI commands.
CRI_COMMAND_ACK

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | x | **0D** | **00** | cmd1 | cmd2 | cmd3 | cmd4 | x | x | |

This is an ACK for a CRI command. this ACK is sent to the computer by the computer-radio-interface, after executing a command successfully.
P: Computer address 00–03 H
cmd 1,2: Received CRI command MSB ok ack. 00–FF H
cmd 3,4: Received CRI command LSB ok ack. 00–FF H
1. 01 60 00 00 0D 00 0C 01 00 00 OK ack for 0C01 CRI command (SWITCH AUDIO OUT TO JACK)
the computer_radio_interface number is 6.
2. 01 60 00 00 0D 00 0C 0F 00 00 OK ack for 0C0F CRI command (CRI reset)
the computer_radio_interface number is 6.
This ack is also sent on POWER UP RESET

Reference is now made to FIG. 8A, which is a simplified flowchart illustration of a preferred method for receiving radio signals, executing commands comprised therein, and sending radio signals, within the toy control device 130 of FIG. 1A. Typically, each message as described above comprises a command, which may include a command to process information also comprised in the message. The method of FIG. 8A preferably comprises the following steps:

A synchronization signal or preamble is detected (step 400). A header is detected (step 403).

A command contained in the signal is received (step 405).

The command contained in the signal is executed (step 410). Executing the command may be as described above with reference to FIG. 1A.

A signal comprising a command intended for the computer radio interface 110 is sent (step 420).

Reference is now made to FIGS. 8B–8T which, taken together, comprise a simplified flowchart illustration of a preferred implementation of the method of FIG. 8A. The method of FIGS. 8B–8T is self-explanatory.

Reference is now made to FIG. 9A, which is a simplified flowchart illustration of a preferred method for receiving MIDI signals, receiving radio signals, executing commands comprised therein, sending radio signals, and sending MIDI signals, within the computer radio interface 110 of FIG. 1A. Some of the steps of FIG. 9A are identical to steps of FIG. 8A, described above. FIG. 9A also preferably comprises the following steps:

A MIDI command is received from the computer 100 (step 430). The MIDI command may comprise a command intended to be transmitted to the toy control device 130, may comprise an audio in or audio out command, or may comprise a general command.

A MIDI command is sent to the computer 100 (step 440). The MIDI command may comprise a signal received from the toy control device 130, may comprise a response to a MIDI command previously received by the computer radio interface 110 from the computer 100, or may comprise a general command.

The command contained in the MIDI command or in the received signal is executed (step 450). Executing the command may comprise, in the case of a received signal, reporting the command to the computer 100, whereupon the computer 100 may typically carry out any appropriate action under program control as, for example, changing a screen display or taking any other appropriate action in response to the received command. In the case of a MIDI command received from the computer 100, executing the command may comprise transmitting the command to the toy control device 130. Executing a MIDI command may also comprise switching audio output of the computer control device 110 between the secondary audio interface 230 and the radio transceiver 260. Normally the secondary audio interface 230 is directly connected to the audio interface 220 preserving the connection between the computer sound board and the peripheral audio devices such as speakers, microphone and stereo system.

Reference is now made to FIGS. 9B–9N, and additionally reference is made back to FIGS. 8D–8M, all of which, taken together, comprise a simplified flowchart illustration of a preferred implementation of the method of FIG. 9A. The method of FIGS. 9B–9M, taken together with FIGS. 8D–8M, is self-explanatory.

Figure 10A:
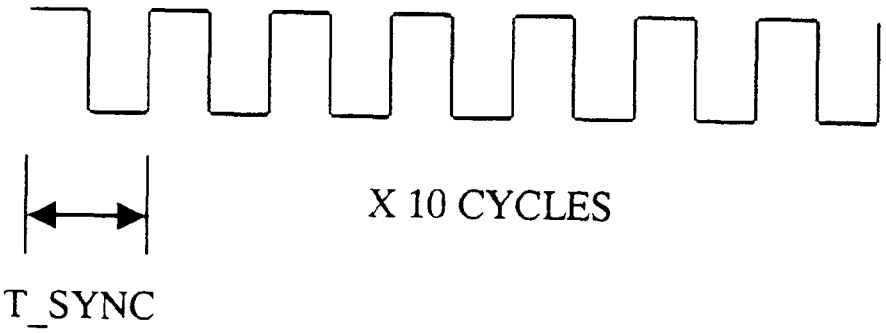
FIGS. 10A–10C are simplified pictorial illustrations of a signal transmitted between the computer radio interface 110 and the toy control device 130 of FIG. 1A.
Figure 10B:
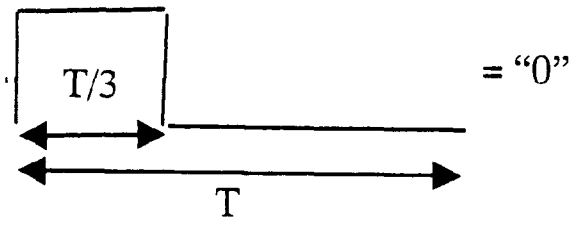
Figure 10C:
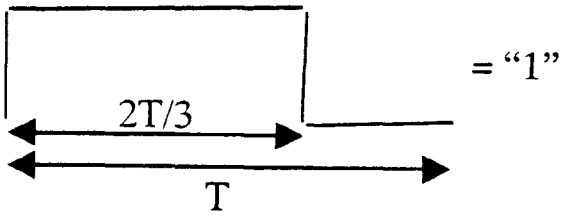

Reference is now additionally made to FIGS. 10A–10C, which are simplified pictorial illustrations of a signal transmitted between the computer radio interface 110 and the toy control device 130 of FIG. 1A. FIG. 10A comprises a synchronization preamble. The duration T_SYNC of the synchronization preamble is preferably 0.500 millisecond, being preferably substantially equally divided into on and off components.

FIG. 10B comprises a signal representing a bit with value 0, while FIG. 10C comprises a signal representing a bit with value 1.

It is appreciated that FIGS. 10B and 10C refer to the case where the apparatus of FIG. SD is used. In the case of the apparatus of FIG. 5E, functionality corresponding to that depicted in FIGS. 10B and 10C is provided within the apparatus of FIG. 5E.

Preferably, each bit is assigned a predetermined duration T, which is the same for every bit. A frequency modulated carrier is transmitted, using the method of frequency modulation keying as is well known in the art. An "off" signal (typically less than 0.7 Volts) presented at termination 5 of U2 in FIG. 5D causes a transmission at a frequency below the median channel frequency. An "on" signal (typically over 2.3 Volts) presented at pin 5 of U2 in FIG. 5D causes a transmission at a frequency above the median frequency. These signals are received by the corresponding receiver U1. Output signal from pin 6 of U1 is fed to the comparator 280 of FIGS. 4 and 6 that is operative to determine whether the received signal is "off" or "on", respectively.

It is also possible to use the comparator that is contained within U1 by connecting pin 7 of U1 of FIG. 5D, through pin 6 of the connector J1 of FIG. 5D, pin 6 of connector J1 of FIG. 5A, through the jumper to pin 12 of U1 of FIG. 5A.

Preferably, receipt of an on signal or spike of duration less than 0.01*T is ignored. Receipt of an on signal as shown in FIG. 10B, of duration between 0.01*T and 0.40*T is preferably taken to be a bit with value 0. Receipt of an on signal as shown in FIG. 10C, of duration greater than 0.40*T is preferably taken to be a bit with value 1. Typically, T has a value of 1.0 millisecond.

Furthermore, after receipt of an on signal, the duration of the subsequent off signal is measured. The sum of the durations of the on signal and the off signal must be between 0.90 T and 1.10 T for the bit to be considered valid. Otherwise, the bit is considered invalid and is ignored.

Figure 11:
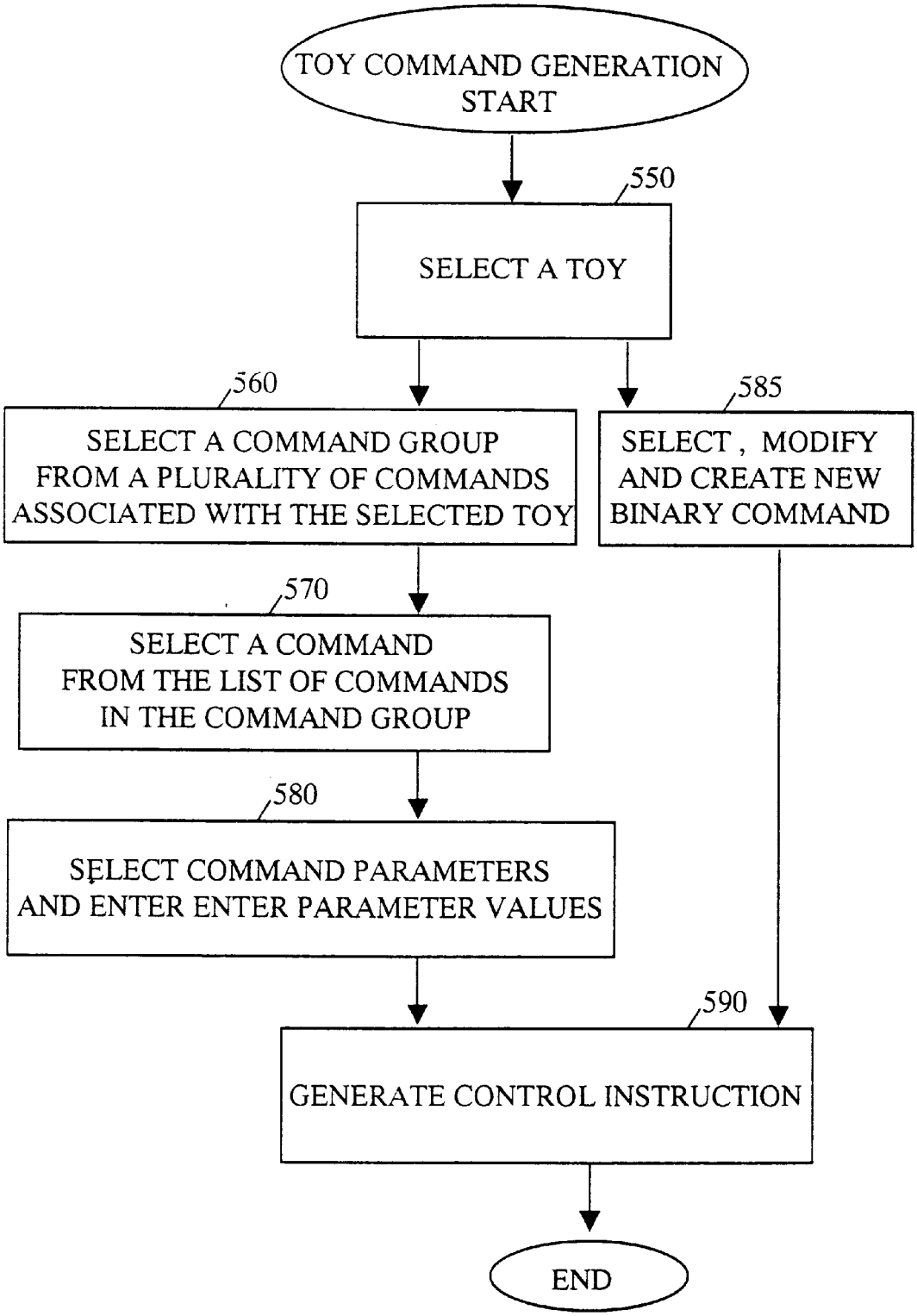

Reference is now made to FIG. 11, which is a simplified flowchart illustration of a method for generating control instructions for the apparatus of FIG. 1A. The method of FIG. 11 preferably includes the following steps:

A toy is selected (step 550). At least one command is selected, preferably from a plurality of commands associated with the selected toy (steps 560–580). Alternatively, a command may be entered by selecting, modifying, and creating a new binary command 'step 585).

Typically, selecting a command in steps 560–580 may include choosing a command and specifying one or more control parameters associated with the command. A control parameter may include, for example, a condition depending on a result of a previous command, the previous command being associated either with the selected toy or with another toy. A control parameter may also include an execution condition governing execution of a command such as, for example: a condition stating that a specified output is to occur based on a status of the toy, that is, if and only if a specified input is received; a condition stating that the command is to be performed at a specified time; a condition stating that performance of the command is to cease at a specified time; a condition comprising a command modifier modifying execution of the command, such as, for example, to terminate execution of the command in a case where execution of the command continues over a period of time; a condition dependent on the occurrence of a future event; or another condition.

The command may comprise a command to cancel a previous command.

The output of the method of FIG. 11 typically comprises one or more control instructions implementing the specified command, generated in step 590. Typically, the one or more control instructions are comprised in a command file. Typically, the command file is called from a driver program which typically determines which command is to be executed at a given point in time and then calls the command file associated with the given command.

Figure 12A:
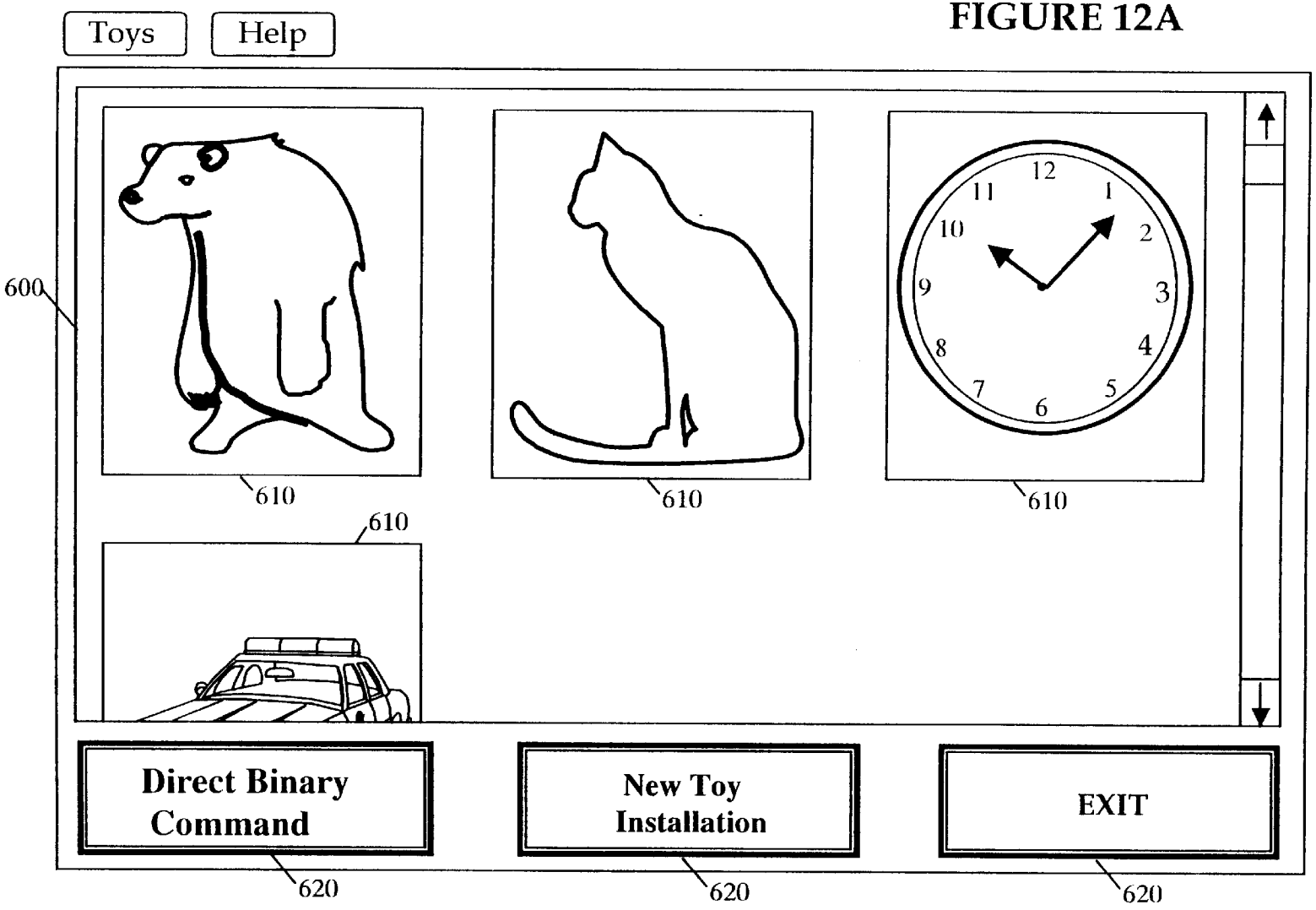
FIGS. 12A–12C are pictorial illustrations of a preferred implementation of a graphical user interface implementation of the method of FIG. 11.
Figure 12B:
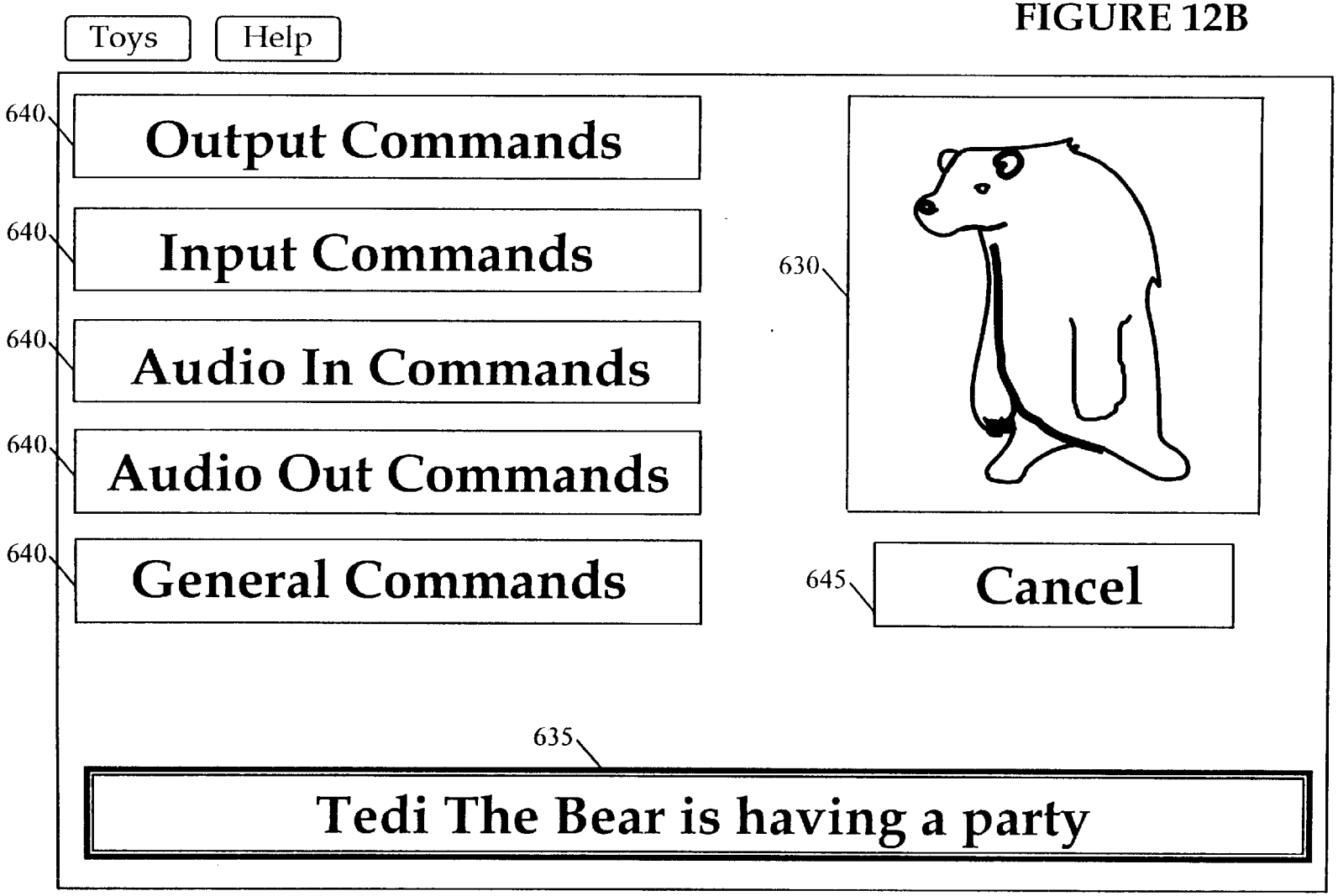
Figure 12C:
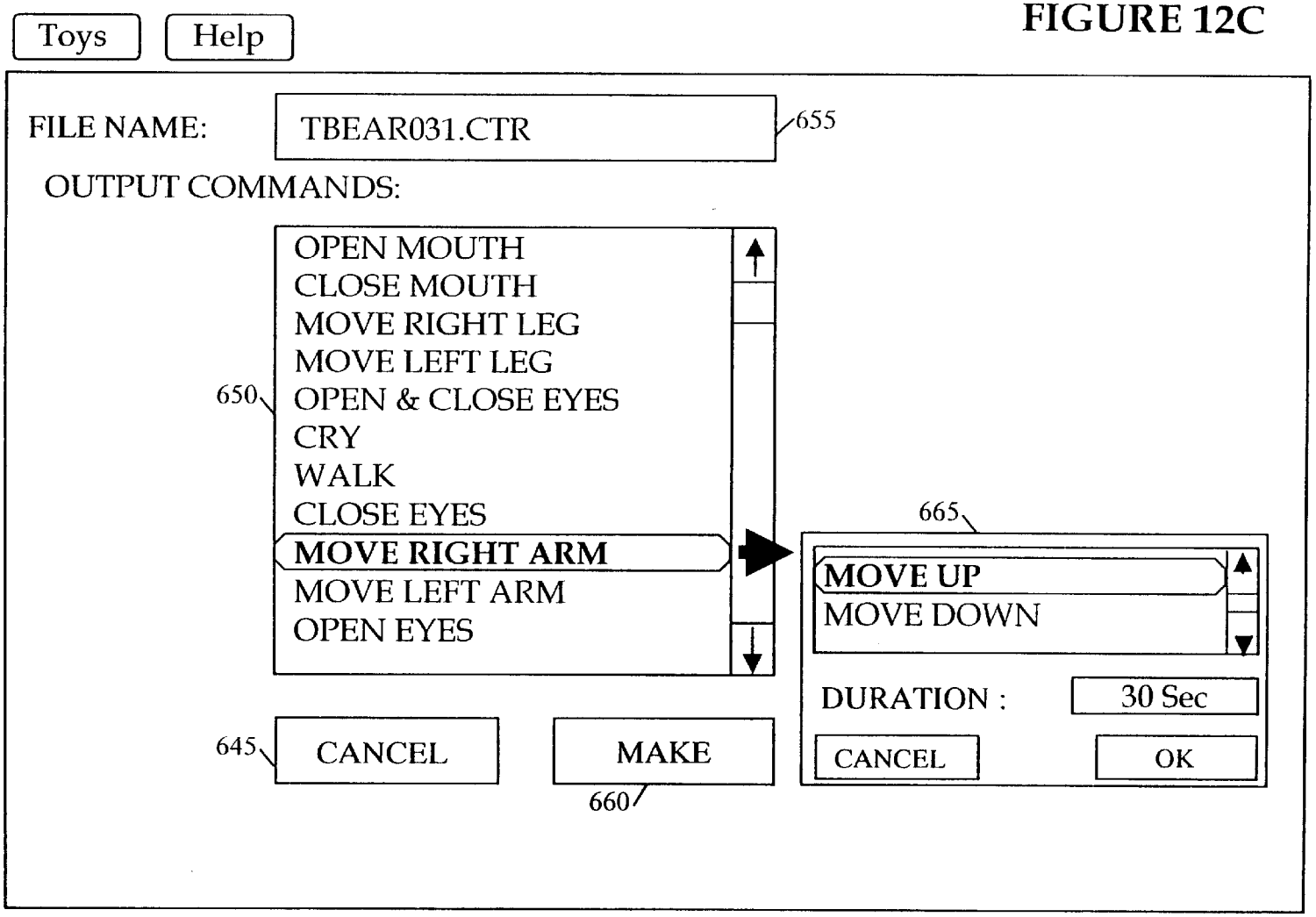

Preferably, a user of the method of FIG. 11 performs steps 550 and 560 using a computer having a graphical user interface. Reference is now made to FIGS. 12A–12C, which are pictorial illustrations of a preferred embodiment of a graphical user interface implementation of the method of FIG. 11.

FIG. 12A comprises a toy selection area 600, comprising a plurality of toy selection icons 610, each depicting a toy. The user of the graphical user interface of FIGS. 12A–12C typically selects one of the toy selection icons 610, indicating that a command is to be specified for the selected toy.

FIG. 12A also typically comprises action buttons 620, typically comprising one or more of the following:

- a button allowing the user, typically an expert user, to enter a direct binary command implementing an advanced or particularly complex command not otherwise available through the graphical user interface of FIGS. 12A–12C;
- a button allowing the user to install a new toy, thus adding a new toy selection icon 610; and
- a button allowing the user to exit the graphical user interface of FIGS. 12A–12C.

FIG. 12B depicts a command generator screen typically displayed after the user has selected one of the toy selection icons 610 of FIG. 12A. FIG. 12B comprises an animation area 630, preferably comprising a depiction of the selected toy selection icon 610, and a text area 635 comprising text describing the selected toy.

FIG. 12B also comprises a plurality of command category buttons 640, each of which allow the user to select a category of commands such as, for example: output commands; input commands; audio in commands; audio out commands; and general commands.

FIG. 12B also comprises a cancel button 645 to cancel command selection and return to the screen of FIG. 12A.

FIG. 12C comprises a command selection area 650, allowing the user to specify a specific command. A wide variety of commands may be specified, and the commands shown in FIG. 12C are shown by way of example only.

FIG. 12C also comprises a file name area 655, in which the user may specify the name of the file which is to receive the generated control instructions. FIG. 12C also comprises a cancel button 645, similar to the cancel button 645 of FIG. 12B. FIG. 12C also comprises a make button 660. When the user actuates the make button 660, the control instruction generator of FIG. 11 generates control instructions implementing the chosen command for the chosen toy, and writes the control instructions to the specified file.

FIG. 12C also comprises a parameter selection area 665, in which the user may specify a parameter associated with the chosen command.

Reference is now made to Appendix A, which is a computer listing of a preferred software implementation of the method of FIGS. 8A–8T.

Appendix A is an INTEL hex format file. The data bytes start from character number 9 in each line. Each byte is represented by 2 characters. The last byte (2 characters) in each line, should be ignored.

For example, for a sample line:

| | |
|---|---|
| The original line reads: | 0700000002010002032032 9F |
| The data bytes: | 02010002032032 (02,01,00,02,03,20,32) |
| Starting address of the data bytes: | 0000 (00,00) |

Appendix A may be programmed into the memory of microcontroller 250 of FIG. 6.

Appendix B is a computer listing of a preferred software implementation of the method of FIGS. 9A–9N, together with the method of FIGS. 8D–8M.

Appendix B is an INTEL hex format file. The data bytes start from character number 9 in each line. Each byte is represented by 2 characters. The last byte (2 characters) in each line, should be ignored.

For example, for a sample line:

| | |
|---|---|
| The original line reads: | 0700000000201000205A73216 |
| The data bytes: | 0201000205A732 (02,01,00,02,05,A7,32) |
| Starting address of the data bytes: | 0000 (00,00) |

Appendix B may be programmed into the memory of microcontroller 250 of FIG. 4.

Appendix C is a computer listing of a preferred software implementation of an example of a computer game for use in the computer 100 of FIG. 1.

Appendix D is a computer listing of a preferred software implementation of the method of FIGS. 11 and FIGS. 12A–12C.

For Appendices C and D, these programs were developed using VISUAL BASIC. To run the programs you need to install the VISUAL BASIC environment first. The application needs a Visual Basic custom control for performing MIDI I/O similar to the one called MIDIVBX. VBX. VISUAL BASIC is manufactured by Microsoft Corporation, One Microsoft Way, Redmond, Wash. 98052-6399, USA. MIDIVBX.VBX is available from Wayne Radinsky, electronic mail address a-wayner@microsoft.com.

The steps for programming the microcontrollers of the present invention include the use of a universal programmer, such as the Universal Programmer, type EXPRO 60/80, manufactured by Sunshine Electronics Co. Ltd., Taipei, Japan.

The method for programming the microcontrollers with the data of Appendices A and B, includes the following steps:

1. Run the program EXPRO.EXE, which is provided with the EXPRO 60/80".
2. Choose from the main menu the EDIT/VIEW option.
3. Choose the EDIT BUFFER option.
4. Enter the string E 0000.
5. Enter the relevant data (given in Appendices A or B), byte after byte, starting from the address 0000. In each line there is a new starting address for each data byte which appears in this line.
6. Press ESC.
7. Enter the letter Q.
8. Choose from the main menu the DEVICE option.
9. Choose the MPU/MCU option.

10. Choose the INTEL option.
11. Choose the 87C51.
12. Choose from the main menu the RUNFUNC option.
13. Choose the PROGRAM option. 14. Place the 87C51 chip in the programmer's socket.
15. Enter Y and wait until the OK message.
16. The chip is now ready to be installed in the board.

The method for creating the relevant files for the computer 100, with the data of Appendices C and D, includes using a HEX EDITOR which is able to edit DOS formatted files. A typical HEX and ASCII editor is manufactured by Martin Doppelbauer, Am Spoerkel 17, 44227 Dortmund, Germany, UET401 at electronic mail address hrz.unidozr.uni-dortmund.de.

The steps necessary for creating the files by means of a HEX editor, such as by the Martin Doppelbauer editor include the following:

1. Copy any DOS file to a new file with the desired name and with the extension .EXE. (For example, write COPY AUTOEXEC.BAT TOY1.EXE).
2. Run the program ME.EXE.
3. From the main menu press the letter L (load file).
4. Write the main menu of the new file (for example TOY1.EXE).
5. From the main menu, press the letter (insert). 6. Enter the relevant data (written in Appendices C or D), byte after byte, starting from the address 0000.
7. Press ESC.
8. From the main menu, enter the letter W(write file).
9. Press the RETURN key and exit from the editor by pressing the letter Q.

The above-described embodiment of FIG. 1C includes a description of a preferred set of predefined messages including a category termed "General commands". Other General Commands are defined by the following description:

MULTIPORT COMMANDS
AVAILABILITY_INTERROGATION_COMMAND

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | A | 04 | 05 | 00 | 00 | 00 | 00 | x | x | |

A computer transmits this command to verify that the radio channel is vacant. If another computer is already using this channel it will respond with the Availability Response Command. If no response is received within 250 msec the channel is deemed vacant.
P: Computer address 00–03 H
A: unit address - 00–FF H

AVAILABILITY_RESPONSE_COMMAND

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | A | 04 | 06 | 00 | 00 | 00 | 00 | x | x | |

A computer transmits this command in response to an Availability Interrogation Command to announce that the radio channel is in use.
P: Computer address 00–03 H
A: unit address - 00–FF H

TOY_AVAILABILITY_COMMAND

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | A | 04 | 07 | 00 | 00 | 00 | 00 | x | x | |

A Toy transmits this command to declare its existence and receive in response a Channel Pair Selection Command designating the computer that will control it and the radio channels to use.
P: Computer address 00–03 H
A: unit address - 00–FF H

CHANNEL_PAIR_SELECTION_COMMAND

| | byte 1 | | byte 2 | byte 3 | byte 4 | byte 5 | byte 6 8 bits | | byte 7 8 bits | | byte 8 8 bits | | |
|---|---|---|---|---|---|---|---|---|---|---|---|---|---|
| byte 0 Head 8 bit | PC add 2 bit | Unit # A-sb 6 bit | Unit # B-sb 8 bit | Unit # C-sb 8 bit | CMD msb 8 bit | CMD lsb 8 bit | Dat1 msb 4 bit | Dat1 lsb 4 bit | Dat2 msb 4 bit | Dat2 lsb 4 bit | Dat3 msb 4 bit | Dat3 lsb 4 bit | byte 9 CRC 8 bits |
| 01 | P | 00 | 00 | A | 04 | 08 | CH1 | CH2 | 00 | 00 | x | x | |

A computer transmits this command in response to a Toy Availability Command to inform the toy the radio channels to be used.

Figure 13:
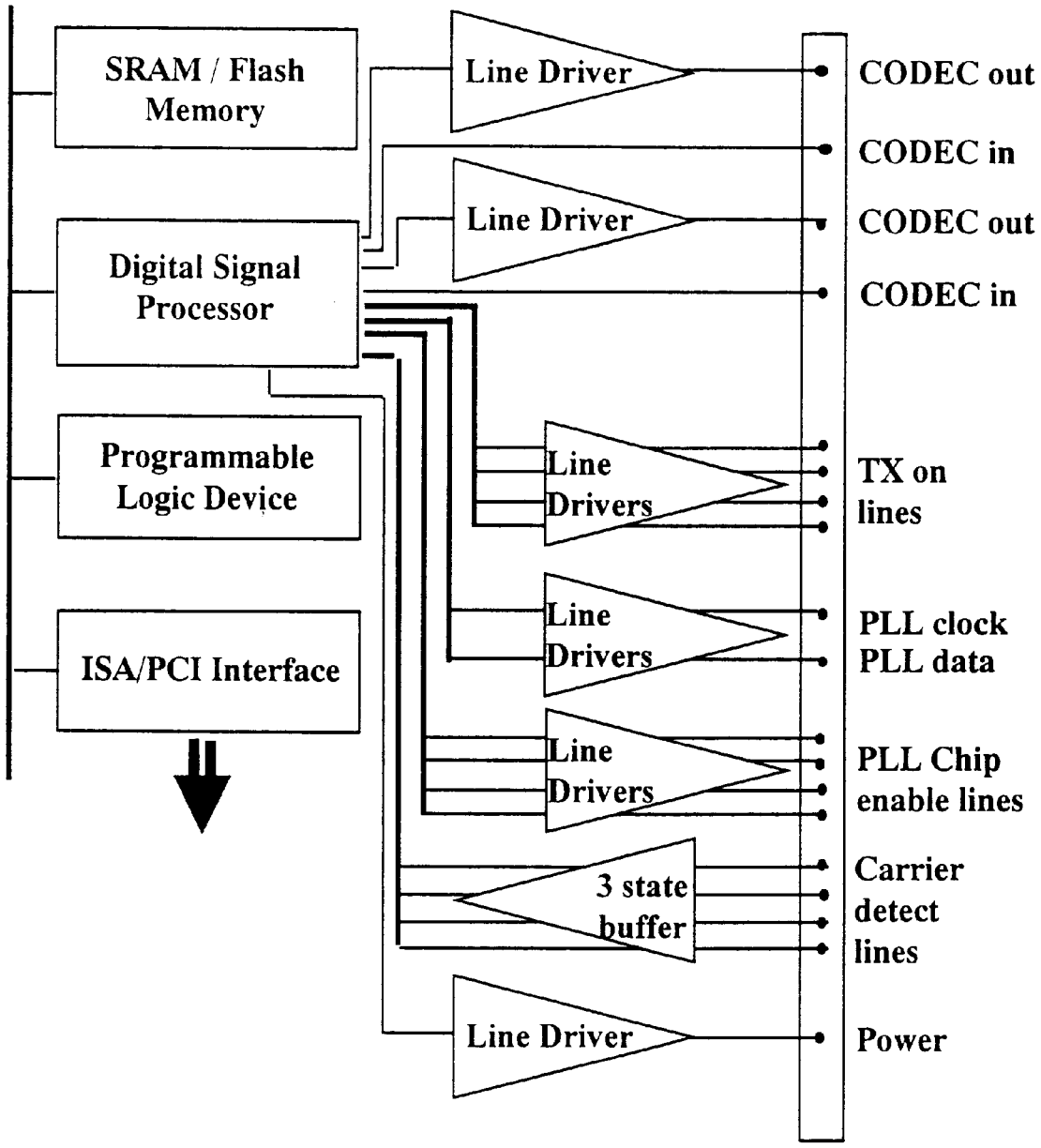
Figure 14:
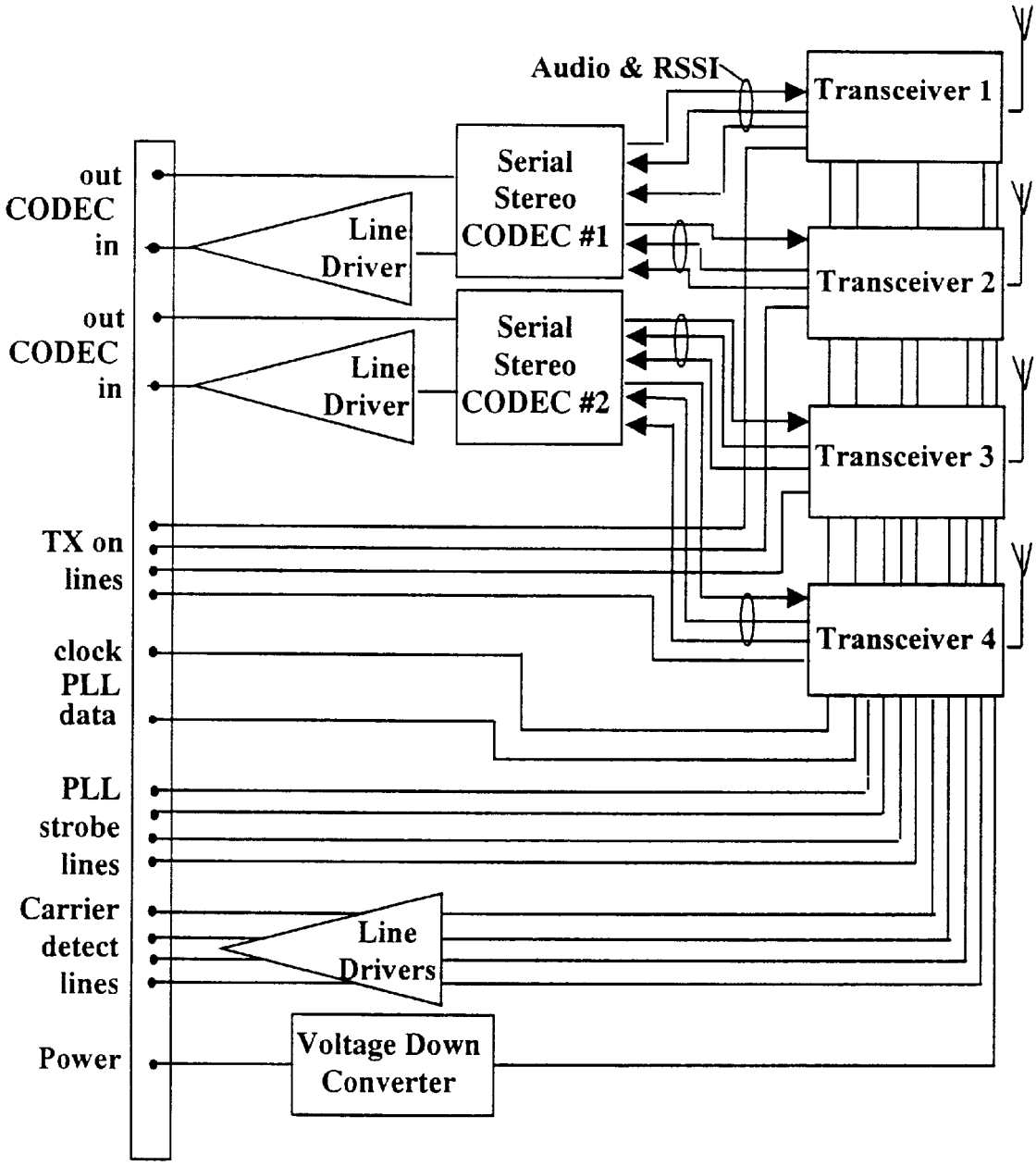
Figure 15A:
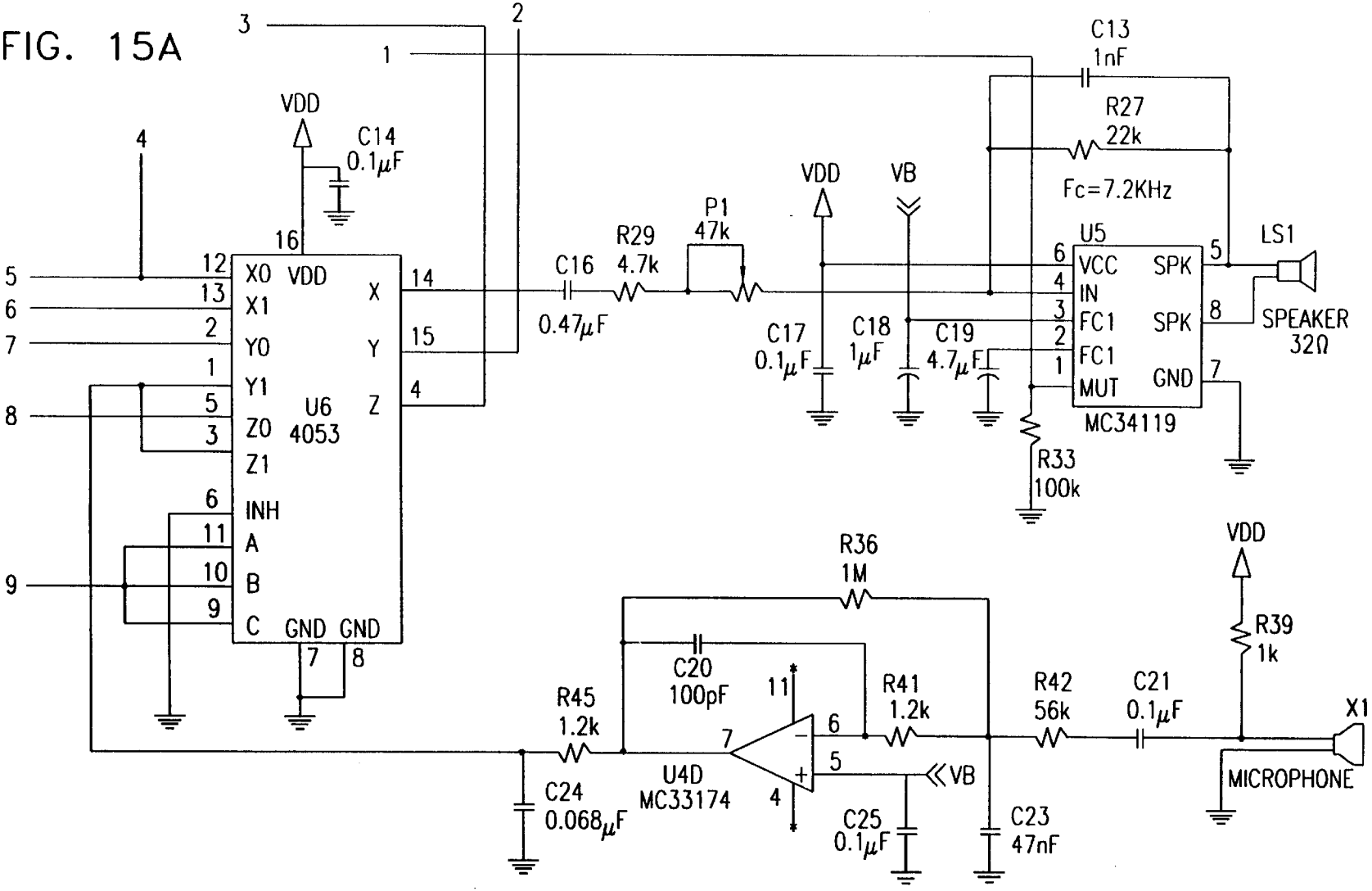
Figure 15B:
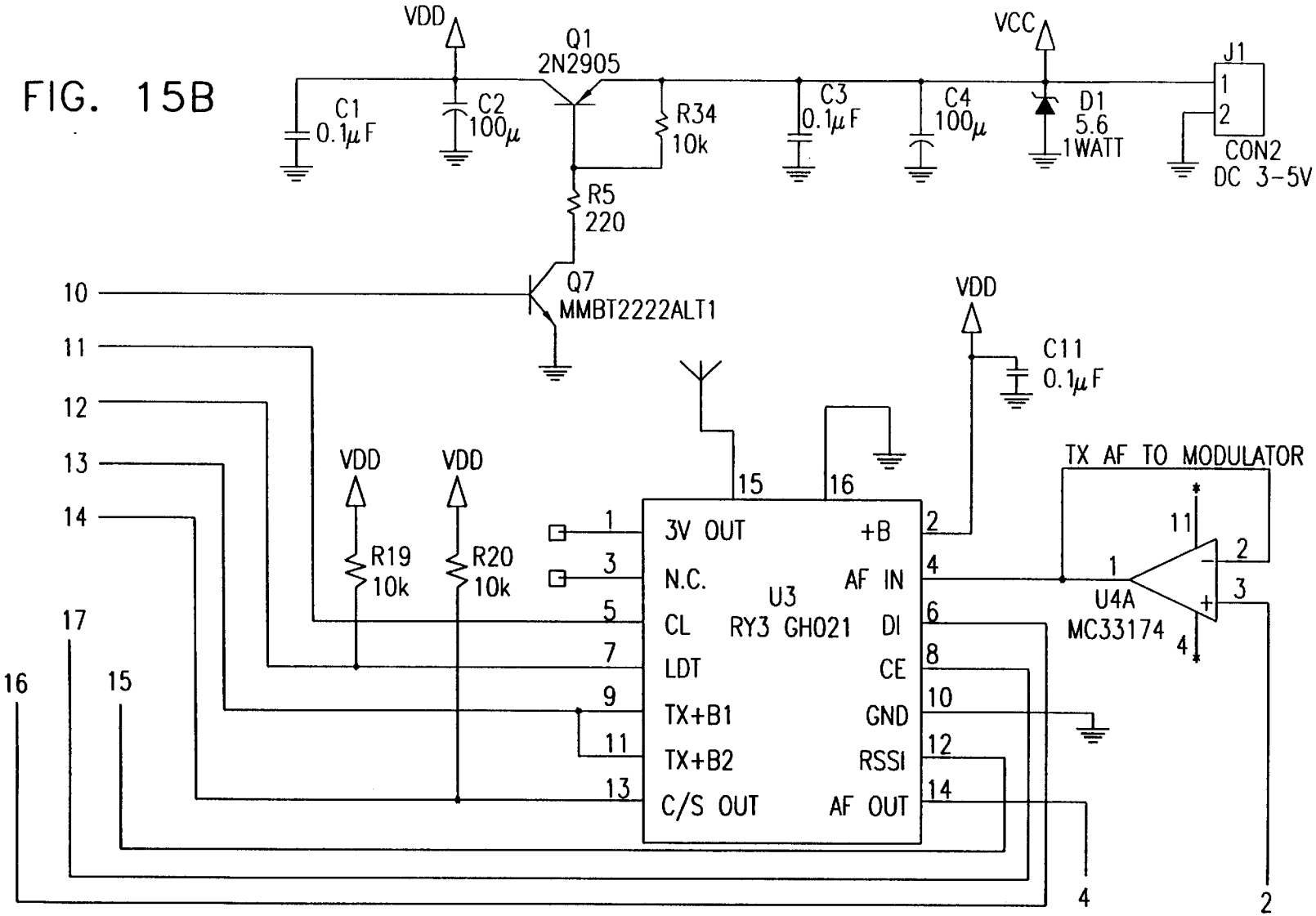
Figure 15C:
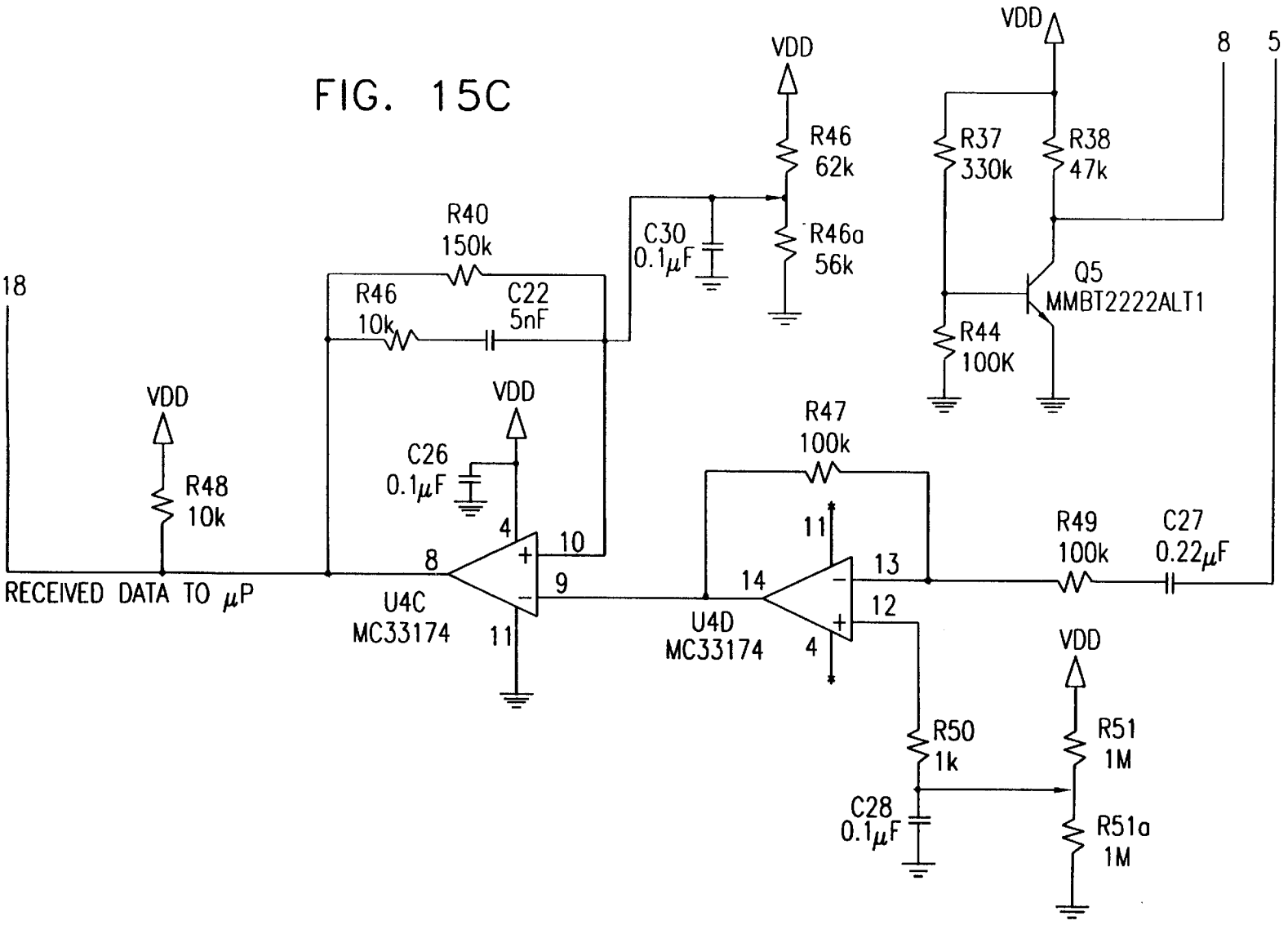
Figure 15E:
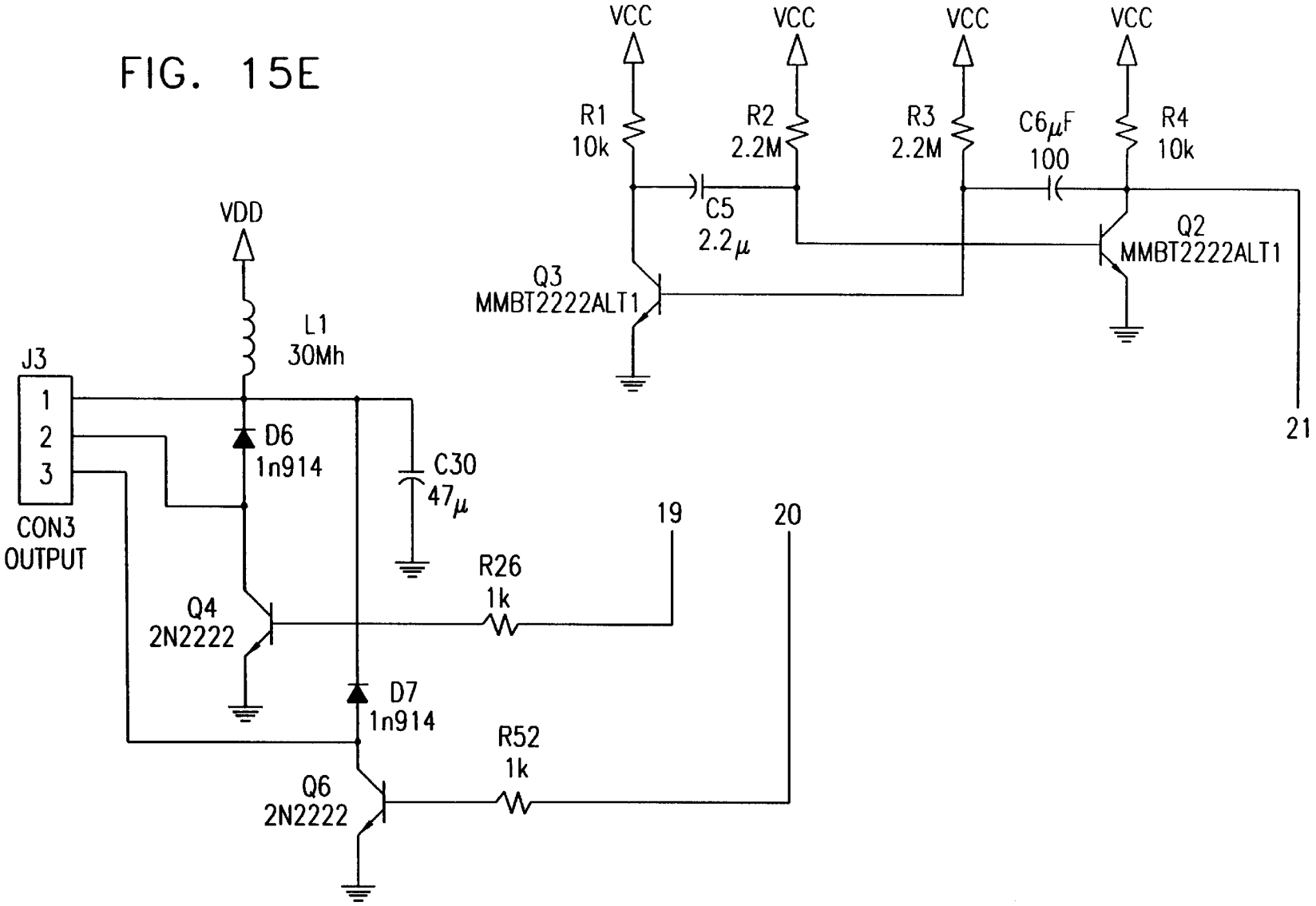

P: Computer address 00–03 H
A: unit address - 00–FF H
CH1: Toy transmit channel 0–F H
CH1: Toy receive channel 0–F H In FIGS. 13 and 14 there are illustrated block diagrams of multiport multi-channel implementation of the computer radio interface 110 of FIG. 1A. FIG. 13 illustrates the processing sub-unit of the computer interface that is implemented as an add-in board installed inside a PC. FIG. 14 is the RF transceiver which is a device external to the computer and connects to the processing subunit by means of a cable. In the present application of the RF unit there are 4 transceivers each capable of utislizing two radio channels simultaneously.

Referring briefly to FIG. 3, it is appreciated that, optionally, both sound and control commands may be transmitted via the MIDI connector 210 rather than transmitting sound commands via the analog connector 220, It is additionally appreciated that the functions of the interfaces 210 and 220 between the computer radio interface 110 and the sound card 190 may, alternatively, be implemented as connections between the computer radio interface 110 to the serial and/or parallel ports of the computer 100, as shown in FIGS. 25A–25F.

If it is desired to provide full duplex communication, each transceiver 260 which forms part of the computer radio interface 110 of FIG. 1A preferably is operative to transmit on a first channel pair and to receive on a different, second channel pair. The transceiver 260 (FIG. 4) which forms part of the toy control device 130 of FIG. 1A preferably is operative to transmit on the second channel and to receive on the first channel.

Any suitable technology may be employed to define at least two channel pairs such as narrow band technology or spread spectrum technologies such as frequency hopping technology or direct sequence technology, as illustrated in FIGS. 15A–15E, showing a Multi-Channel Computer Radio Interface, and in FIGS. 24A–24E showing a Multi-Channel Toy Control Device.

Appendices E–H, taken together, are computer listings from which a first, DLL-compatible, functions library may be constructed. The DLL-compatible functions library may be subsequently used by a suitable computer system such as an IBM PC to generate a variety of games for any of the computer control systems shown and described herein. Alternatively, games may be generated using the applications generator of FIGS. 11–12C.

Figure 16:
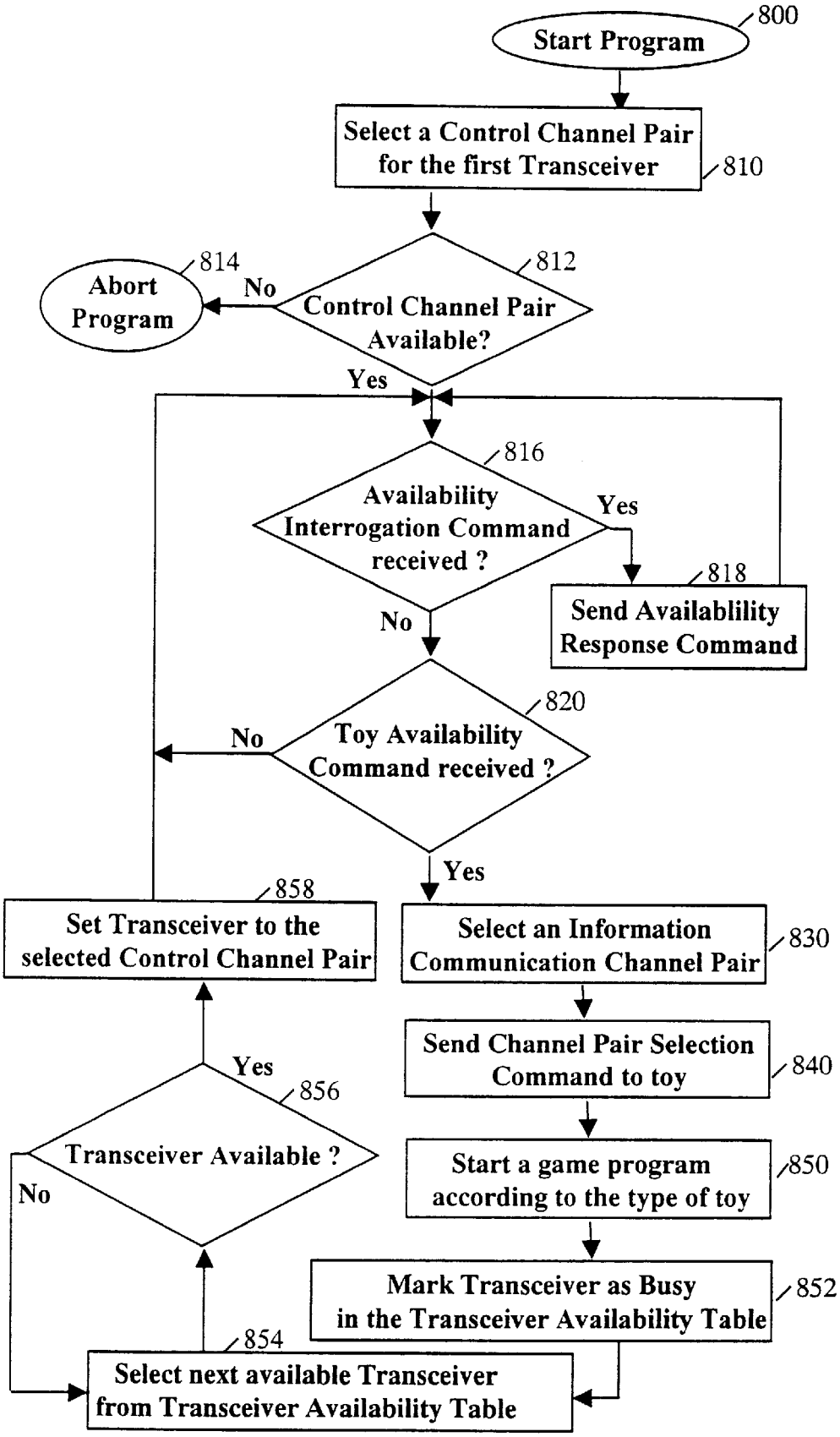

Reference is now made to FIG. 16 which is a simplified flowchart illustration of a preferred method of operation of a computer radio interface (CRI) 110 operative to service an individual computer 100 of FIG. 1A without interfering with other computers or being interfered with by the other computers, each of which is similarly serviced by a similar CRI. Typically, the method of FIG. 16 is implemented in software on the computer 100 of FIG. 1A.

The CRI includes a conventional radio transceiver (260 of FIG. 4) which may, for example, comprise an RY3 GB021 having 40 channels which are divided into 20 pairs of channels. Typically, 16 of the channel pairs are assigned to information communication and the remaining 4 channel pairs are designated as control channels.

In the method of FIG. 16, one of the 4 control channel pairs is selected by the radio interface (step 810) as described in detail below in FIG. 17. The selected control channel pair i is monitored by a first transceiver (step 820) to detect the appearance of a new toy which is signaled by arrival of a toy availability command from the new toy (step 816). When the new toy is detected, an information communication channel pair is selected (step 830) from among the 16 such channel pairs provided over which game program information will be transmitted to the new toy. A preferred method for implementing step 830 is illustrated in self-explanatory flowchart FIG. 18A. The "Locate Computer" command in FIG. 18A (step 1004) is illustrated in the flowchart of FIG. 18B.

The identity of the selected information communication channel pair, also termed herein a "channel pair selection command", is sent over the control channel pair to the new toy (step 840). A game program is then begun (step 850), using the selected information communication channel pair. The control channel pair is then free to receive and act upon a toy availability command received from another toy. Therefore, it is desirable to assign another transceiver to that control channel pair since the current transceiver is now being used to provide communication between the game and the toy.

To assign a further transceiver to the now un-monitored control channel, the transceiver which was formerly monitoring that control channel is marked as busy in a transceiver availability table (step 852). The transceiver availability table is then scanned until an available transceiver, i.e. a transceiver which is not marked as busy, is identified (step 854). This transceiver is then assigned to the control channel i (step 858).

Figure 17:
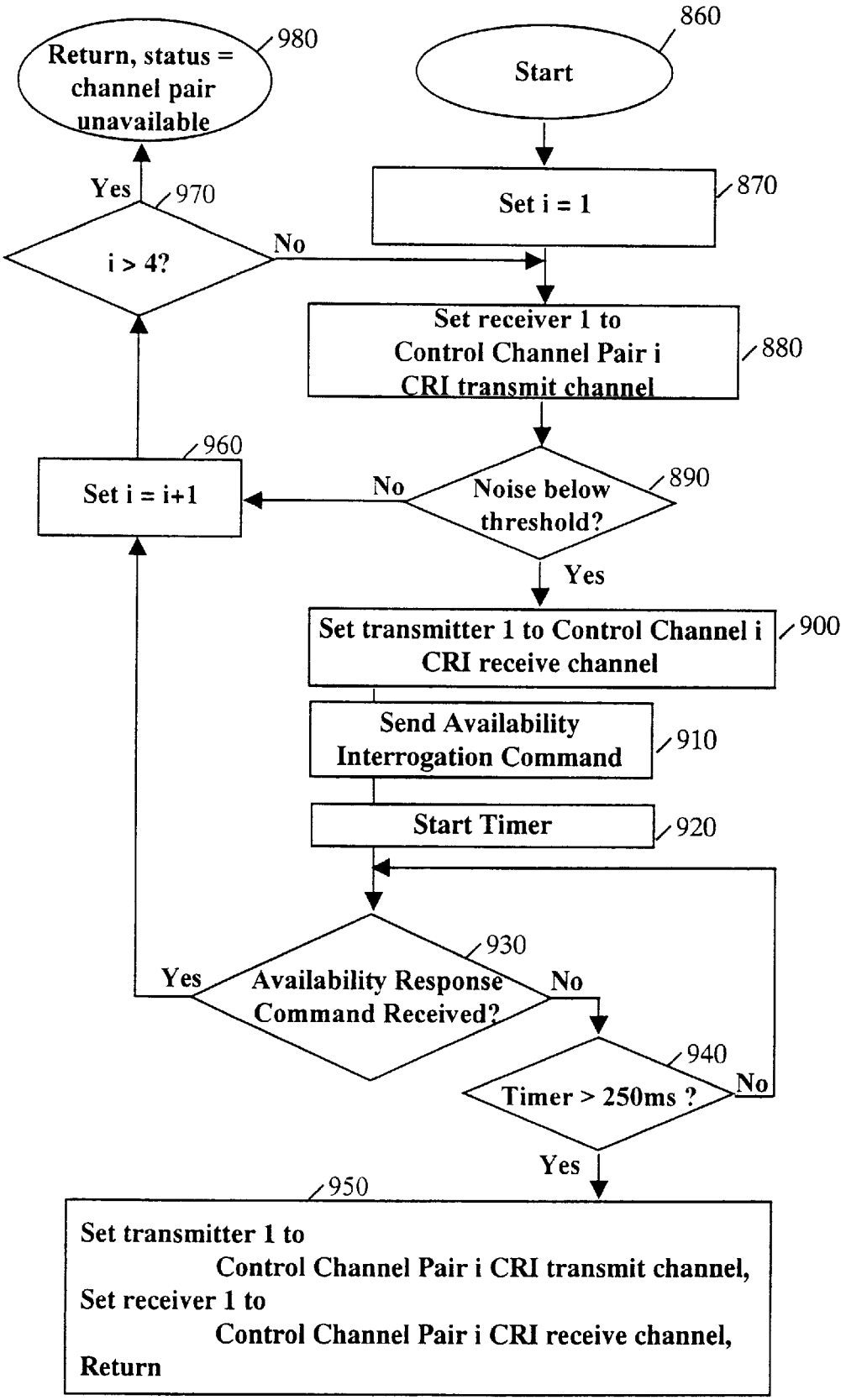
Figure 18A:
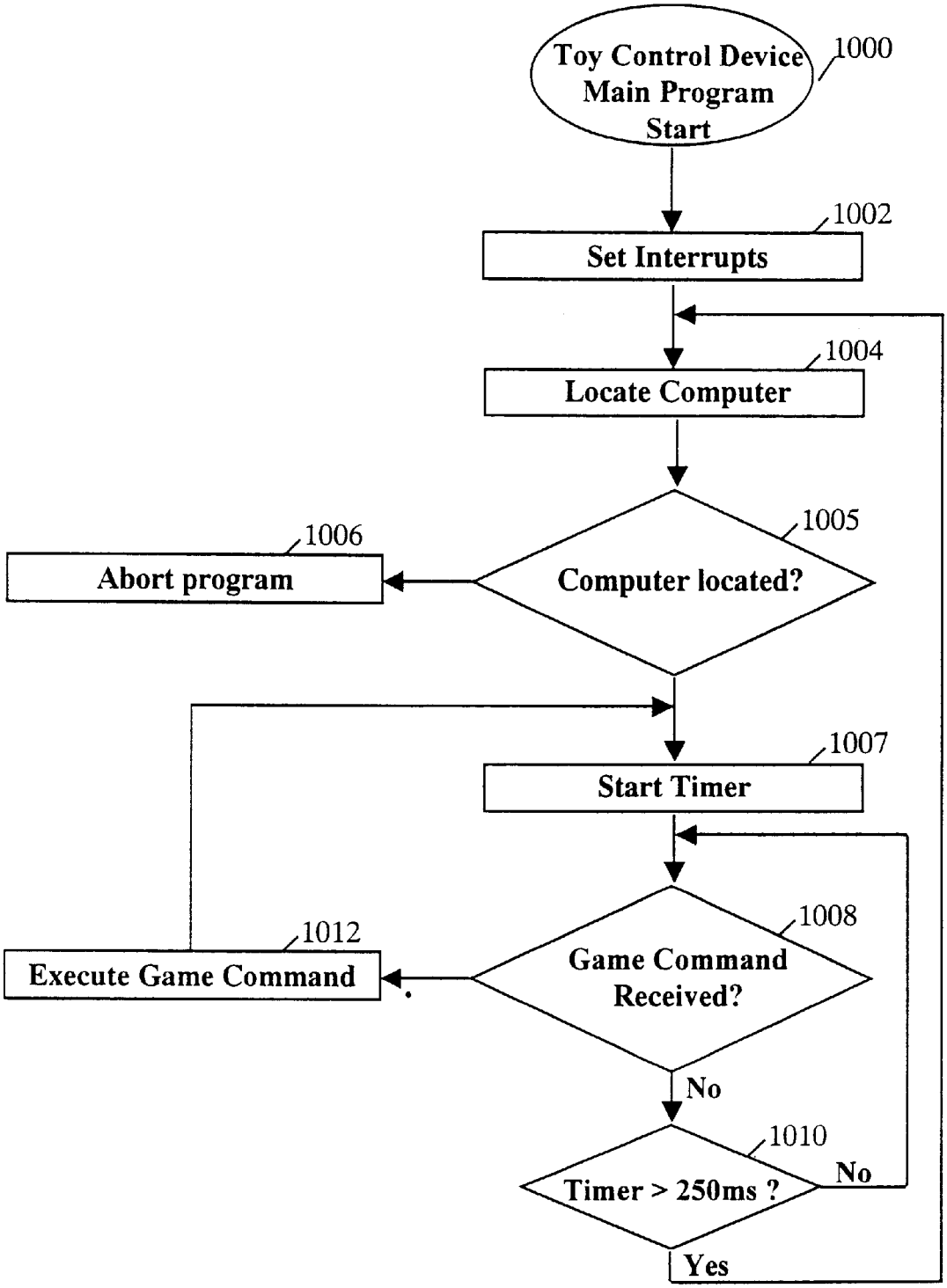
FIG. 18A is a simplified flowchart illustration of a preferred method for implementing the "select information communication channel pair" step of FIG. 16.
Figure 18B:
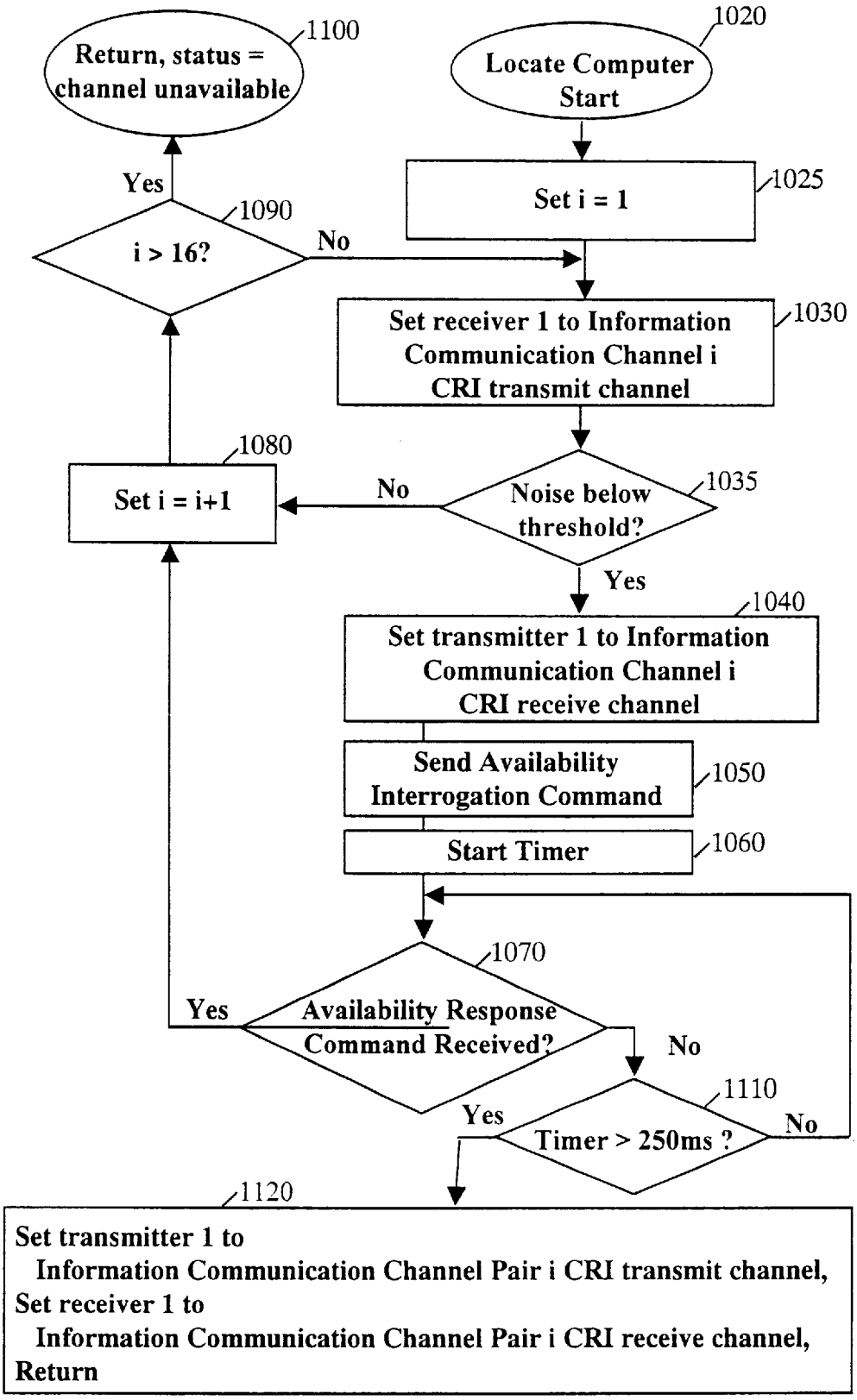
FIG. 18B is a simplified flowchart illustration of a preferred method for performing the "locate computer" step of FIG. 18A.

FIG. 17 is a simplified flowchart illustration of a preferred method for implementing "select control channel pair" step 810 of FIG. 16. In FIG. 17, the four control channels are scanned. For each channel pair in which the noise level falls below a certain threshold (step 895), the computer sends an availability interrogation command (step 910) and waits for a predetermined time period, such as 250 ms, for a response (steps 930 and 940). If no other computer responds, i.e. sends back an "availability response command", then the channel pair is deemed vacant. If the channel pair is found to be occupied the next channel is scanned. If none of the four channel pairs are found to be vacant, a "no control channel available" message is returned.

Figure 19:
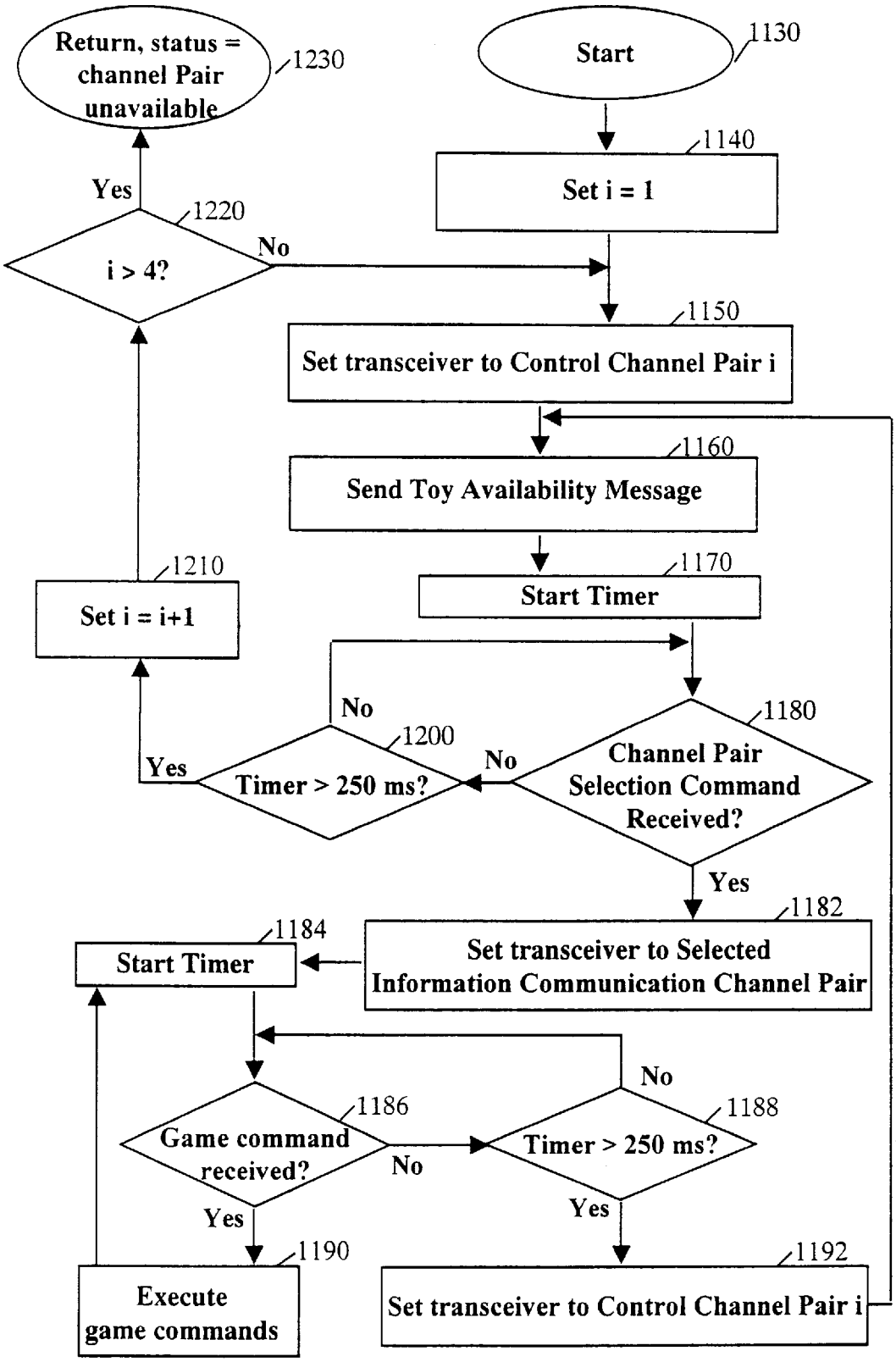

FIG. 19 is a self-explanatory flowchart illustration of a preferred method of operation of the toy control device 130 which is useful in conjunction with the "multi-channel" embodiment of FIGS. 16–18B. i=1, . . . \ an index of the control channels of the system. The toy control device sends a "toy availability command" (step 1160) which is a message advertising the toy's availability, on each control channel i in turn (steps 1140, 1150, 1210), until a control channel is reached which is being monitored by a computer. This becomes apparent when the computer responds (step 1180) by transmitting a "channel pair selection command" which is a message designating the information channel pair over which the toy control device may communicate with the game running on the computer. At this point (step 1190), the toy control device may begin receiving and executing game commands which the computer transmits over the information channel pair designated in the control channel.

Figure 20:
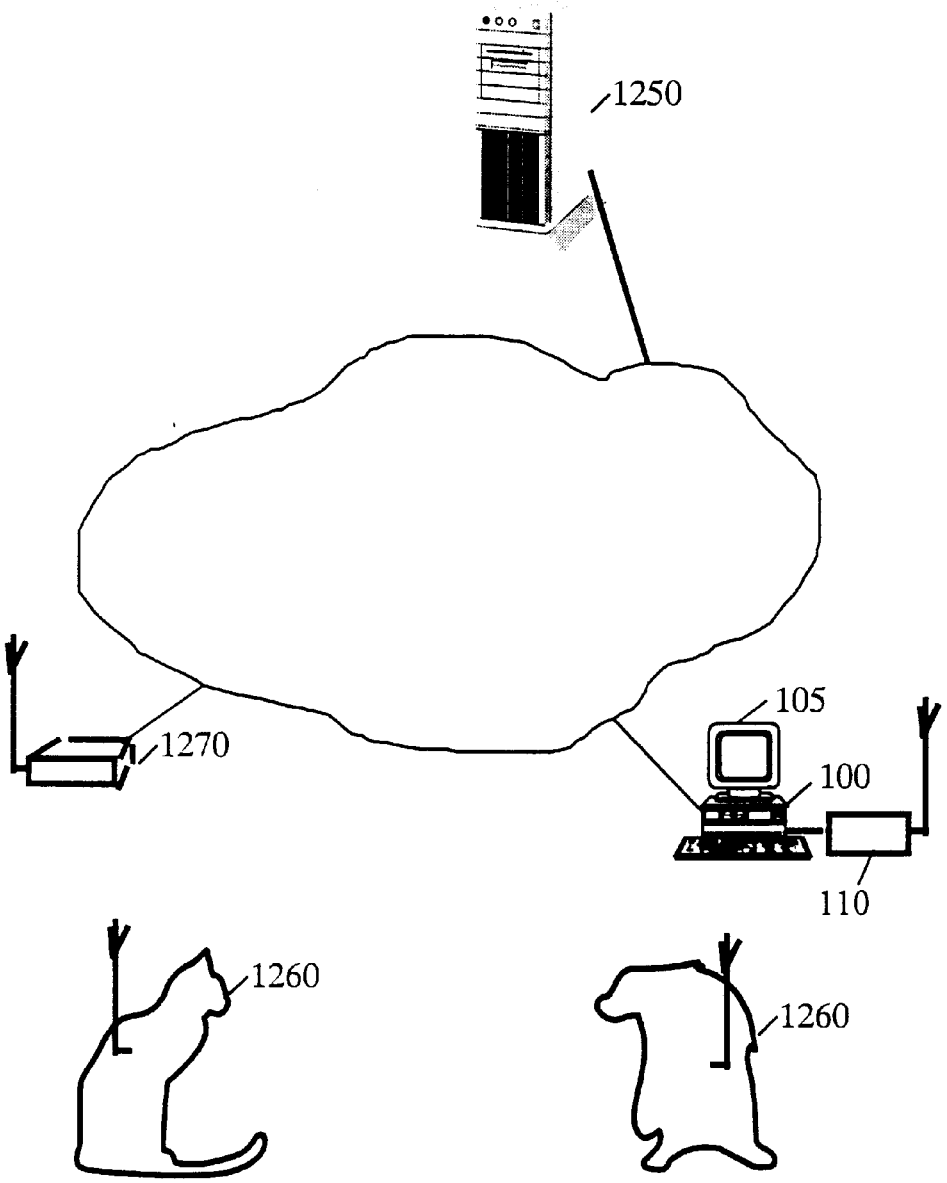

According to a preferred embodiment of the present invention, a computer system is provided, in communication with a remote game server, as shown in FIG. 20. The remote game server 1250 is operative to serve to the computer 100 at least a portion of at least one toy-operating game, which operates one or more toys 1260. Optionally, an entire game may be downloaded from the remote game server 1250. However, alternatively, a new toy action script or new text files may be downloaded from the remote game server 1250 whereas the remaining components of a particular game may already be present in the memory of computer 100.

Downloading from the remote game server 1250 to the computer 100 may take place either off-line, before the game begins, or on-line, in the course of the game. Alternatively, a first portion of the game may be received off-line whereas an additional portion of the game is received on-line.

The communication between the remote game server 1250 and the computer 100 may be based on any suitable technology such as but not limited to ISDN; X.25; Frame-Relay; and Internet.

An advantage of the embodiment of FIG. 20 is that a very simple computerized device may be provided locally, i.e. adjacent to the toy, because all "intelligence" may be provided from a remote source. In particular, the computerized device may be less sophisticated than a personal computer, may lack a display monitor of its own, and may, for example, comprise a network computer 1270.

Figure 21:
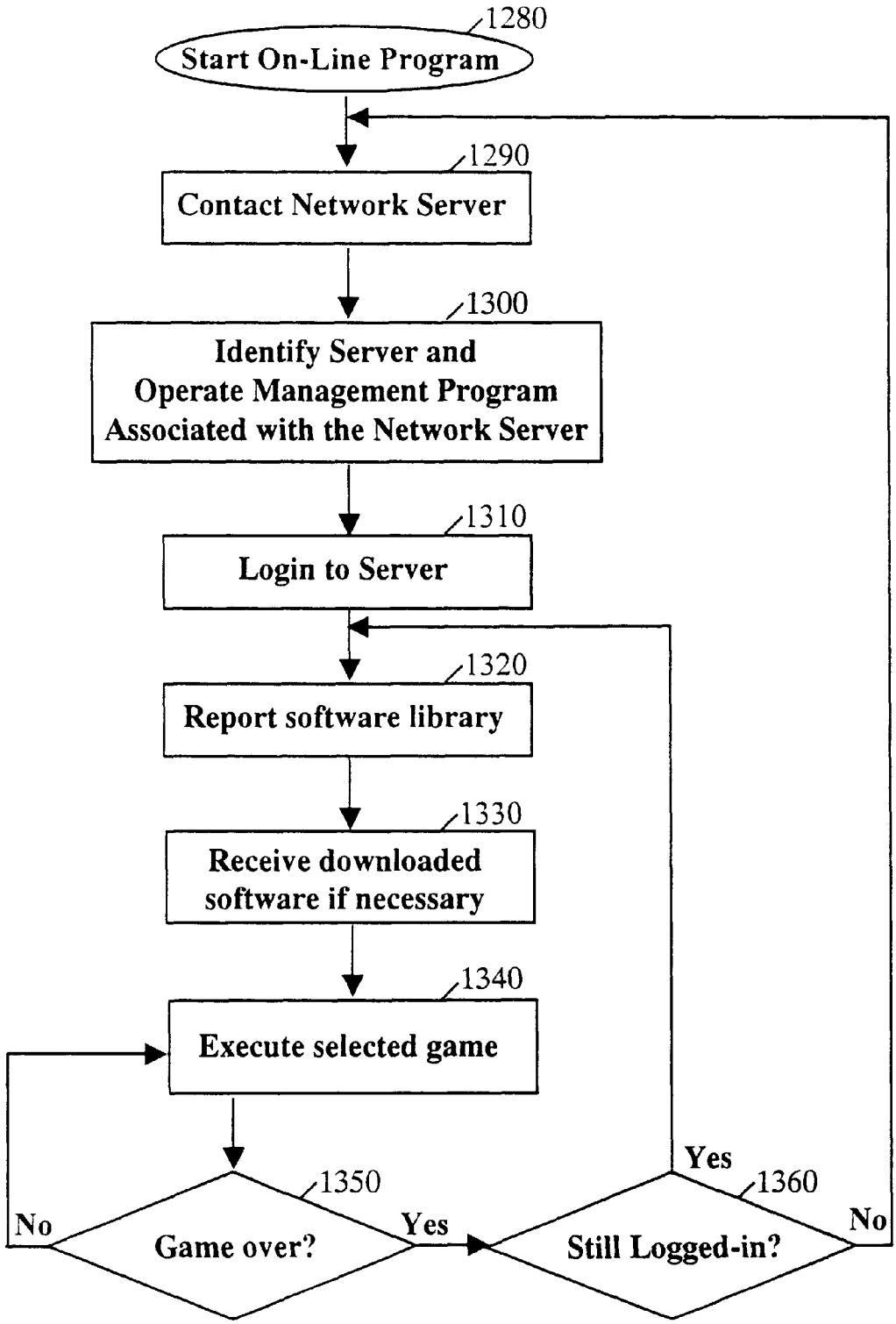

FIG. 21 is a simplified flowchart illustration of the operation of the computer 100 or of the network computer 1260 of FIG. 20, when operating in conjunction with the remote server 1250.

Figure 22:
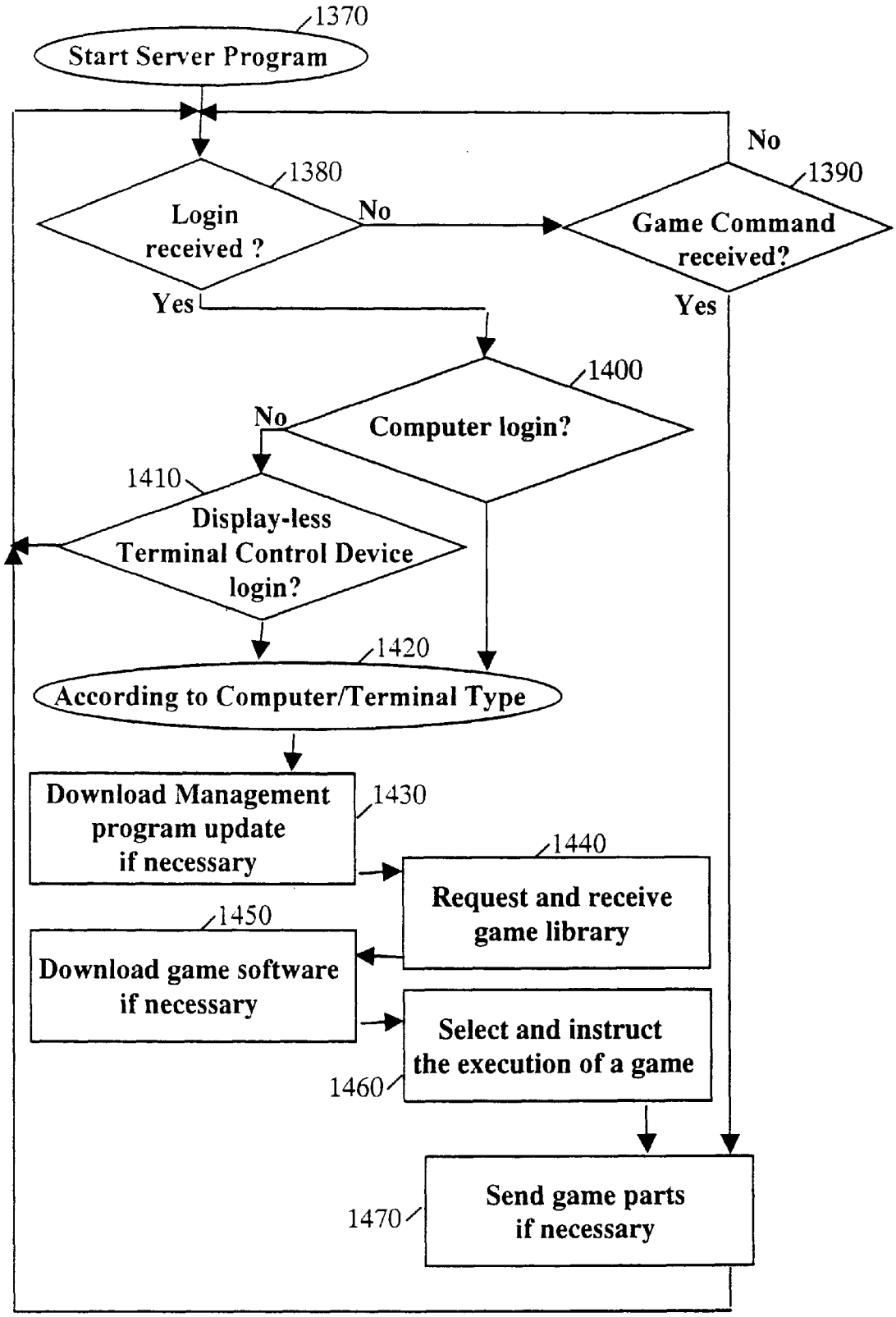

FIG. 22 is a simplified flowchart illustration of the operation of the remote game server 1250 of FIG. 20.

Figure 23:
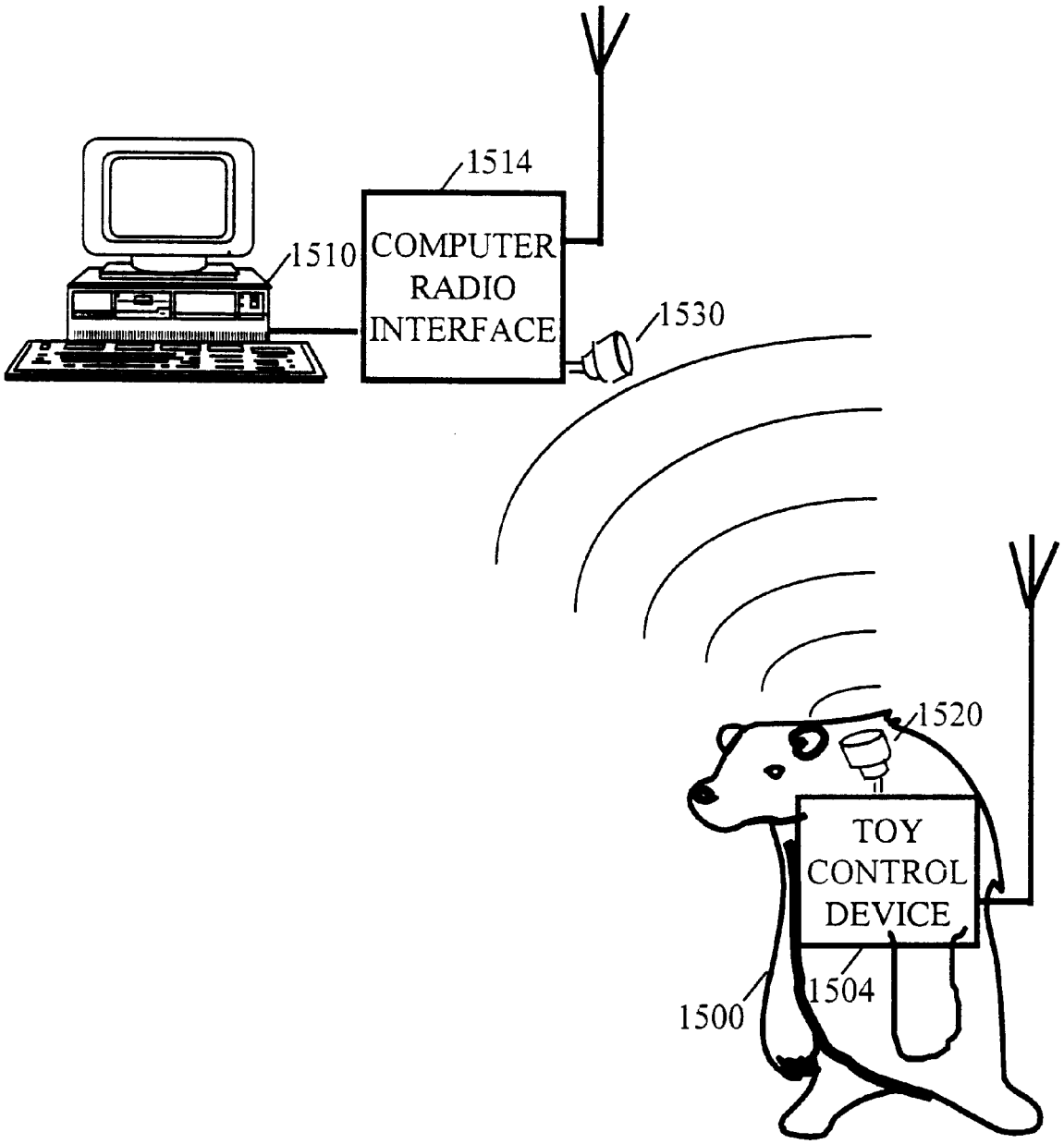
Figure 24A:
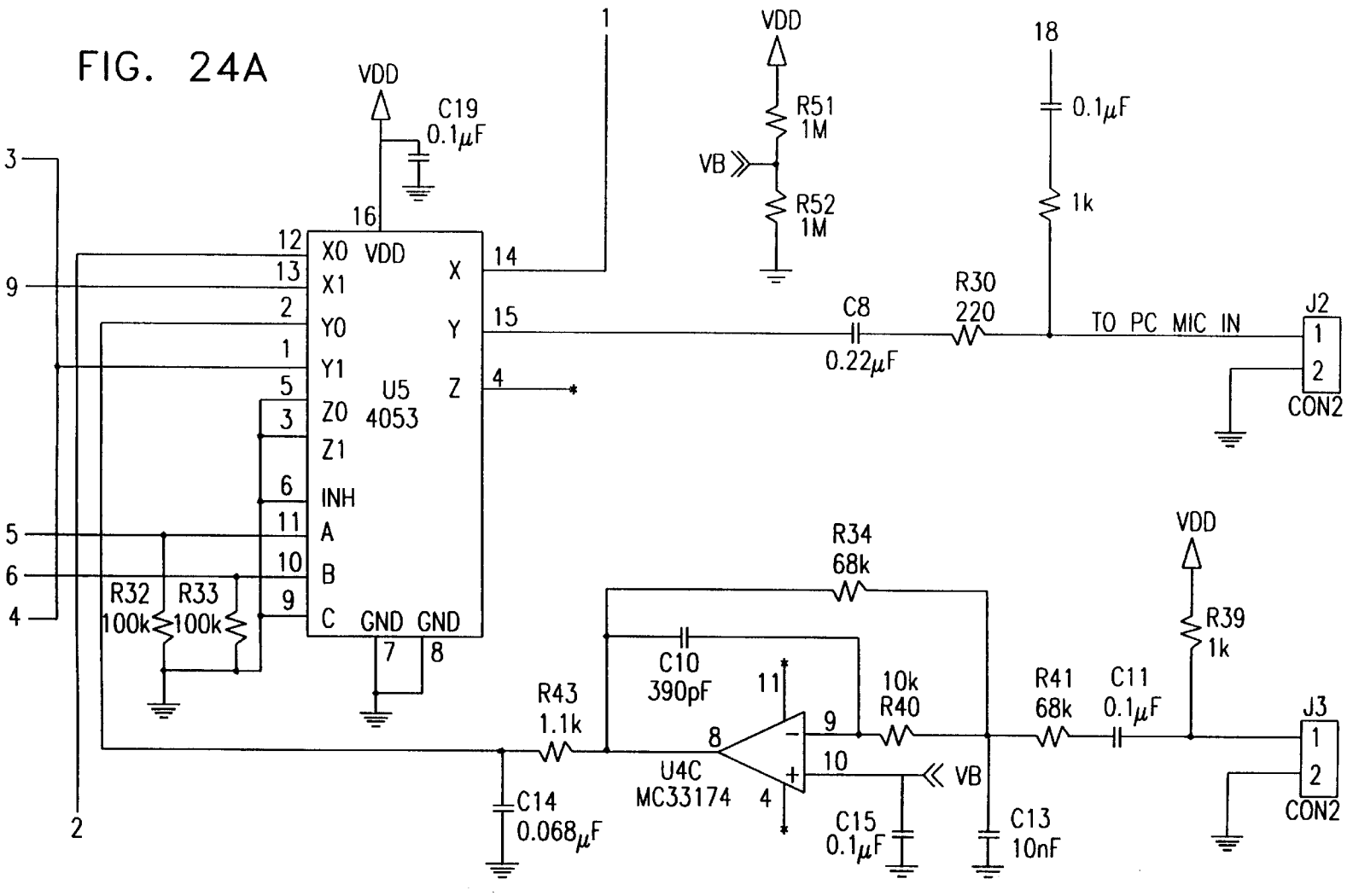
FIGS. 24A–24E, taken together, form a detailed electronic schematic diagram of a multi-channel implementation of the computer radio interface 10 of FIG. 3 which is similar to the detailed electronic schematic diagrams of FIGS. 5A–5D except for being multi-channel, therefore capable of supporting full duplex applications, rather than single-channel.
Figure 24B:
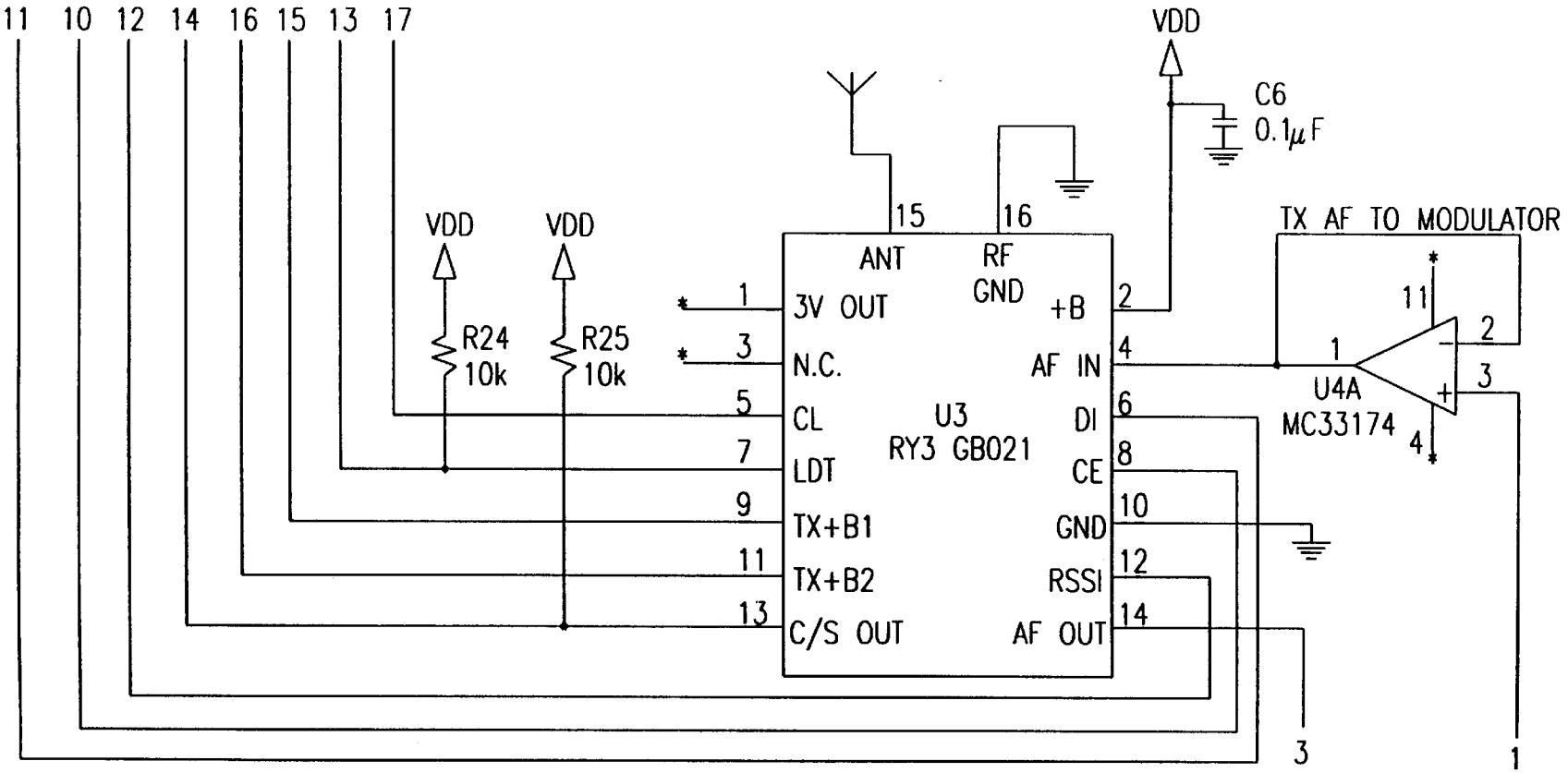
Figure 24C:
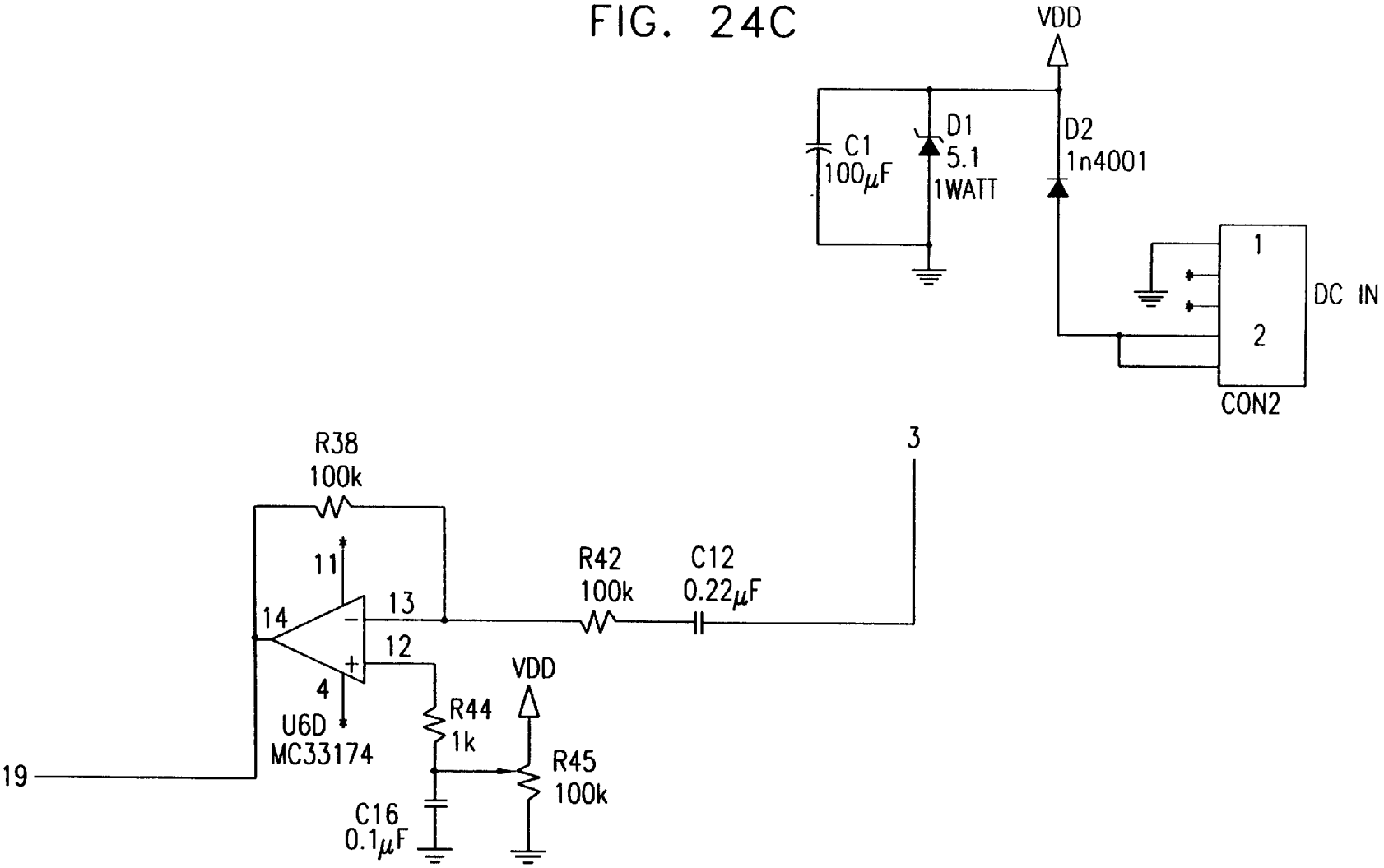
Figure 24D:
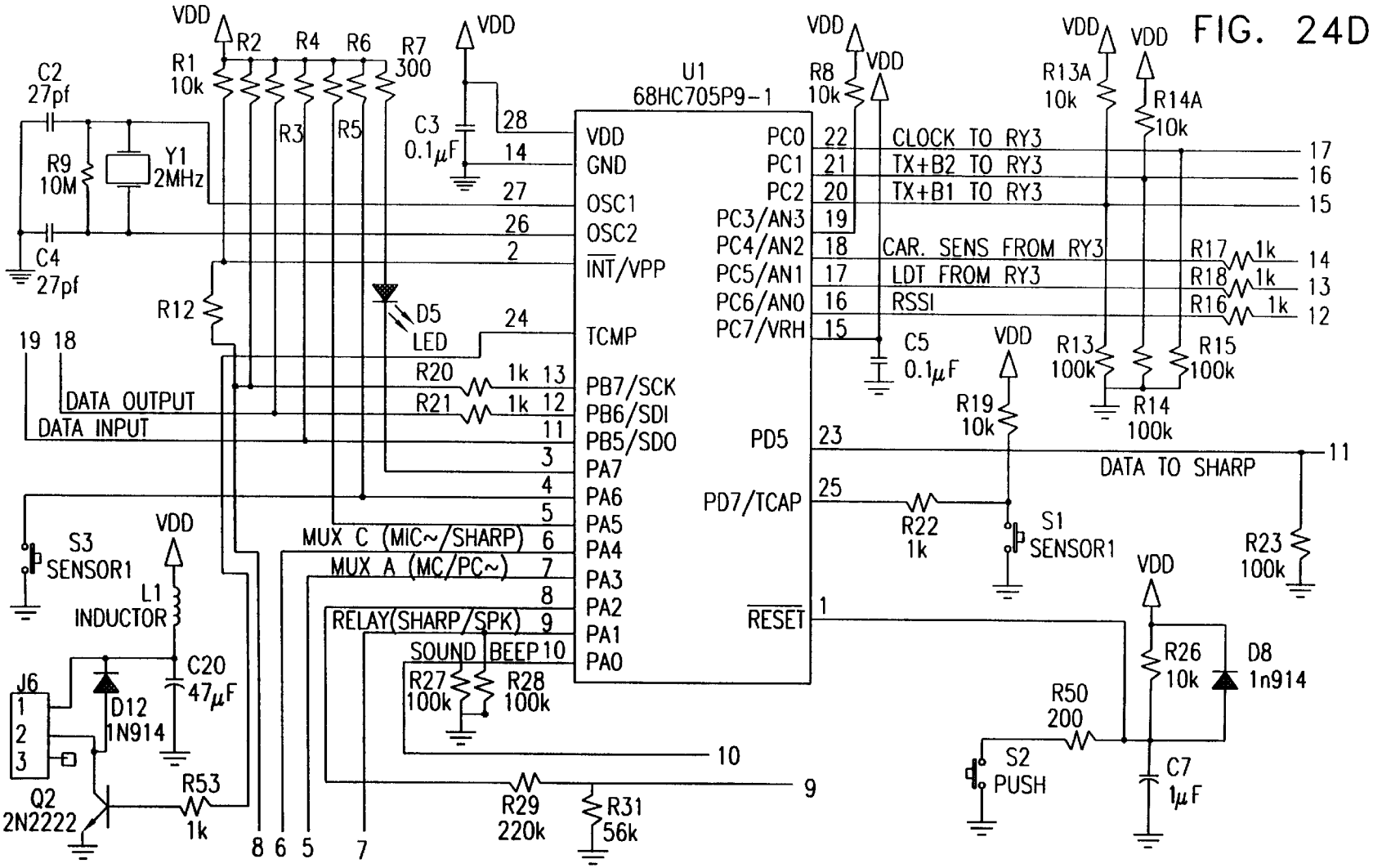
Figure 24E:
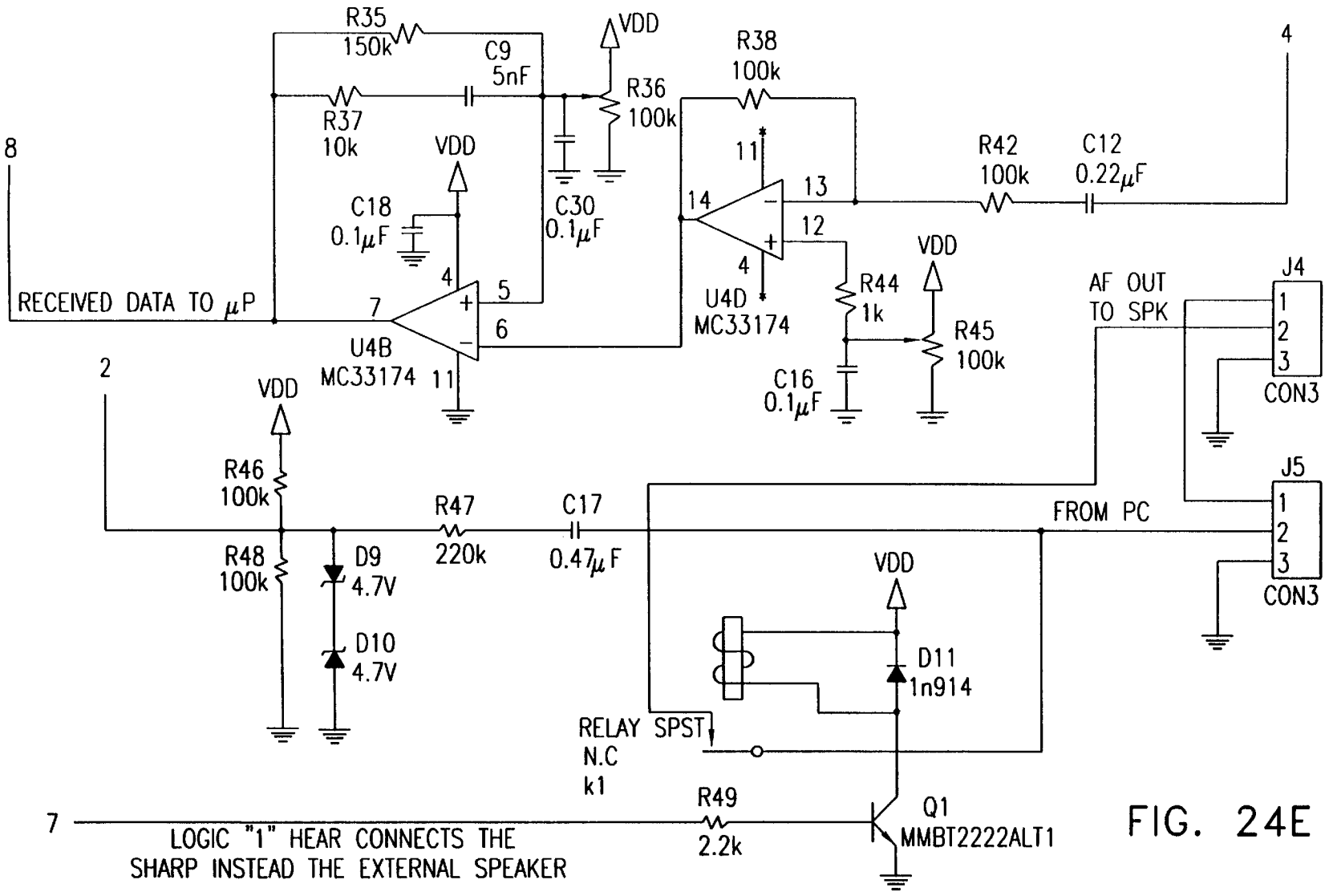
Figure 25A:
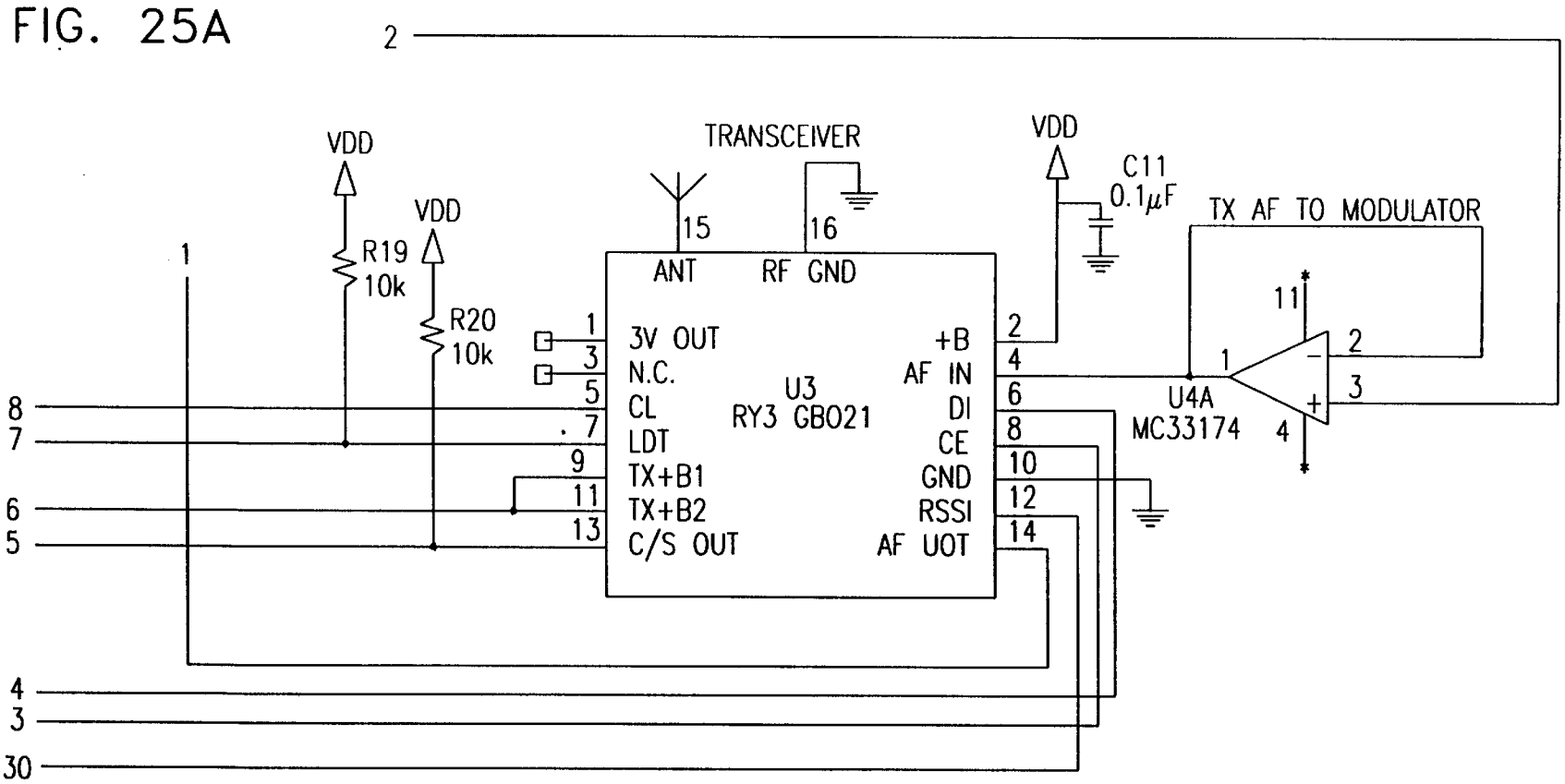
Figure 25B:
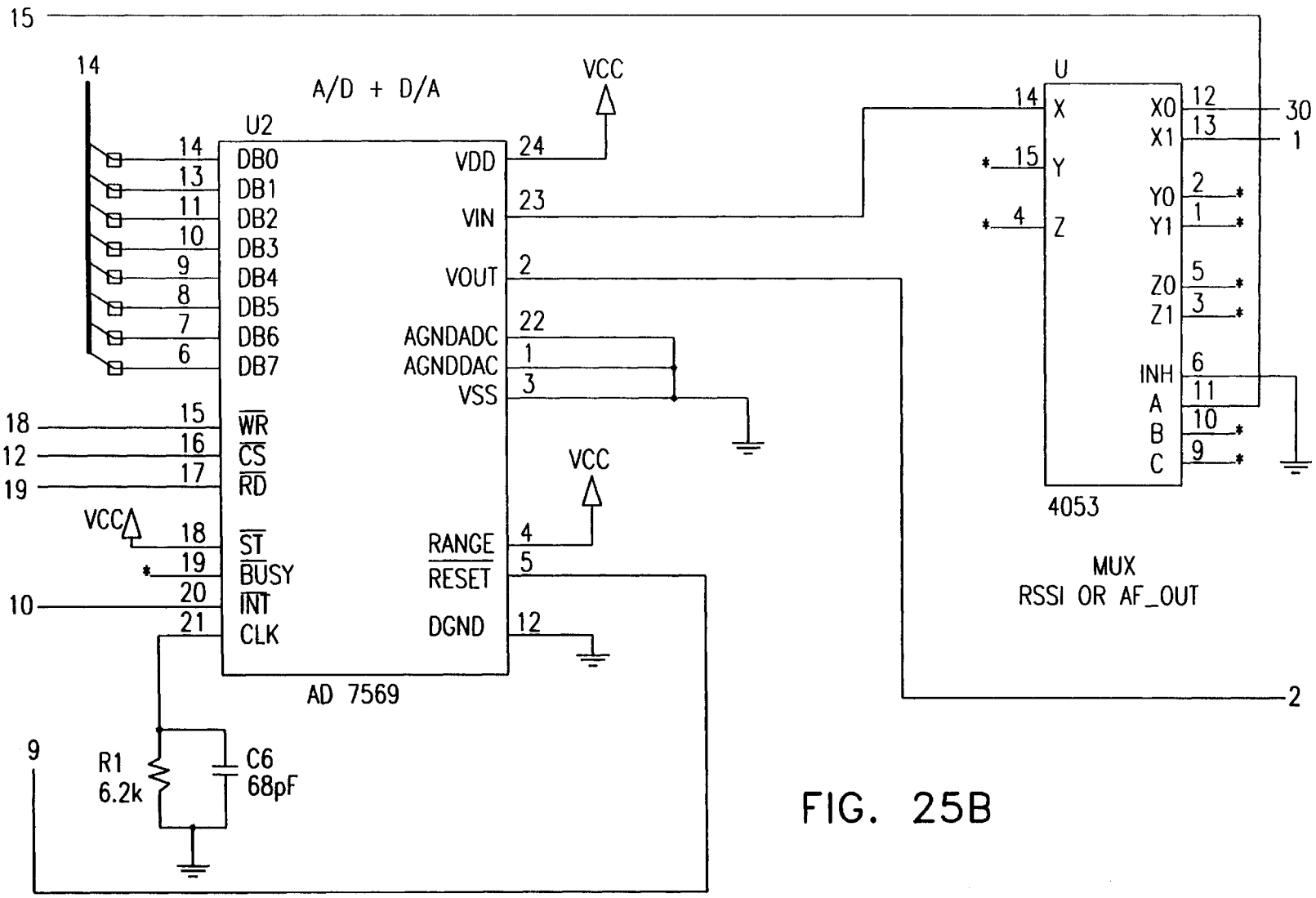
Figure 25C:
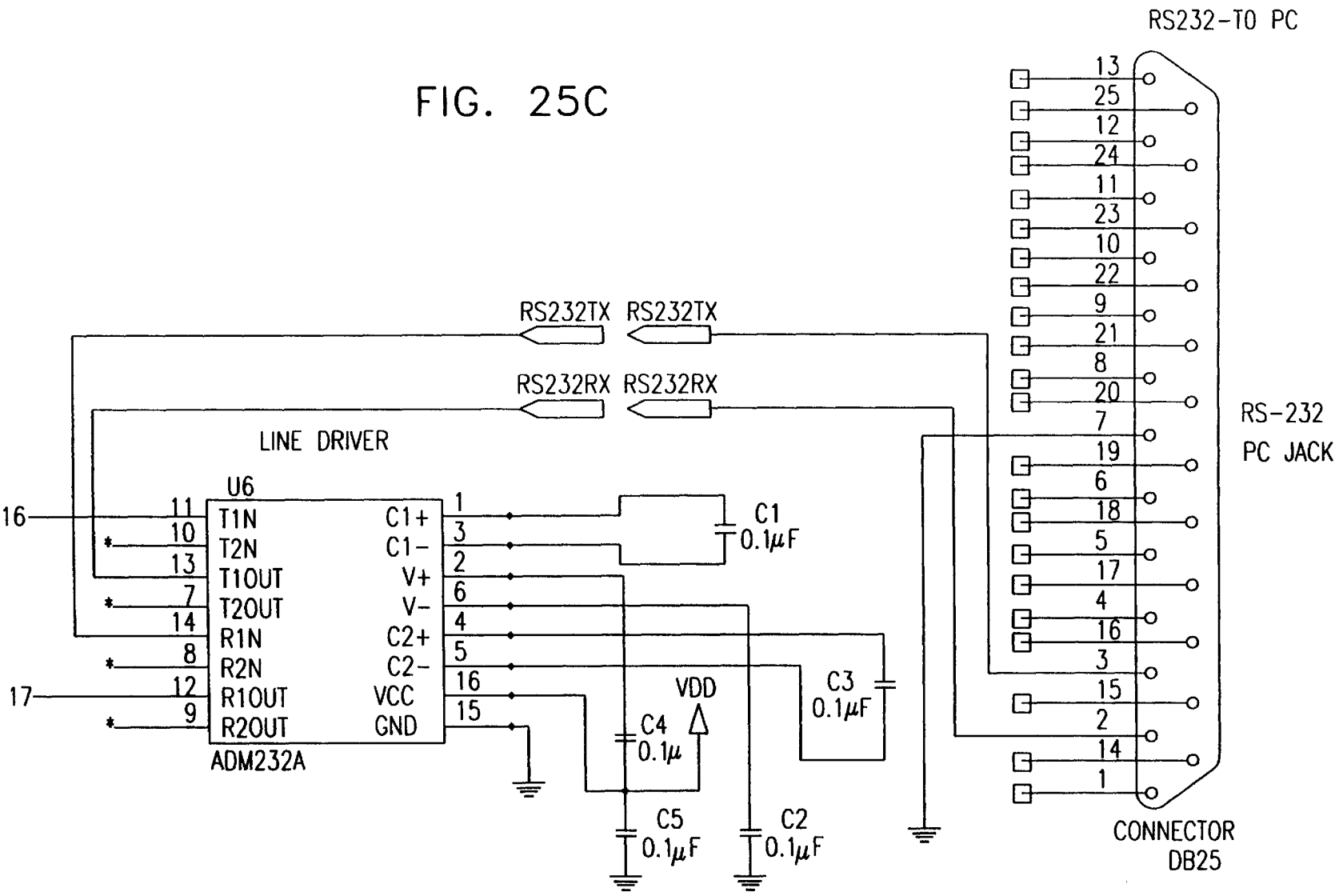
Figure 25D:
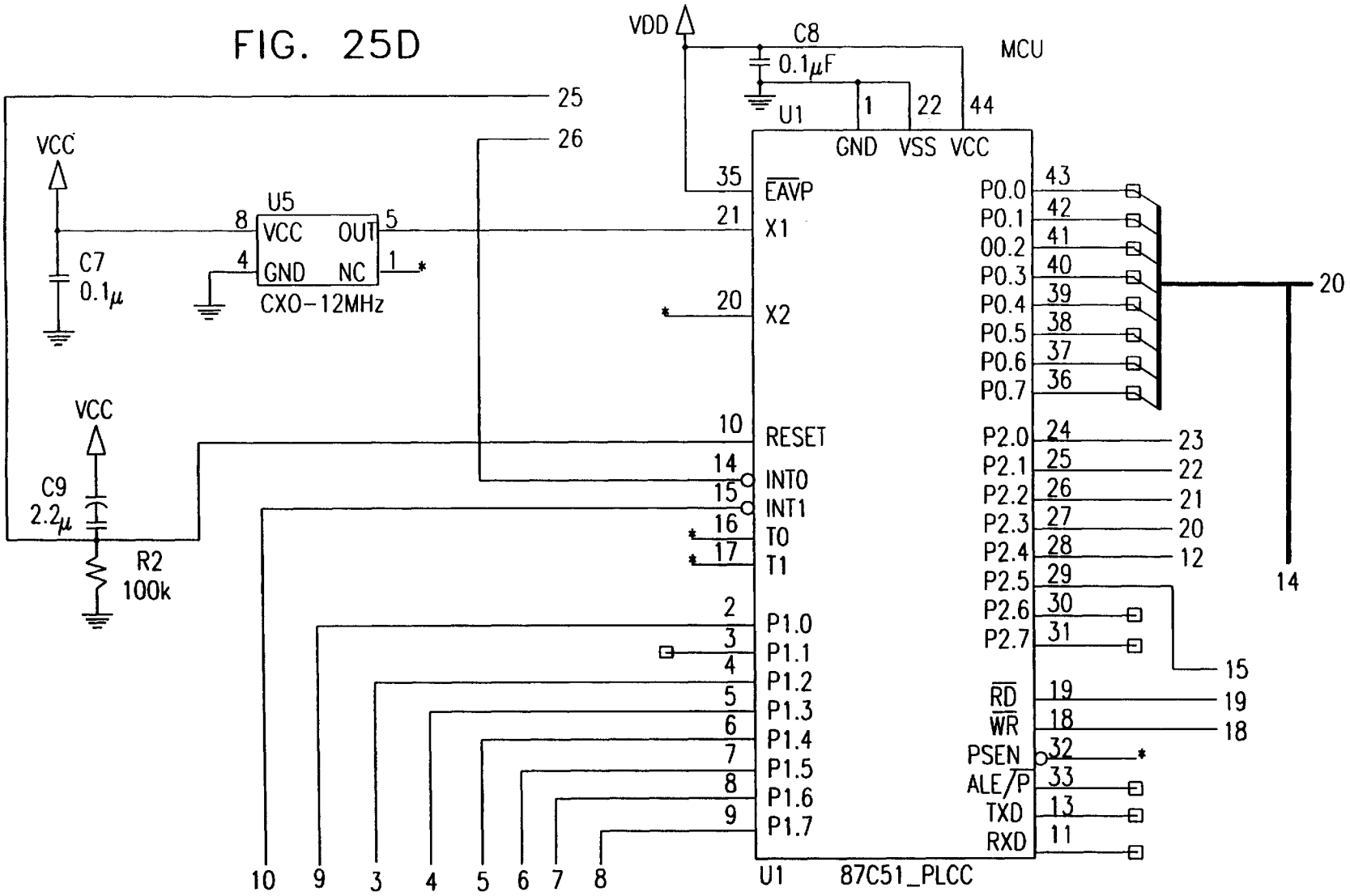
Figure 25E:
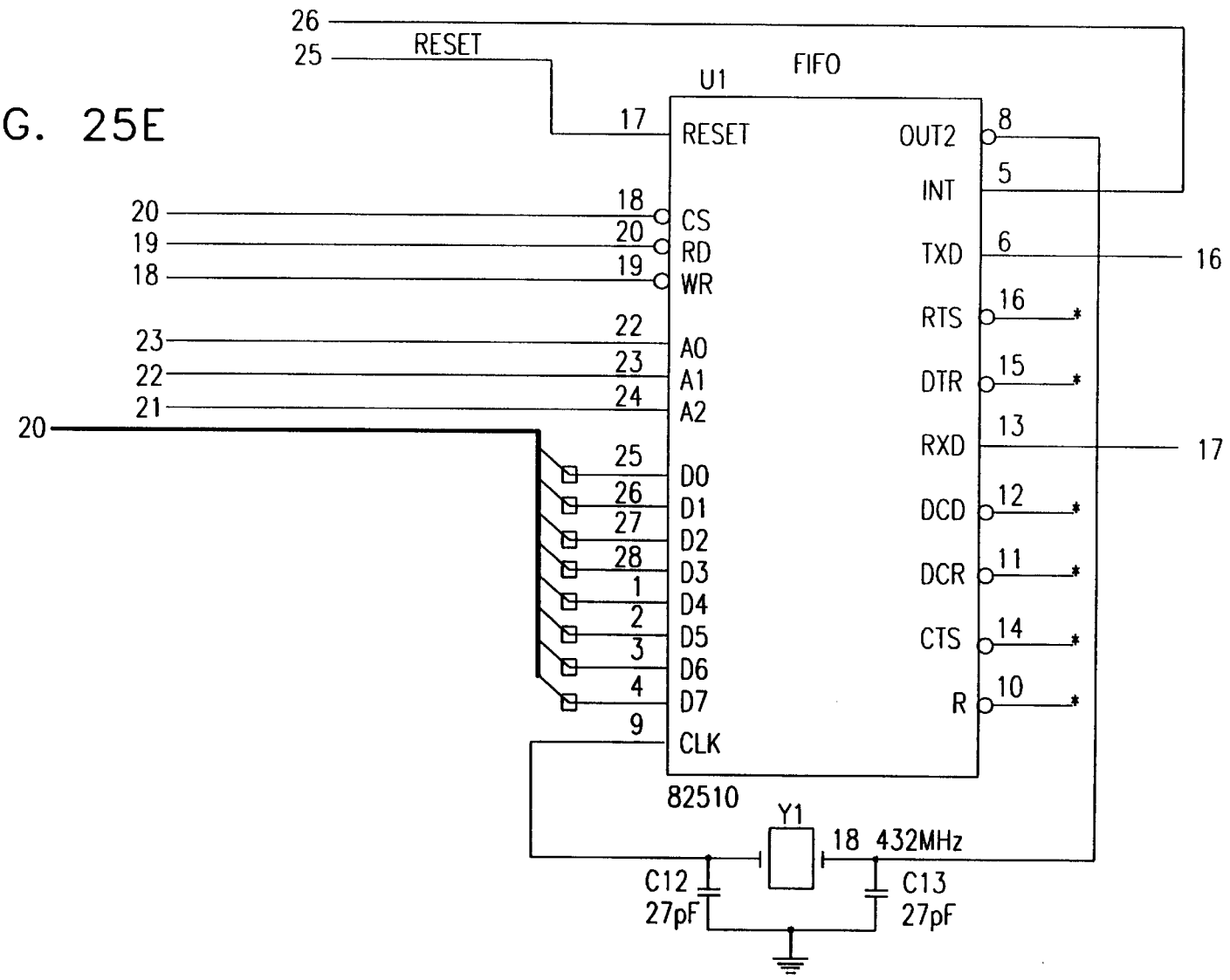
Figure 26A:
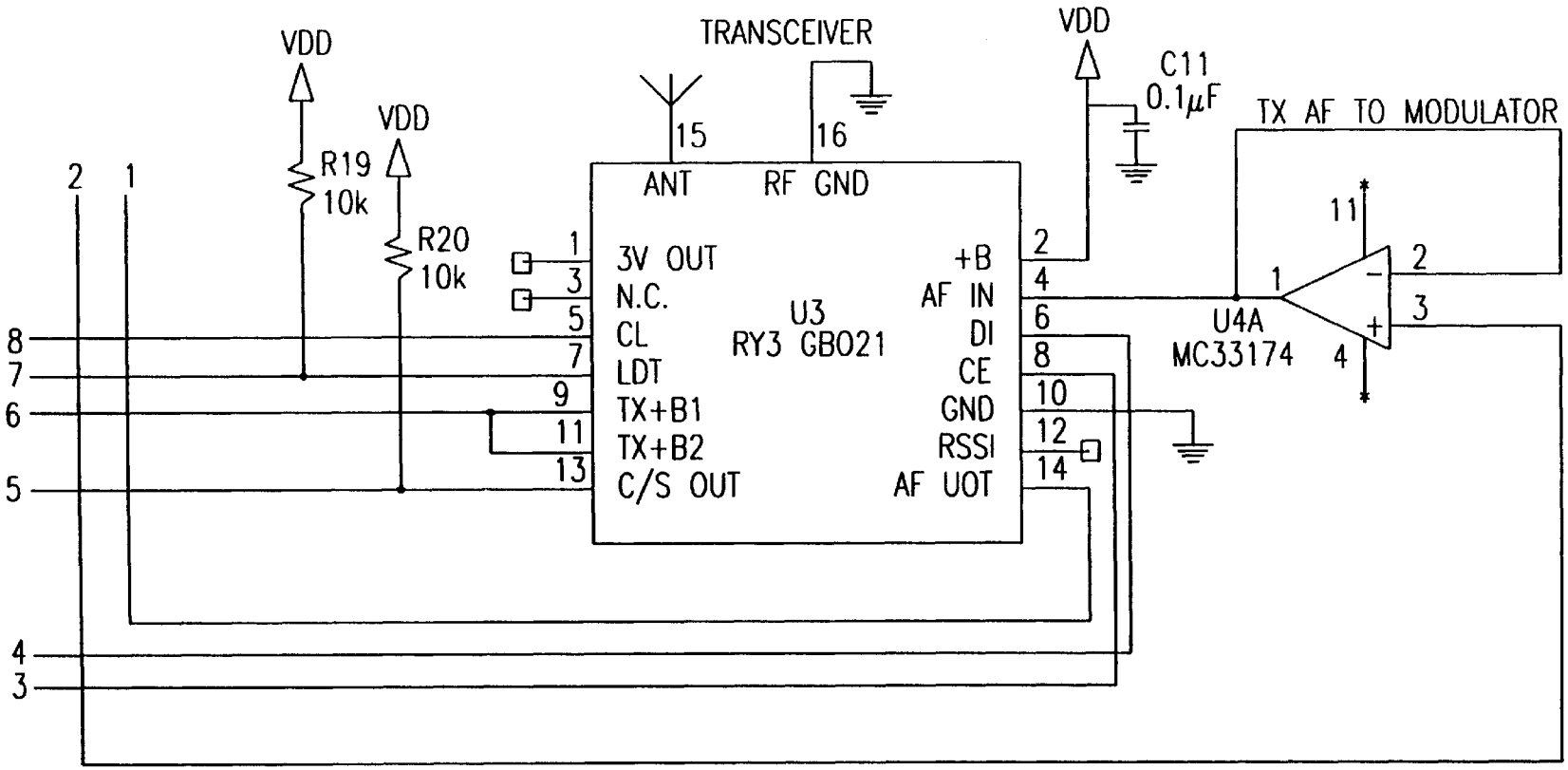
FIGS. 26A–26D, taken together, form a detailed schematic illustration of a computer radio interface which connects to a parallel port of a computer rather than to the sound board of the computer.
Figure 26B:
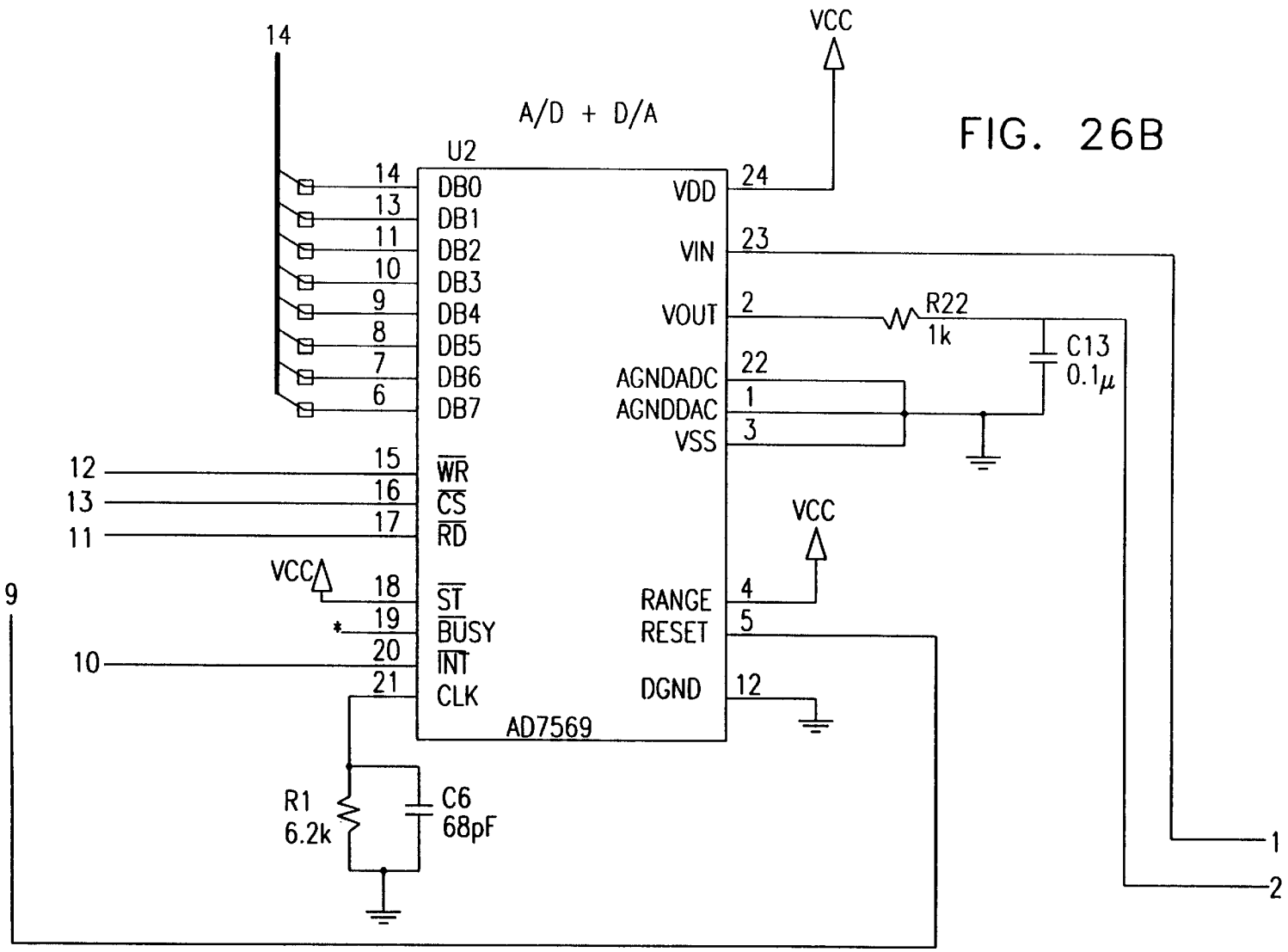
Figure 26C:
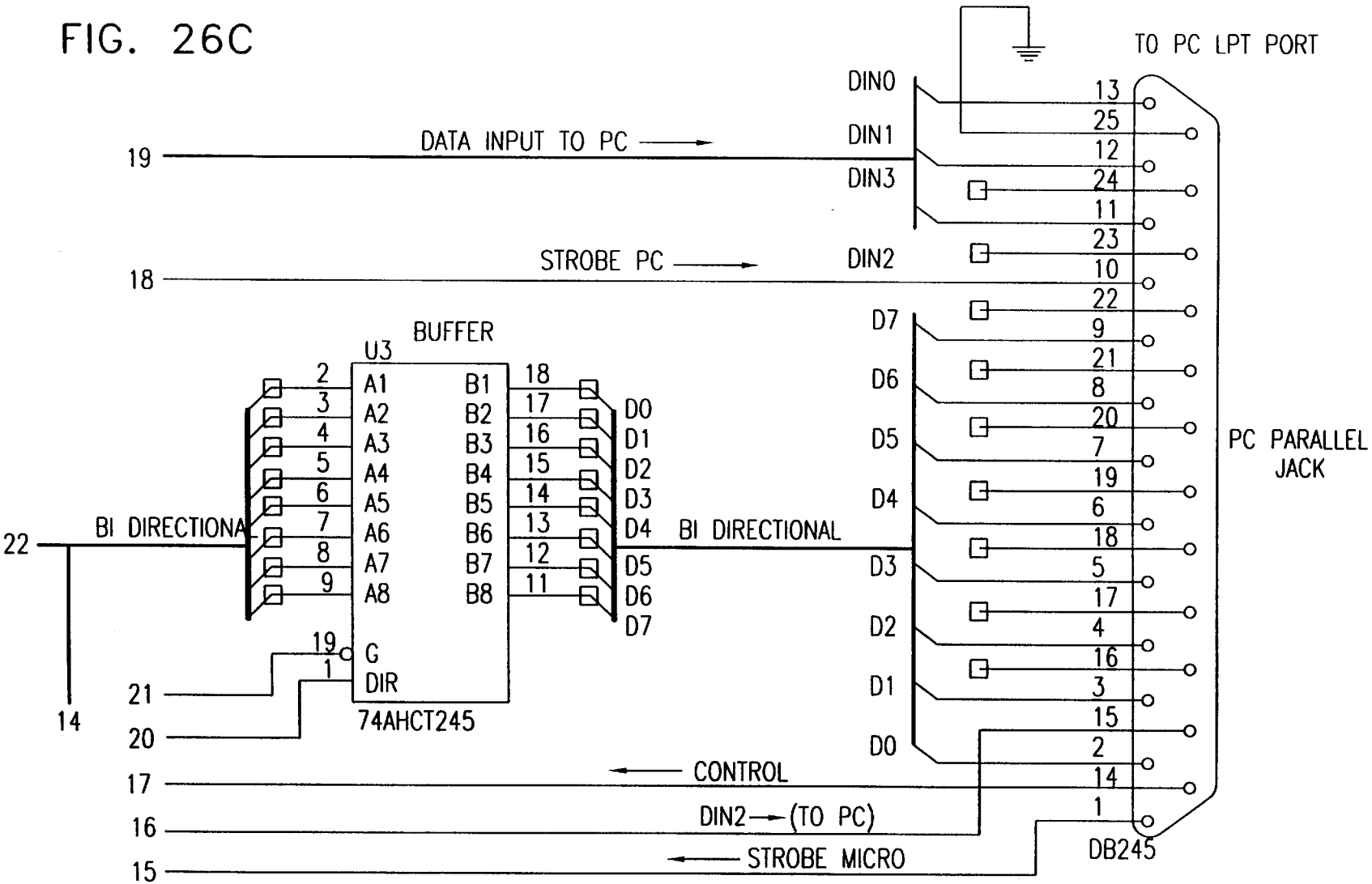
Figure 26D:
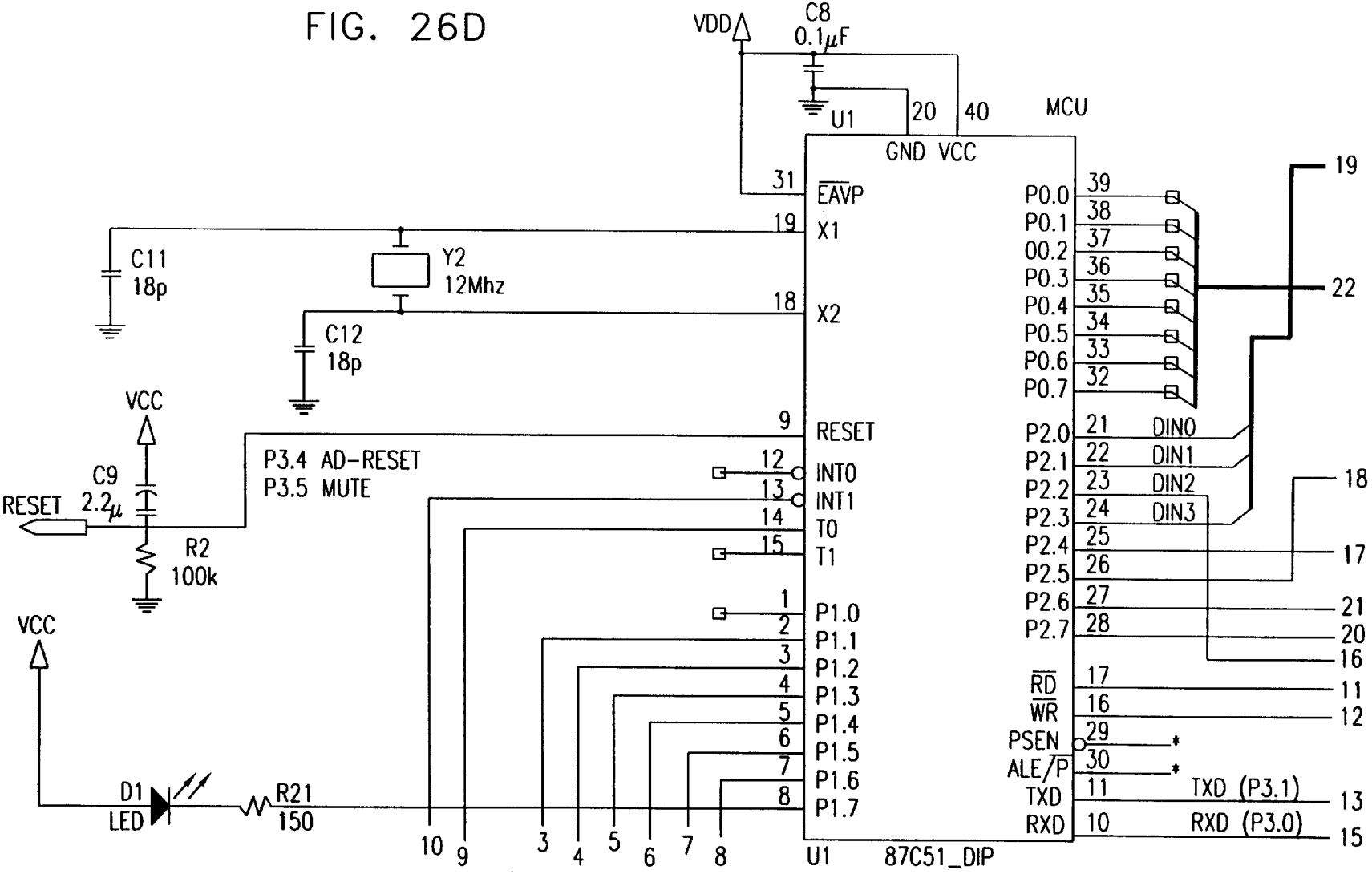
Figure 26D:
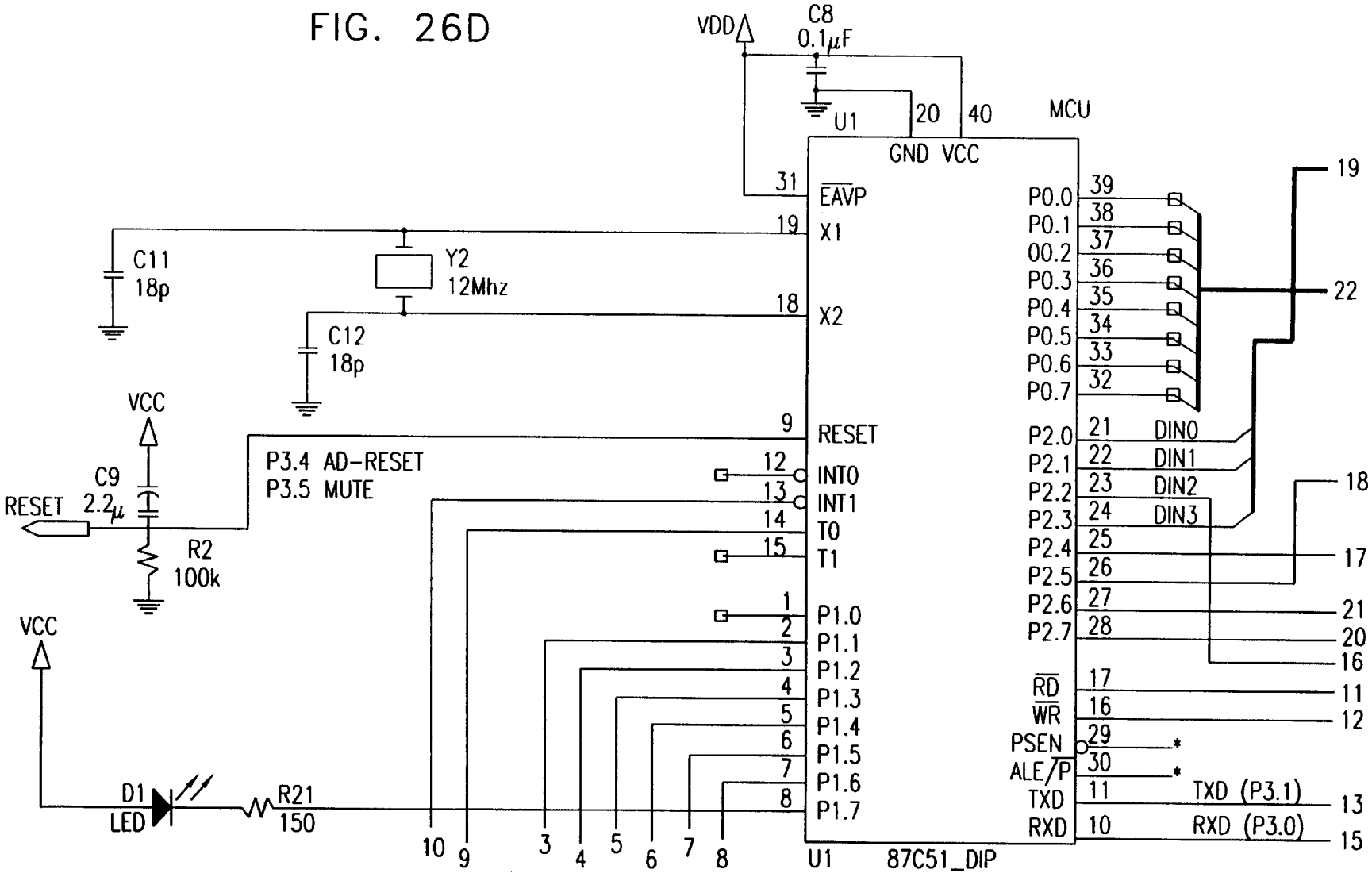
Figure 27A:
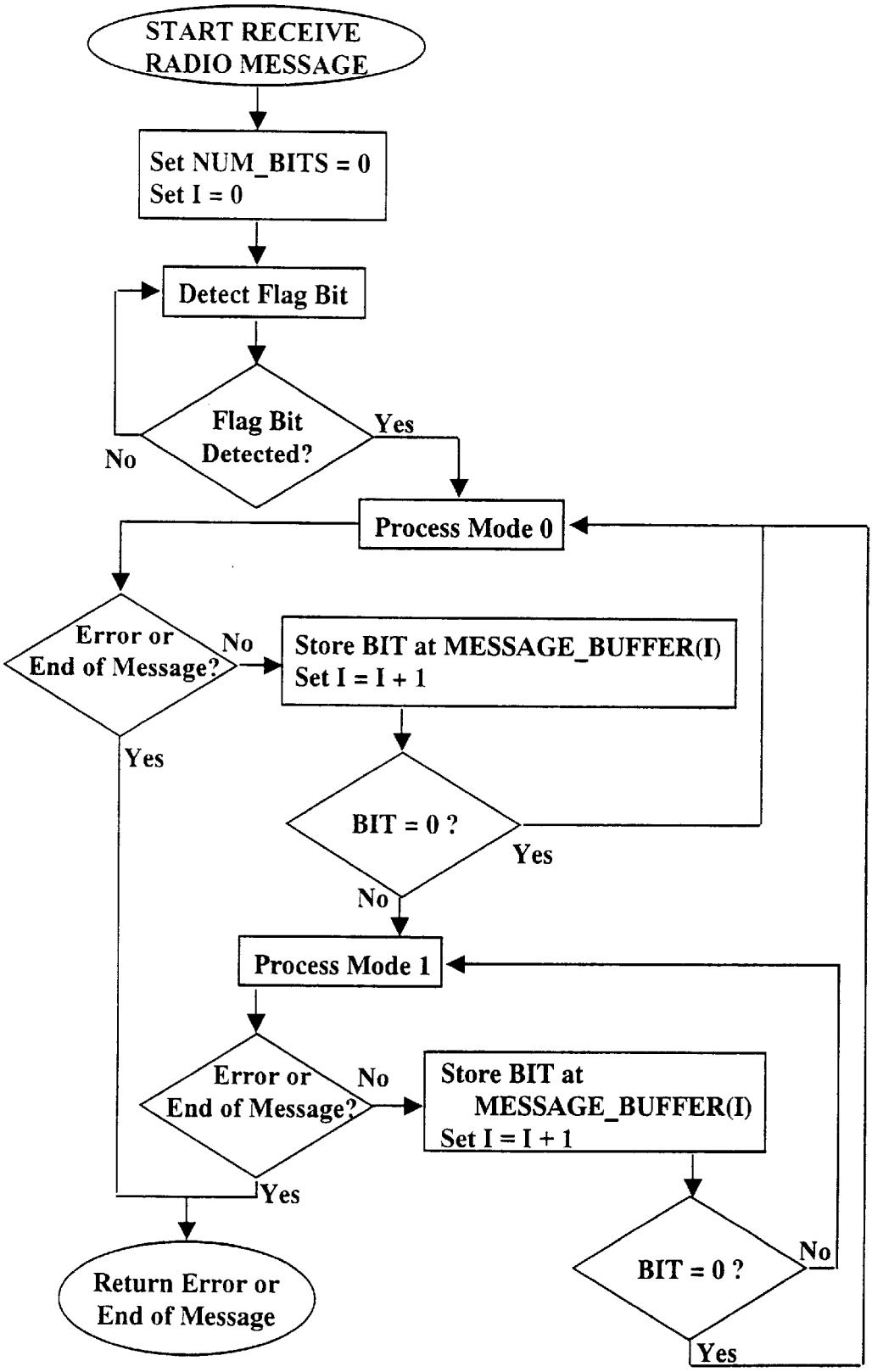
FIGS. 27A–27J are preferred flowchart illustrations of a preferred radio coding technique which is an alternative to the radio coding technique described above with reference to FIGS. 8E, 8G–8M and 10A–C.
Figure 27B:
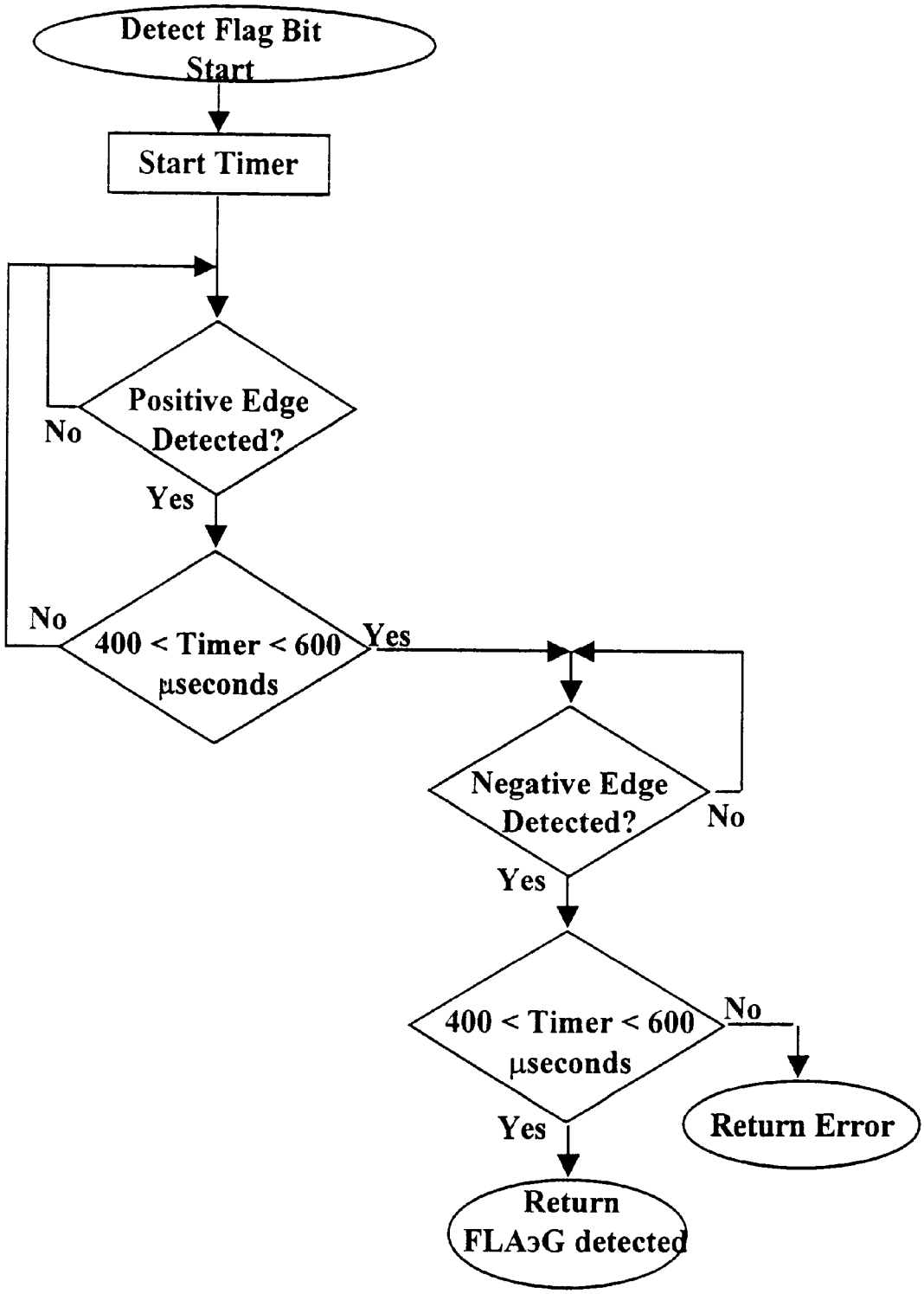
Figure 27C:
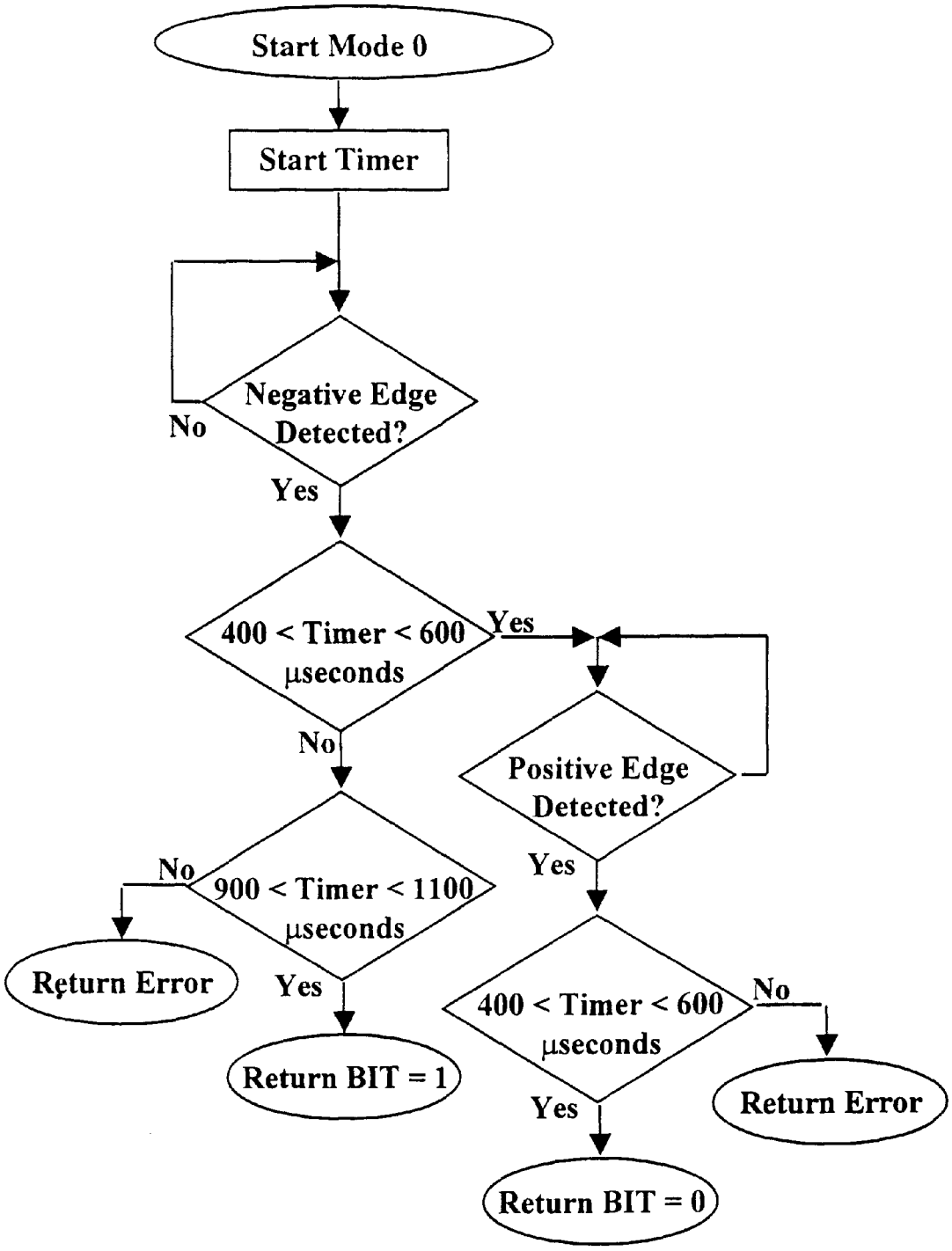
Figure 27D:
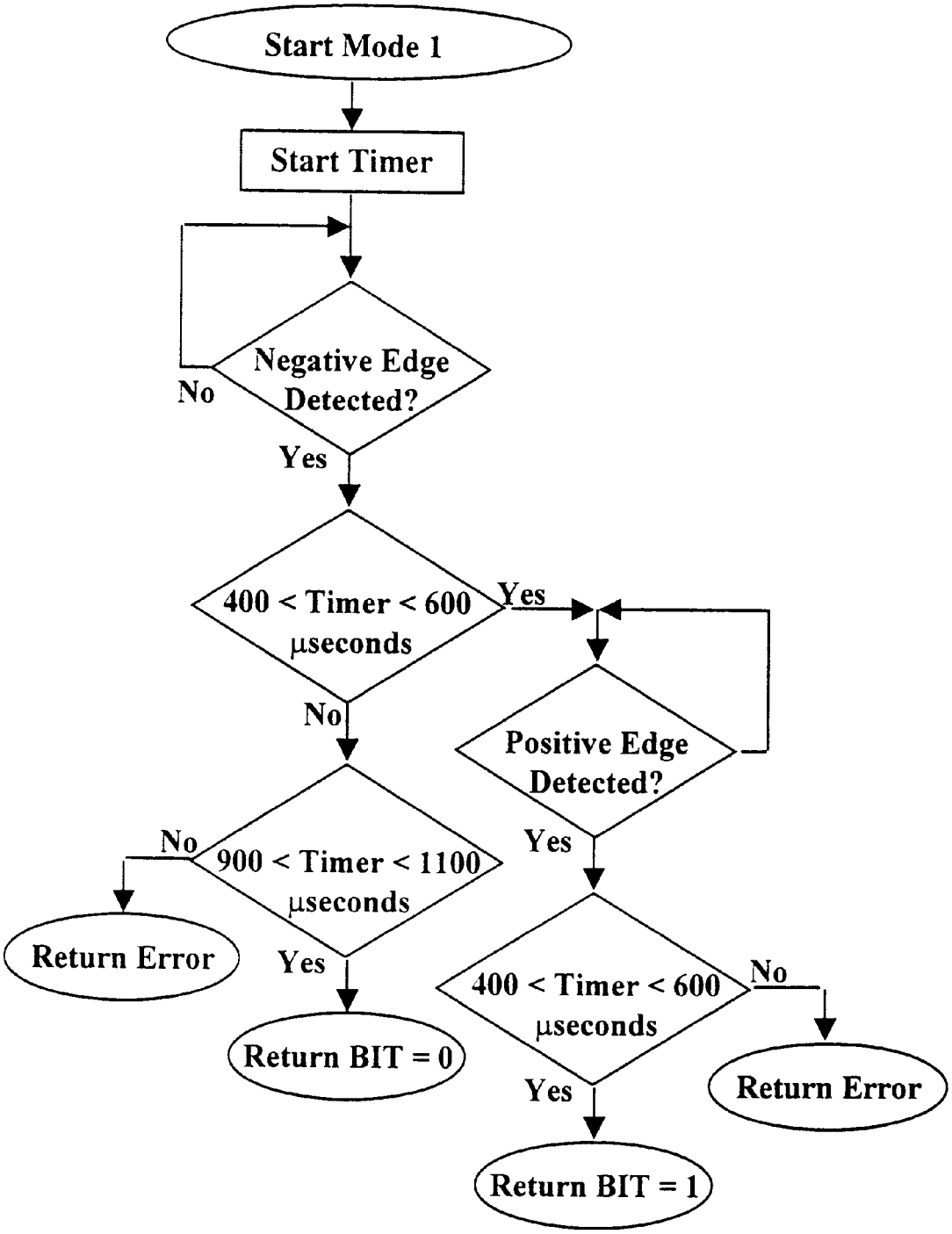
Figure 27E:
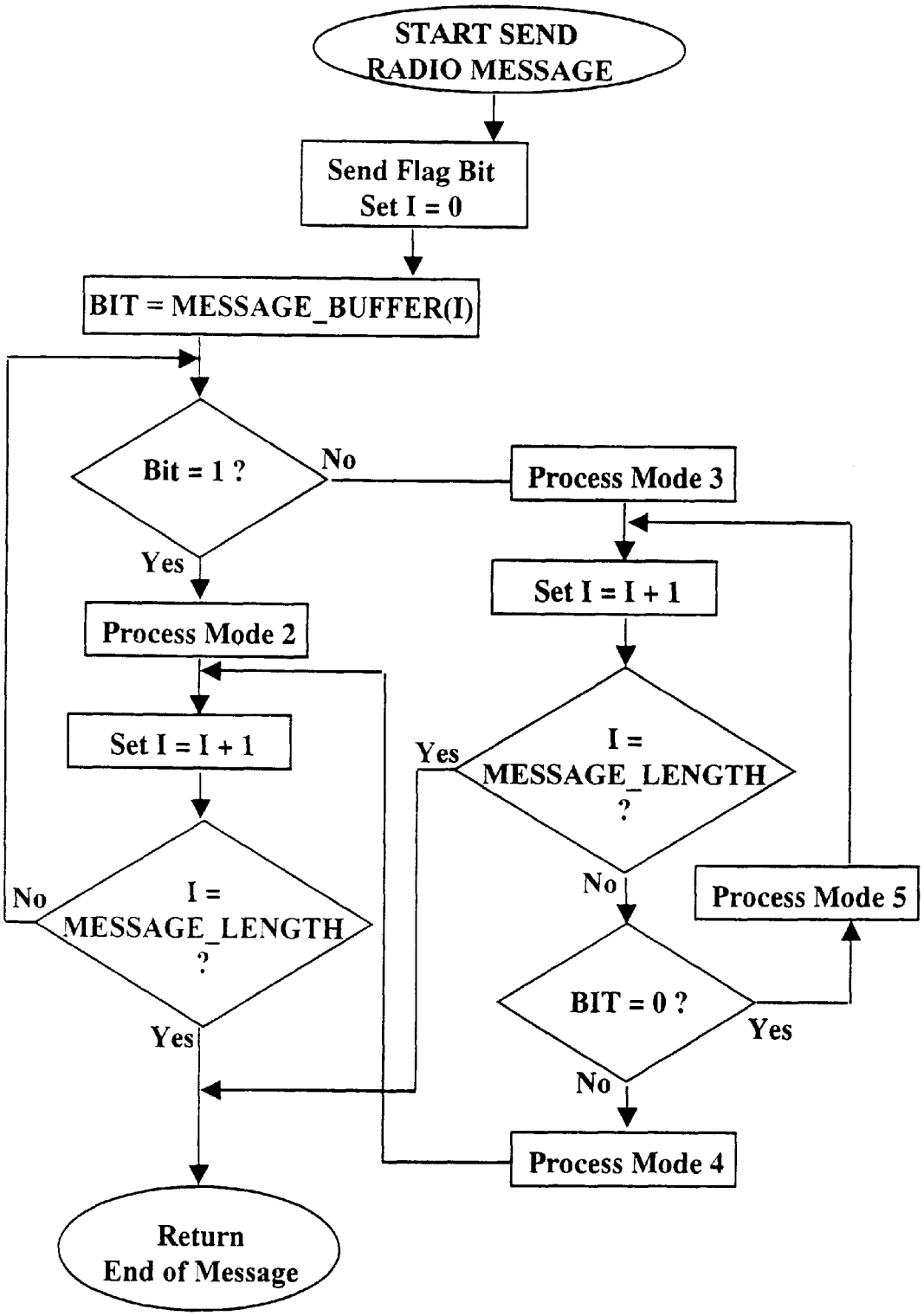
Figure 27F:
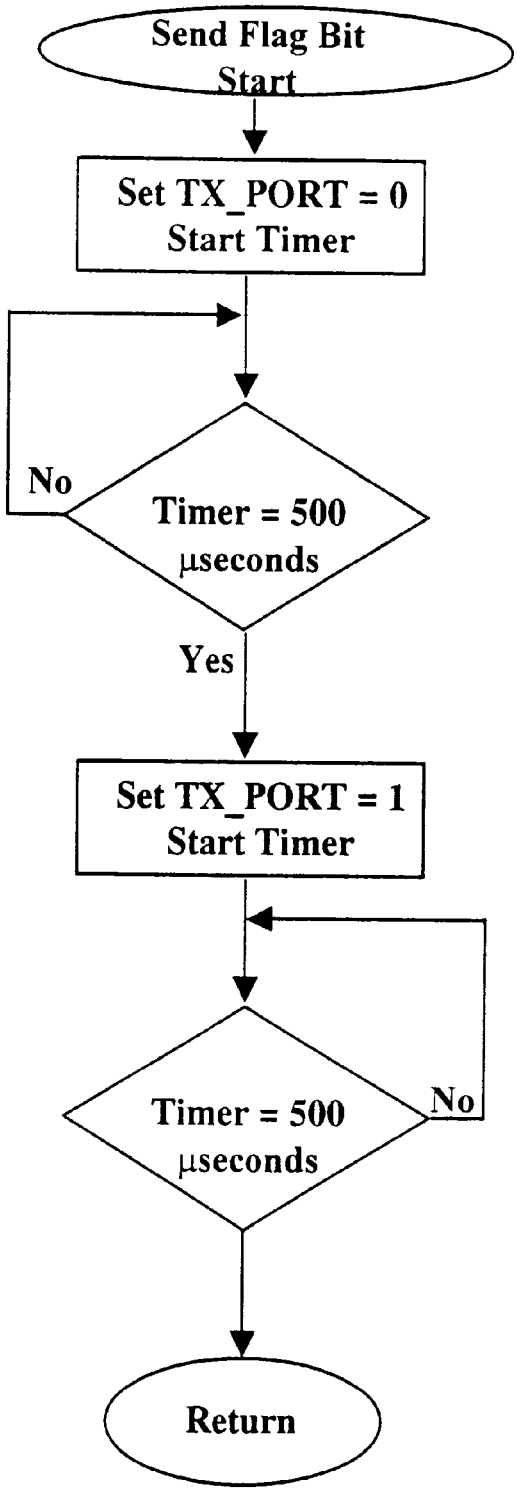
Figure 27G:
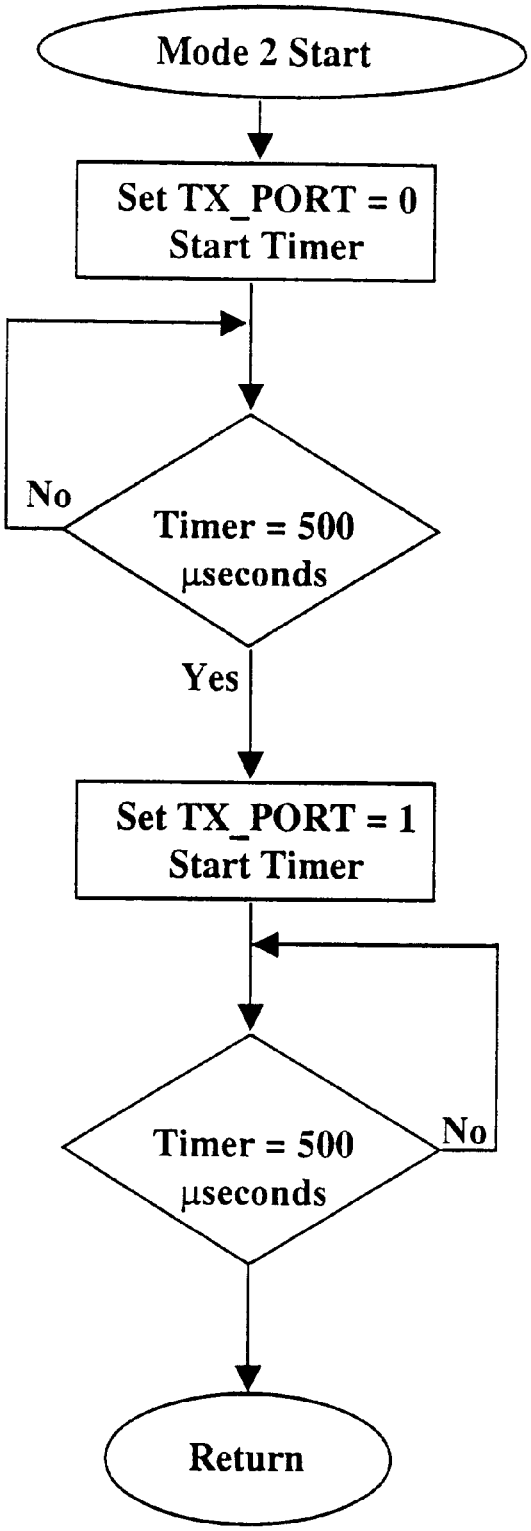
Figure 27H:
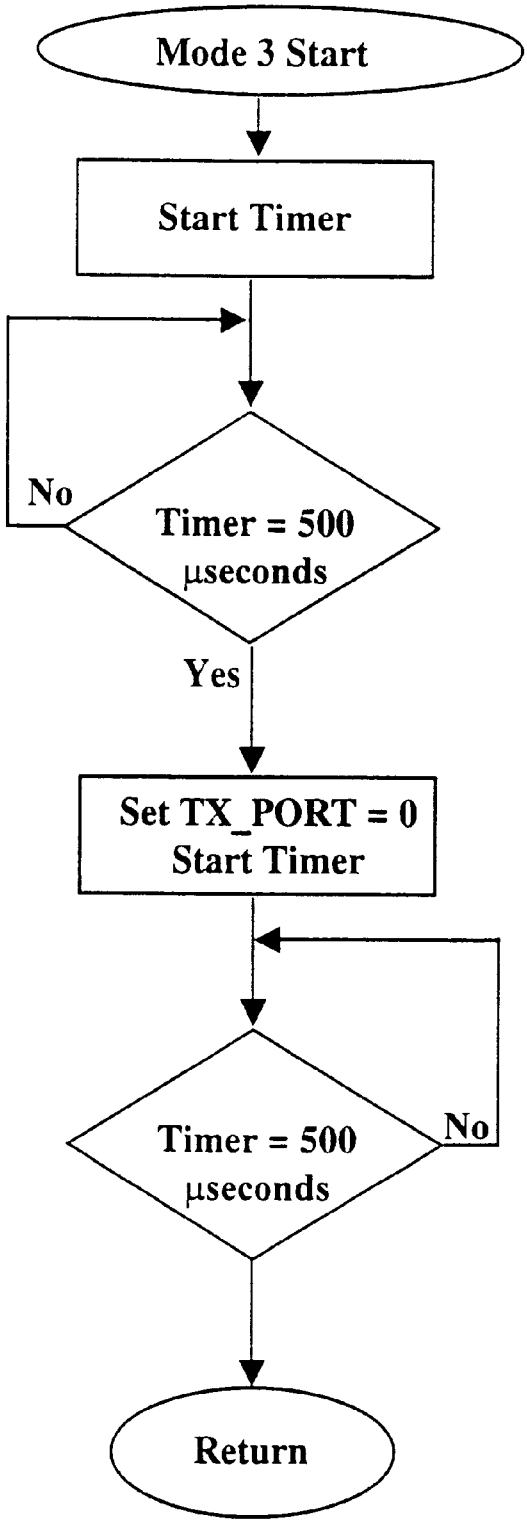
Figure 27I:
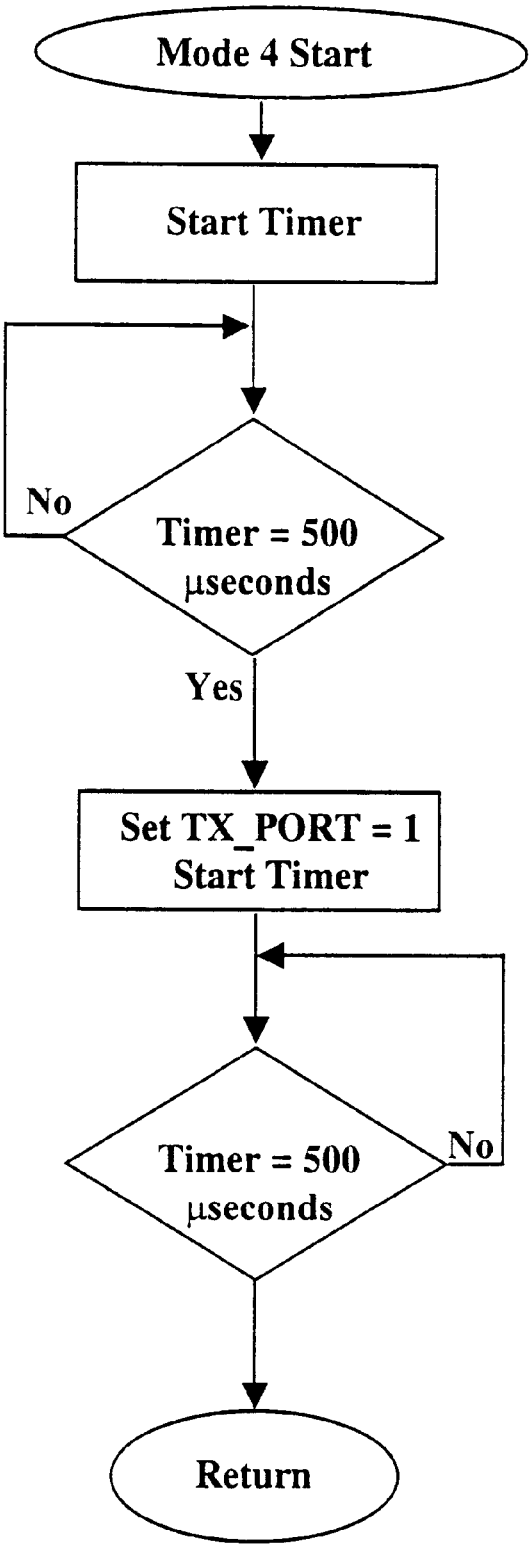
Figure 27J:
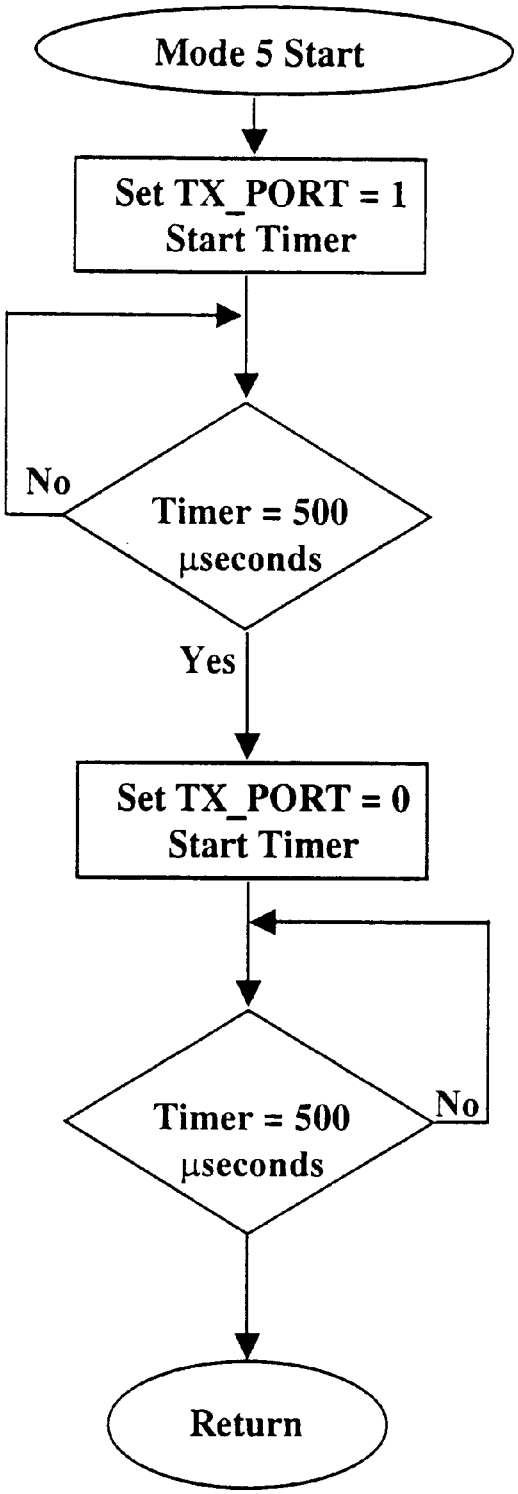

FIG. 23 is a semi-pictorial semi-block diagram illustration of a wireless computer controlled toy system including a toy 1500 having a toy control device 1504, a computer 1510 communicating with the toy control device 1504 by means of a computer-radio interface 1514 and a proximity detection subsystem operative to detect proximity between the toy and the computer. The proximity detection subsystem may for example include a pair of ultrasound transducers 1520 and 1530 associated with the toy and computer respectively. The toy's ultrasound transducer 1520 typically broadcasts ultrasonic signals which the computer's ultrasound transducer 1530 detects if the computer and toy are within ultrasonic communication range, e.g. are in the same room.

FIGS. 24A–24E, taken together, form a detailed electronic schematic diagram of a multi-channel implementation of the computer radio interface 110 of FIG. 3 which is similar to the detailed electronic schematic diagrams of FIGS. 5A–5D except for being multi-channel, therefore capable of supporting full duplex applications, rather than single-channel.

FIGS. 25A–25F, taken together, form a detailed schematic illustration of a computer radio interface which connects to a serial port of a computer rather than to the sound board of the computer.

FIGS. 26A–26D, taken together, form a detailed schematic illustration of a computer radio interface which connects to a parallel port of a computer rather than to the sound board of the computer.

FIGS. 27A–27J are preferred self-explanatory flowchart illustrations of a preferred radio coding technique, based on the Manchester coding, which is an alternative to the radio coding technique described above with reference to FIGS. 8E, 8G–8M and 10A–C.

FIGS. 28A–28K, taken together, form a detailed electronic schematic diagram of the multi-port multi-channel computer radio interface sub-unit of FIG. 13.

FIGS. 29A–29I, taken together, form a detailed electronic schematic diagram of the multi-port multi-channel computer radio interface sub-unit of FIG. 14.

Figure 30:
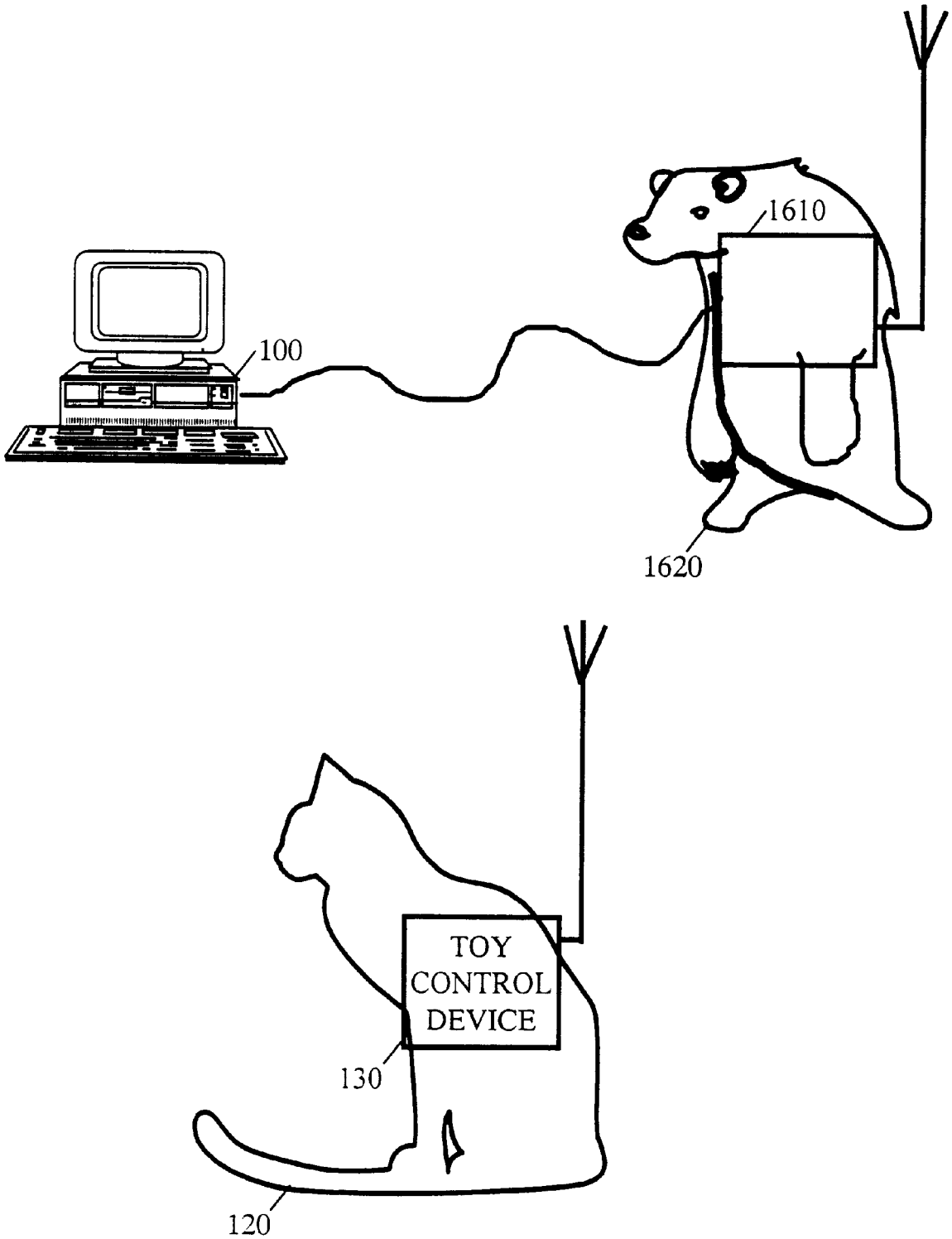

FIG. 30 illustrates a further embodiment of the present invention which includes a combination of a Computer Radio Interface (CRI) and a Toy Control Device (TCD), 1610.

The combined unit 1610 controls a toy 1620 which is connected to the computer 100 by a device, such as a cable, and communicates with other toys, 120, by means such as radio communication, using the computer radio interface 110. The toy 1620 is operated in a similar manner as the toy device 120.

Figure 31:
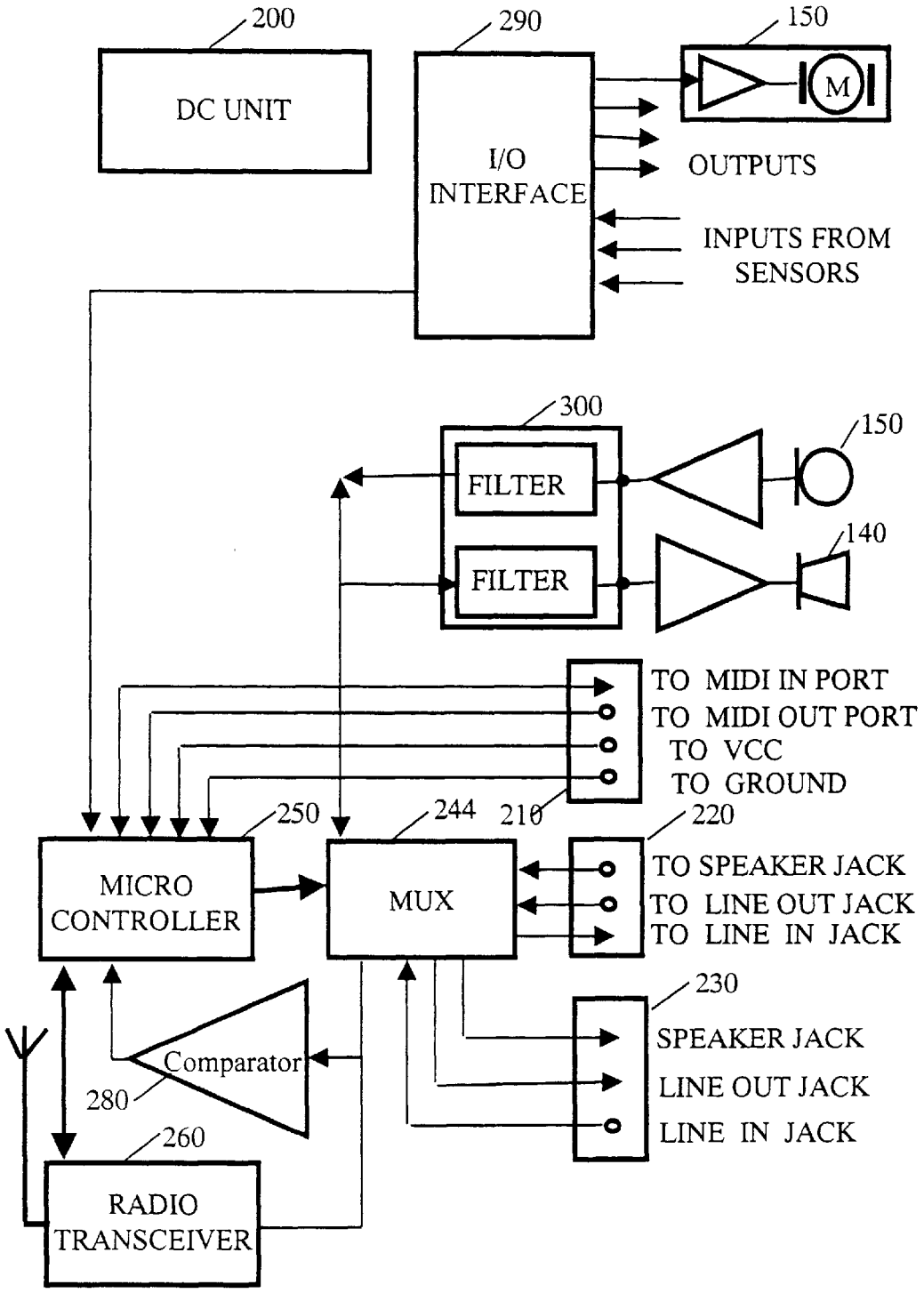

FIG. 31 illustrates a simplified block diagram of the combined unit 1610.

Figure 28A:
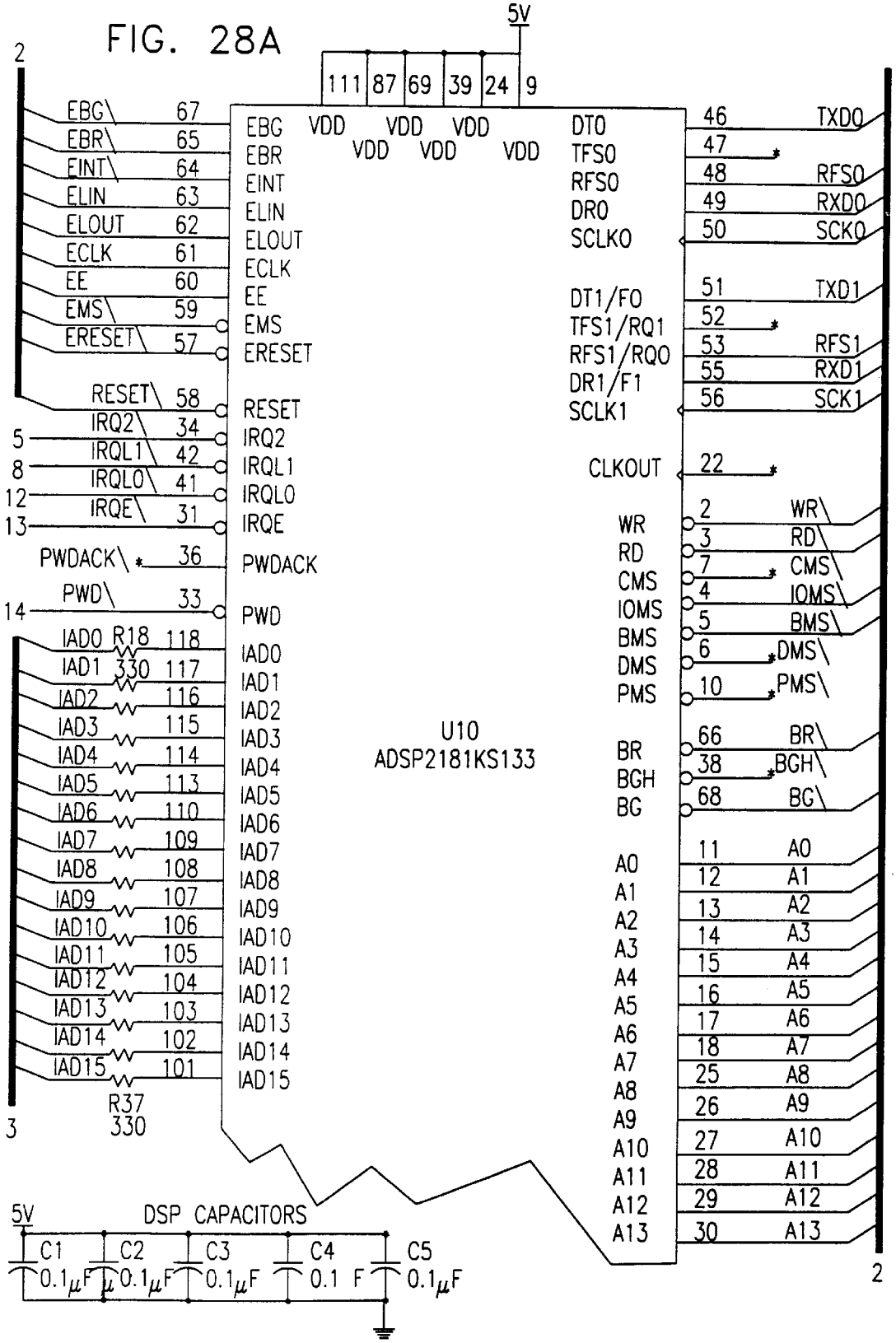
FIGS. 28A–28K, taken together, form a detailed electronic schematic diagram of the multi-port multi-channel computer radio interface sub-unit of FIG. 13.
Figure 28B:
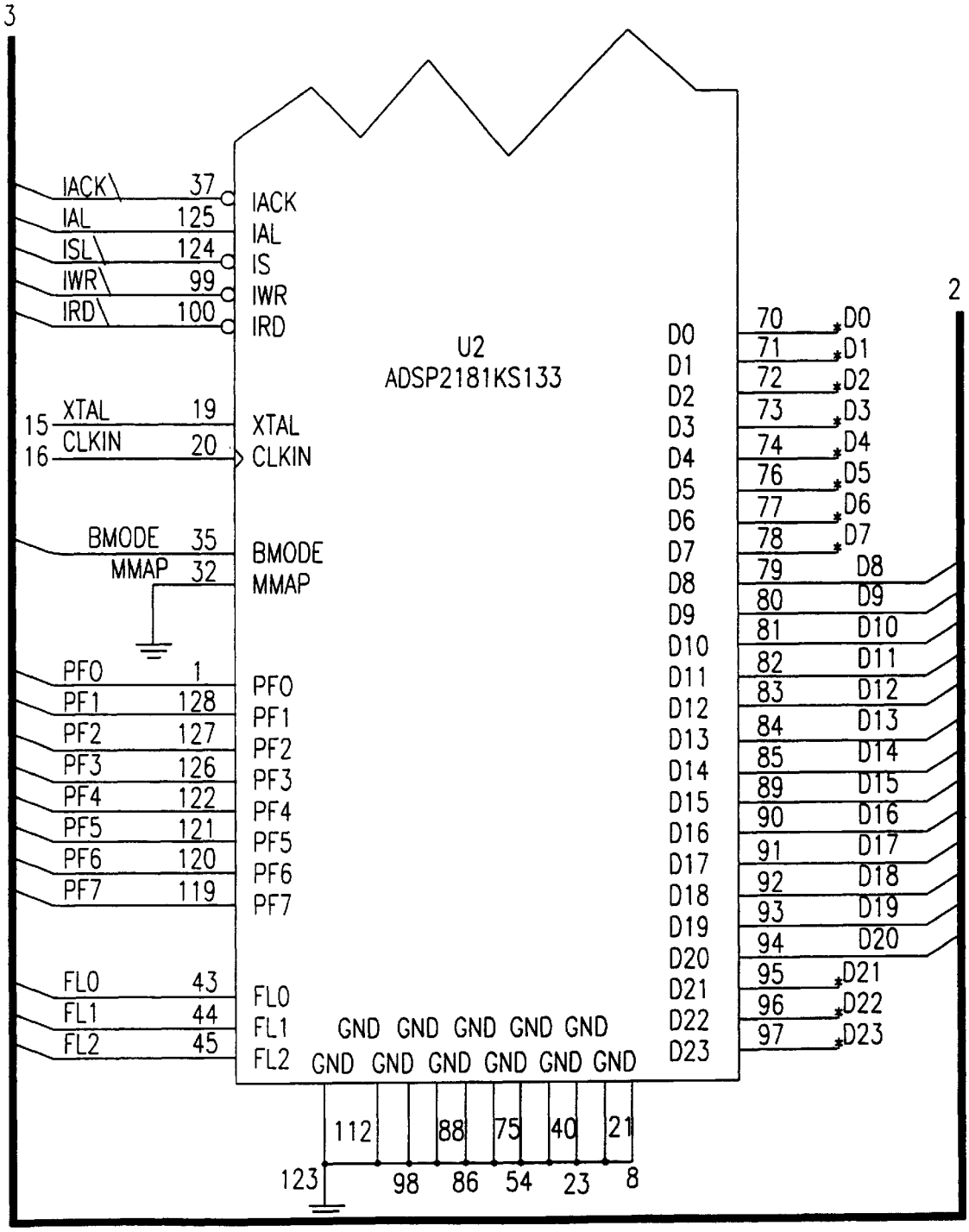
Figure 28C:
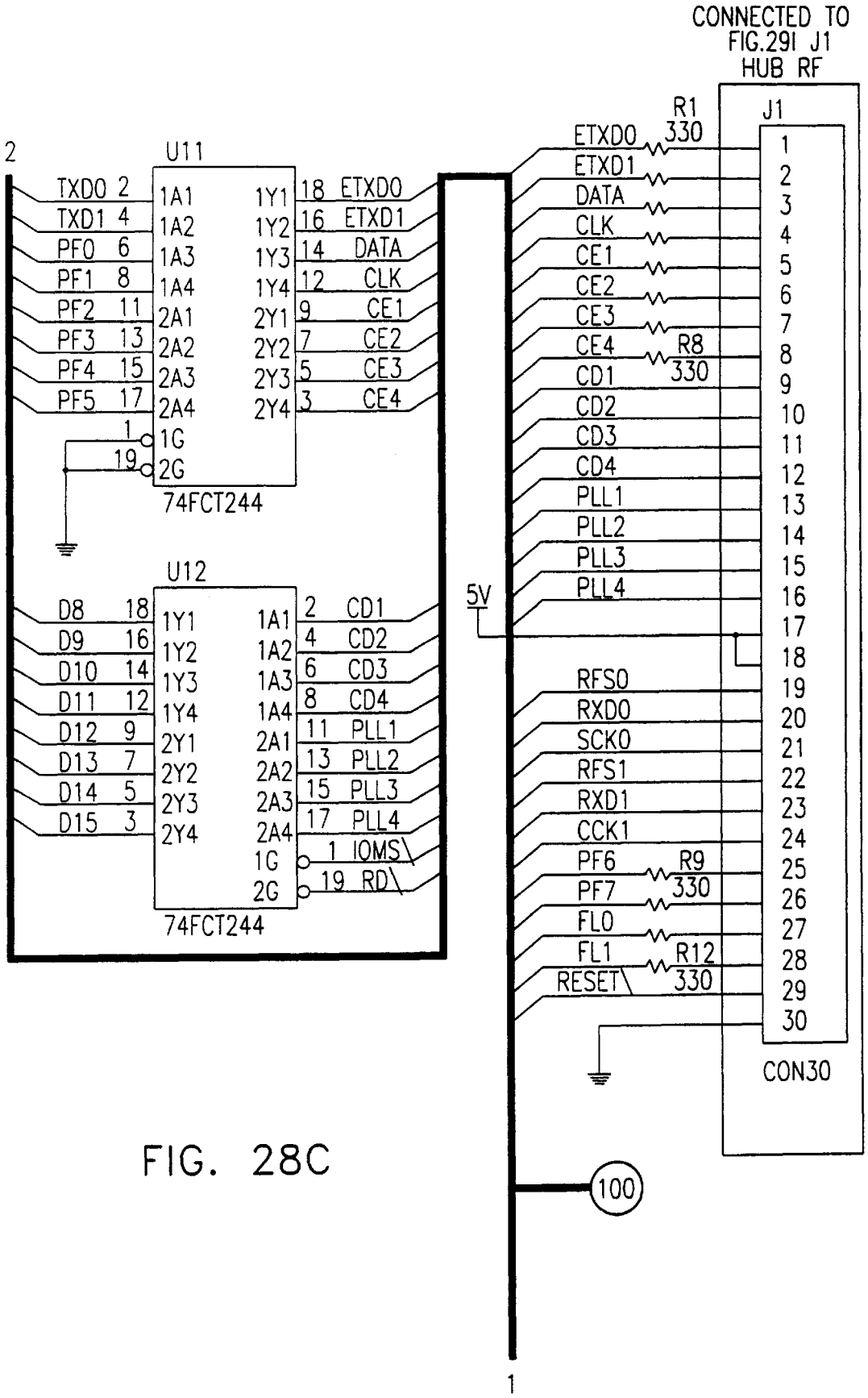
Figure 28D:
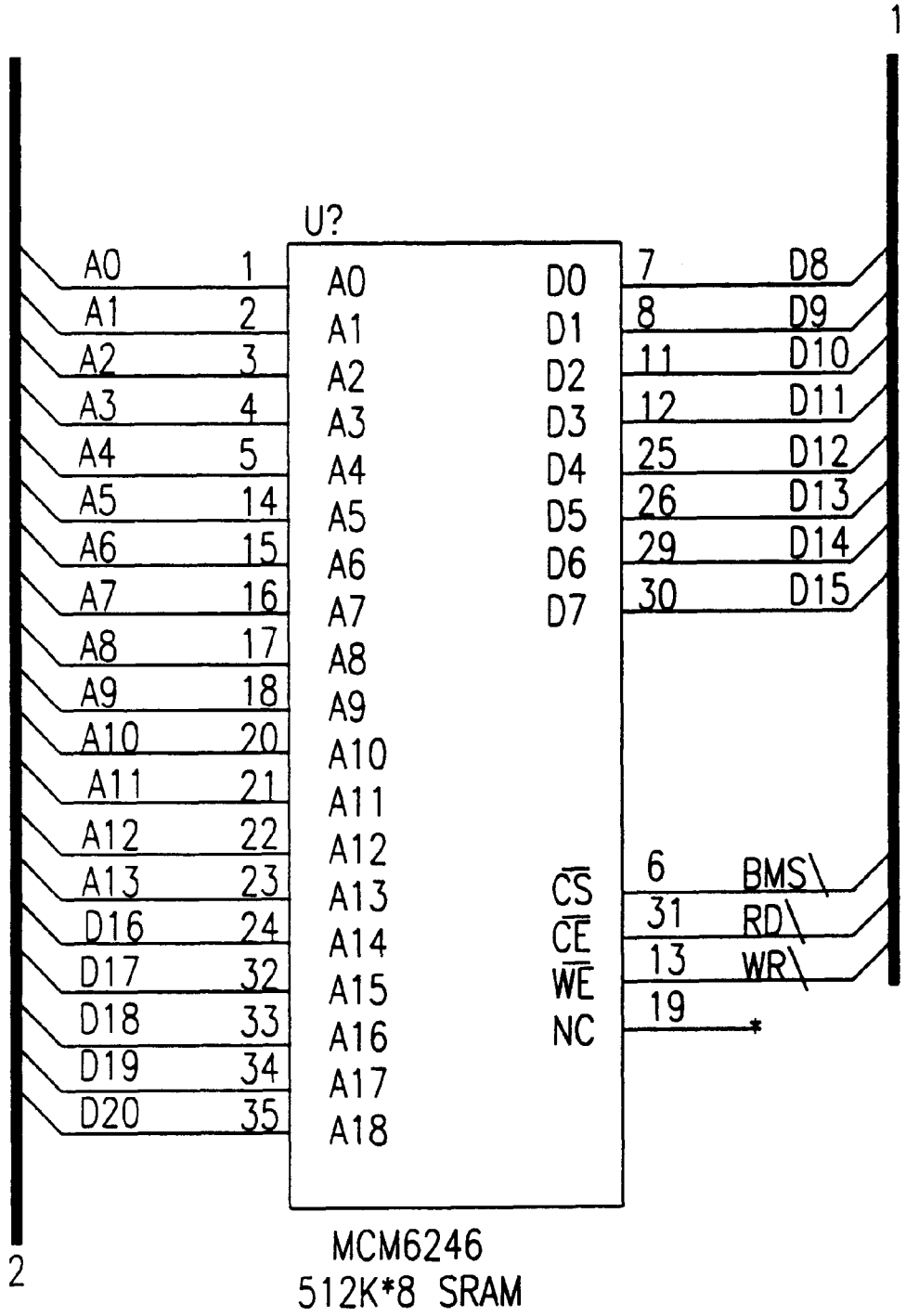
Figure 28E:
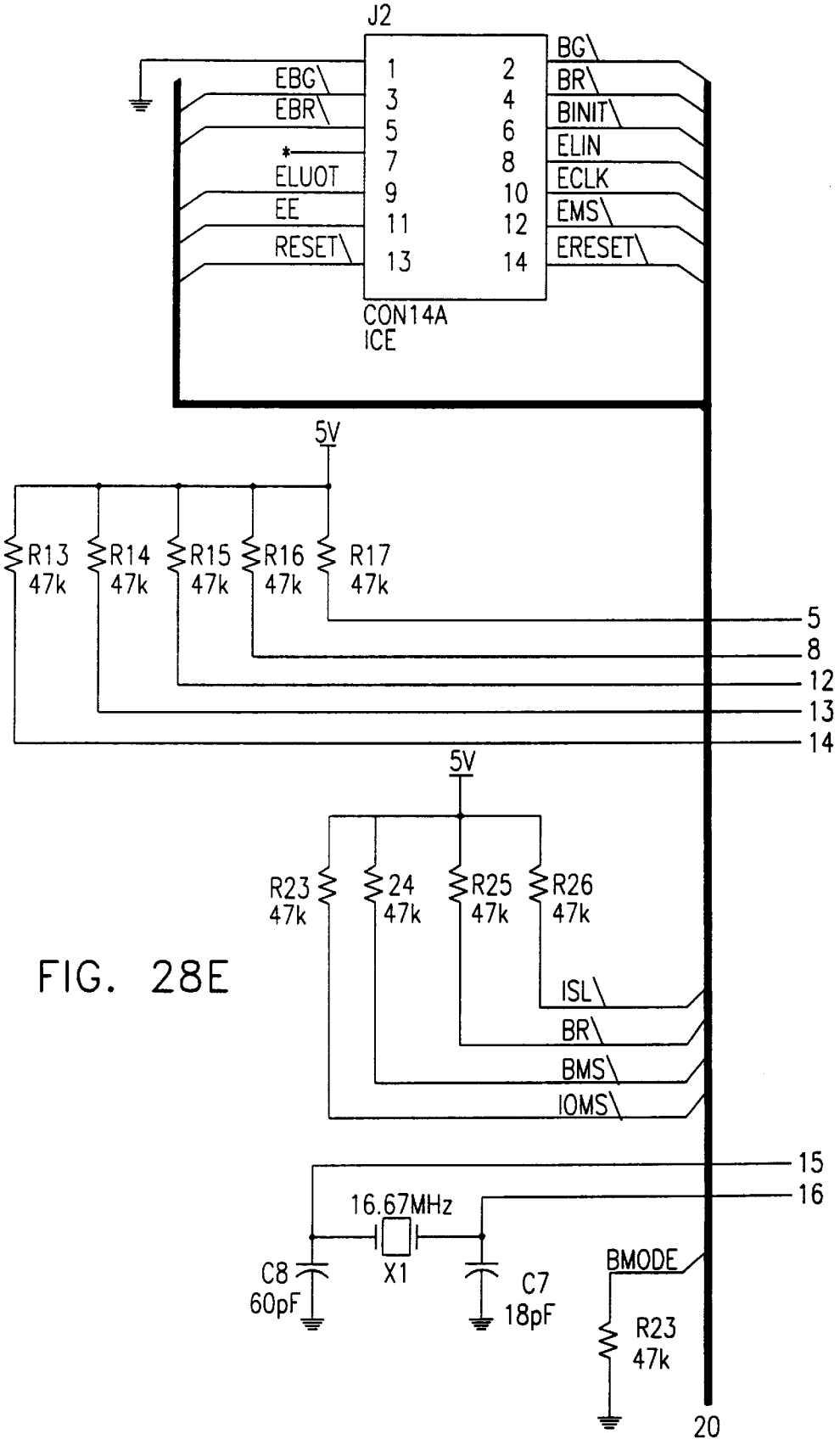
Figure 28F:
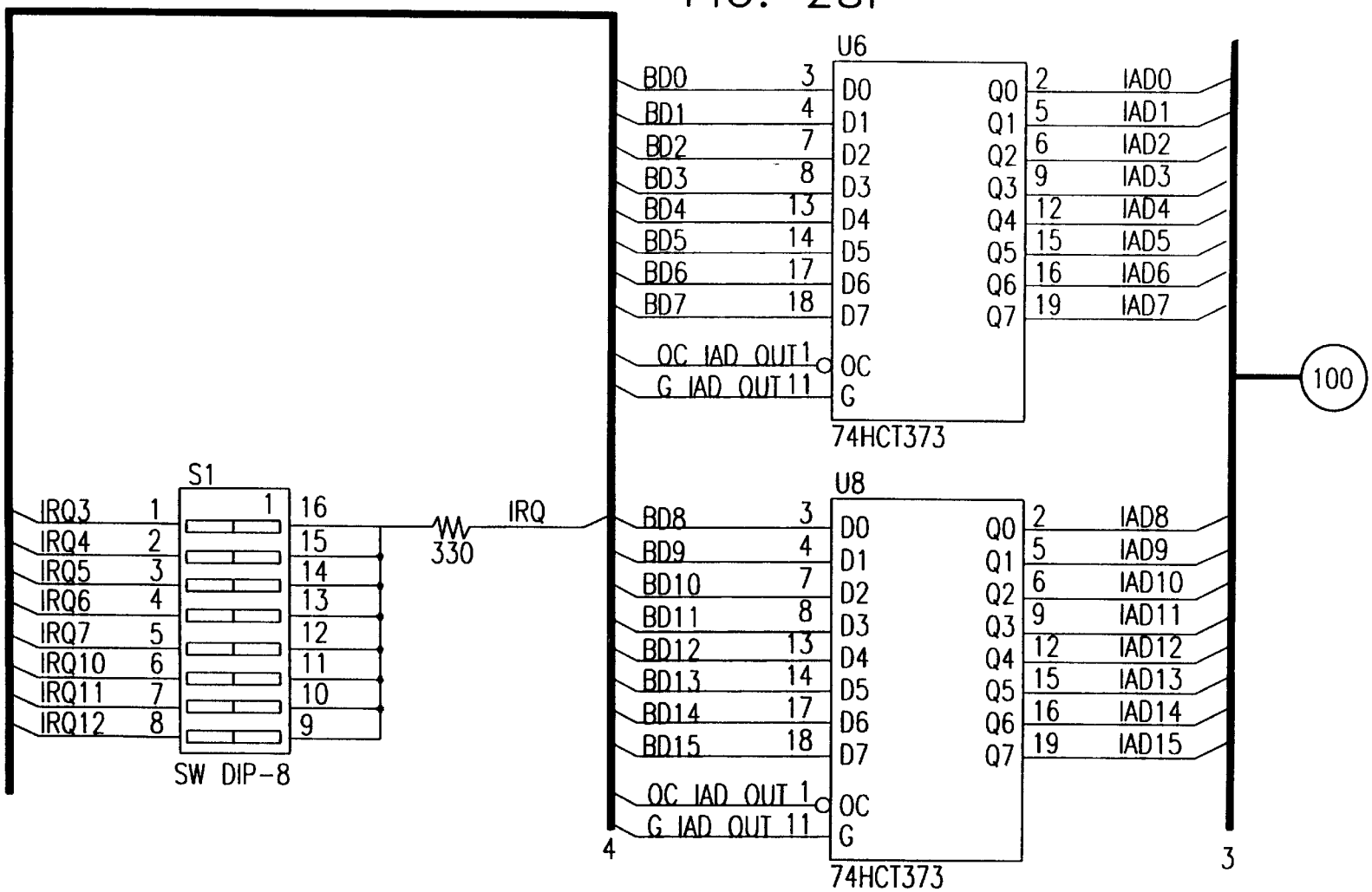
Figure 28G:
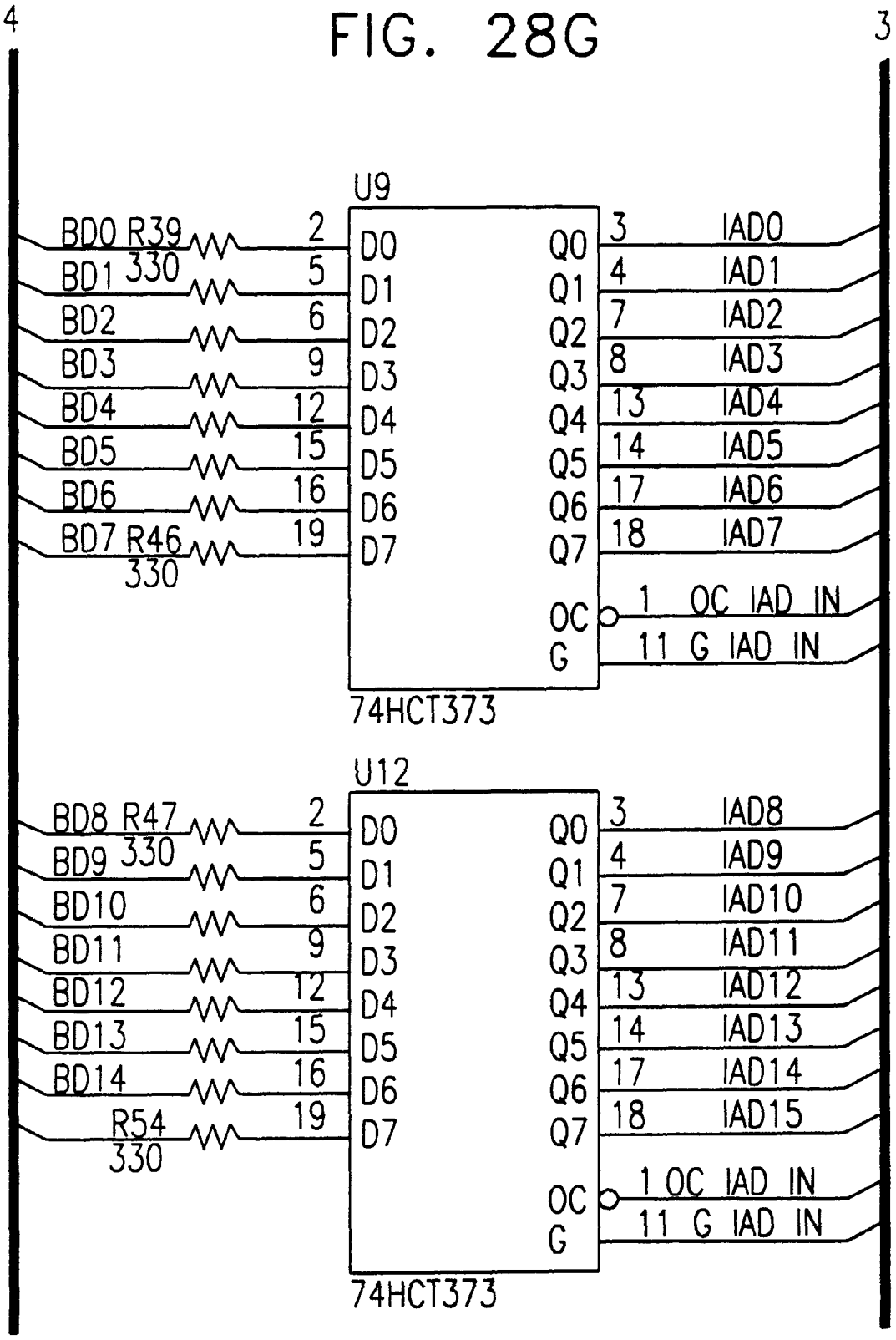
Figure 28H:
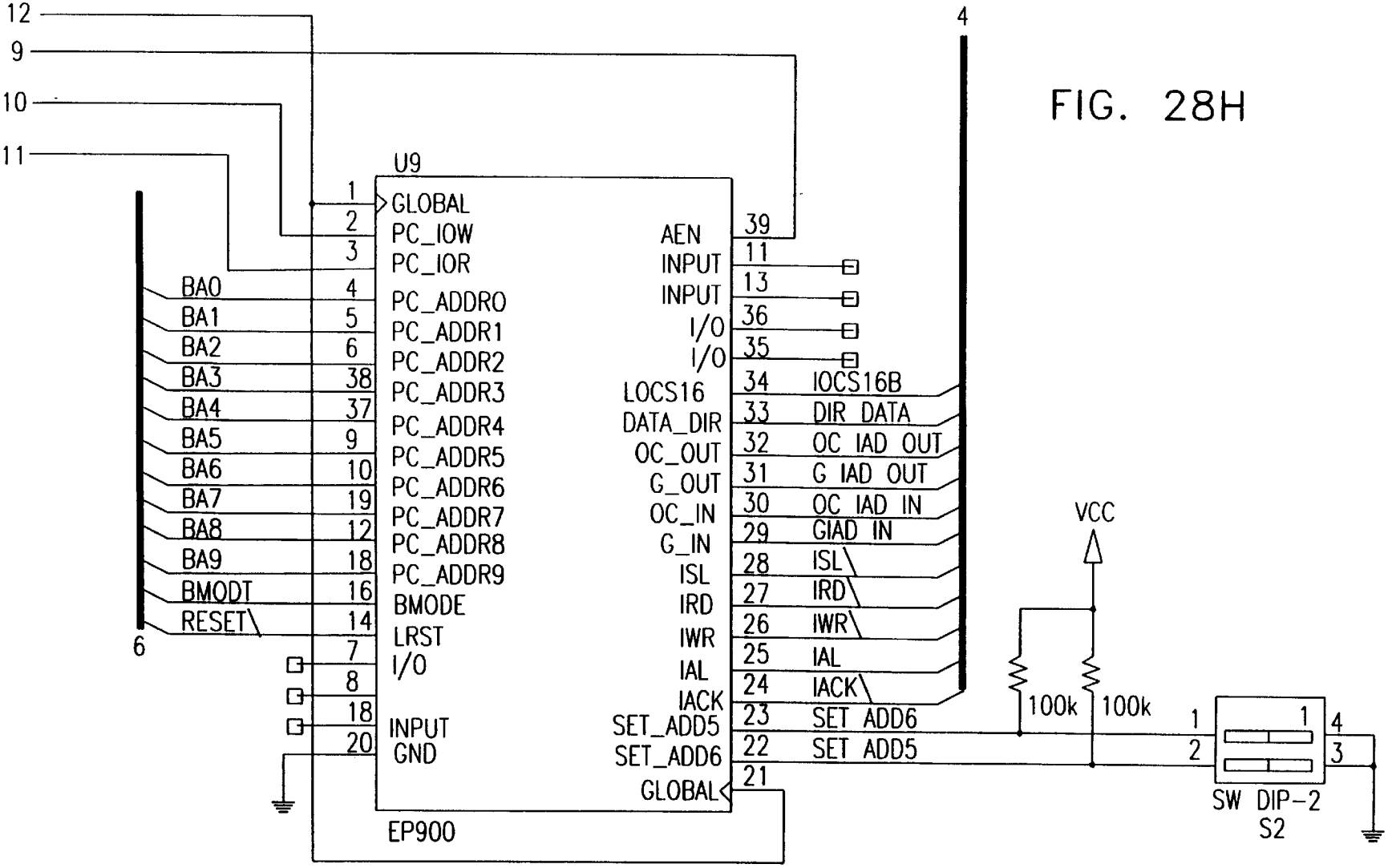
Figure 28I:
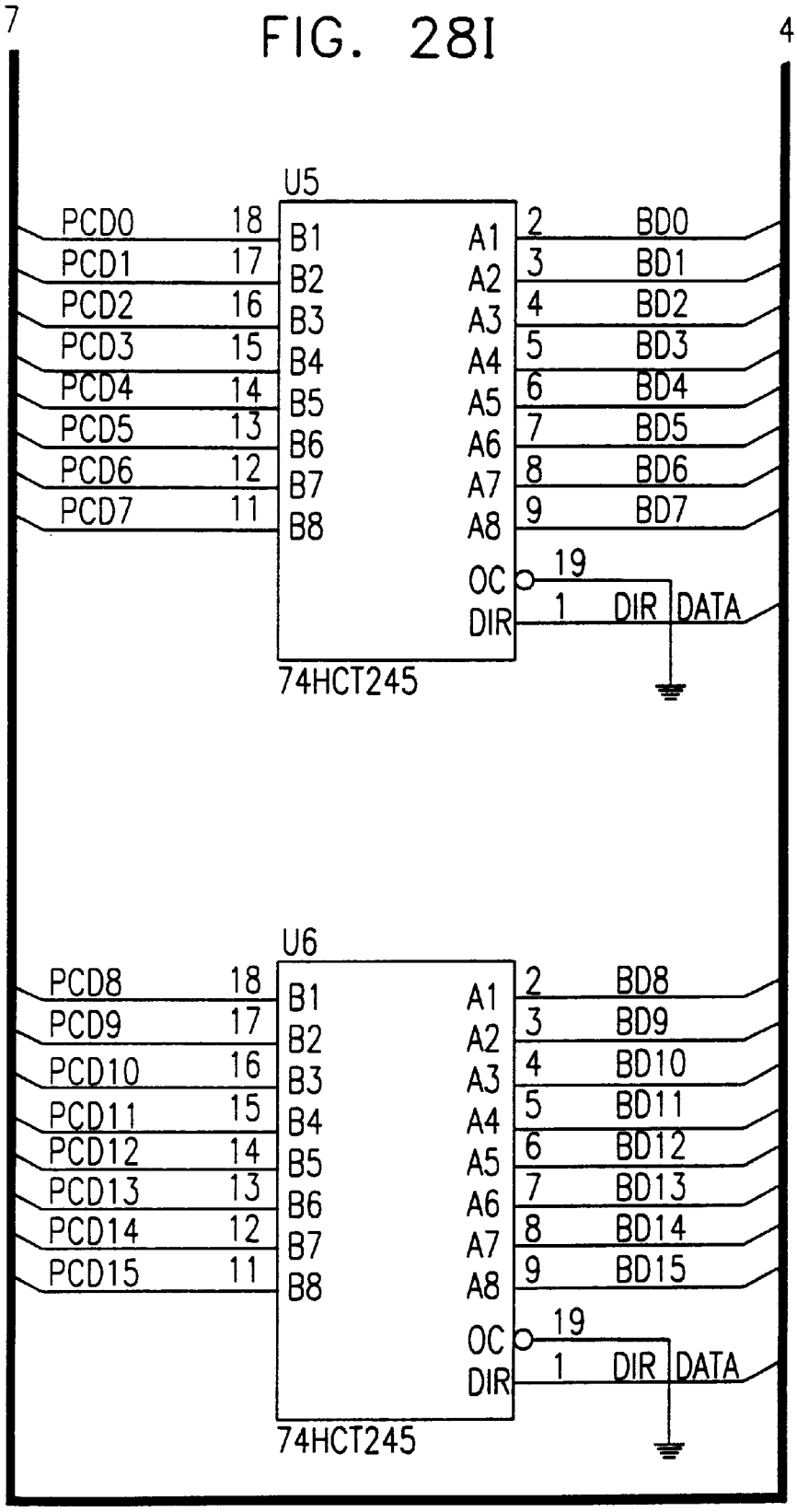
Figure 28J:
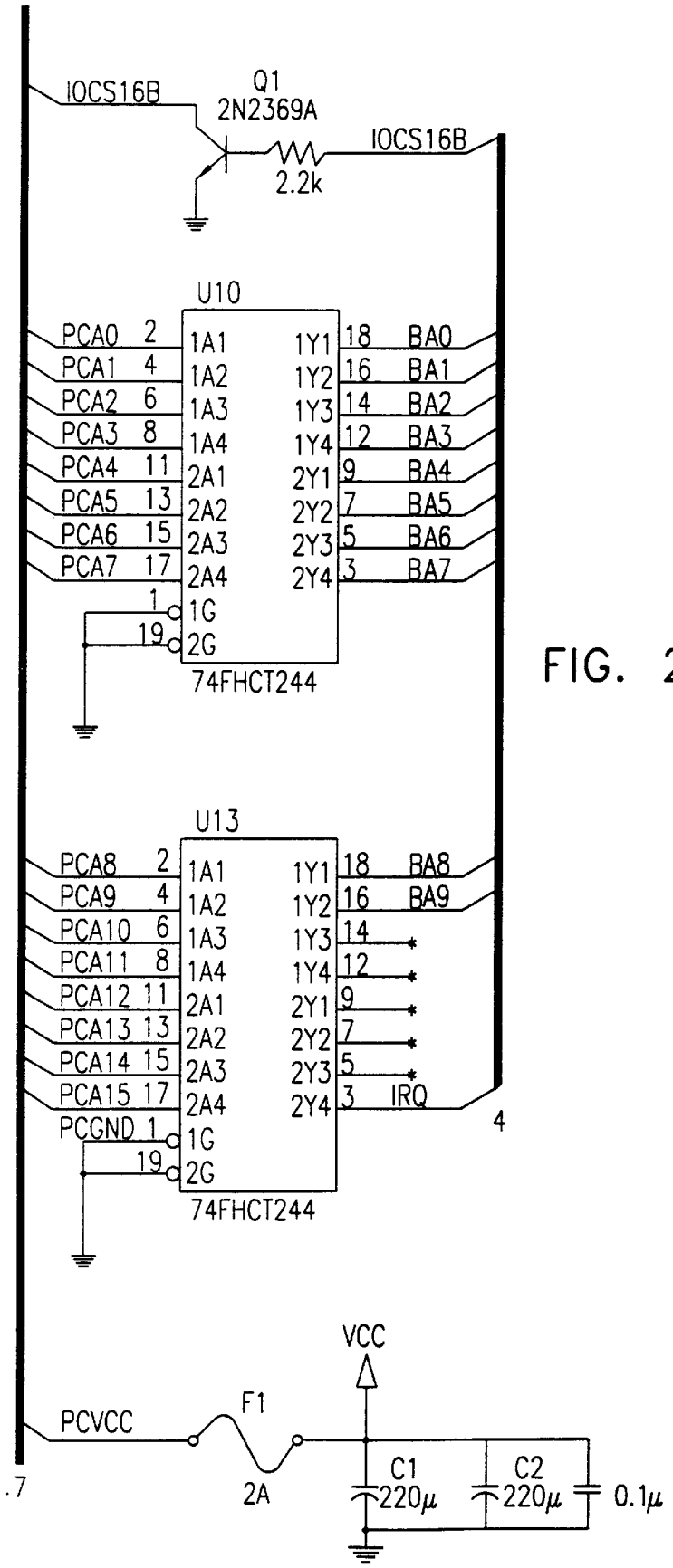
Figure 28K:
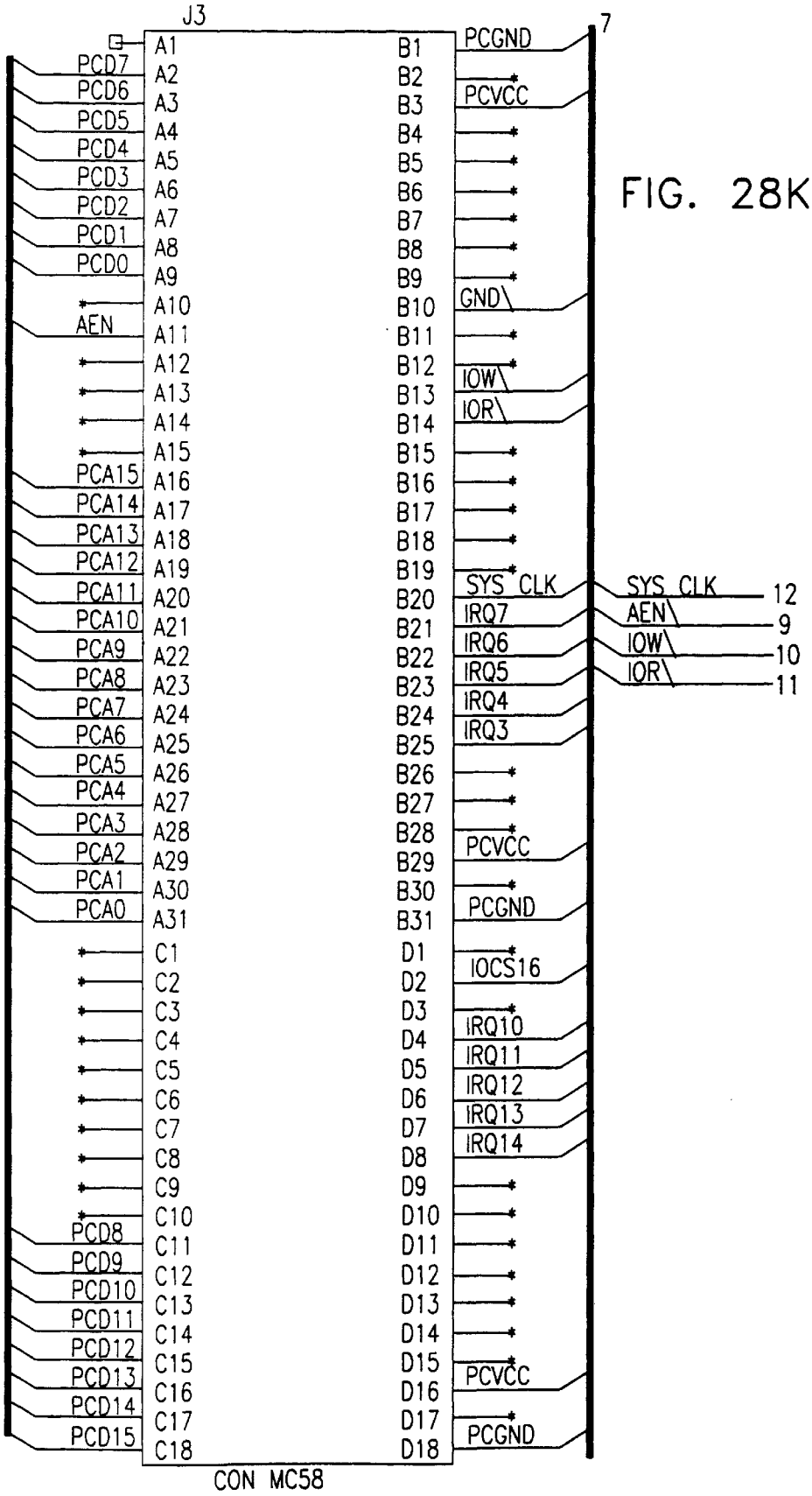
Figure 29A:
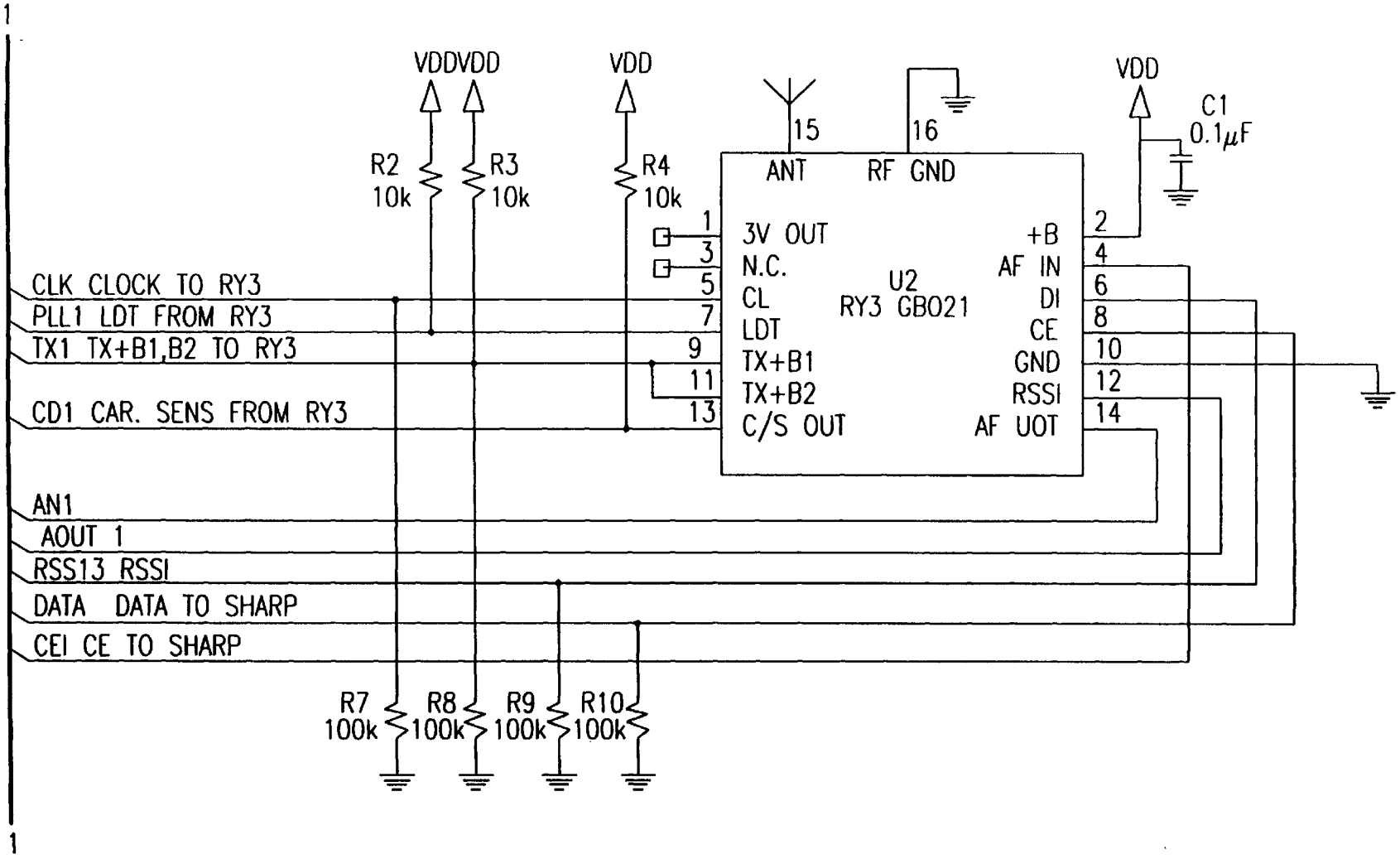
FIGS. 29A–29I, taken together, form a detailed electronic schematic diagram of the multi-port multi-channel computer radio interface sub-unit of FIG. 14.
Figure 29B:
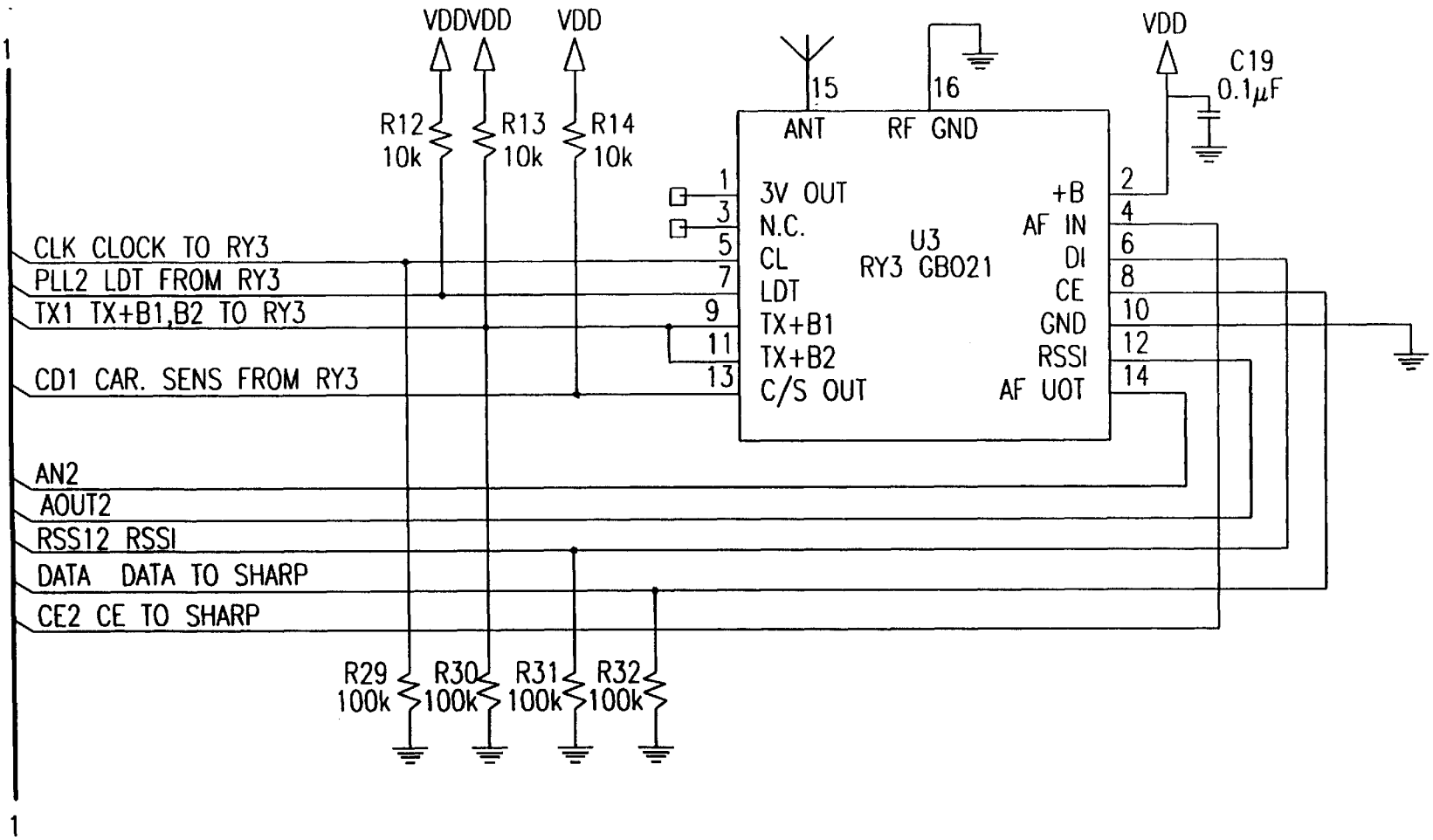
Figure 29C:
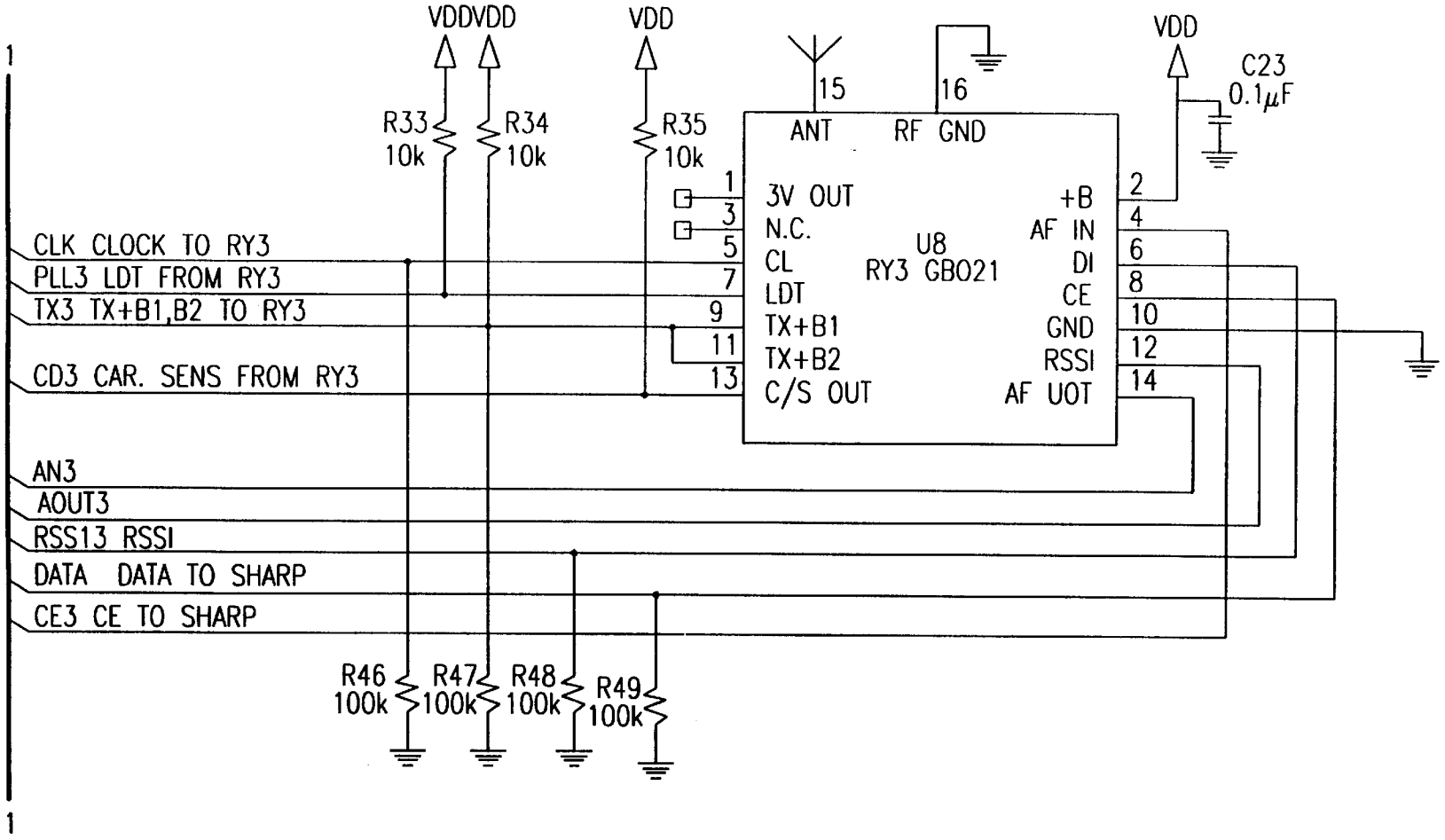
Figure 29D:
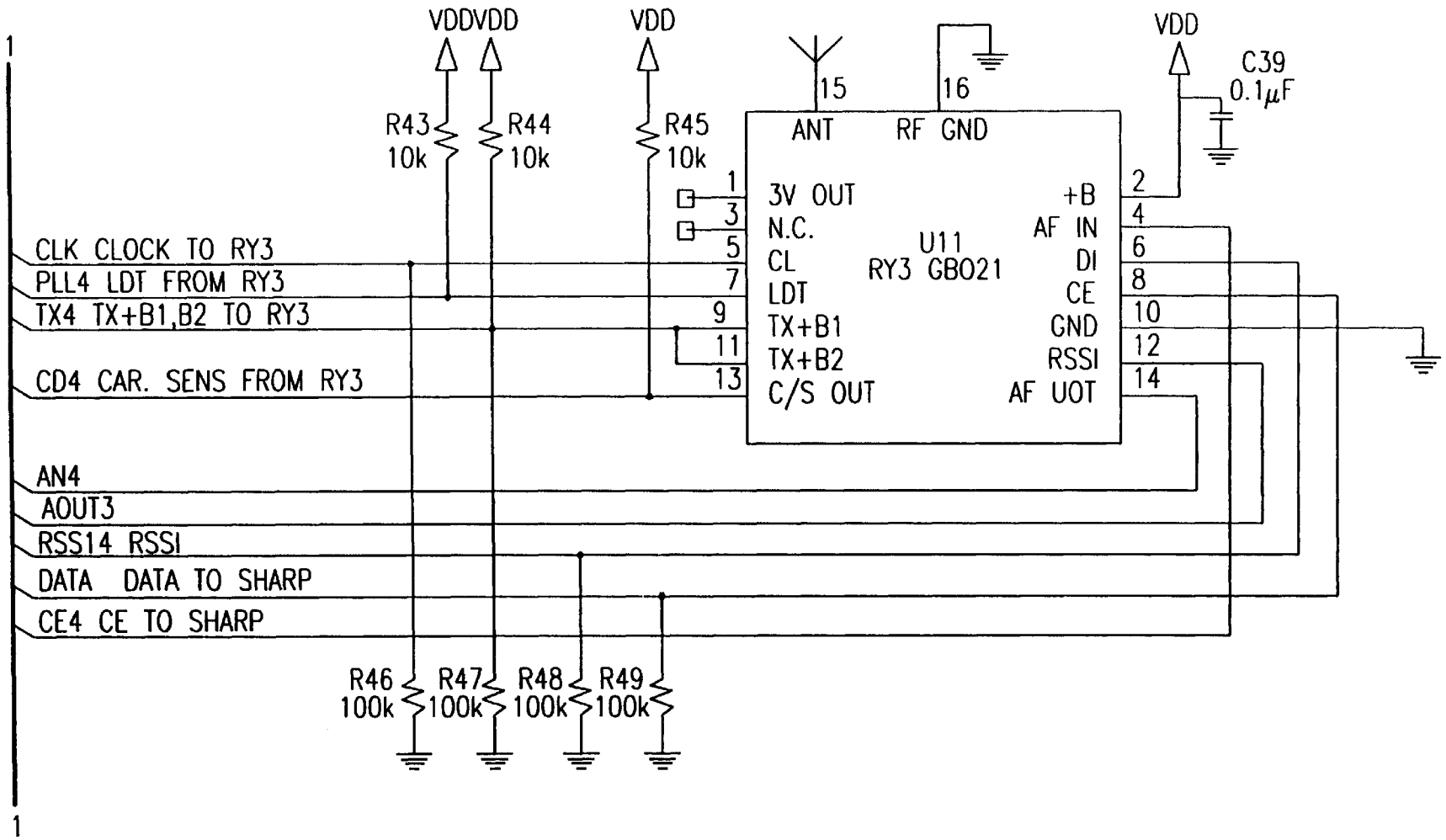
Figure 29E:
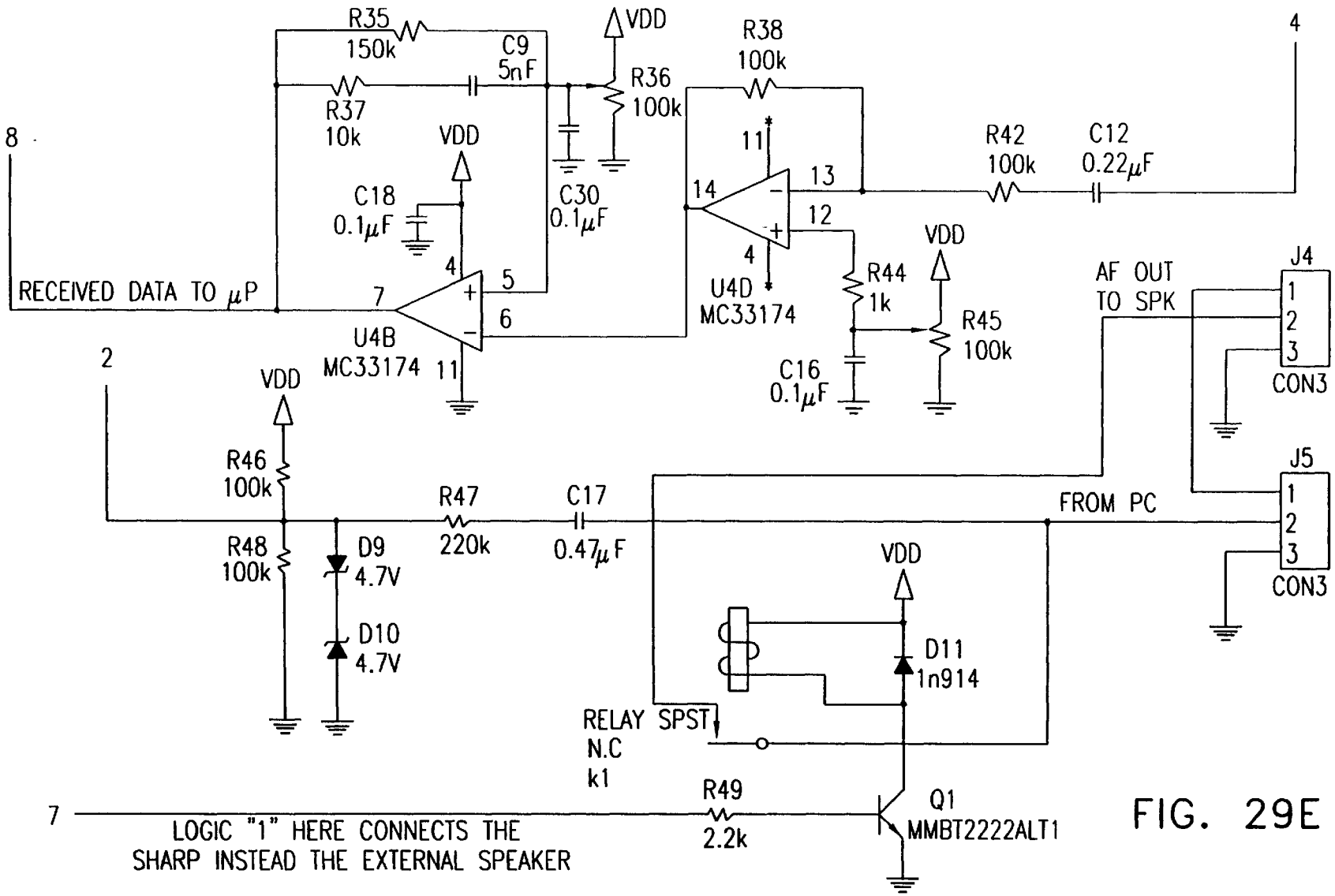
Figure 29F:
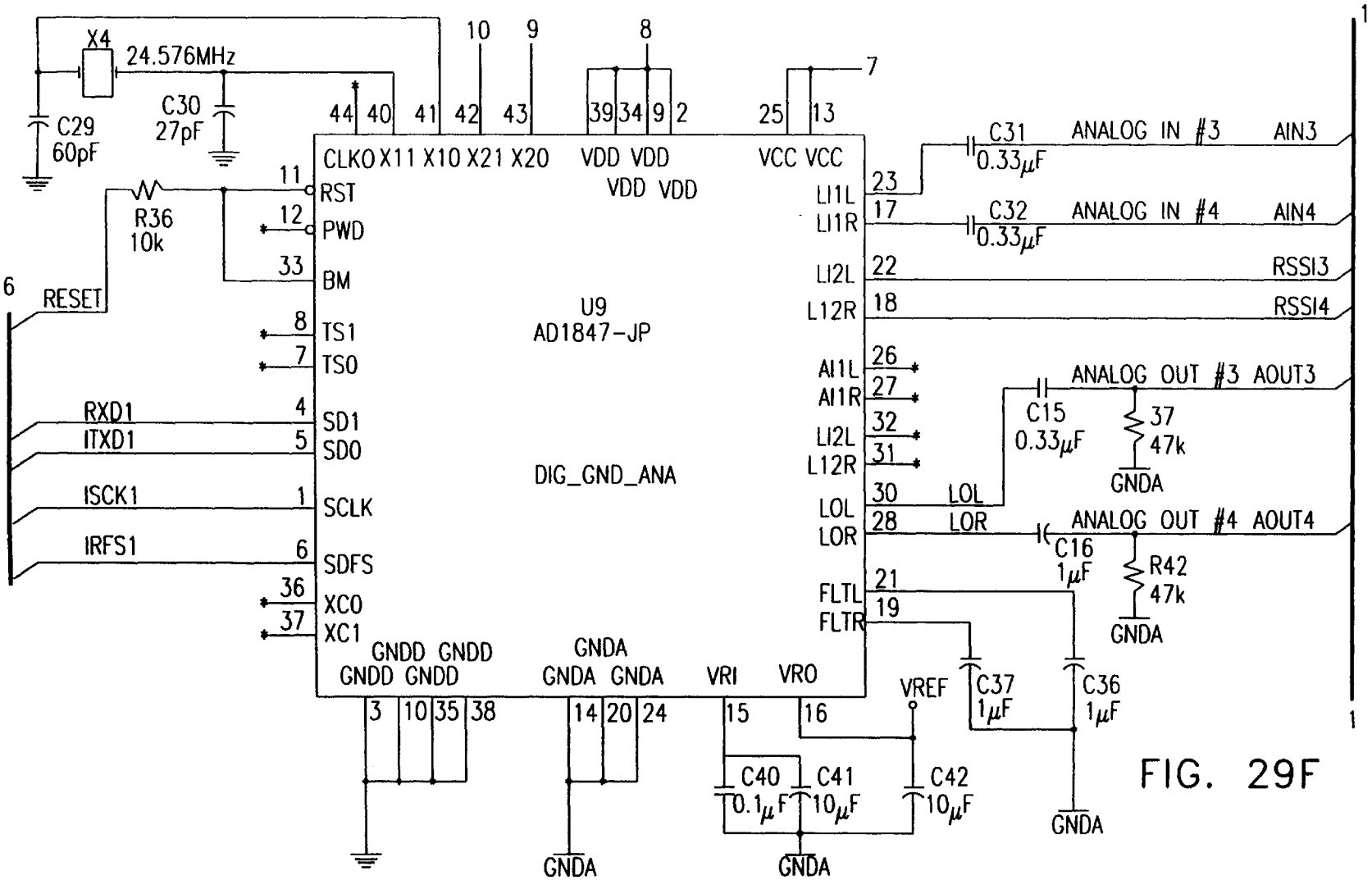
Figure 29G:
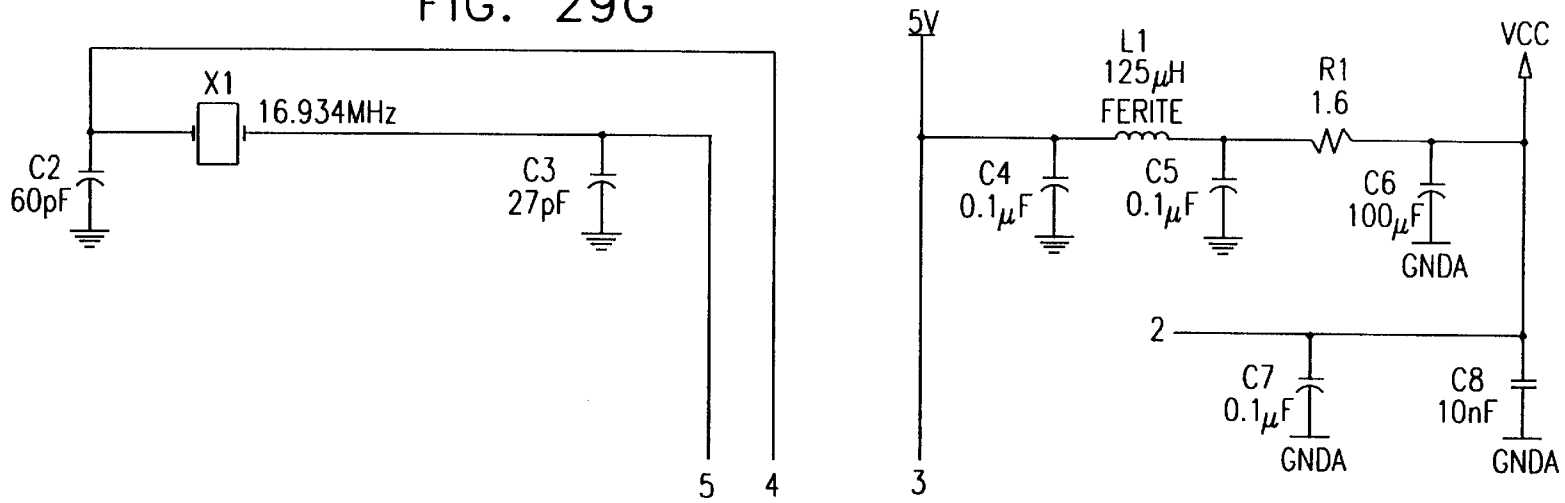
Figure 29H:
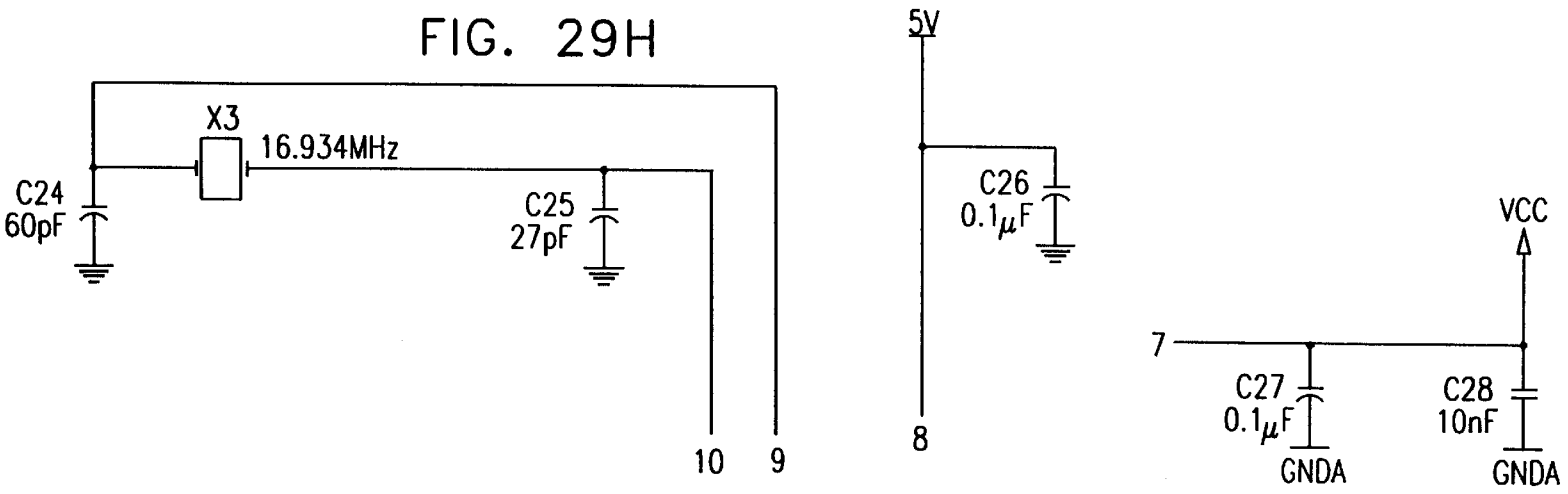
Figure 29I:
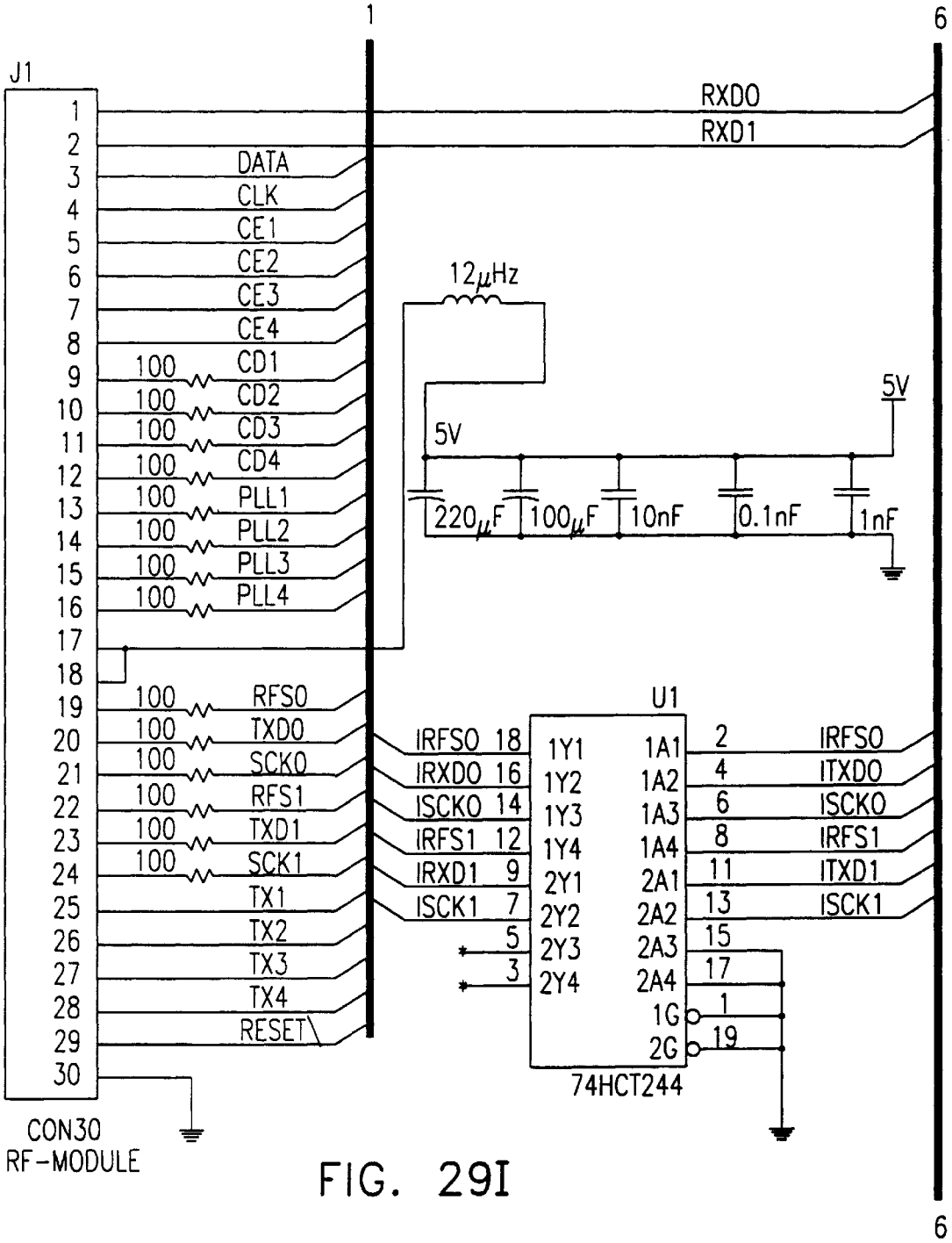
Figure 32A:
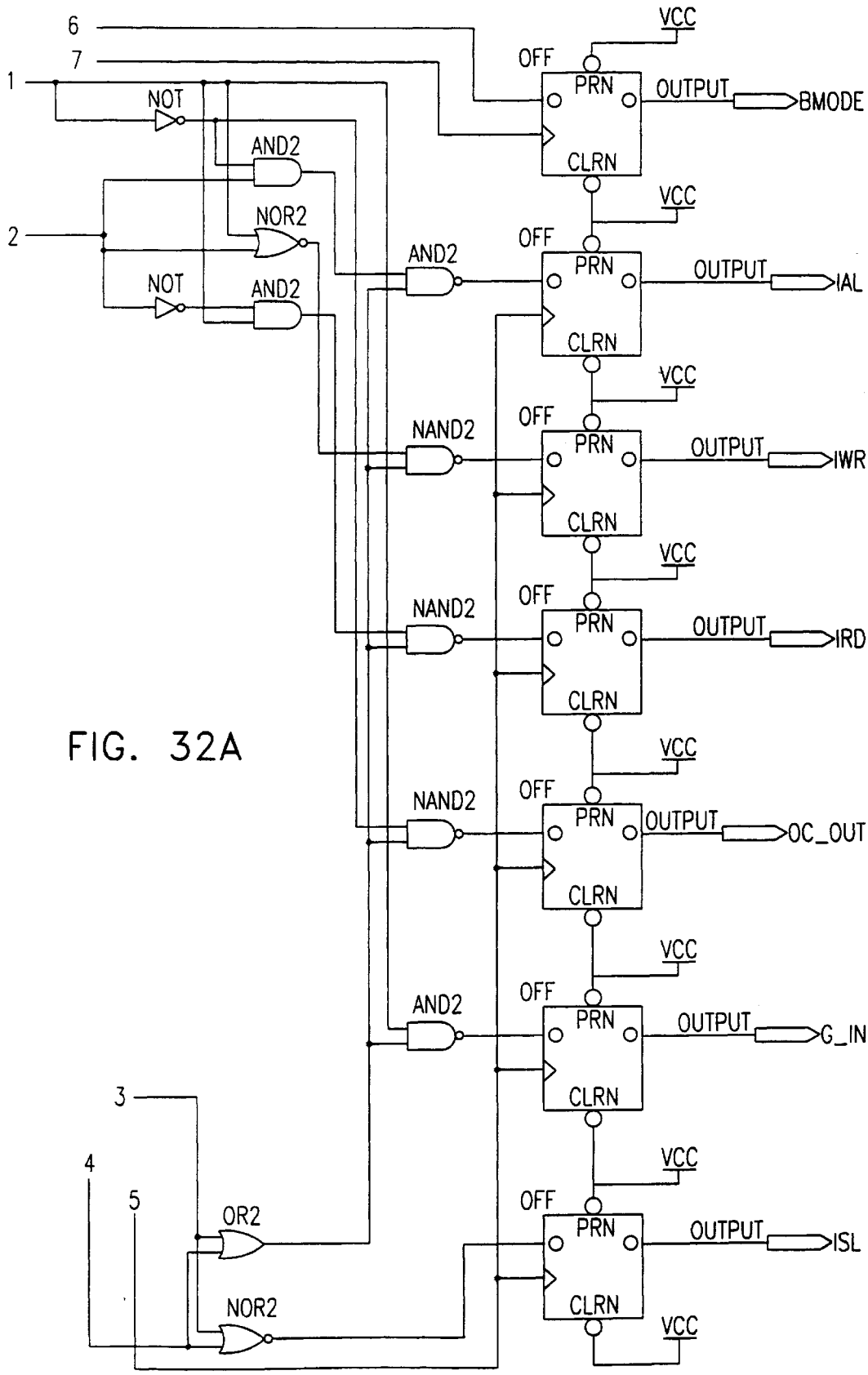
Figure 32B:
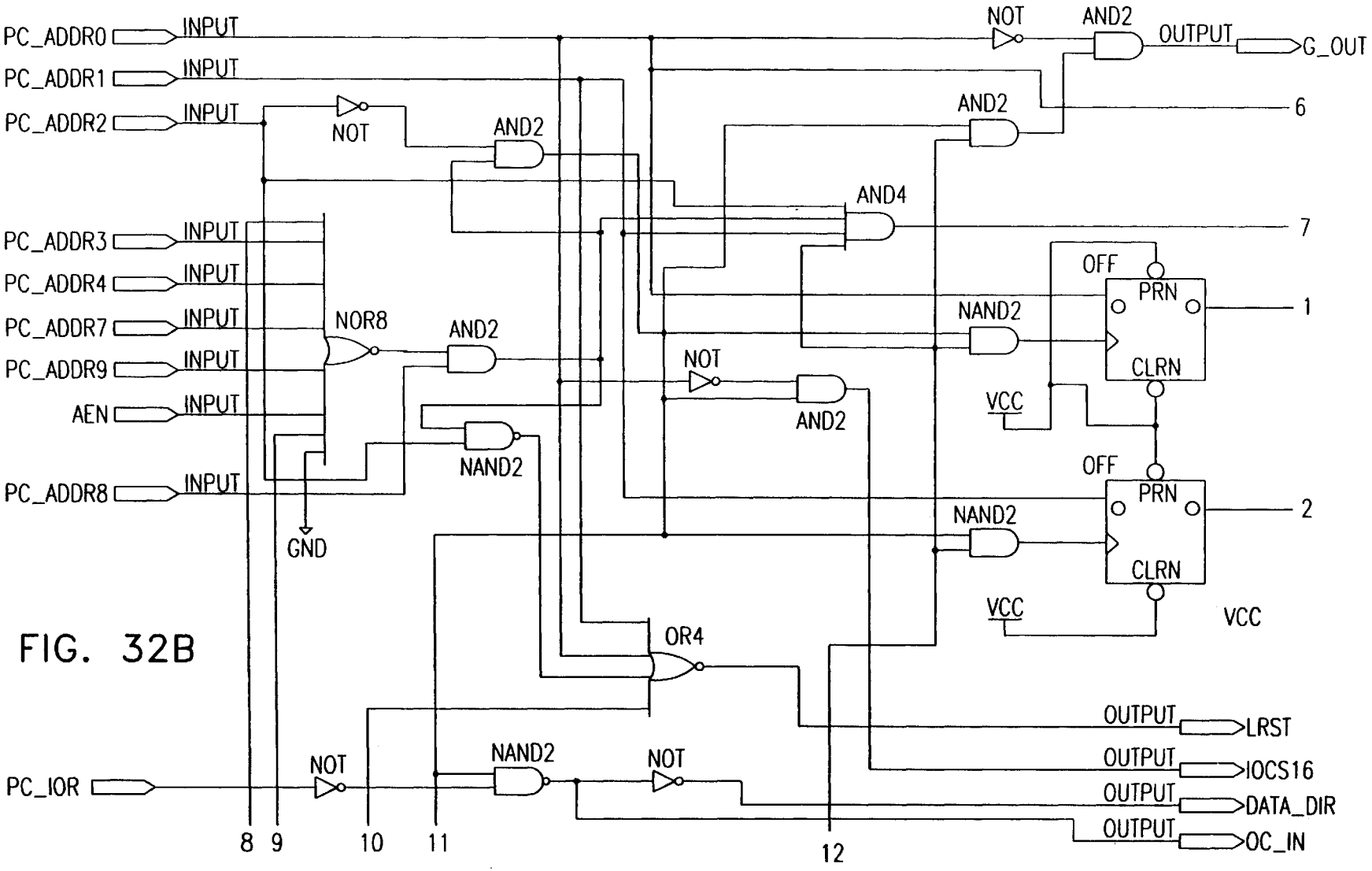

FIGS. 32A, 32B and 32C taken together form a simplified schematic diagram of the EP900 EPLD chip (U9) of FIG. 28H. The code to program the EPLD chip for this schematic diagram preferably uses the programming package "Max Plus II Ver. 6.2" available from Altera Corporation, 3525 Monroe Street, Santa Clara, Calif. 5051, USA.

FIGS. 33–62, described hereinbelow, illustrate embodiments of the toy system of FIGS. 1–32C.

Figure 33A:
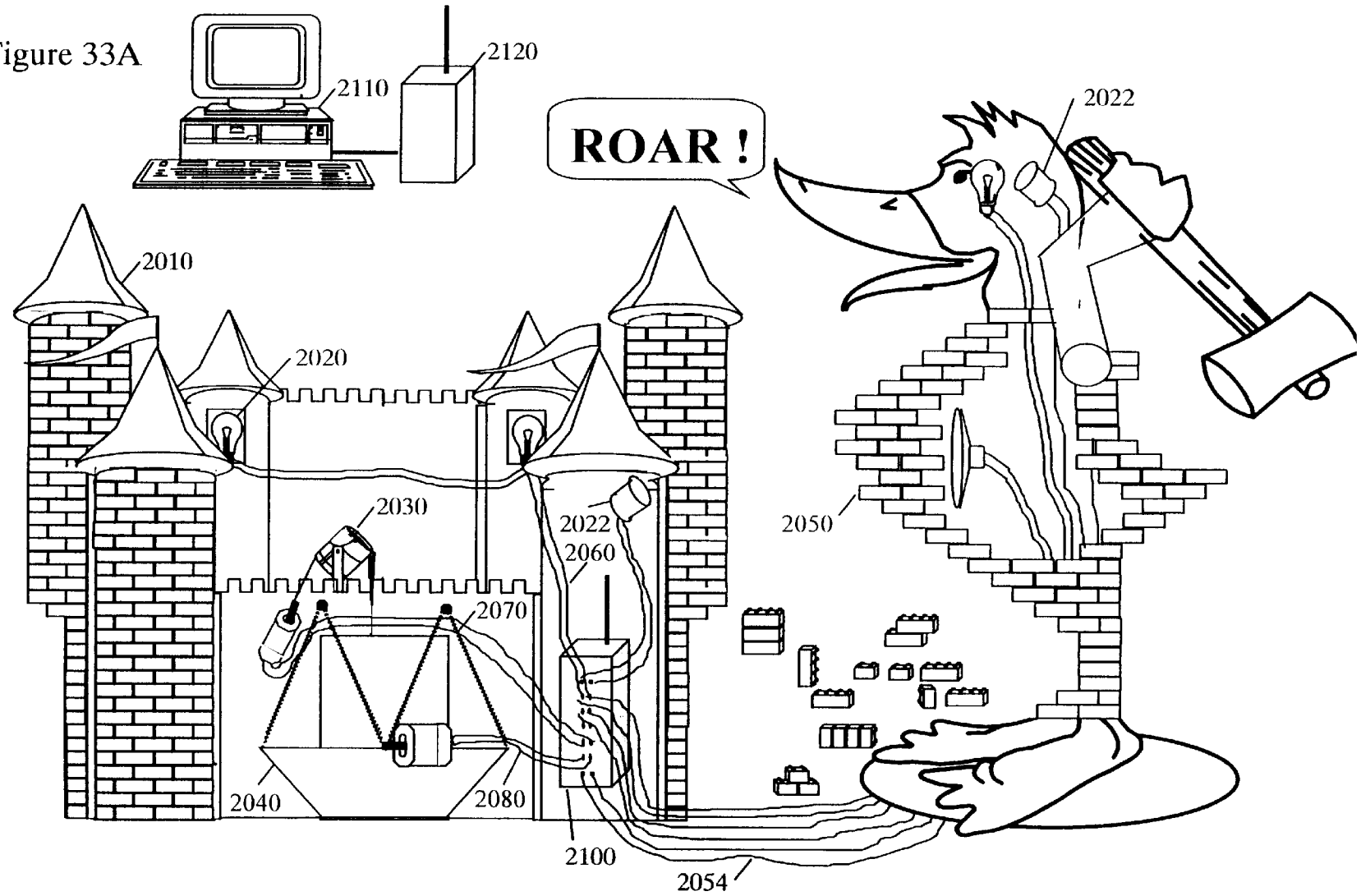
FIG. 33A is a pictorial illustration of a programmable assembly toy in assembled form including several player selectable structures, the assembly toy being constructed and operative in accordance with a preferred embodiment of the present invention.
Figure 35:
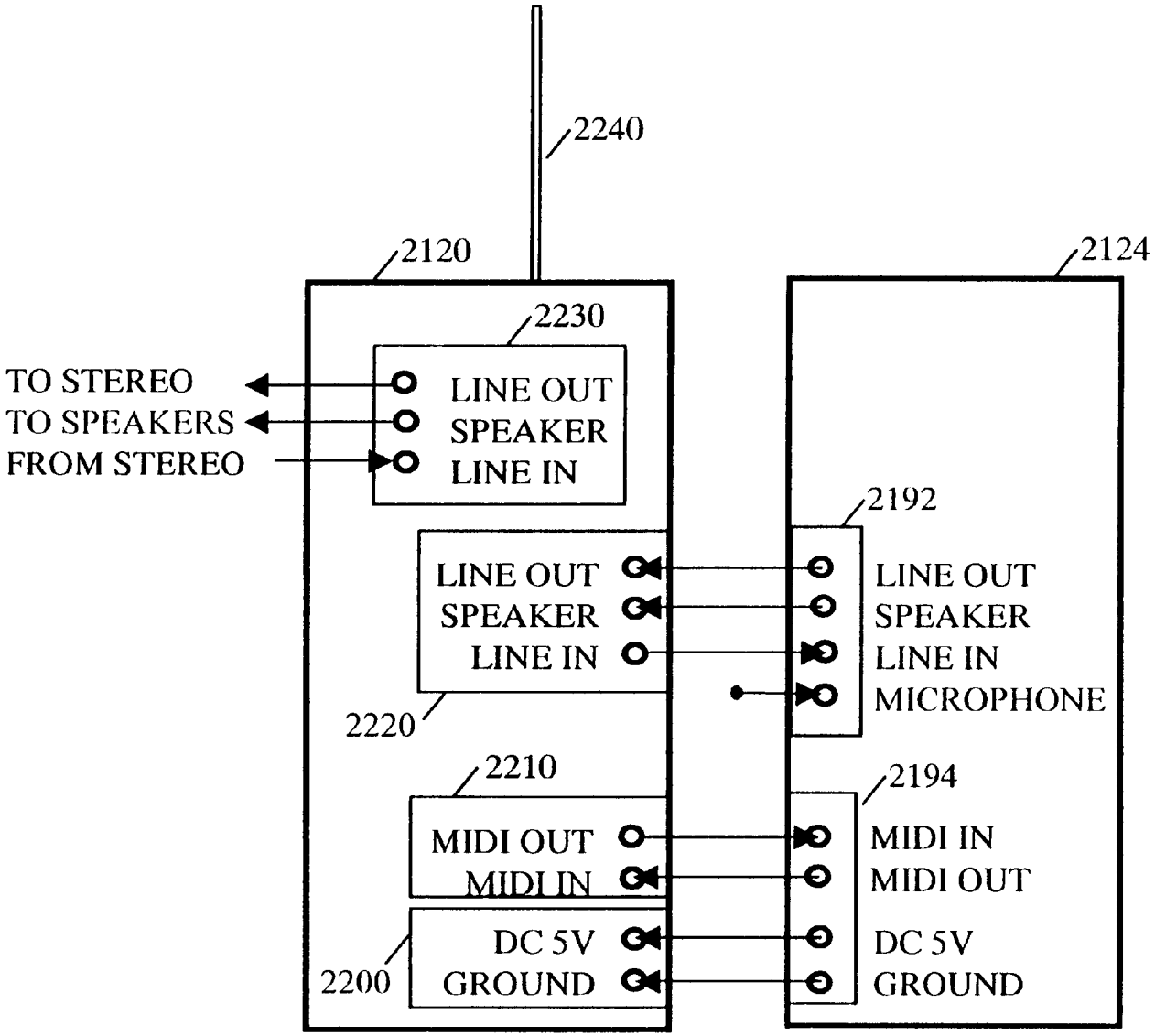

Reference is now made to FIG. 33A which is a pictorial illustration of a programmable assembly toy in assembled form including several player selectable structures such as a castle 2010, lamps 2020, a spillable bucket 2030, a drawbridge 2040, and a roaring giant duck 2050 attacking the castle which is associated via wires 2054 with the castle. The player selectable structures 2020, 2030, and 2040 are each associated via a wire 2060, 2070, and 2080 respectively with a player programmable control system including a transceiver/controller 2100 wirelessly associated with a computer 2110 via a computer radio interface unit 2120 associated with sound card 2124 of the computer (FIG. 35).

Figure 33B:
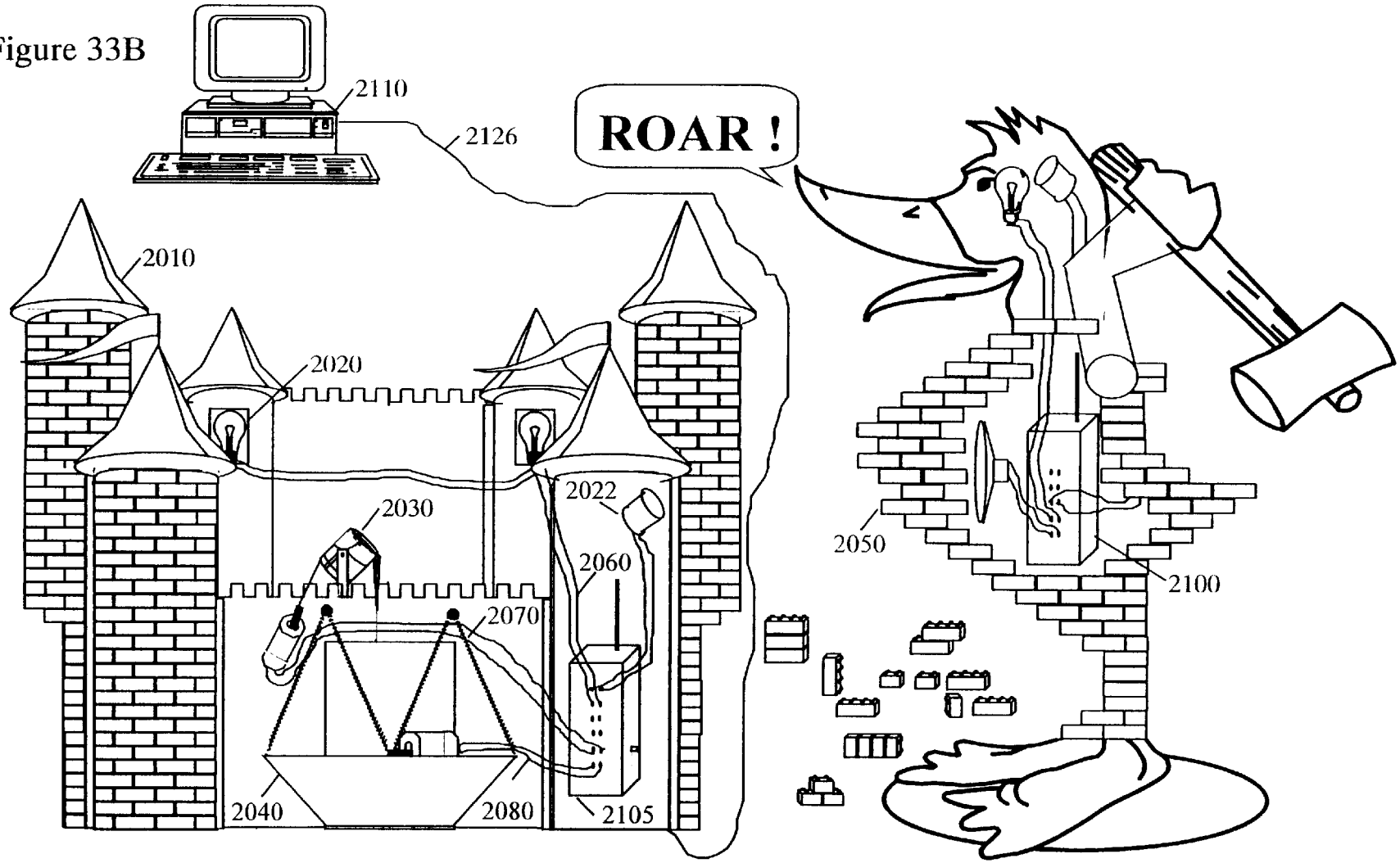
FIG. 33B is a pictorial illustration of a variation of the apparatus of FIG. 33A in which a generally stationary player selectable structure is associated by means of wires with a computer and player selectable structures which are apt to be moved by the child are wirelessly associated with one of the generally stationary player selectable structures.

Reference is made to FIG. 33B which is a pictorial illustration of a variation of the apparatus of FIG. 33A in which the castle 2010, which is a generally stationary player selectable structure, is associated by means of wires 2126 with the computer 2110 and player selectable structures which are apt to be moved by the player, such as the roaring duck 2050, are wirelessly associated with one of the generally stationary player selectable structures such as the castle 2010, via wireless communication between transceiver/controller 2100 and a computer radio interface/controller 2105. In this embodiment, the castle 2010 is equipped with the computer radio interface/controller 2105 which is a combination of the computer radio interface unit 2120 and the transceiver/controller 2100, both of FIG. 33A.

Figure 56:
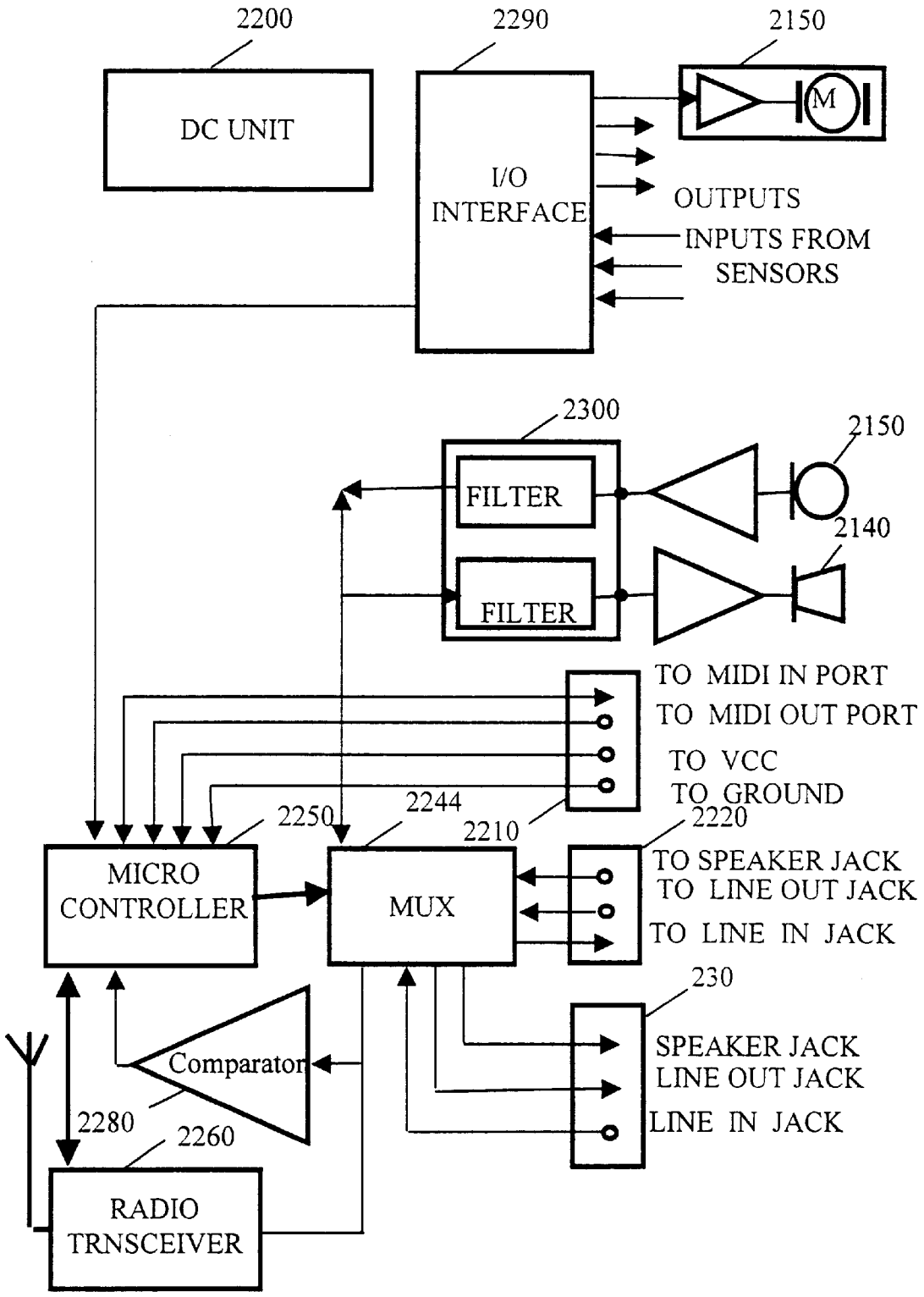

A preferred embodiment of the computer radio interface controller 2105 of FIG. 33B is illustrated in FIG. 56. The programmable assembly toy illustrated in FIGS. 33A and 33B preferably also includes a microphone 2022.

Figure 34:
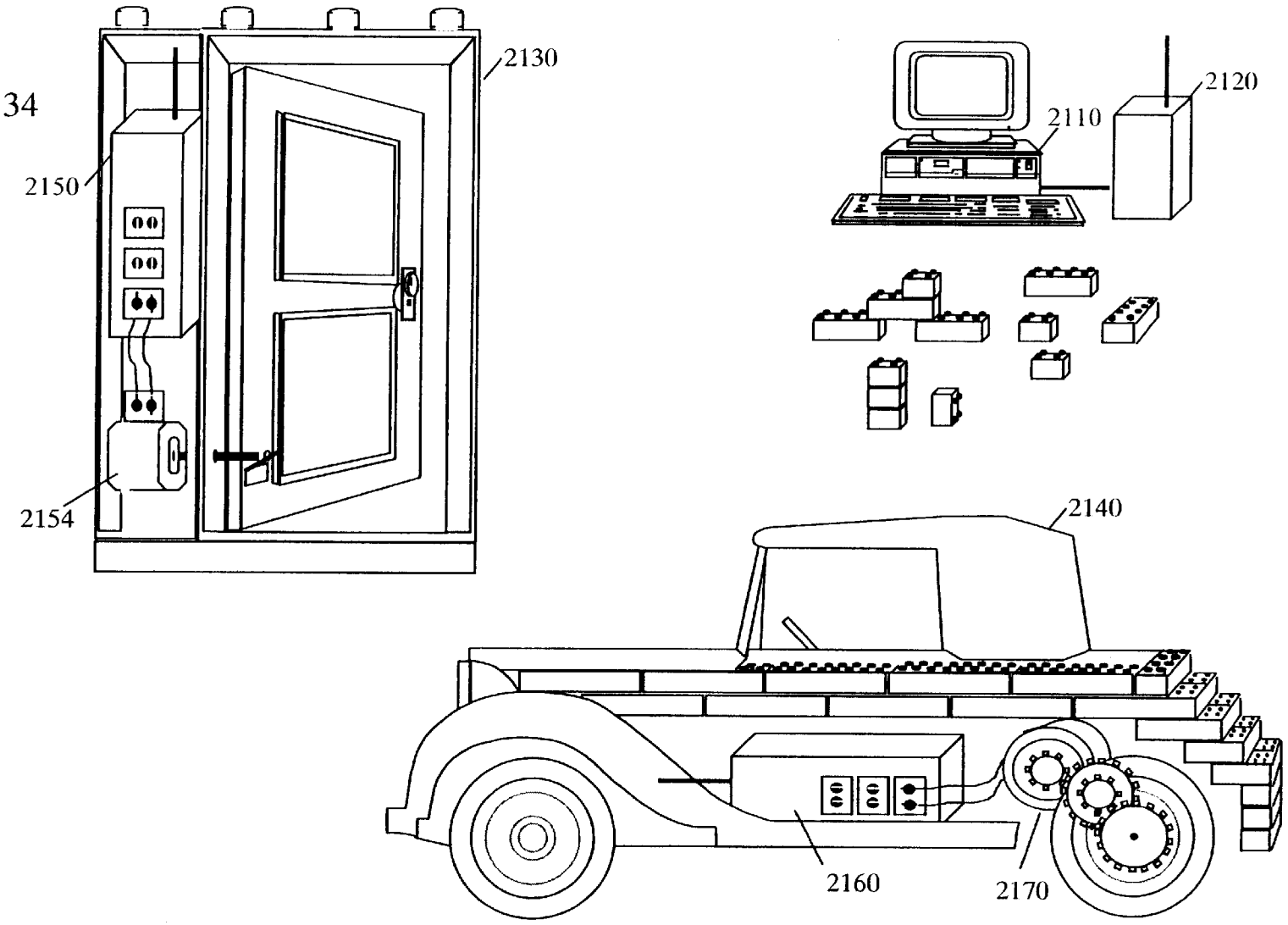

FIG. 34 is a pictorial illustration of a programmable assembly toy in assembled form which is a variation of the apparatus of FIGS. 33A–33B. The assembly toy of FIG. 34 includes several player selectable structures such as an opening door 2130 unit (not to scale) and a vehicle 2140 wirelessly associated with the computer 2110 via transceiver/controllers 2150 and 2160 respectively. The transceiver/controller 2150, in the illustrated embodiment, is integrally formed with a solenoid 2154. In contrast, the transceiver/controller 2160 is a modular unit not associated with an actuator. The transceiver/controller 2160 is fixedly associated with motor 2170 by means of conventional interlocking parts (not shown).

Reference is now made to FIG. 35 which is a simplified interface diagram of a preferred embodiment of the computer radio interface 2120 of FIGS. 33A–33B in conjunction with a sound card 2124.

The computer radio interface 2120 comprises a DC unit 2200 which is fed with power through a MIDI interface 2210 from a sound card MIDI interface 2194, and the following interfaces: a MIDI interface 2210 which connects to the sound card MIDI interface 2194; an audio interface 2220 which connects to an audio interface 2192 of the sound card 2124; and a secondary audio interface 2230 which preferably connects to a stereo sound system for producing high quality sound under control of software running on the computer 2110 (not shown).

The apparatus of FIG. 35 also comprises an antenna 2240, which is operative to send and receive signals between the computer radio interface 2110 and one or more toy control devices, such as door unit 2130.

Figure 36:
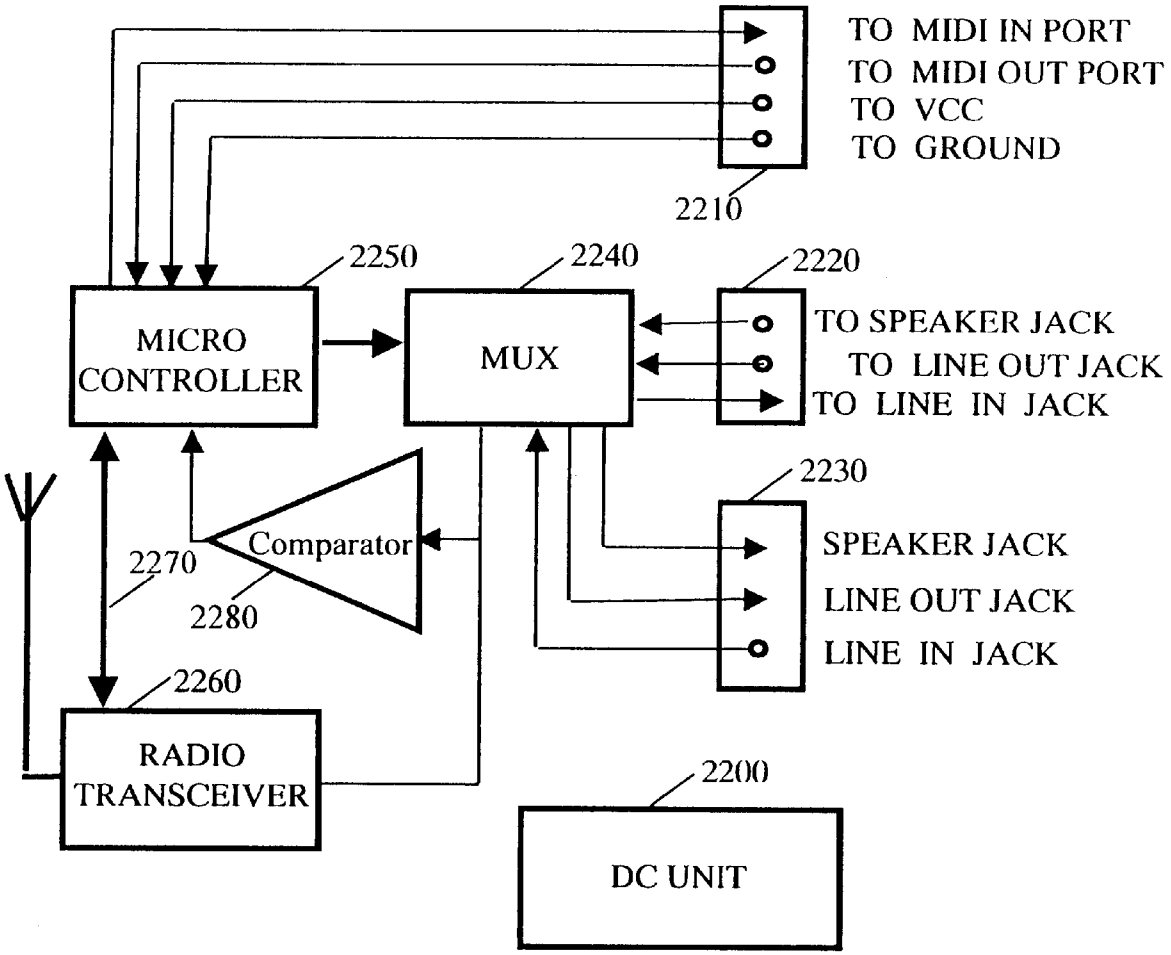

FIG. 36 is a simplified block diagram of the computer radio interface 2120 of FIG. 35. The apparatus of FIG. 36 comprises the DC unit 2200, the MIDI interface 2210, the audio interface 2220, and the secondary audio interface 2230. The apparatus of FIG. 36 also comprises a multiplexer 2240, a micro controller 2250, a radio transceiver 2260, a connecting bus 2270 connecting the radio transceiver 2260 to the micro controller 2250, and a comparator 2280.

Reference is now made to FIGS. 37A–37D, which taken together comprise a schematic diagram of the apparatus of FIG. 36.

Figure 37A:
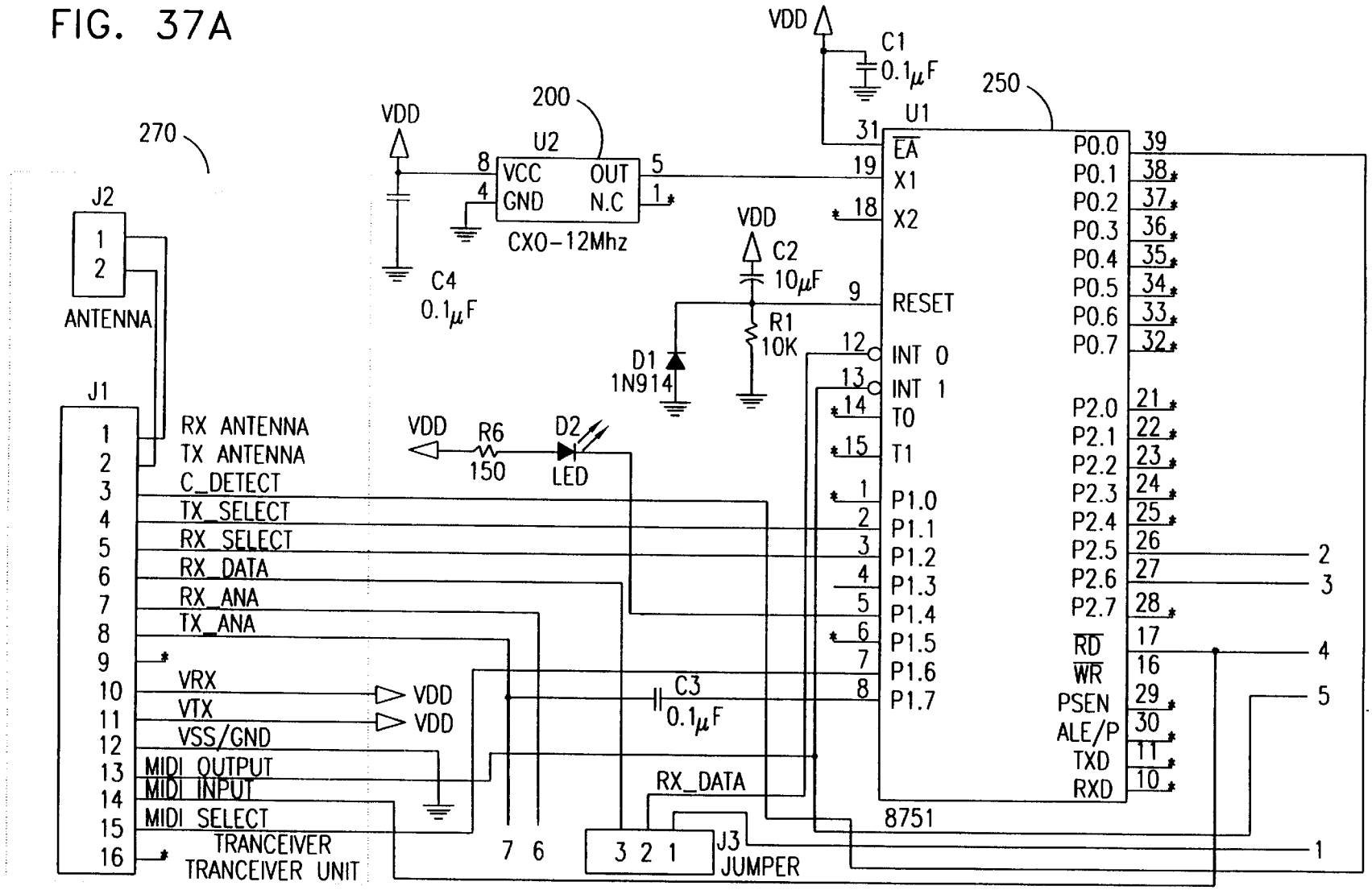
FIGS. 37A–37D, taken together, comprise a schematic diagram of the apparatus of FIG. 36.
Figure 37B:
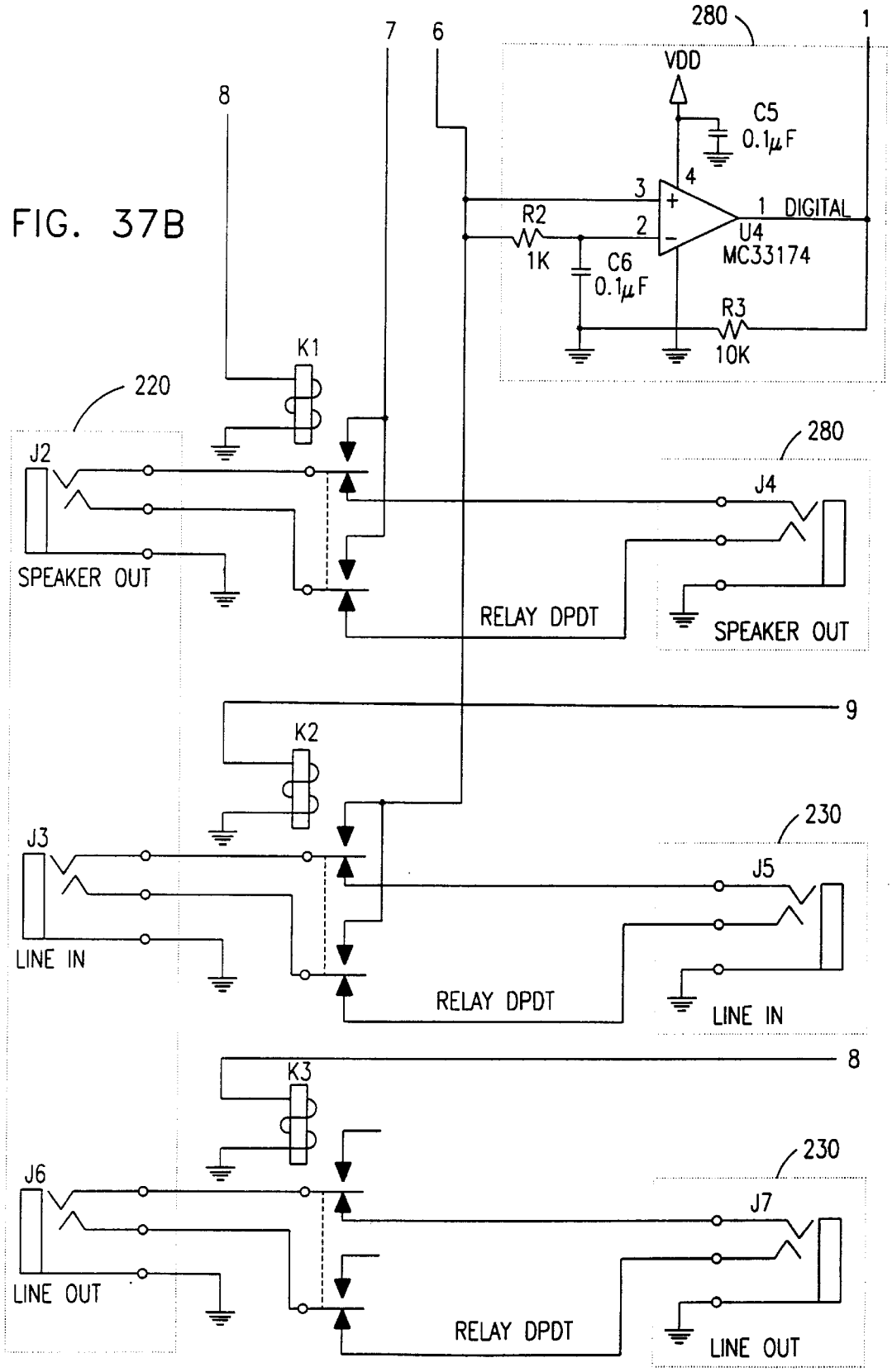
Figure 37C:
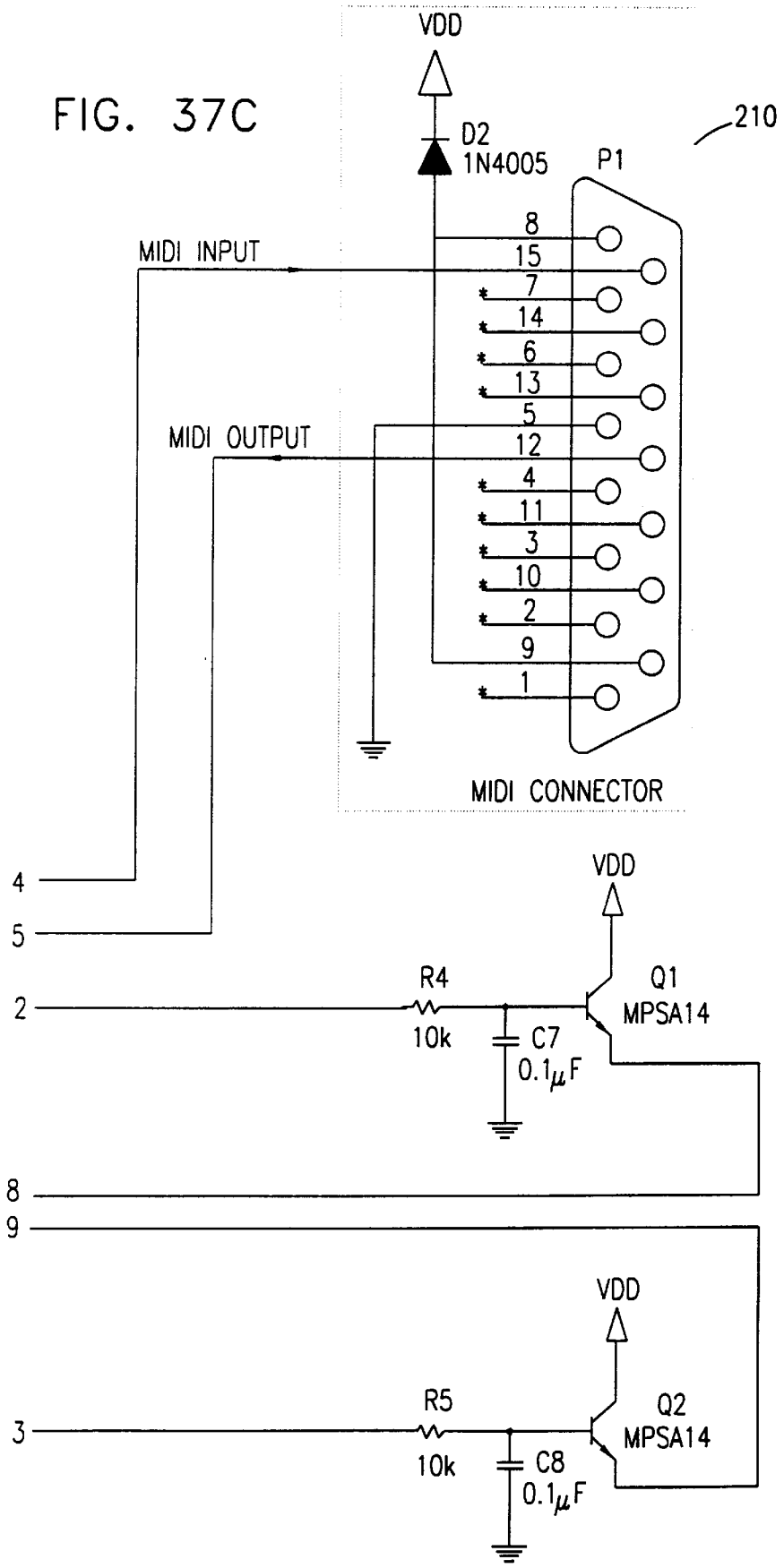

The following is a preferred parts list for the apparatus of FIGS. 37A–37C:

1. K1 Relay Dept, Idec, 1213 Elco Drive, Sunnyvale, Calif. 94089-2211, USA.

2. U1 8751 microcontroller, Intel Corporation, San Tomas 4, 2700 Sun Tomas Expressway, 2nd Floor, Santa Clara 95051, Calif. USA.

3. U2 CXO-12 MHZ (crystal oscillator), Raltron, 2315 N.W. 107th Avenue, Miami, Fla. 33172, USA.

4. U4 MC33174, Motorola, Phoenix, Ariz. USA., Tel. No. (602)897-5056.

5. Diodes 1N914, Motorola, Phoenix, Ariz., USA. Tel. No. (602)897-5056.

6. Transistors 2N3906 and MPSA14, Motorola, Phoenix, Ariz., USA. Tel. No. (602)897-5056.

Figure 37D:
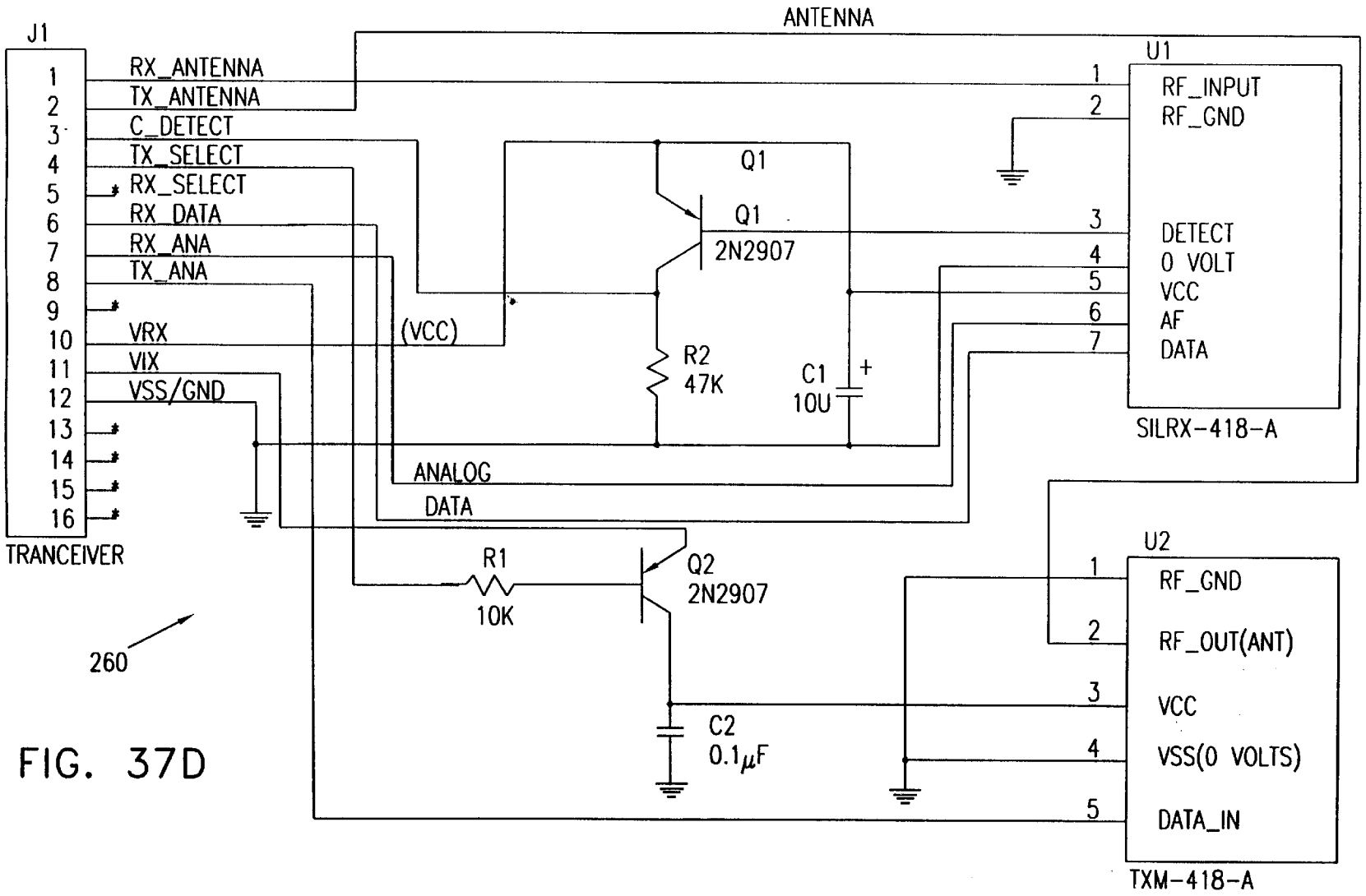

The following is a preferred parts list for the apparatus of FIG. 37D:

1. U1 SILRAX-418-A UFH radio telemetry receive module, Ginsburg Electronic GmbH, Am Moosfeld 85, D-81829, Munchen, Germany.

2. U2 TXM-418-A low power UHF radio telemetry transmit module, Ginsburg Electronic GmbH, Am Moosfeld 85, D-81829, Munchen, Germany.

Figure 37E:
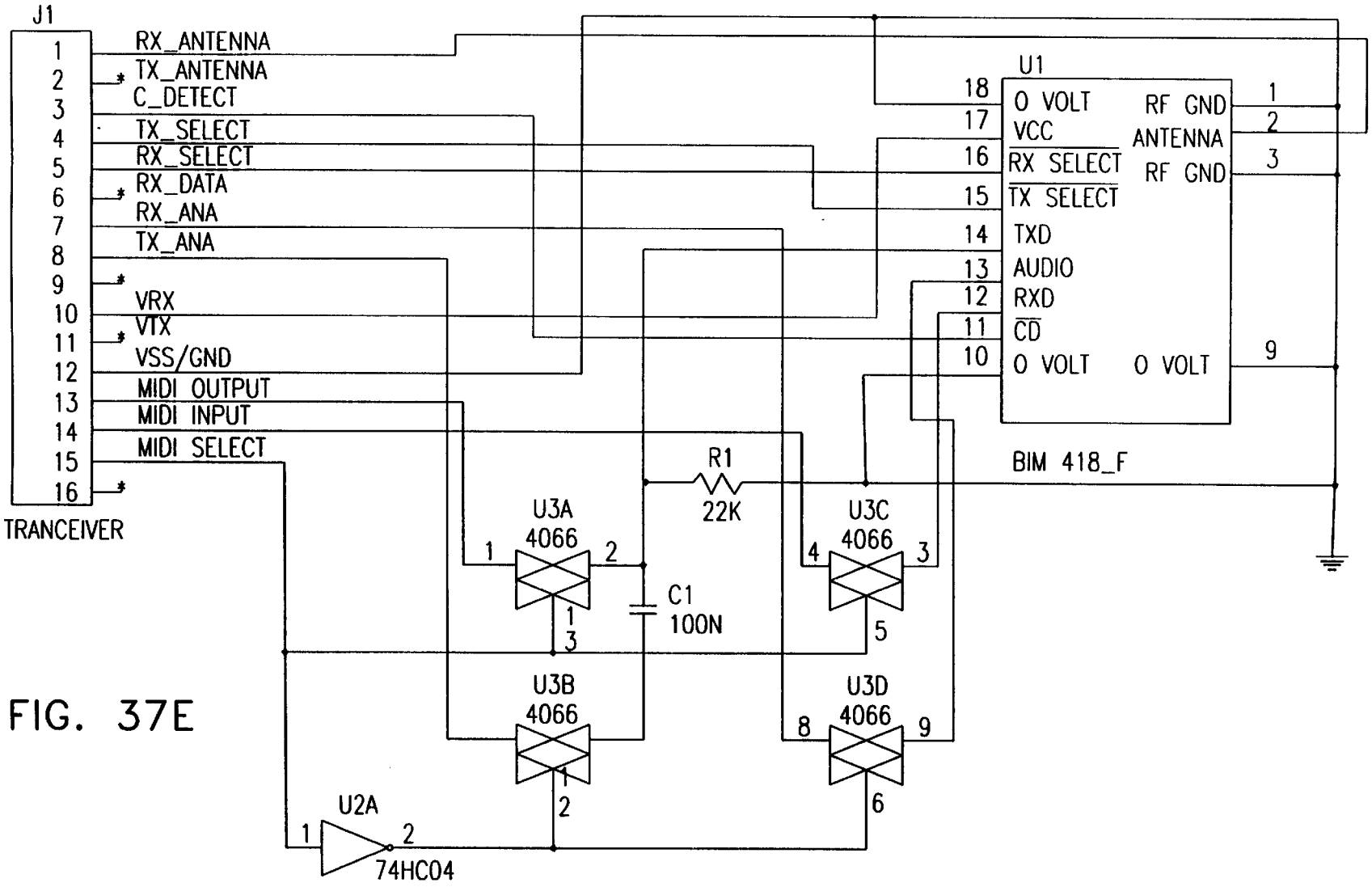
FIG. 37E is a schematic diagram of an alternative implementation of the apparatus of FIG. 37D.

Reference is now additionally made to FIG. 37E, which is a schematic diagram of an alternative implementation of the apparatus of FIG. 37D. The following is a preferred parts list for the apparatus of FIG. 37E:

1. U1 BIM-418-F low power UHF data transceiver module, Ginsburg Electronic GmbH, Am Moosfeld 85, D-81829, Munchen, Germany.

Alternate 1. U1 S20043 spread spectrum full duplex transceiver, AMI Semiconductors-American Microsystems, Inc., Idaho, USA.

Alternate 1. U1 SDT-300 synthesized transceiver, Circuit Design, Inc., Japan.

In the parts list for FIG. 37E, one of item 1 or either of the alternate items 1 may be used for U1. It is appreciated that the appropriate changes will have to be made to the circuit boards for alternate embodiments of the apparatus.

The apparatus of FIG. 37E has similar functionality to the apparatus of FIG. 37D, but has higher bit rate transmission and reception capacity and is, for example, preferred when MDI data is transmitted and received.

FIGS. 37A–37E are self-explanatory with regard to the above parts lists.

Figure 38:
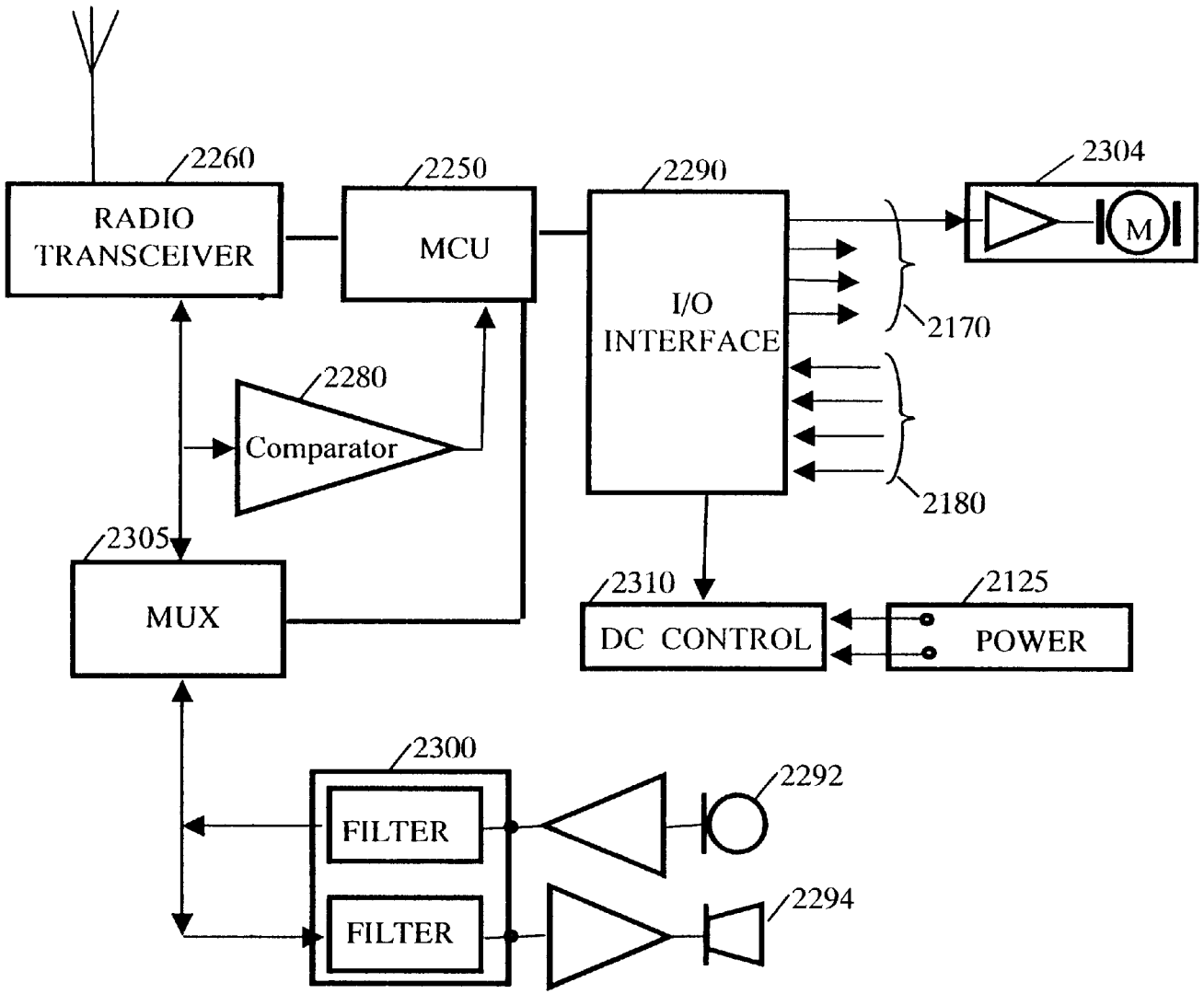
Figure 39A:
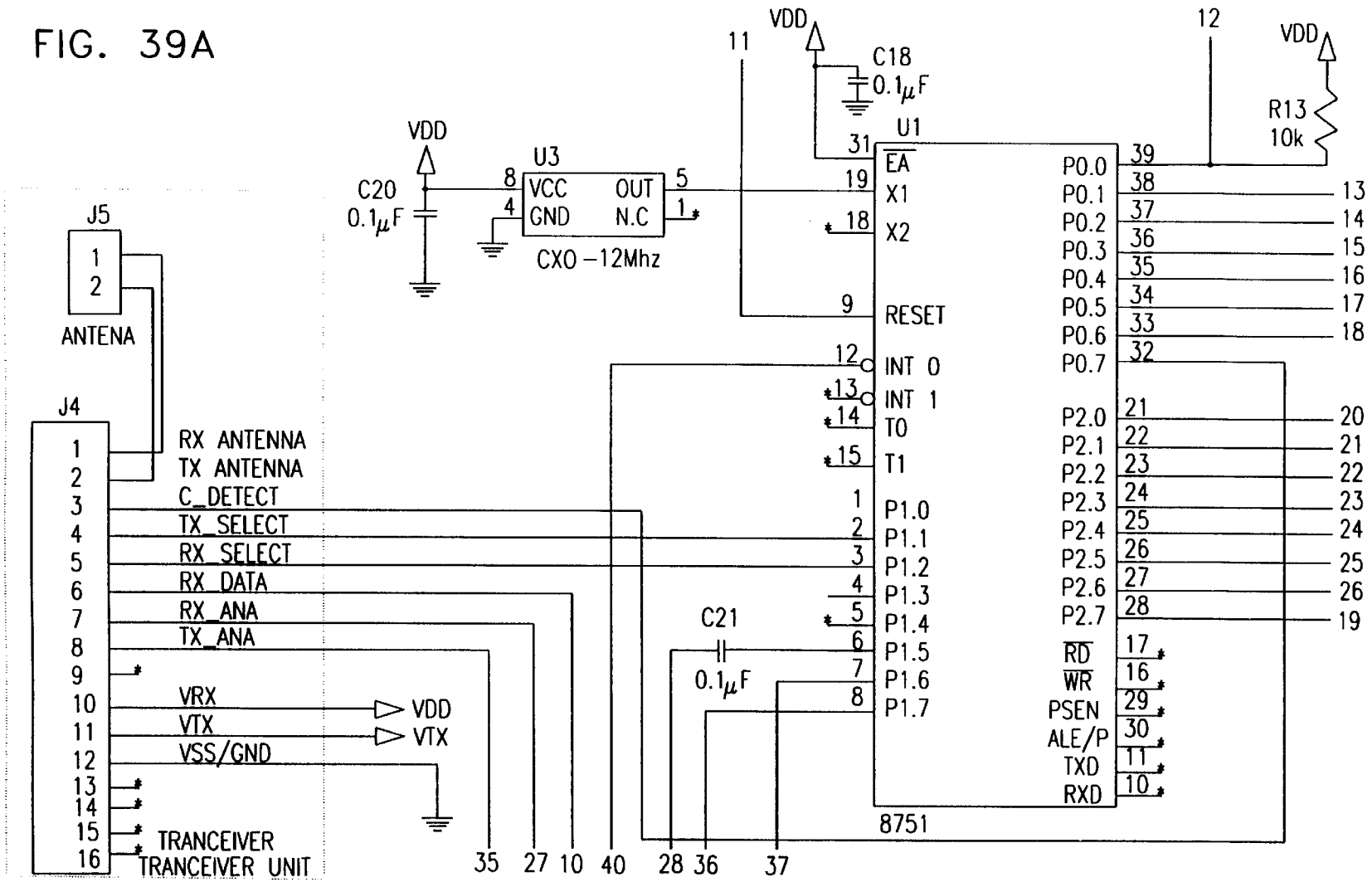
FIGS. 39A–39F, taken together, comprise a schematic diagram of a preferred implementation of the digital I/O interface of FIG. 38.
Figure 39B:
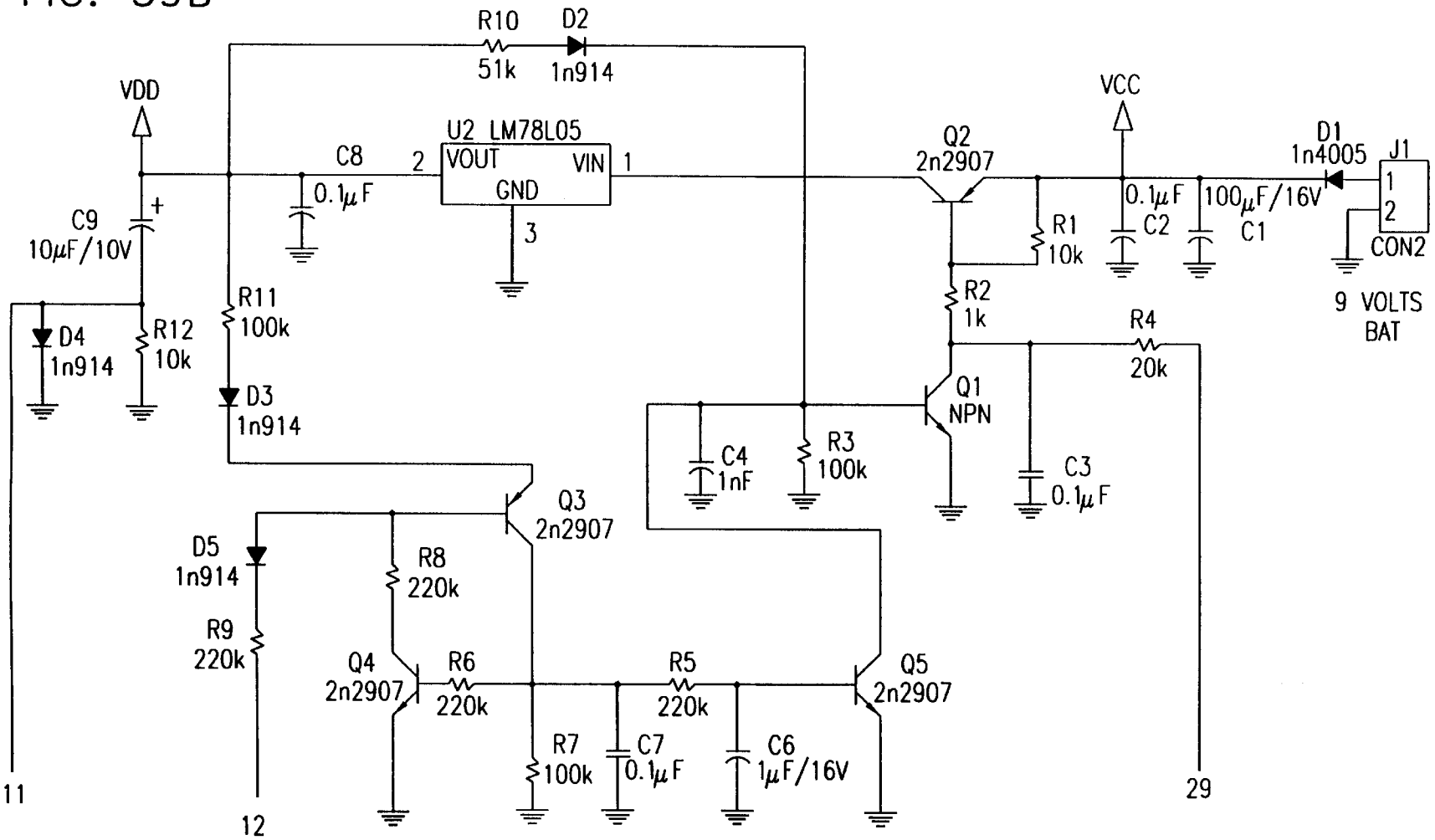
Figure 39C:
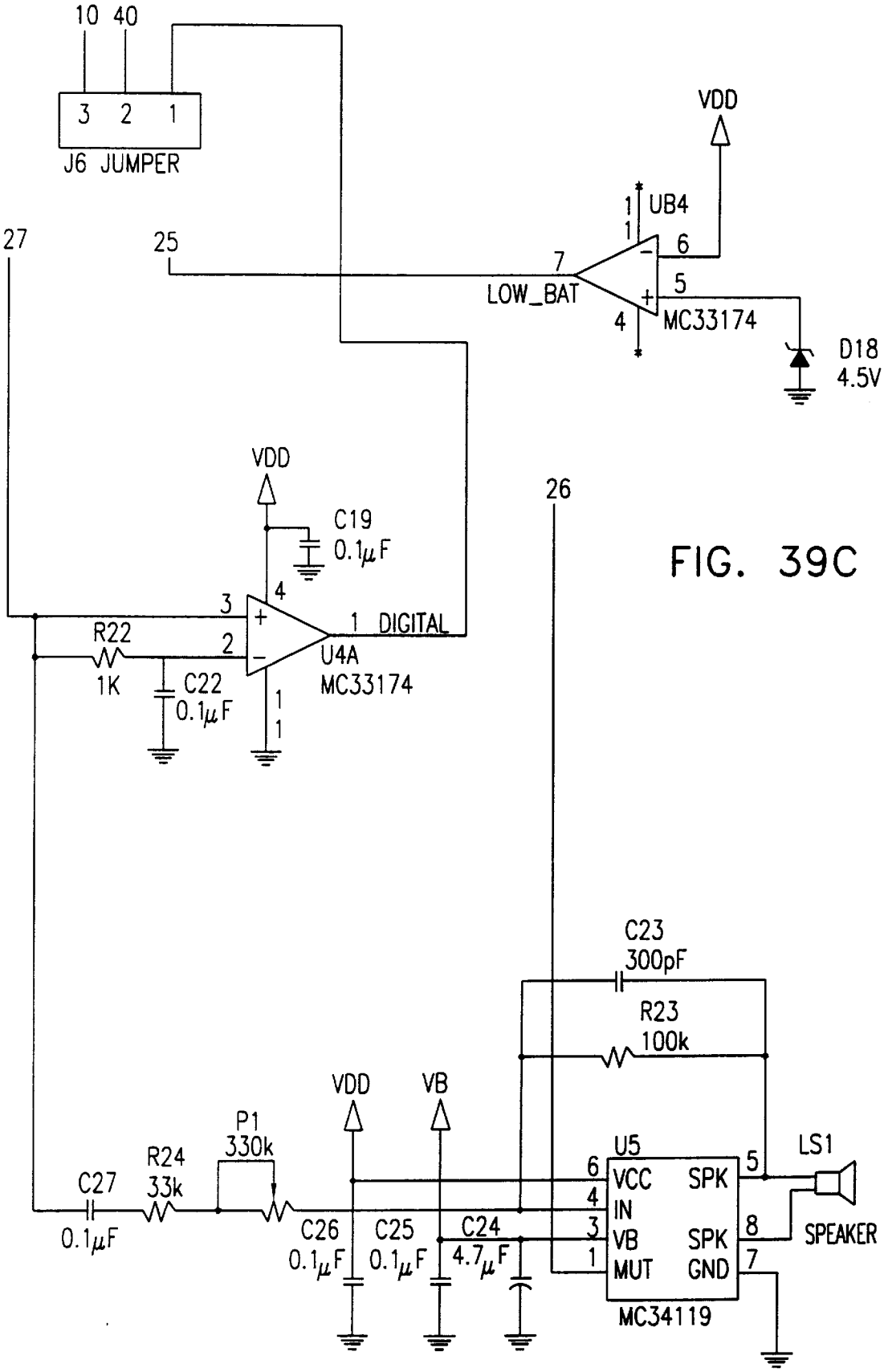
Figure 39D:
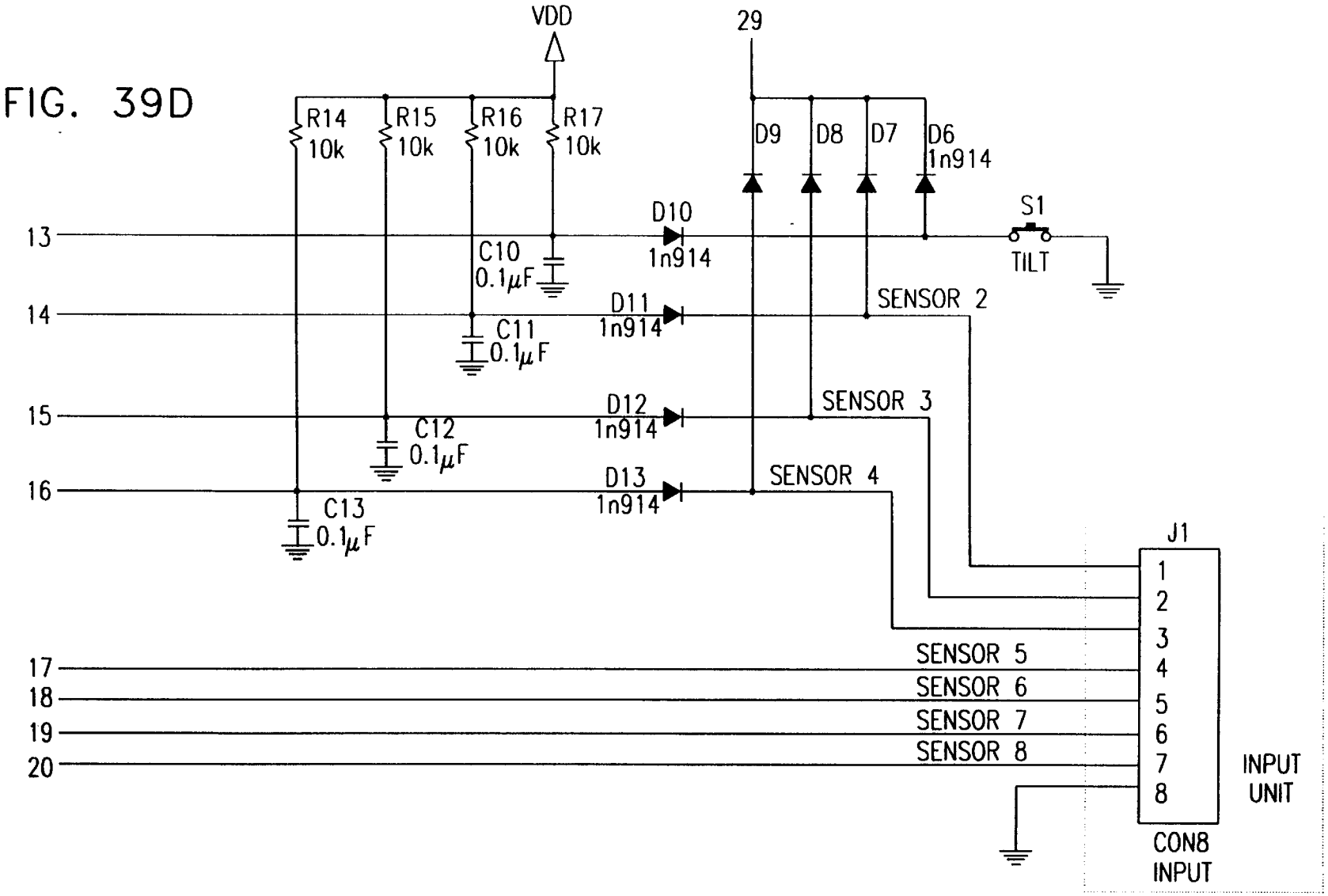
Figure 39E:
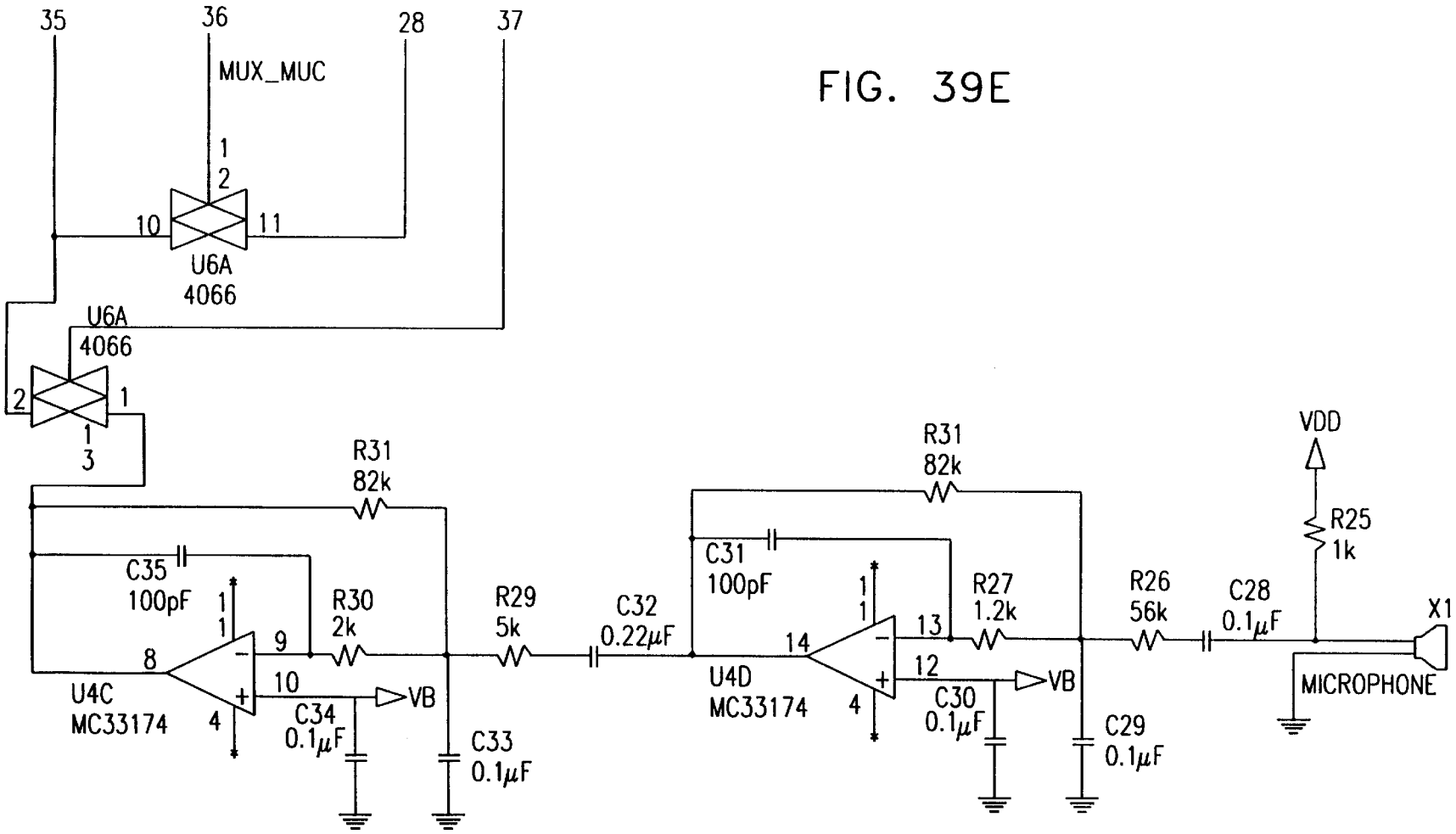
Figure 39F:
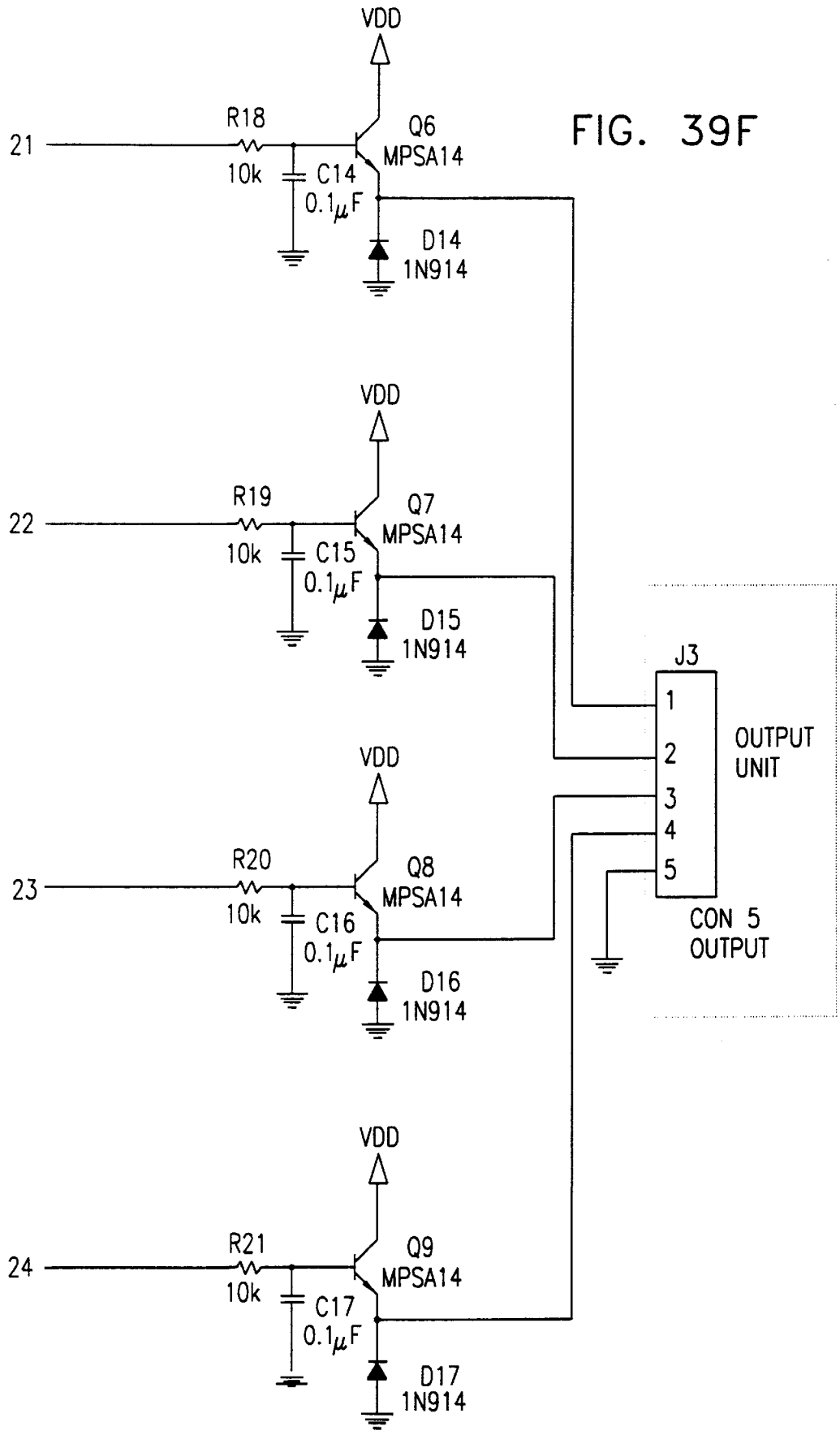

FIG. 38 is a simplified block diagram of the transceiver/controller 2100 of FIG. 33A or FIG. 33B which is associatable with one or more player selectable structures, typically with motors or actuators of these structures, via a wire 2170. Preferably, the controller 2100 is operative to receive, via input connections 2180, inputs from switches, microphones, photodiodes or other sensors, which elements may be embedded in or attachable to individual player selectable structures. The apparatus of FIG. 38 comprises a radio transceiver 2260, similar to the radio transceiver 2260 of FIG. 36. The apparatus of FIG. 38 also comprises a microcontroller 2250 similar to the microcontroller 2250 of FIG. 36.

The apparatus of FIG. 38 also comprises a digital input/output interface (digital I/O interface) 2290, which is operative to provide an interface between the microcontroller 2250 and a plurality of input and output devices which may be connected thereto such as, for example, four input device and four output devices. A preferred implementation of the digital I/O interface 2290 is described in more detail below with reference to FIG. 39A–39F.

The apparatus of FIG. 38 also comprises an analog input/output interface (analog I/O interface) 2300 operatively connected to the radio transceiver 2260, and operative to receive signals therefrom and to send signals thereto.

The apparatus of FIG. 38 also comprises a multiplexer 2305 which is operative, in response to a signal from the microcontroller 2250, to provide output to the analog I/O interface 2300 only when analog signals are being transmitted by the radio transceiver 2260, and to pass input from the analog I/O interface 2300 only when such input is desired.

The apparatus of FIG. 38 also comprises input devices and output devices. In FIG. 38, the input devices comprise, by way of example, a tilt switch (not shown) operatively connected to the digital U/O interface 2290 via input connectors 2180, and a microphone operatively 2292 connected to the analog I/O interface 2300. It is appreciated that a wide variety of input devices may be used.

In FIG. 38, the output devices comprise, by way of example, a DC motor 2304 operatively connected to the digital I/O interface 2290 via output connectors 2170, and a speaker 2294 operatively connected to the analog I/O interface 2300. It is appreciated that a wide variety of output devices 2150 may be used.

The apparatus of FIG. 38 also comprises a DC control 2310, a preferred implementation of which is described in more detail below with reference to FIGS. 39A–39F.

The apparatus of FIG. 38 also comprises a comparator 2280, similar to the comparator 2280 of FIG. 36.

The apparatus of FIG. 38 also comprises a power source 2125, shown in FIG. 38 by way of example as batteries, operative to provide electrical power to the apparatus of FIG. 38 via the DC control 2310.

Reference is now made to FIGS. 39A–39F which, taken together with either FIG. 37D or 37E, comprise a schematic diagram of the apparatus of FIG. 38. The following is a preferred parts list for the apparatus of FIGS. 39A–39F:

1. U1 8751 microcontroller, Intel Corporation, San Tomas 4, 2700 Sun Tomas Expressway, 2nd Floor, Santa Clara 95051, Calif. USA.
2. U2 LM78L05, National Semiconductor, 2900 Semiconductor Drive, Santa Clara, Calif. 95052, USA.
3. U3 CXO-12 MHz (crystal oscillator), Raltron, 2315 N.W. 107th Avenue, Miami, Fla. 33172, USA.
4. U4 MC33174, Motorola, Phoenix, Ariz. USA. Tel. No. (602)897-5056.
5. U5 MC34119, Motorola, Phoenix, Ariz. USA. Tel. No. (602)897-5056.
6. U6 4066, Motorola, Phoenix, Ariz., USA. Tel. No. (602)897-5056.
7. Diode 1N914, Motorola, Phoenix, Ariz. USA. Tel. No. (602)897-5056.
8. Transistor 2N2222, Motorola, Phoenix, Ariz. USA. Tel. No. (602)897-5056.
7. Transistors 2N2907 and MPSA14, Motorola, Phoenix, Ariz. USA. Tel. No. (602)897-5056.

FIGS. 39A–39F are self-explanatory with reference to the above parts list.

Figure 40:
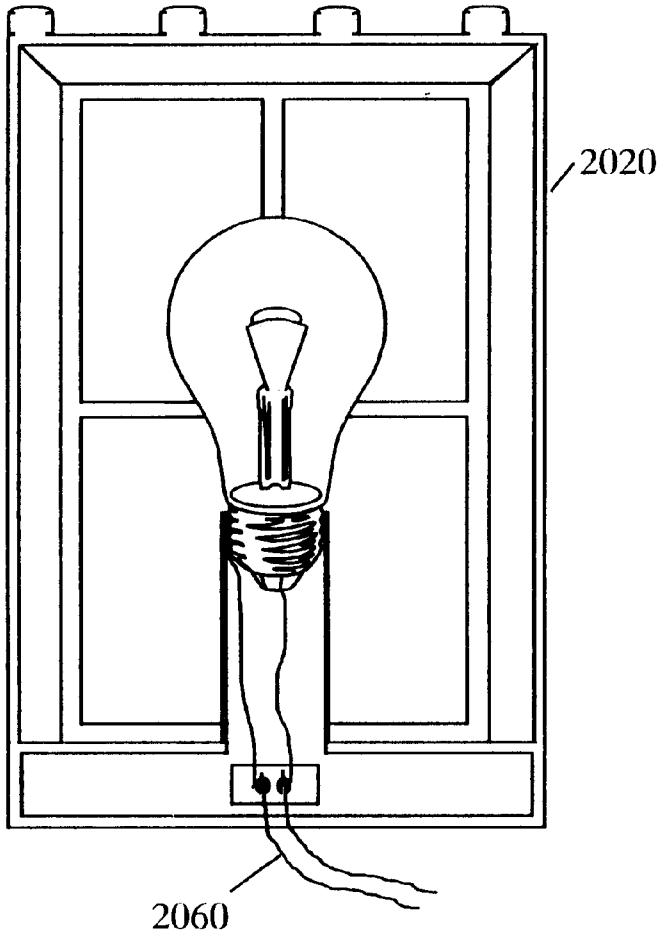

FIG. 40 is a simplified illustration of one of the player selectable structures, such as the structures illustrated in FIG. 33A or FIG. 33B, such as one of the lamps 2020, which is associatable with the transceiver/controller 2100 of FIG. 33A or FIG. 33B via wire 2060 which can be connected to the lamp 2020 by any means suitable for children's play such as non-detachable clamps 2130 or alternatively non-detachable clips or screws.

Figure 41A:
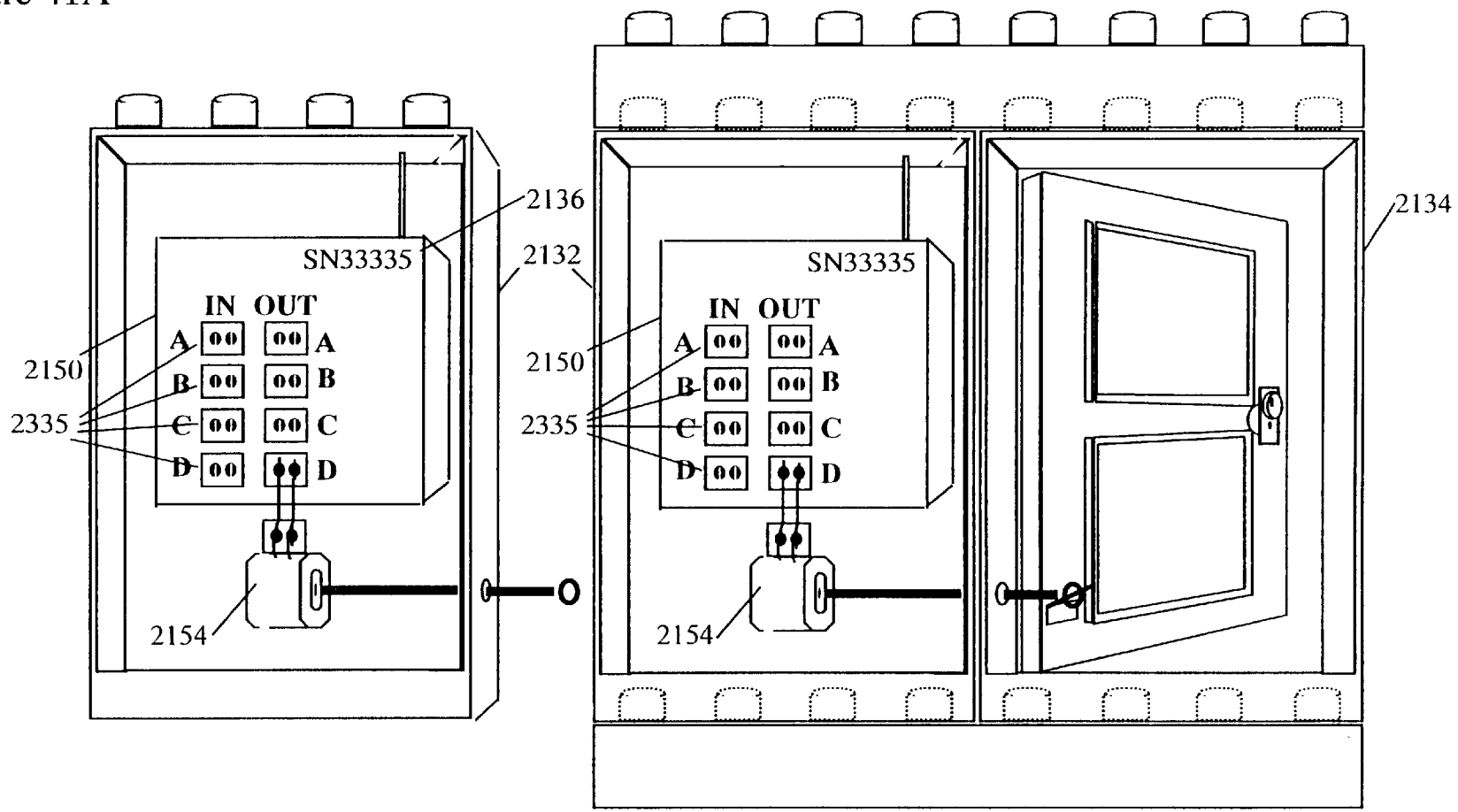
FIG. 41A is a pictorial illustration of a modification of the transceiver/controller-door unit of FIG. 34, assembled of a transceiver/controller unit 2132 and a door unit 2134 and two passive interlocking elements, in a first operative position in which the door is open, which is modular in the sense that the transceiver/controller unit is not integrally formed with the door.
Figure 41B:
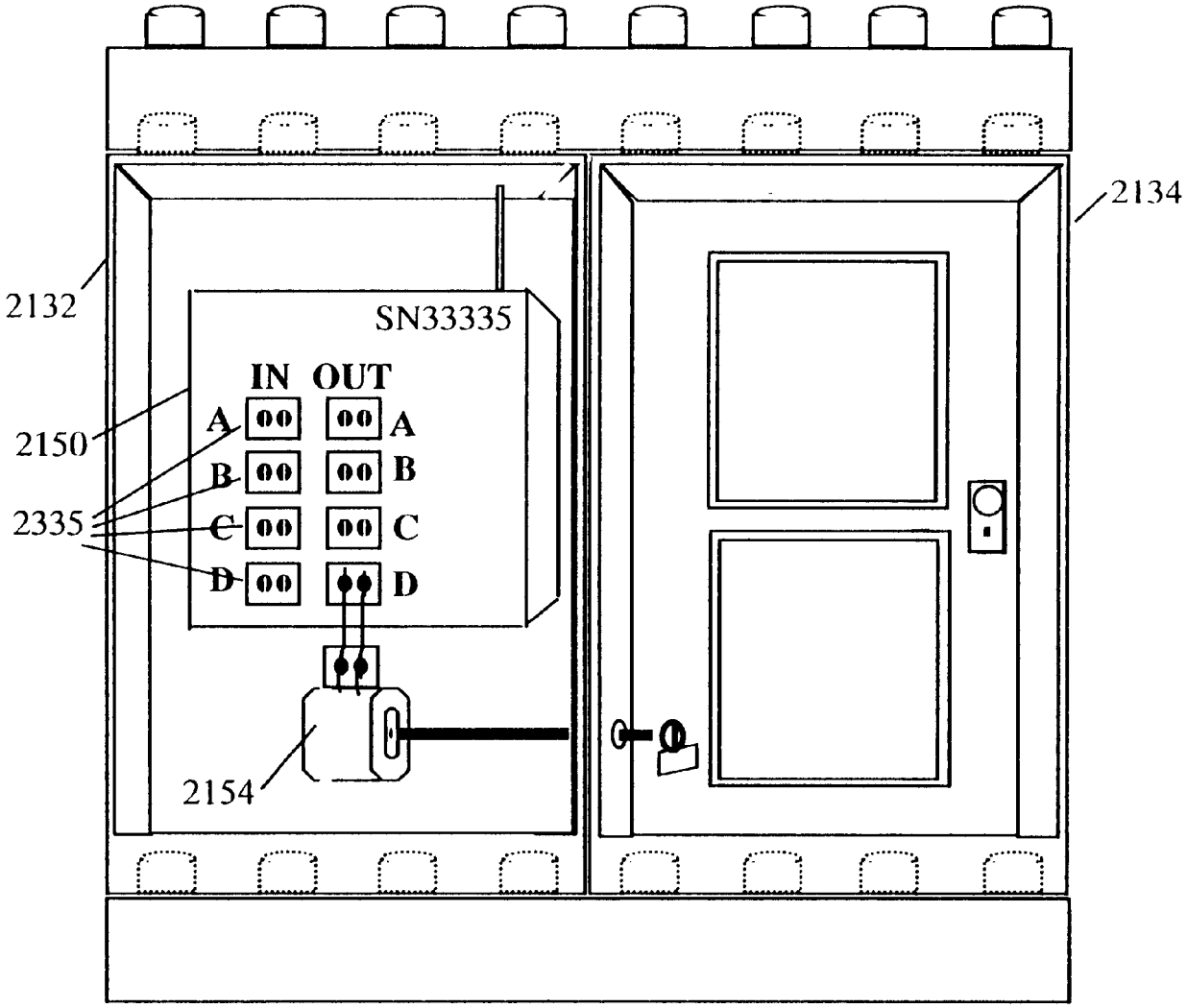
FIG. 41B is a partial pictorial illustration of the apparatus of FIG. 41A, assembled and in a second operative position in which the door is closed.
Figure 41C:
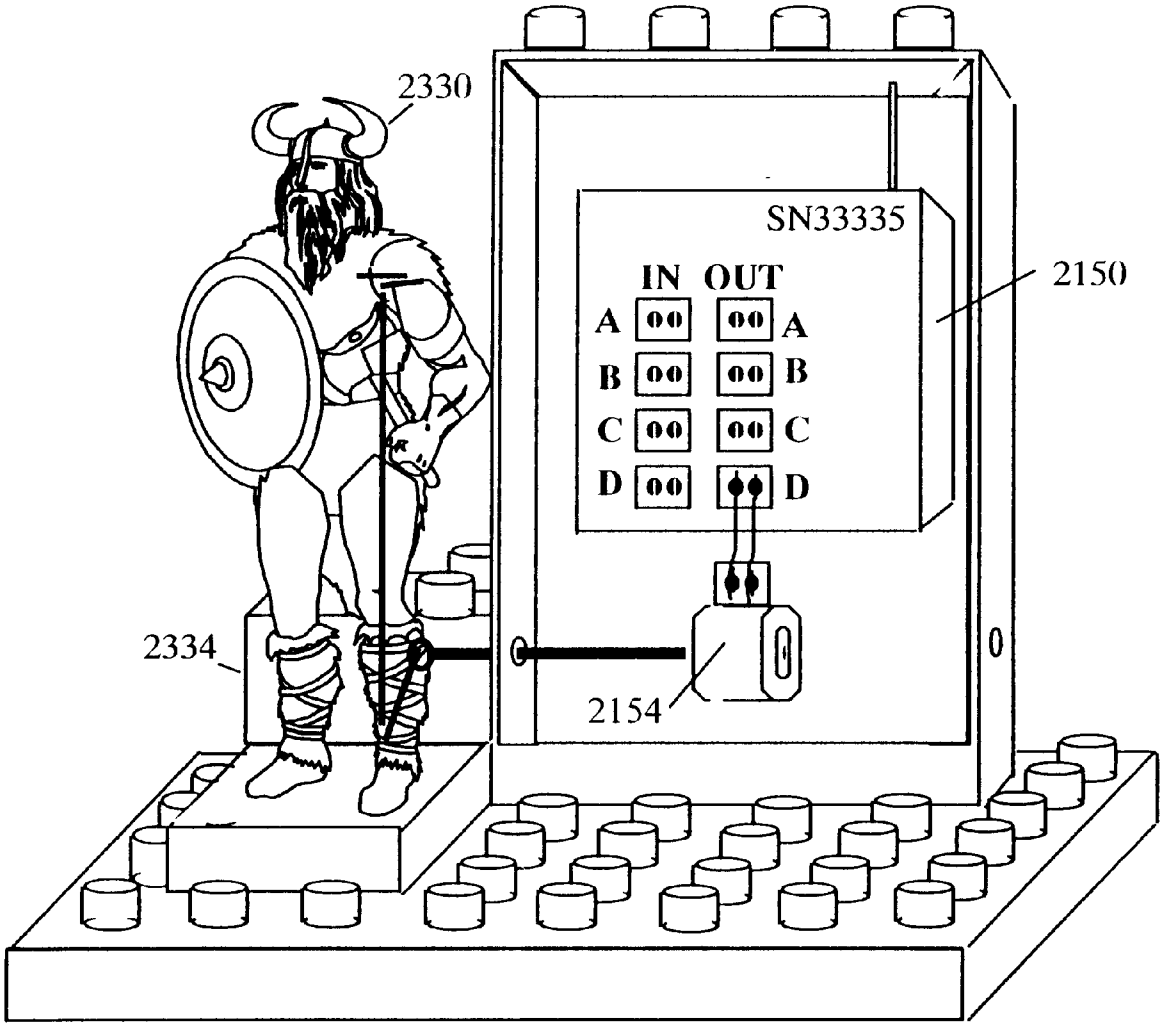
FIG. 41C is a pictorial illustration of the transceiver/controller of FIG. 41A interlocking with a figure in a first operative position and fixedly mounted on an interlocking stand.
Figure 41D:
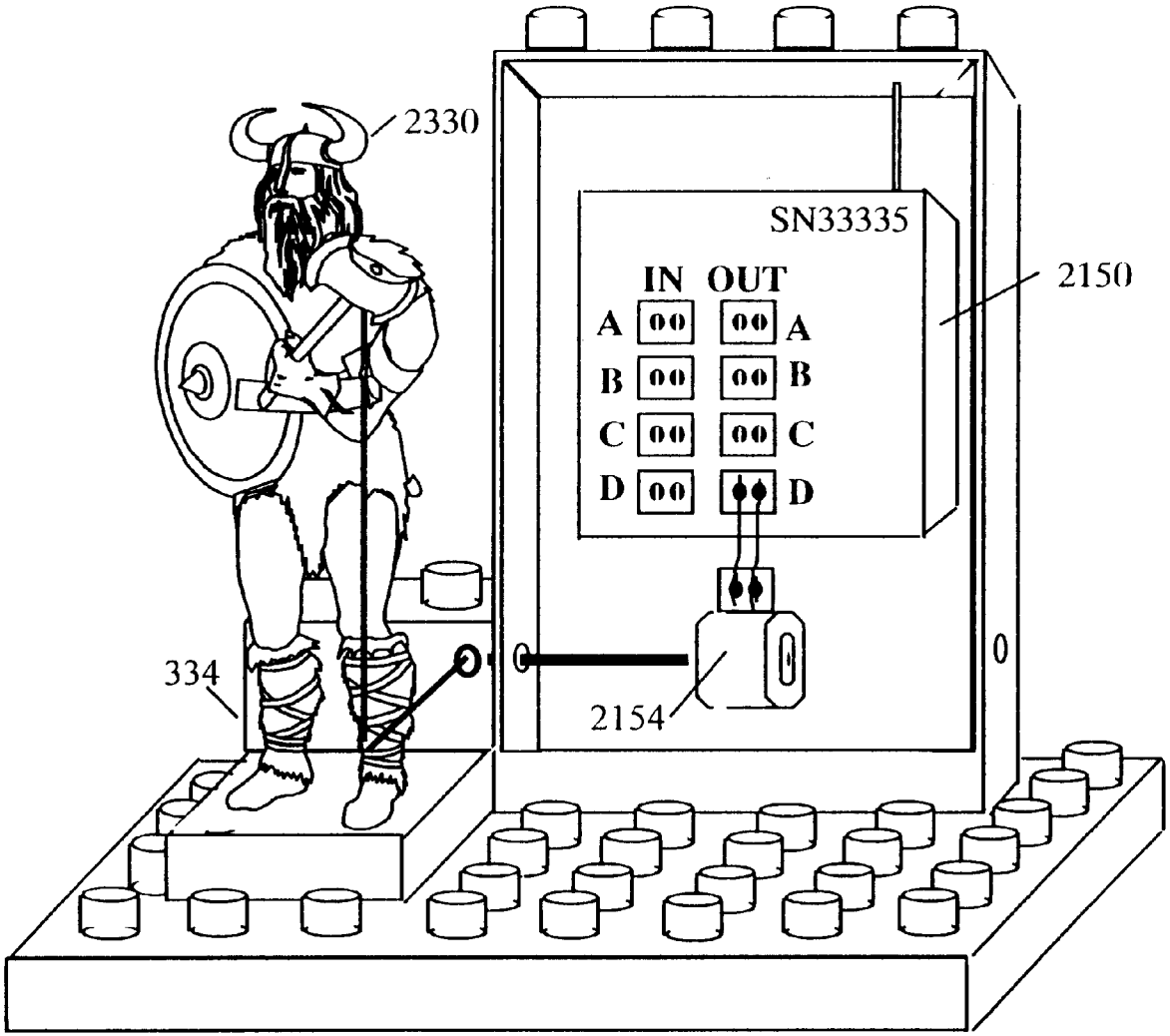
FIG. 41D is a pictorial illustration of the transceiver/controller of FIG. 41A interlocking with a figure in a second operative position and fixedly mounted on an interlocking stand.

FIG. 41A shows a modification of the transceiver/controller-door unit 2130 of FIG. 34, unassembled, which is modular in the sense that transceiver/controller unit 2132 is not integrally formed with the door 2134 or with any other individual interlocking toy element but rather interlocks with a player-selected toy structure, such as the door 2134 or, as shown in FIGS. 41C–41D, with a FIG. 2330 fixedly mounted on an interlocking stand 2334. FIG. 41B shows the apparatus of FIG. 41A, assembled and in a second operative position in which the door is closed. The transceiver/controller unit 2150 preferably includes a plurality of marked connector pairs 2335 such as 4 connector pairs marked "A", "B", "C" and "D". Each player-selected toy structure may include one or more toy elements. The FIG. 2330 preferably includes movable parts as is clear from a comparison of FIGS. 41C and 41 D.

Figure 42A:
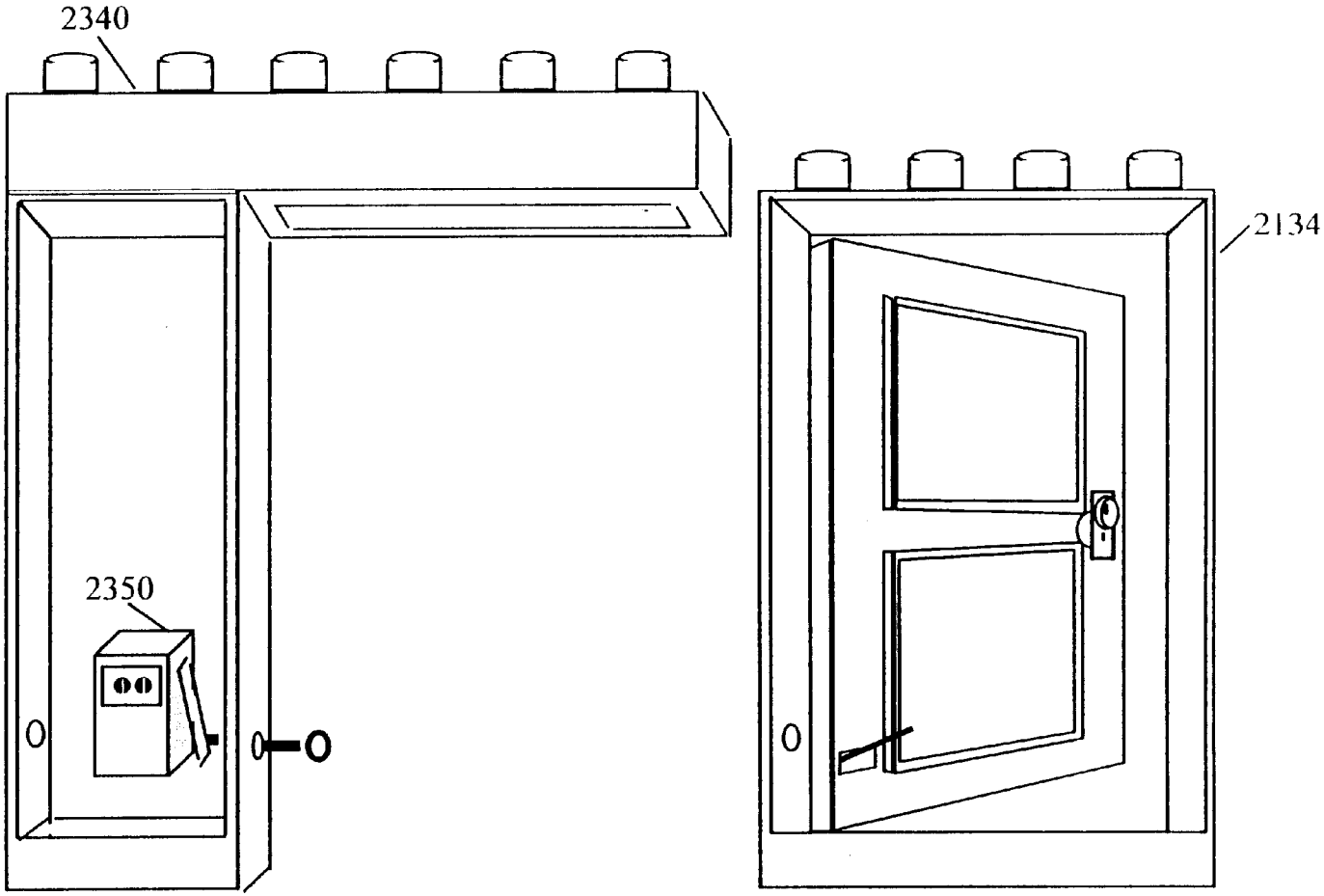
FIG. 42A is a pictorial illustration of a modular sensor unit including a modular sensor not integrally formed with any individual interlocking toy element to be sensed but rather directly interlocking with a player-selected toy structure to be sensed.

FIG. 42A is a pictorial illustration of a modular sensor unit 2340. The modular sensor unit 2340 preferably comprises a sensor such as a microswitch 2350 integrally formed with an interlocking toy element. The apparatus of FIG. 42A is modular in that it is configured and operative to sense operation of an interlocking toy element but is not integrally formed with any individual interlocking toy element to be sensed but rather interlocks with a player-selected toy structure to be sensed, such as a door 2134, either directly or, as shown in FIG. 42B, via intermediate interlocking toy elements.

Figure 42B:
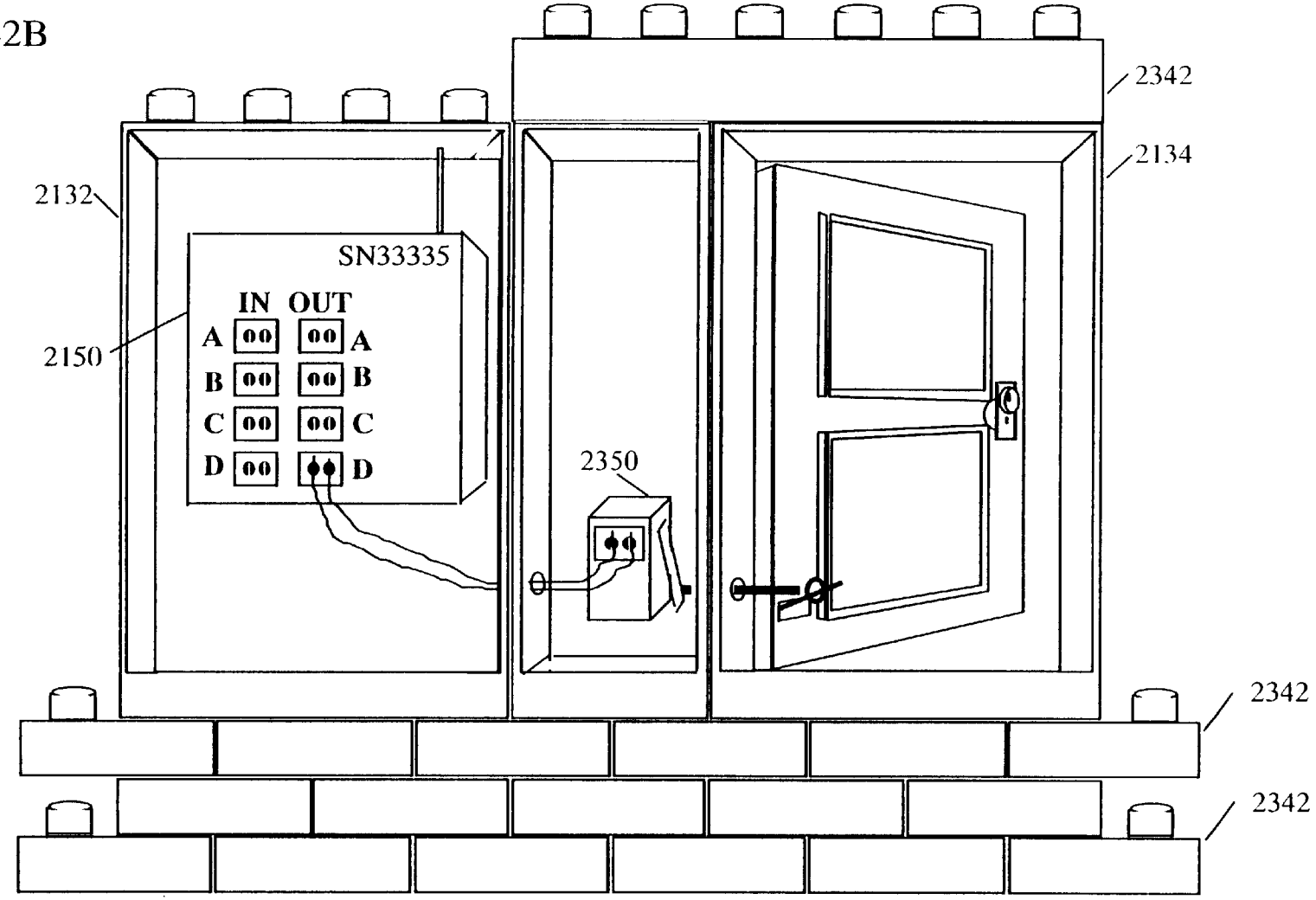
FIG. 42B is a pictorial illustration of a modular sensor unit which is a variation of the apparatus of FIG. 42A in that the modular sensor thereof indirectly interlocks with a player-selected toy structure, via intermediate interlocking toy elements.

FIG. 42B is a pictorial illustration of a modular transceiver/controller unit 2132. The modular transceiver/controller 2132 preferably comprises a transceiver/controller 2150 integrally formed with an interlocking toy element. The apparatus of FIG. 42B is modular in that it is configured and operative to wirelessly relay communications between the remote computer and an interlocking toy element but is not integrally formed with any individual interlocking toy element but rather interlocks with a player-selected toy structure for communication with the computer, such as a door 2134, either directly or, as shown, via intermediate interlocking toy elements 2342.

Figure 43:
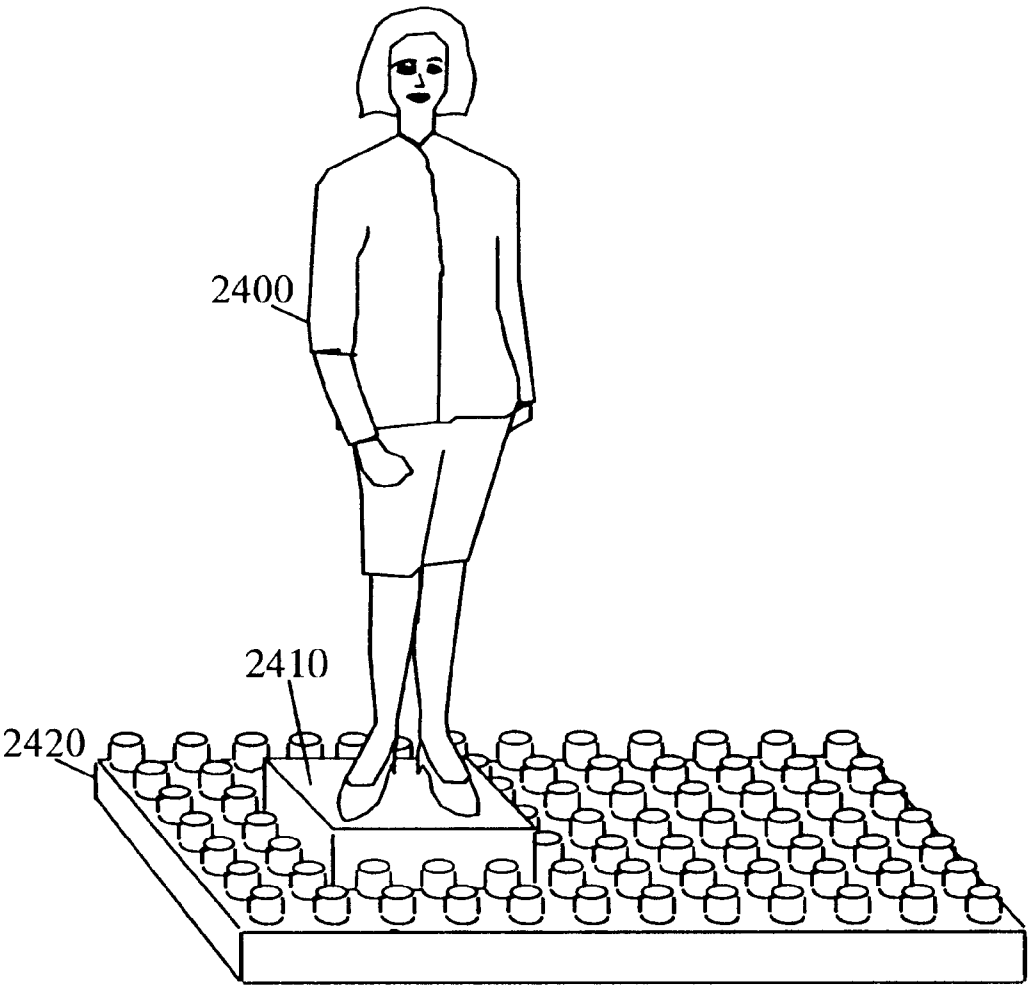

FIG. 43 is a pictorial illustration of a human model figure 2400 fixedly mounted on an integrally formed interlocking stand 2410 configured to interlock with interlocking toy elements such as an interlocking platform 2420.

Figure 44:
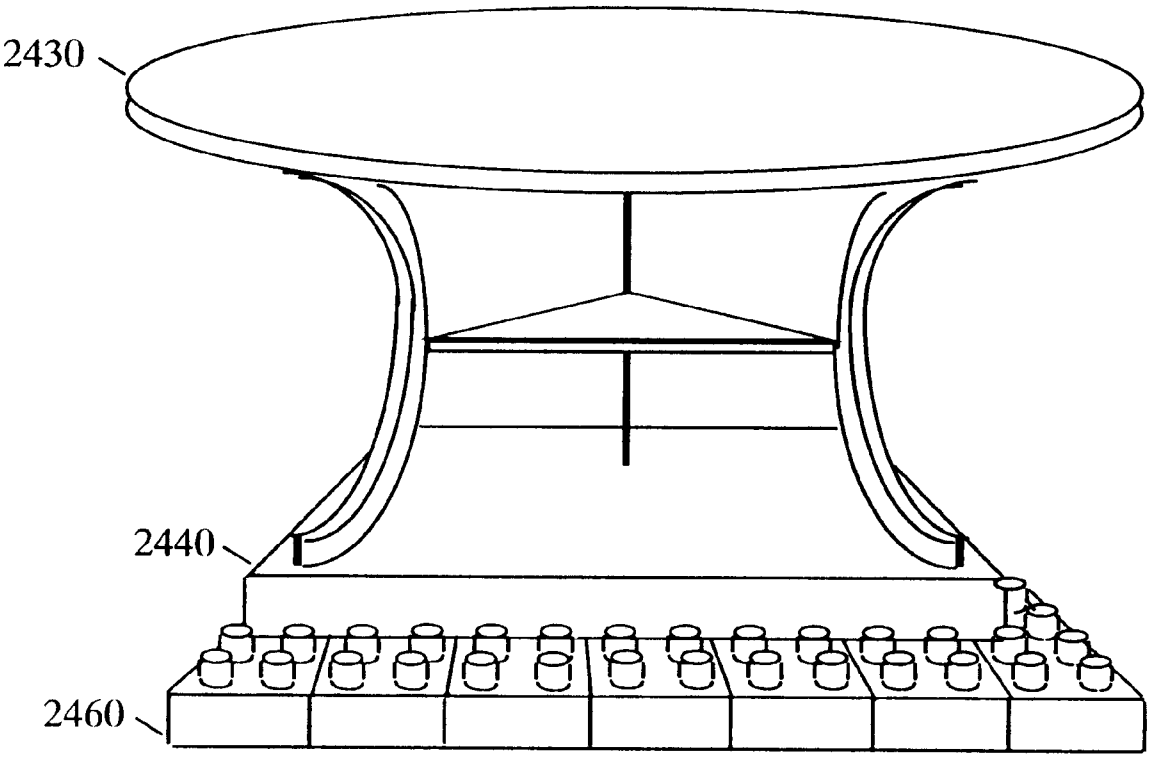

FIG. 44 is a pictorial illustration of an interior household item 2430 having an integrally formed interlocking stand 2440 which is not part of its inherent structure. The interlocking stand 2440 is not part of the inherent structure of the table 2430. In contrast, certain interior household items, such as a refrigerator, have a rectangular base as part of their inherent structure. The stand 2440 interlocks with interlocking toy elements such as interlocking bricks 2460.

Figure 45:
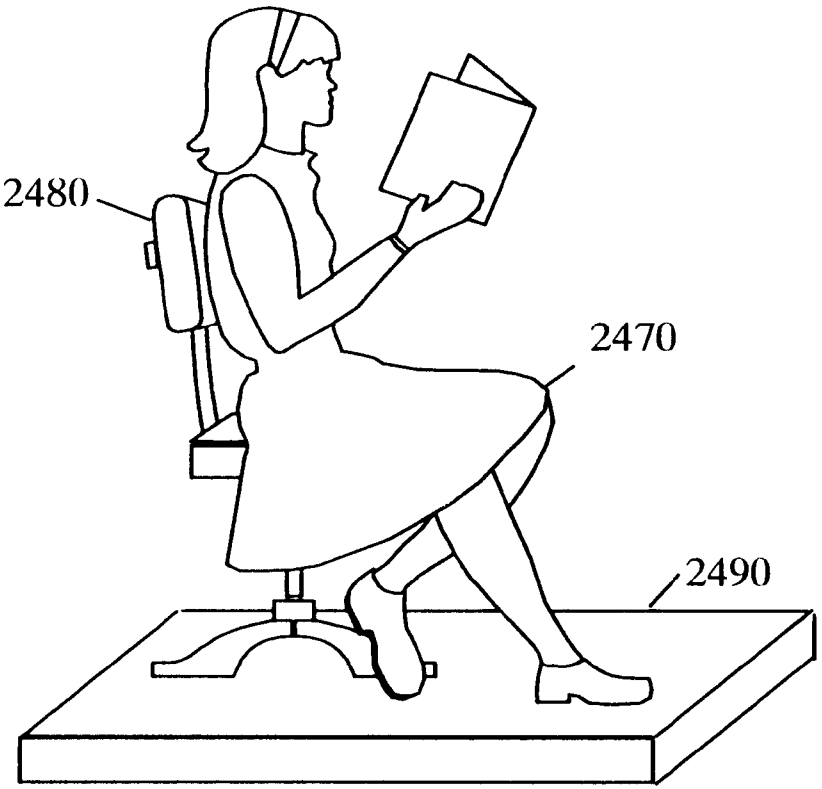

FIG. 45 is a pictorial illustration of an integrally formed combination of a human model FIG. 2470 and a interior household item 2480 both fixedly mounted onto an integrally formed interlocking stand 2490.

Figure 46:
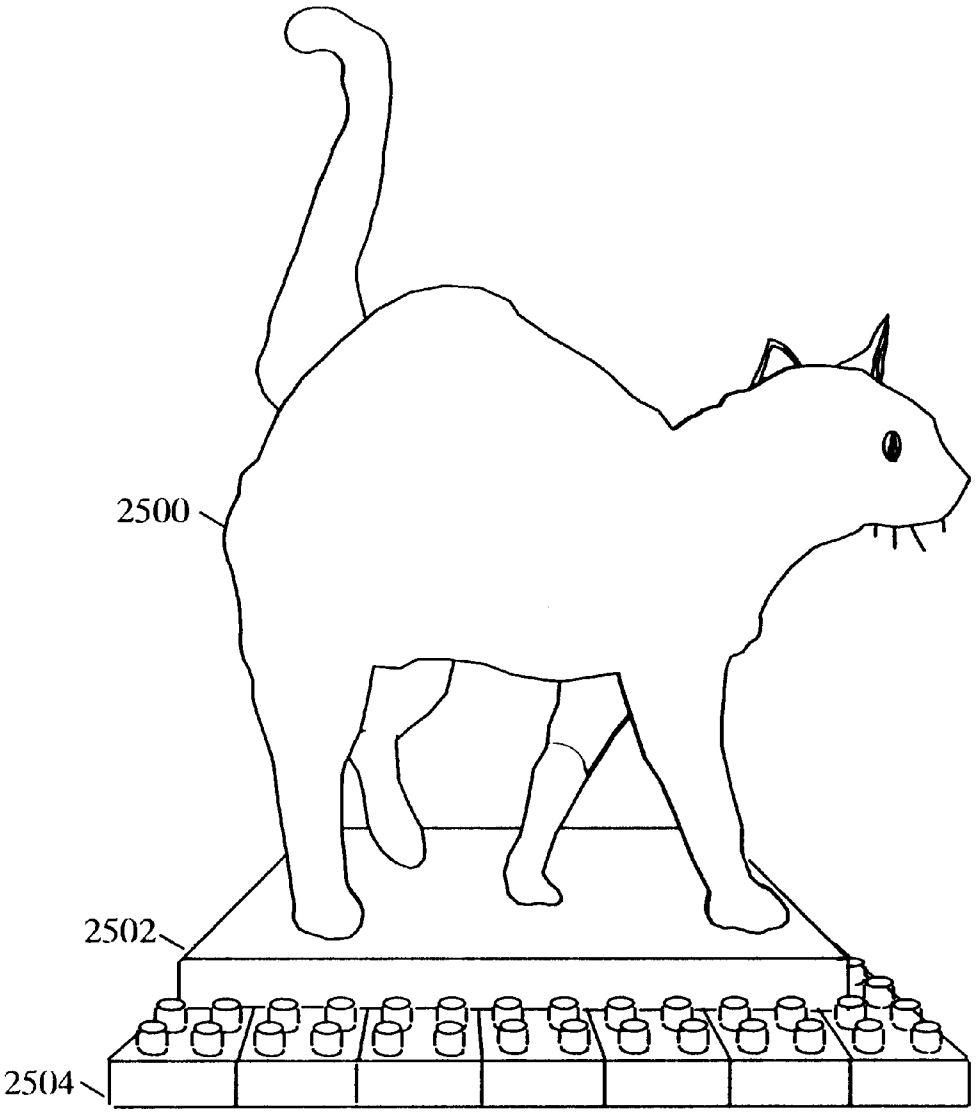

FIG. 46 is a pictorial illustration of an animal model FIG. 2500 fixedly mounted on an integrally formed interlocking stand 2502 configured to interlock with interlocking toy elements such as an interlocking platform 2504.

Figure 47:
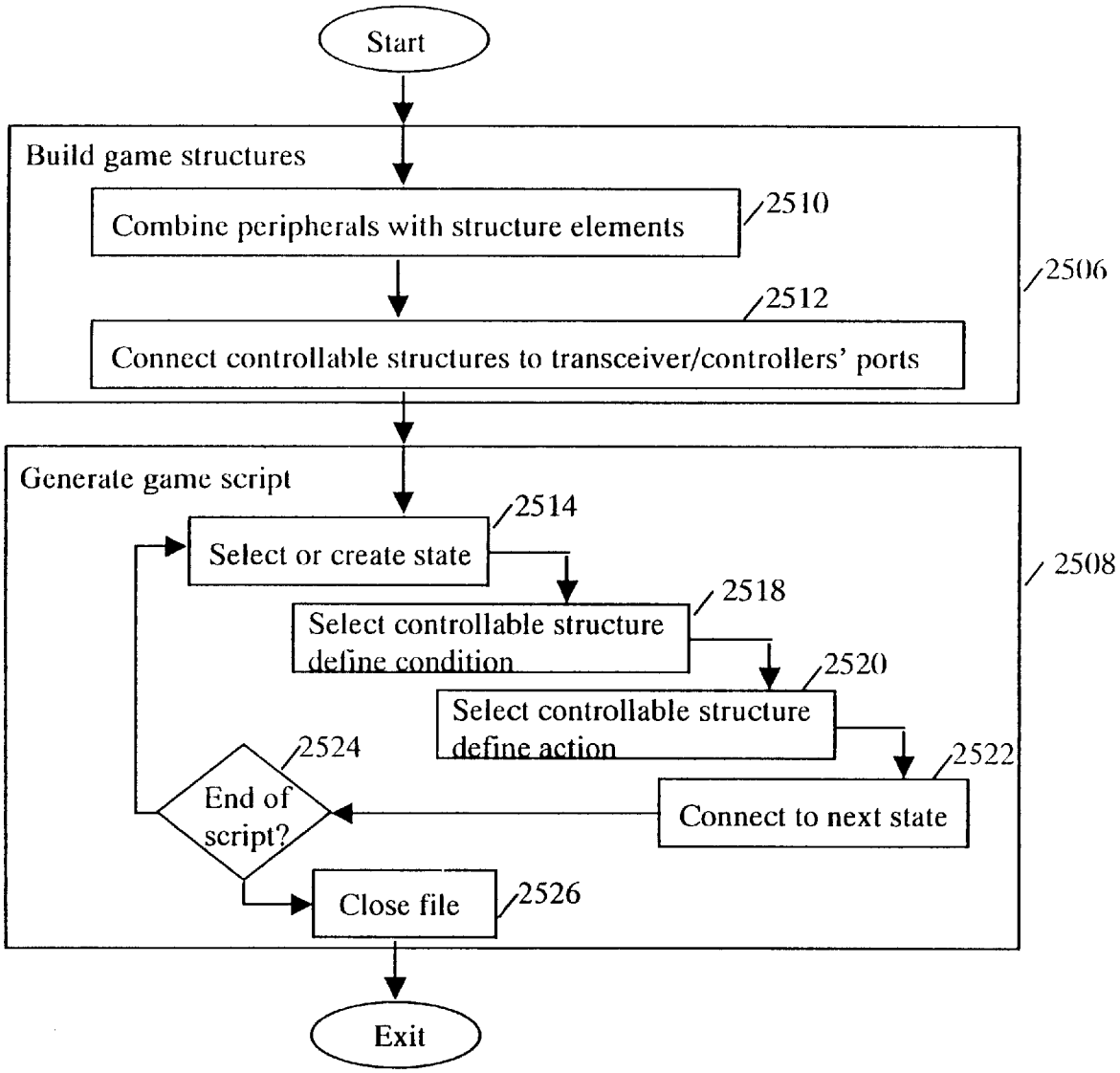

FIG. 47 is a flowchart illustration of a preferred mode or method of interaction between a user and the computer 2110. According to a preferred embodiment of the present invention, the user is prompted or otherwise guided through the flowchart of FIG. 47. It is appreciated that the steps of the flowchart illustration of FIG. 47 may be provided in different sequences as desired.

The method of FIG. 47 typically comprises two main stages:

a. Build game structure (step 2506)—Structures are built by a player using available toy elements such as controllable effect producers, electric control modules, transceiver/controller elements, and integral combinations of the above types of elements. The structures may be physically built and defined for the computer in parallel. Alternatively, the structures may be defined for the computer before or after the physical building stage.
b. Generate game script (step 2508) to operate the structures built in step 2506 by programming the computer 2110.

Figure 48:
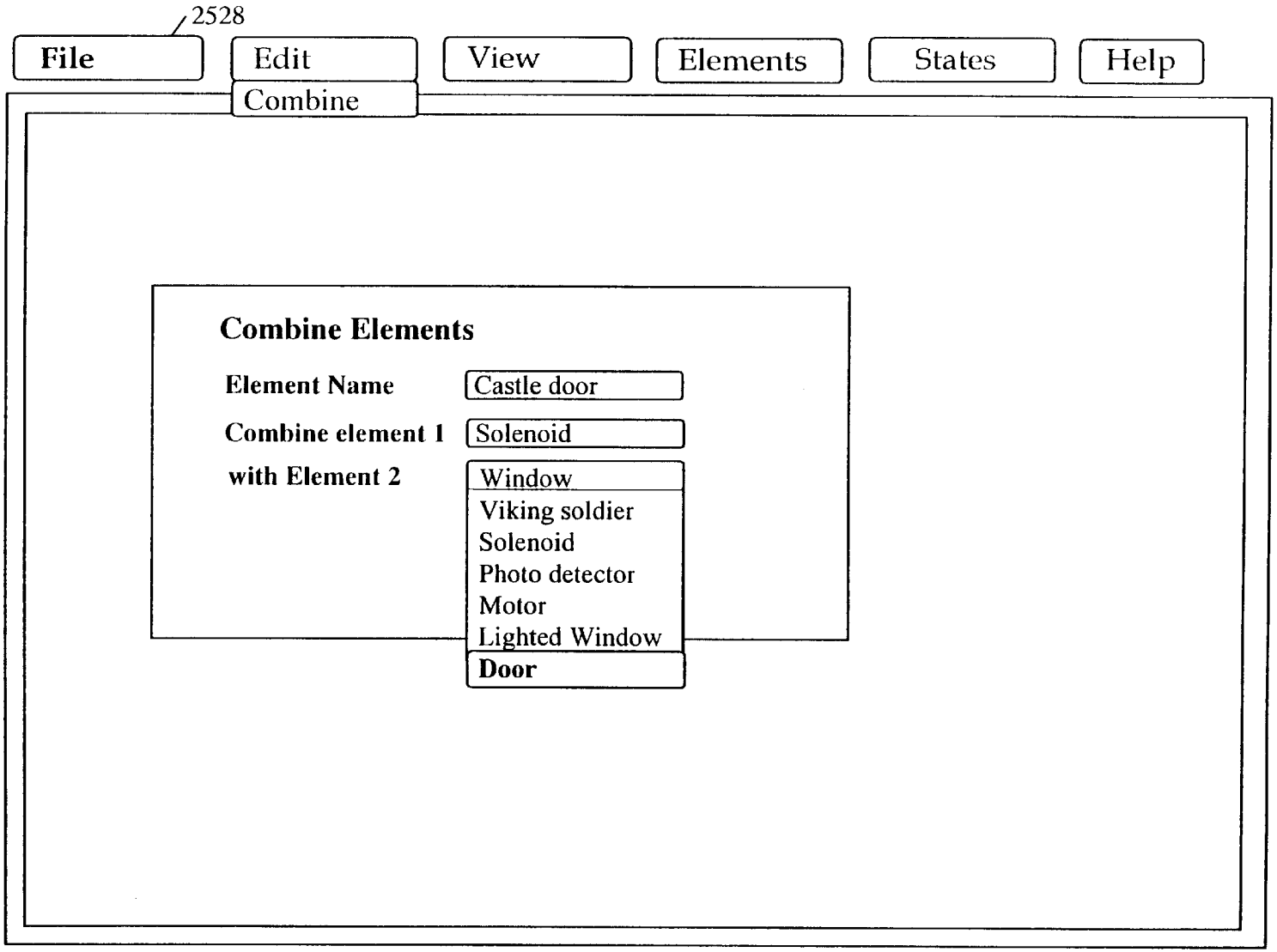
Figure 49:
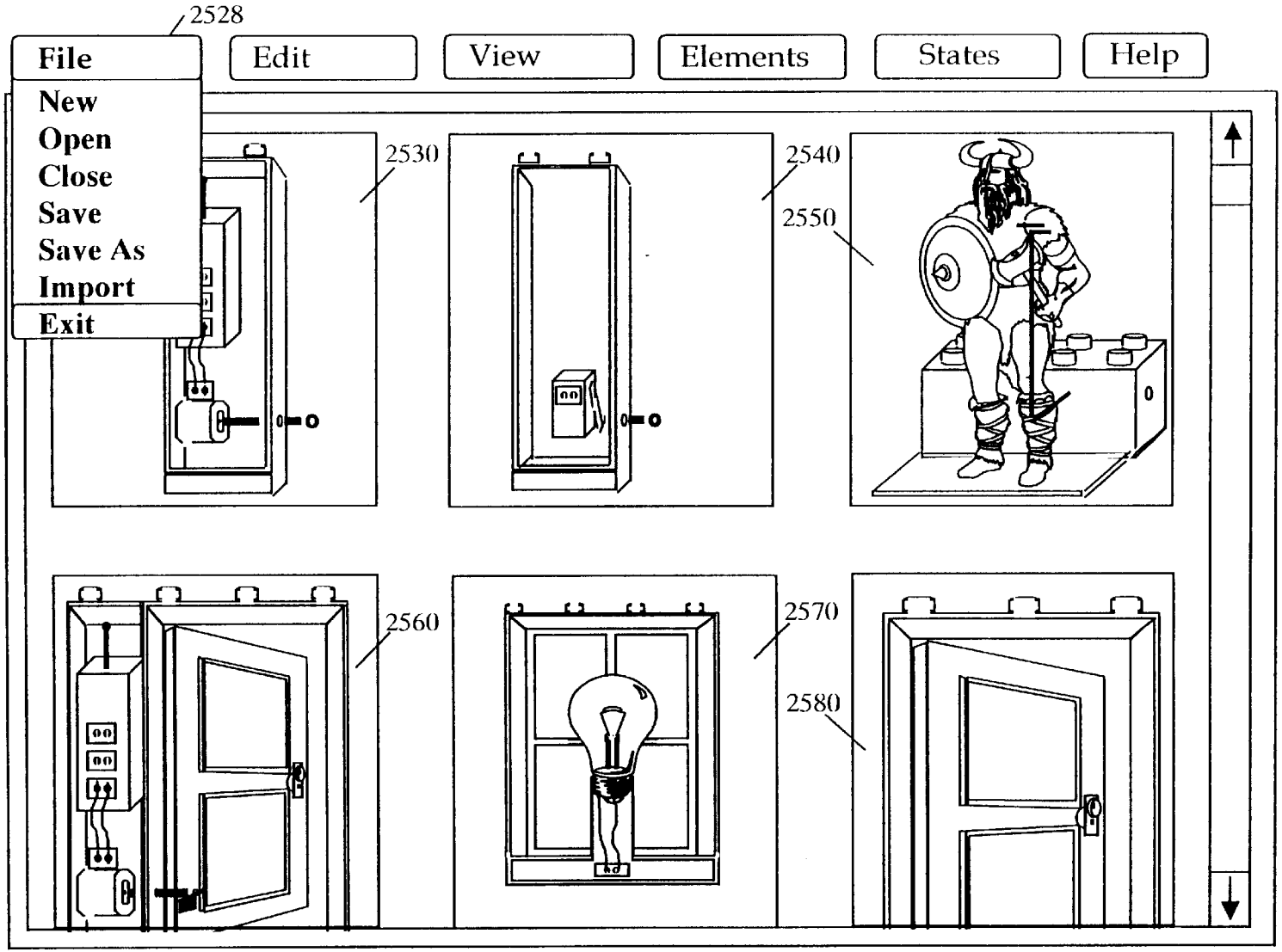
Figure 50:
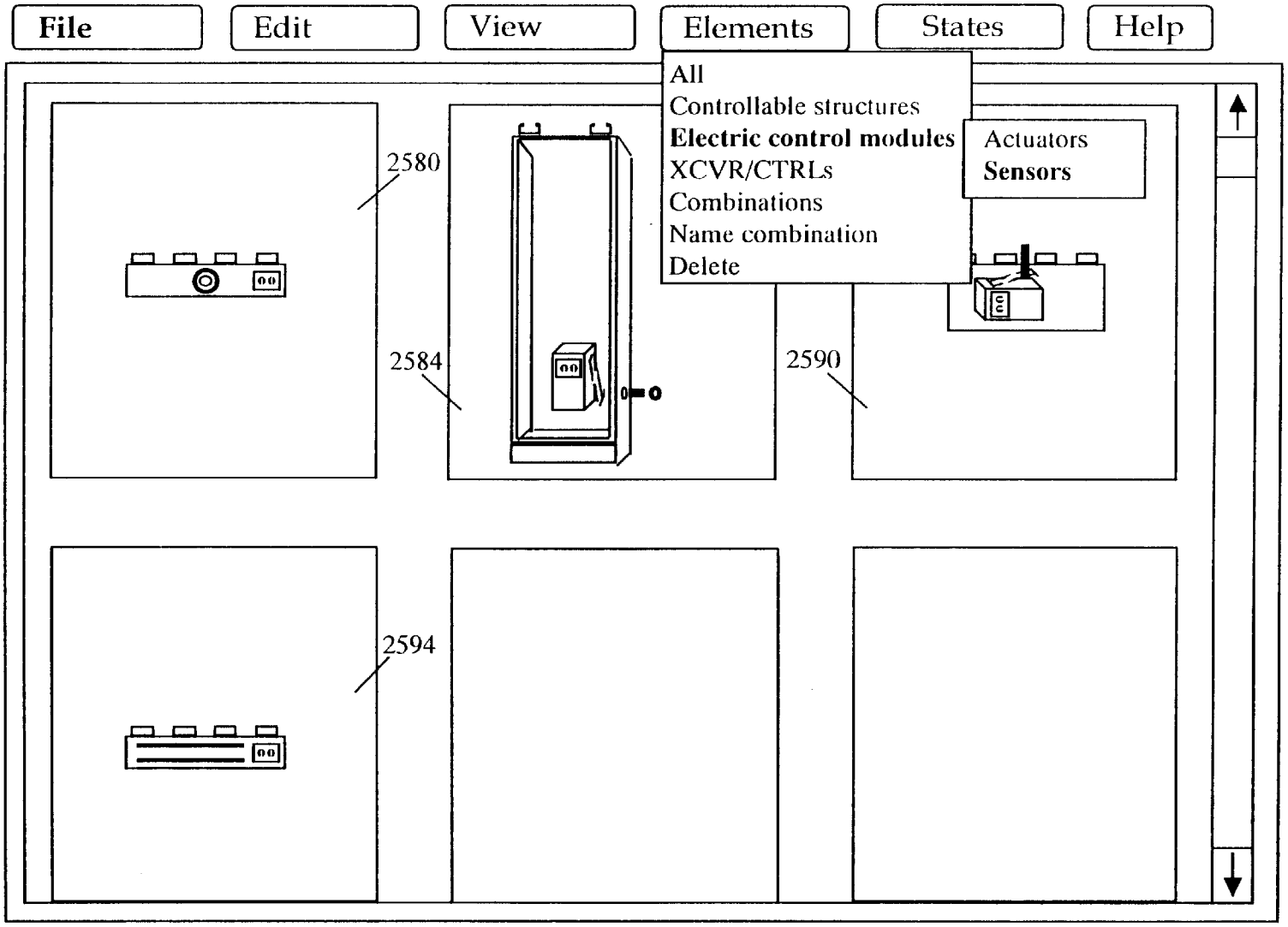

The game structure building stage (step 2506) preferably includes the following two stages each having a physical aspect and a programming (structure defining) aspect:

i. Step 2510—Combining toy elements into desired combinations excepting the transceiver/controller which is an essential component of any combination and which is connected into the combination in the following step 2512. Suitable screen displays enabling a user to perform step 2510 are illustrated in FIGS. 48–50.
ii. Step 2512—Connecting the combination developed in step 2510 to specific port/s of specific transceiver/controller/s.

It is appreciated that the game structure building stage 2506 may include a considerable amount of physical building which does not have a programming counterpart such as physical building of passive structures which neither control nor are controlled and such as physical building of passive components of active structures.

Figure 51:
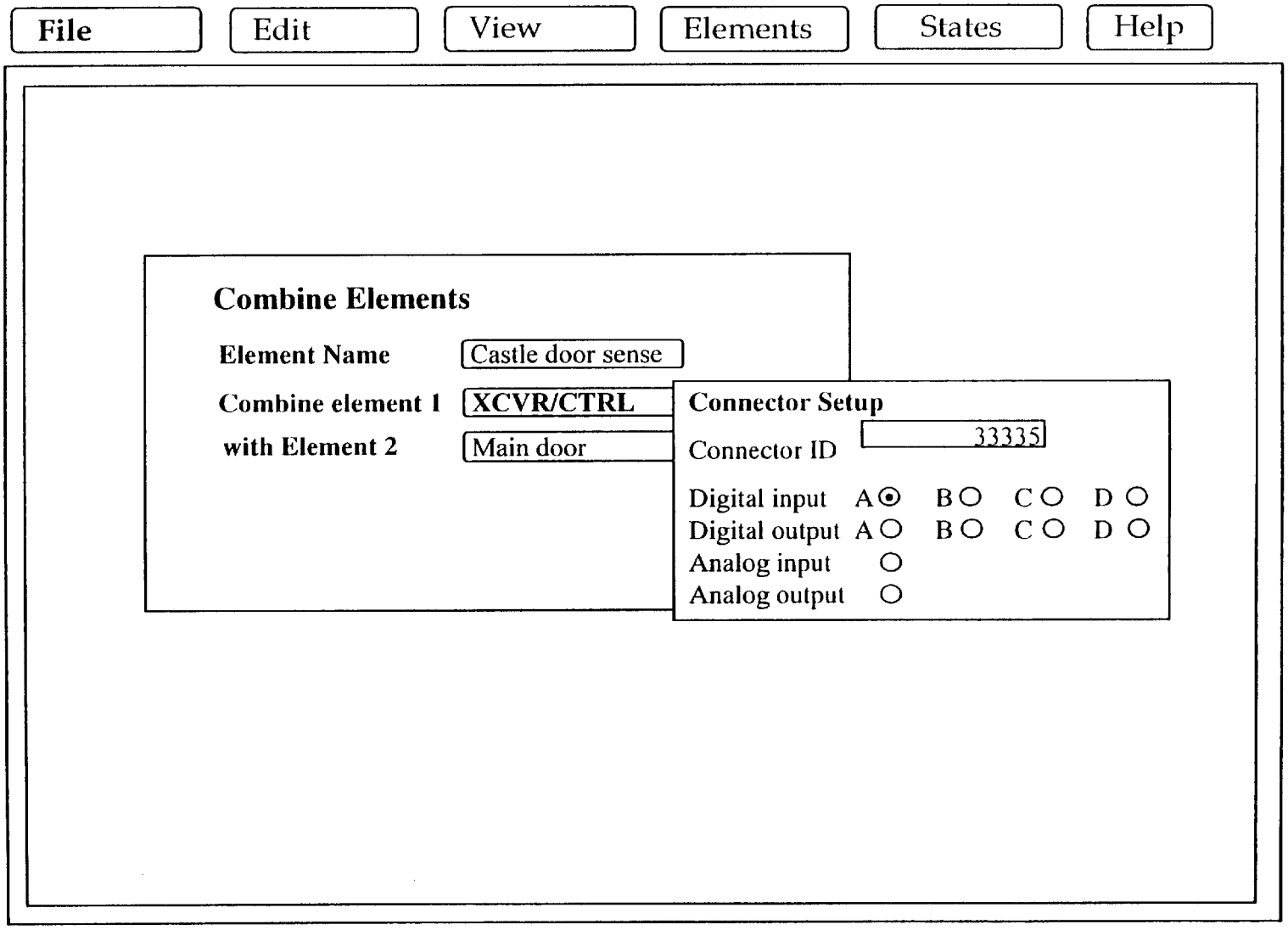

A suitable screen display enabling a user to perform step 2512 is illustrated in FIG. 51.

Figure 52:
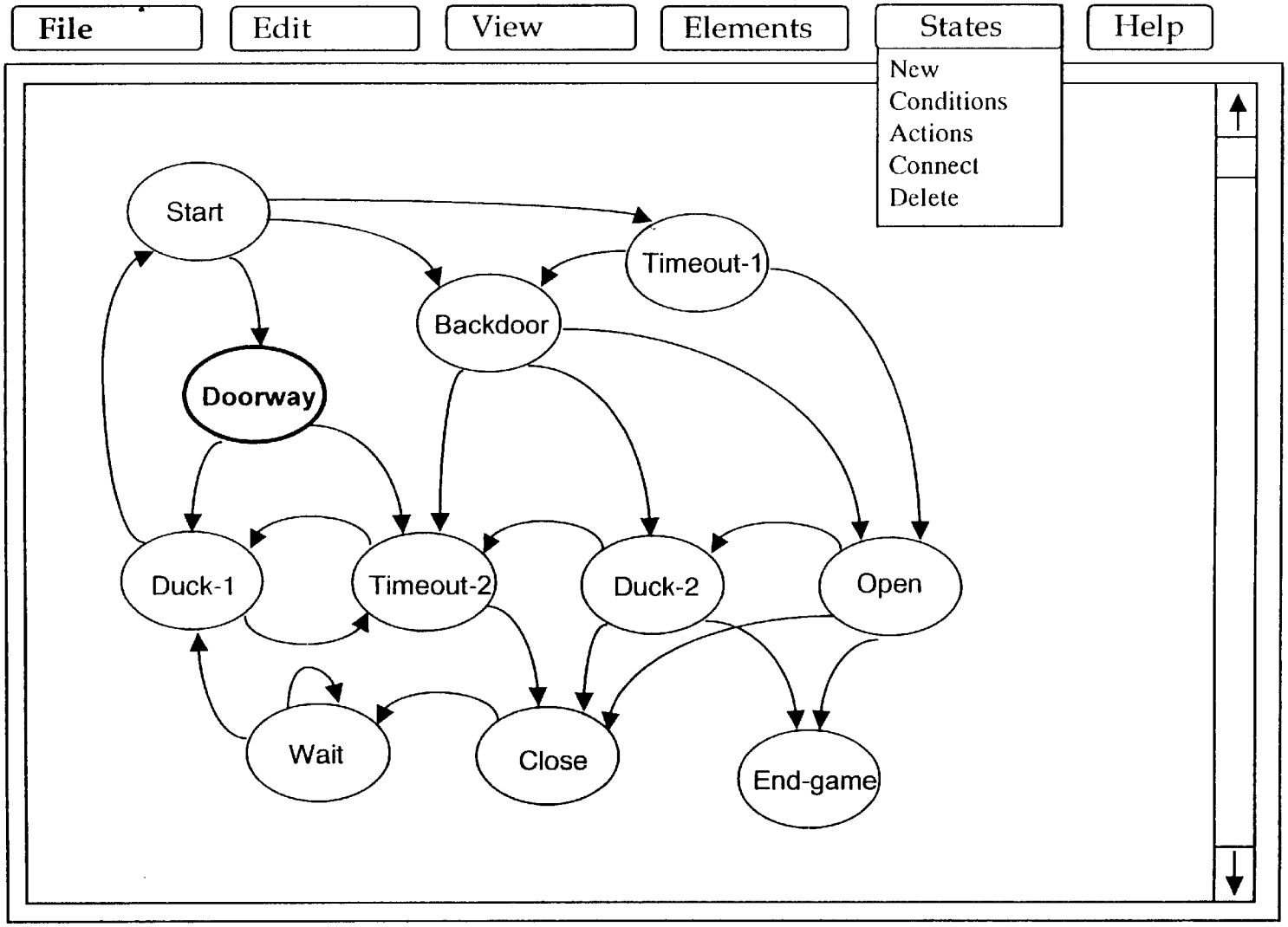

The game script generation stage (step 2508), in which a state machine is constructed which governs the actions of the structures defined in step 2506, typically includes the following steps:

2514—Create new state or select existing state. A suitable screen display enabling a user to perform step 2514 is illustrated in FIG. 52.

Figure 54:
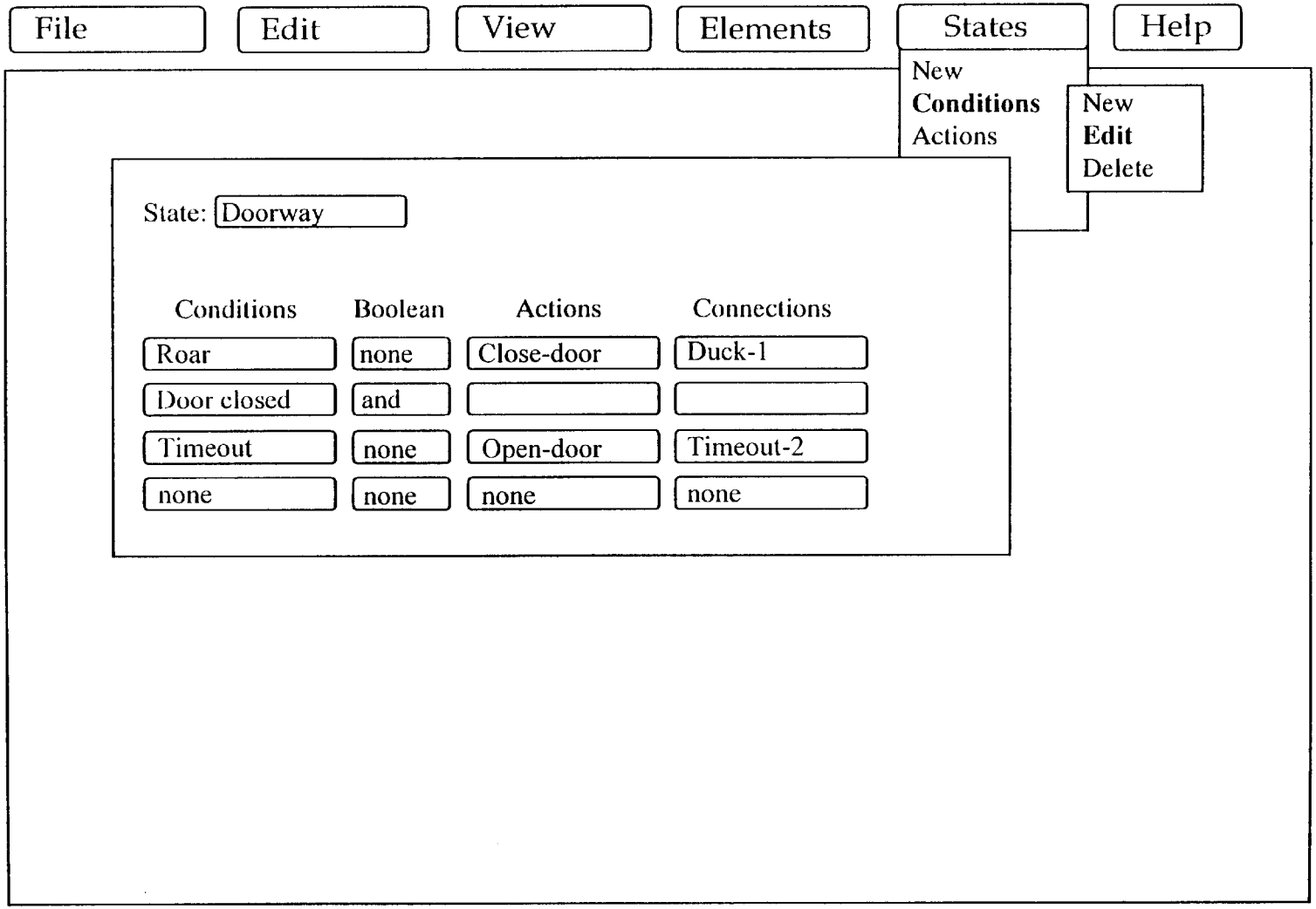

2518—Select controllable structures on which to define conditions and define conditions therefor. A suitable screen display enabling a user to perform step 2518 is illustrated in FIG. 54.

Figure 53:
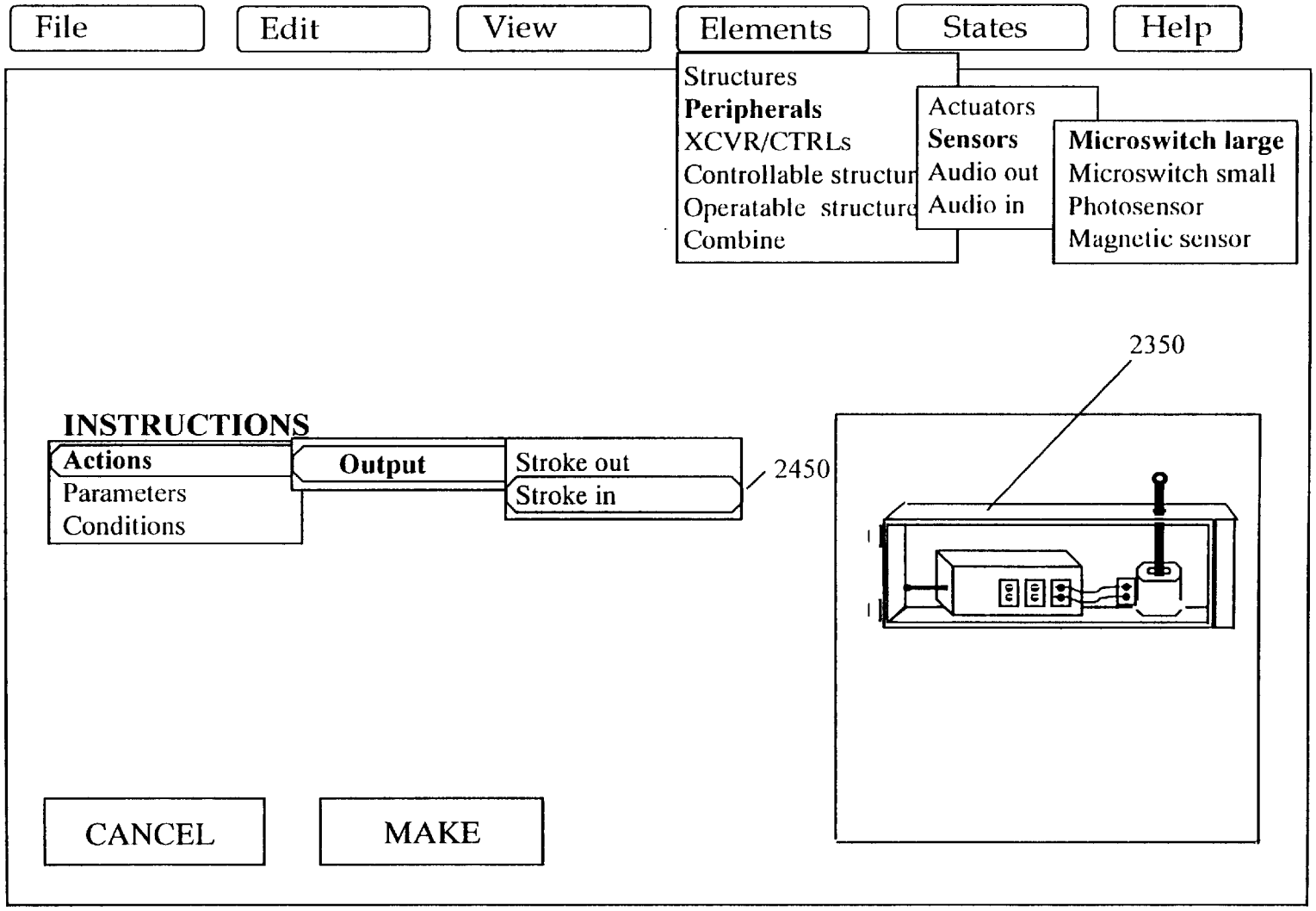

2520—Select controllable structures on which to define actions and define actions therefor, in association with each of the defined conditions. A suitable screen display enabling a user to perform step 2520 is illustrated in FIG. 53.

2522—Define a connection between the current state and another state for each defined condition. Connections may be from the current state to itself. A suitable screen display enabling a user to perform step 2522 is illustrated in FIG. 52 ("connect" option).

2524—If the script (i.e. state machine) is complete the script file is closed (step 2526). Otherwise, the method returns to step 2514.

FIG. 48 is a pictorial illustration of a screen display for the computer 2110 of FIGS. 33A–34. Using the file button 2528, the user is able to manipulate a new or existing file in which to store one or more toy operation schemes or scripts each involving one or more toy structures. A toy operation scheme is a structured set of operations, such as a conditional hierarchy of operations or a conditional network of operations or a conditional or unconditional sequence of operations, to be performed by various elements of one or more toy structures. Once the user has entered a file, the user typically defines a name for the current toy operation scheme and then performs a non-hierarchical textual selection of toy elements to participate in the scheme.

In FIG. 48, the user is in the process of defining a toy structure including two different toy elements, "solenoid" and "door", and naming the toy structure "castle door". It is appreciated that the toy elements are typically named by the system whereas toy structures, including one or more toy elements, are named by the player. For example, "lighted window" is a system-named toy element which may be part of a player-named toy structure, such as "turret window", "lighthouse window", "jail window", etc., either in isolation or in combination with other toy elements such as a light sensor.

Alternatively, as shown in FIG. 49, the user performs a non-hierarchical pictorial selection of toy elements to participate in the scheme. In the illustrated embodiment, the toy element images displayed to the user include a transceiver/controller-solenoid image 2530, a microswitch image 2540, a controllable human figure image 2550, a transceiver/controller/solenoid-door unit image 2560, a lightable window image 2570 and a controllable door image 2580. It is appreciated that the 6 elements shown in FIG. 49 are only exemplary of the many possible toy elements.

Alternatively, as shown in FIG. 50, the user is confronted with a hierarchical display of toy elements available to him. A suitable hierarchy of toy elements may for example include the following categories and sub-categories:

a. Controllable effect producers such as movable toy elements, sound production elements, light production elements. Movable toy elements may include movable human figures or parts thereof, movable animal figures or parts thereof, movable household items or parts thereof, movable vehicles or parts thereof, movable machines or parts thereof b. Electric control modules for controlling the controllable toy elements such as:

1. Actuators (motors, solenoids, etc.) and
2. Sensors (such as microswitches, light sensors, microphones, etc.).

c. Transceiver/controller elements for operating the electric control modules and the electric effect producers by means of a computer via wireless communication;

d. Combinations of the above, e.g. units including two or more of the above types of toy elements such as the unit 2134 of FIG. 41A, previously built and defined by the player-user.

The hierarchical embodiment of FIG. 50, whether pictorial or textual, is particularly suitable when many toy elements are available.

In the illustration of FIG. 50, the player has elected to add to a particular structure an electric control module and further has selected the type of electric control module, namely a sensor rather than an actuator. The system therefore displays pictorial images of 4 possible sensors, including a photodetector 2580, a first model of microswitch 2584, a second model of microswitch 2590 and a magnetic detector 2594.

It is appreciated that the toy element displays of FIGS. 49–50 are useful not only in selecting toy elements for combination into a game structure but also in selecting toy elements for any other purpose, e.g. in order to define an action, forming part of a state machine, or in order to define a condition, forming part of a state machine.

FIG. 51 \ screen display enabling a user-defined toy structure to be associated with a particular connector-pair of a particular transceiver/controller 2100 (FIG. 33A), 2105 (FIG. 33B), 2150 (FIG. 34) or 2160 (FIG. 34). In the illustrated example, the castle door 2560 defined in FIG. 49 is being associated by a user with connector-pair A of a transceiver/controller.

According to one embodiment of the present invention, the software control is limited to only a single transceiver/controller. According to a preferred embodiment of the present invention, more than one transceiver/controller may participate in a single toy operation scheme. According to this embodiment, the transceiver/controller preferably bears a user-legible label or other marking 2136 (FIG. 41A) which indicates to the user the name recognized by computer 2110 for that transceiver/controller. For example, in the illustration of FIG. 51, the castle door is being associated with a particular transceiver/controller whose serial number is "33335".

In FIG. 51, the player indicates to the system the serial number of the transceiver/controller which he is using.

FIGS. 52 onward are a sequence of screen displays which allow a user to define a script or operation scheme for one or more user-selected toy structures, typically by defining a state machine for the selected toy structure/s.

FIG. 52 is a screen display of a game script generated by a user including 11 states and connections therebetween. The user is able to perform any of the following operations:

a. Add a new state to the state machine (FIG. 52, "new" option, which typically results in a new bubble being added to the bubble structure of FIG. 52)

b. Associate a list of conditions with an existing state (FIG. 52, "conditions" option, which leads to the screen display of FIG. 54)

c. Associate actions with particular conditions of a particular state, e.g. using the screen display of FIG. 52, the "conditions" option allows actions and conditions to be associated for the state which was last selected. Once the "conditions" option has been selected, the system advances to the screen display of FIG. 54. Complex actions comprising a sequence of primitive or complex actions, as well as parametric actions can be defined using the screen display of FIG. 55. An example of a parametric action is "text to speech" in which the parameter is a text and the action is producing an utterance which is an oral rendition of the text.

d. Associate connections to another state with particular conditions of a particular state (typically graphically, via the screen display of FIG. 52 with respect to the connections and via the screen display of FIG. 54 with respect to the conditions.

e. Delete an existing state from the state machine, typically, via the "delete" option in FIG. 52 which deletes the currently selected bubble (state) in FIG. 52.

Preferably, the user can modify the features (actions, conditions and connections) of any existing state or alternatively can generate new states or delete any existing state.

FIG. 53 is a screen display enabling a user to associate an action of a particular actuator with a particular condition of a particular state in a current state machine for a game in which the actuator is participating.

In the illustrated embodiment, the user is associating a "stroke in" action 2450 for solenoid 2350 with a condition termed "roar detected" of a state termed "doorway". In other words, the user is designing the game such that if a roar is heard, the stroke of a solenoid associated with a certain doorway will retract and close the door.

FIG. 54 is a screen display enabling the user to associate a condition on a particular sensor with a particular state (or with a particular action or next-state of that particular state) in a current state machine for a game in which the sensor is participating.

Figure 55:
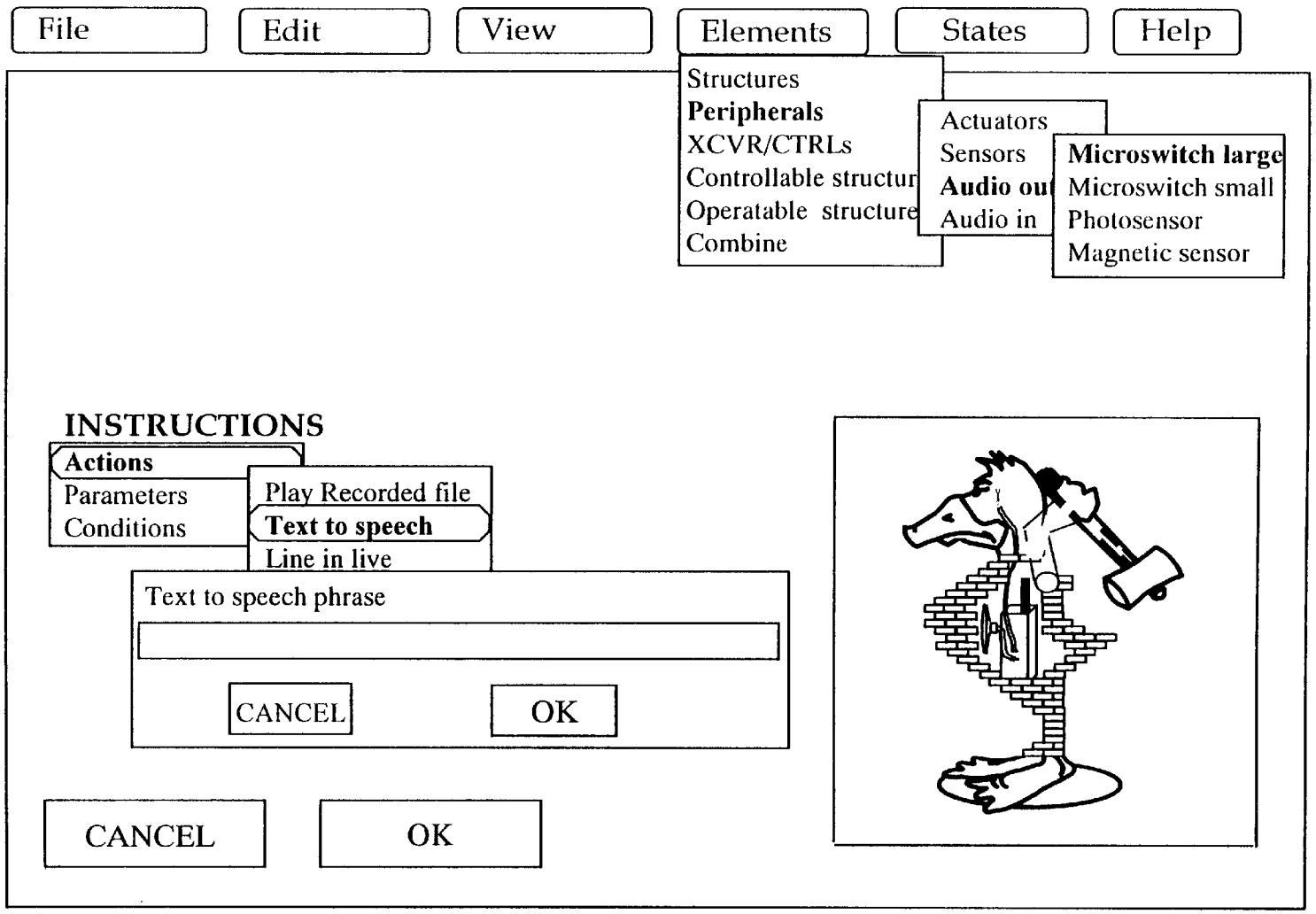

FIG. 55 is a screen display enabling a user to define parameters for parametric actions.

Reference is now made to FIG. 56 which shows a simplified block diagram of the computer radio interface 2105 of FIG. 33B.

Figure 57:
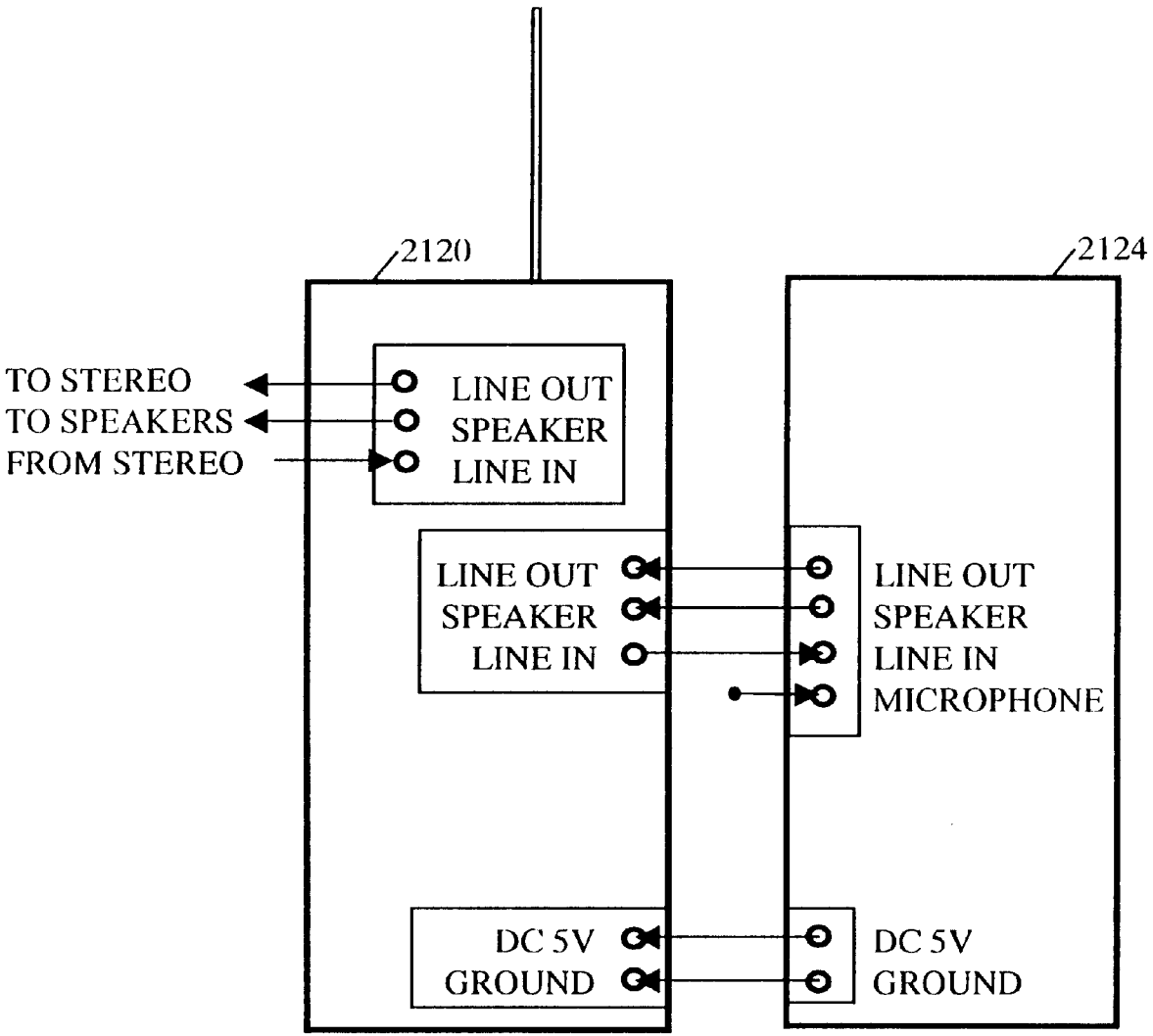

FIG. 57 is a simplified diagram of the interface between computer radio interface 2120 and soundboard 2124. The apparatus of FIG. 57 is generally similar to the apparatus of FIG. 35 except that the MIDI connectors are omitted, such that the apparatus of FIG 57 is useful in conjunction with sound-boards or computers which lack MIDI connectors.

Figure 58:
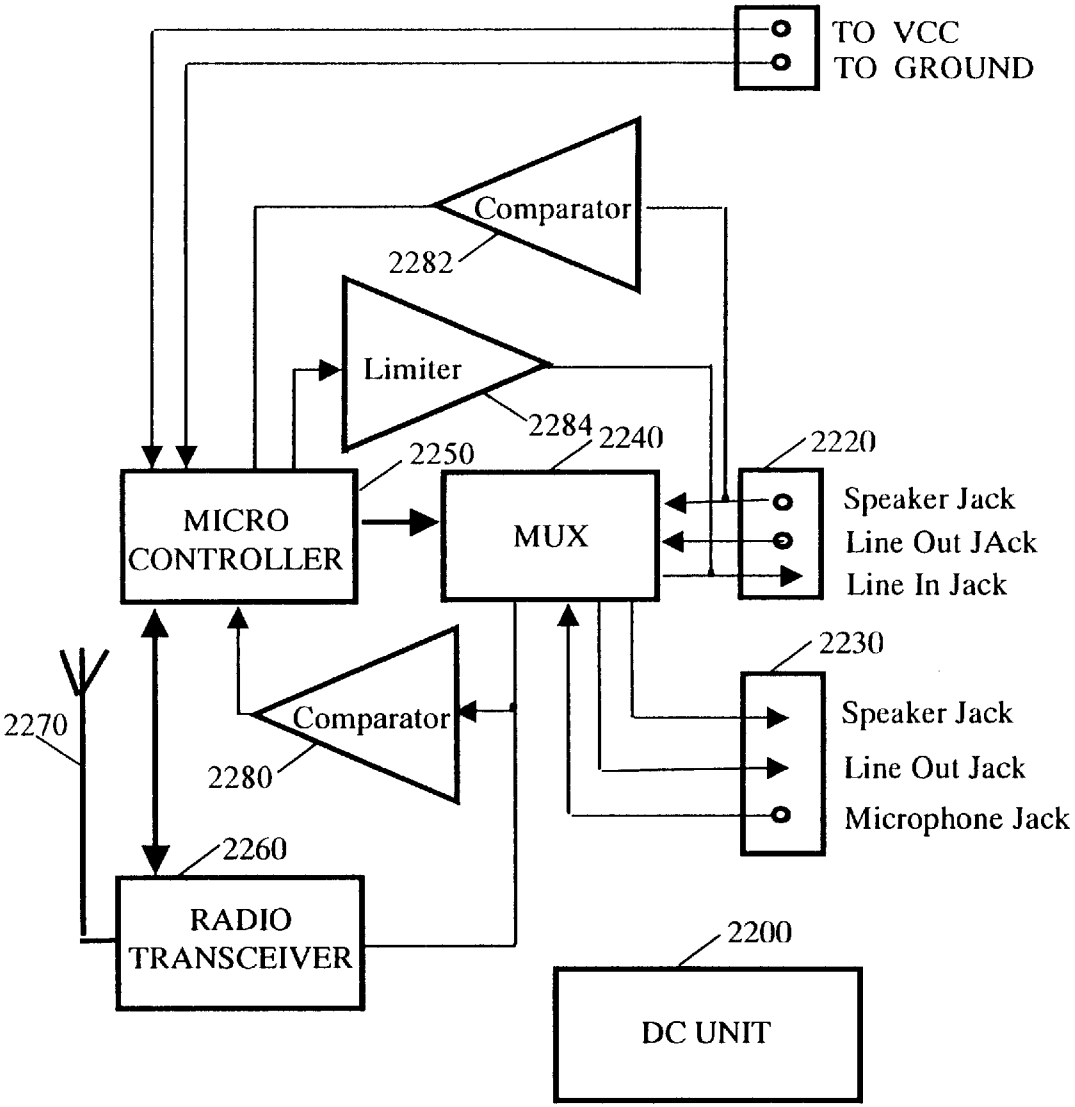

FIG. 58 is a simplified block diagram of computer radio interface 2120. FIG. 58 is generally similar to the apparatus of FIG. 4 except that the MIDI connectors are omitted, such that the apparatus of FIG. 58 is useful in conjunction with sound-boards or computers which lack MDI connectors.

Figure 59:
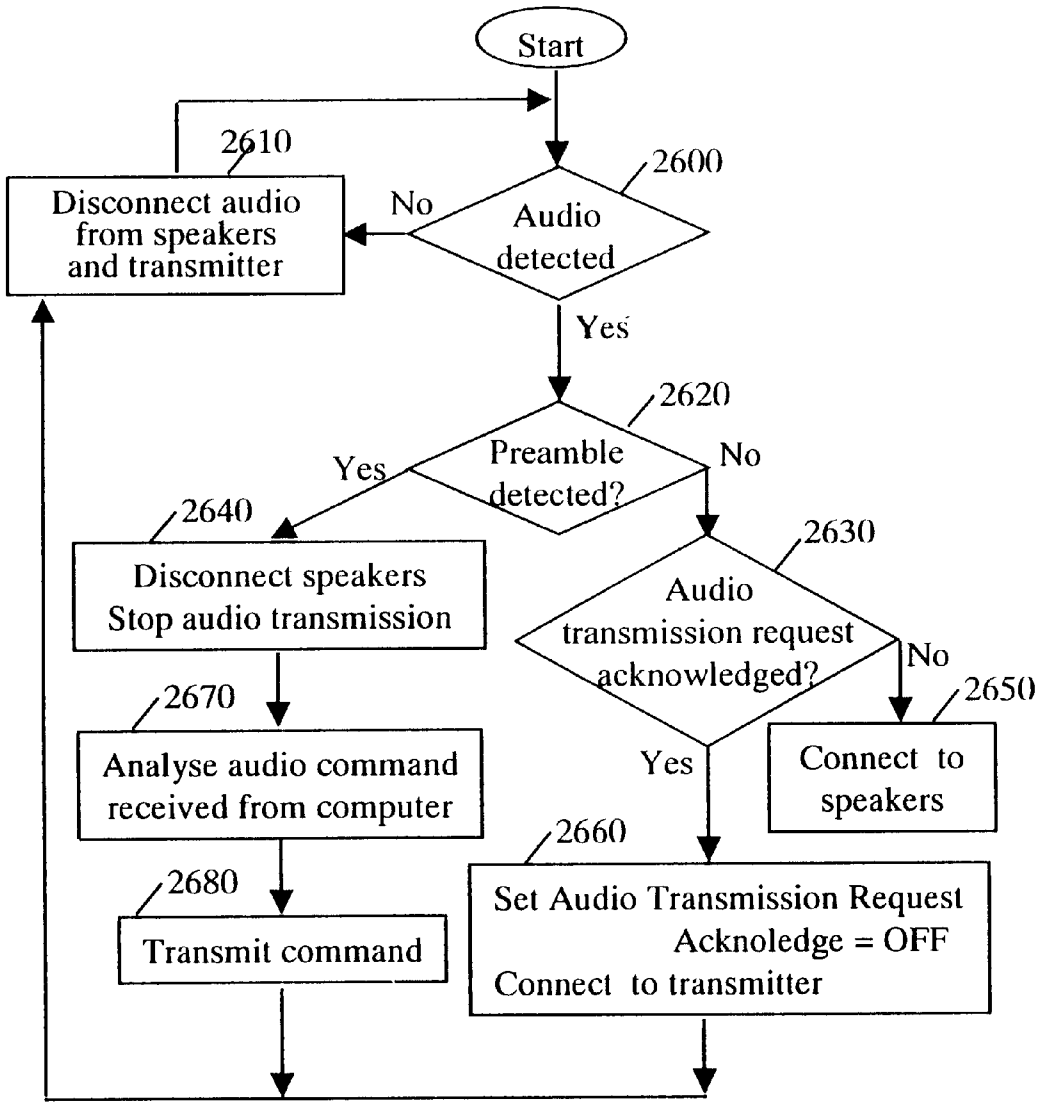

FIG. 59 is a simplified flowchart illustration of a preferred method allowing one of the computer radio interface 2120 and the computer 2110 to receive commands over the audio channel, rather than over the MIDI channel, from the other one of the computer radio interface 2120 and the computer 2110. The method of FIG. 42 first detects whether an audio signal is currently arriving and if so, detects whether the audio signal is audio information (i.e. the contents of an utterance which one of the toy structures' speakers is supposed to emit) or a command. This is preferably effected by detecting whether or not a command-characterizing preamble has been received. The command-characterizing preamble typically comprises SYNC followed by SQ signals as described in detail below with reference to FIG. 59.

Figure 60:
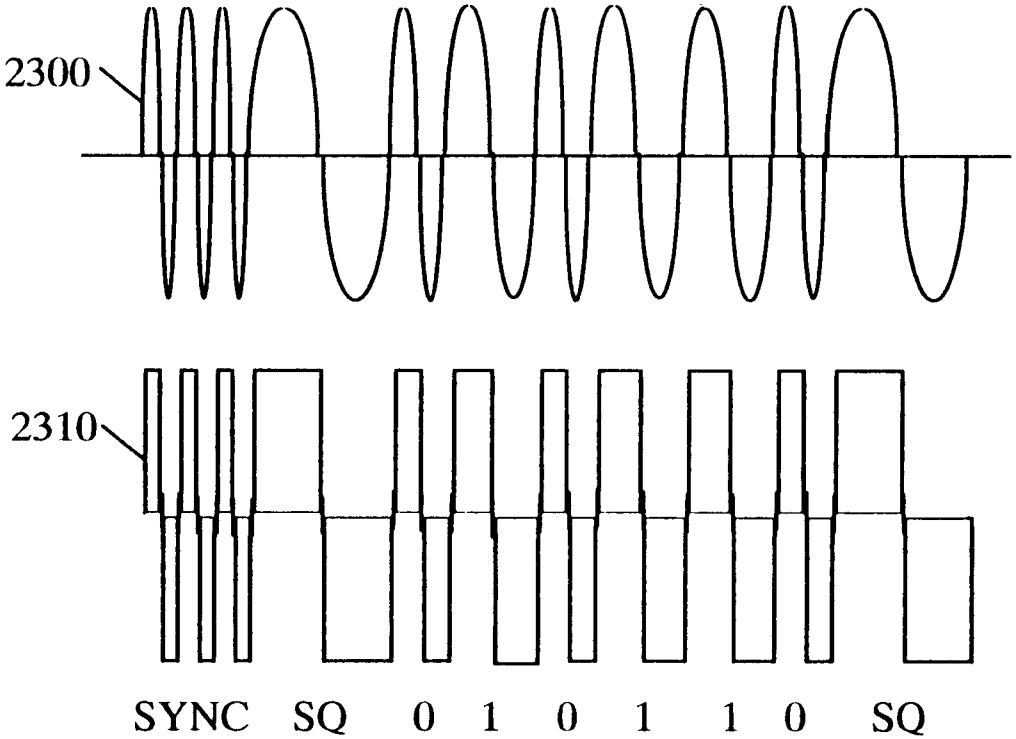
Figure 61A:
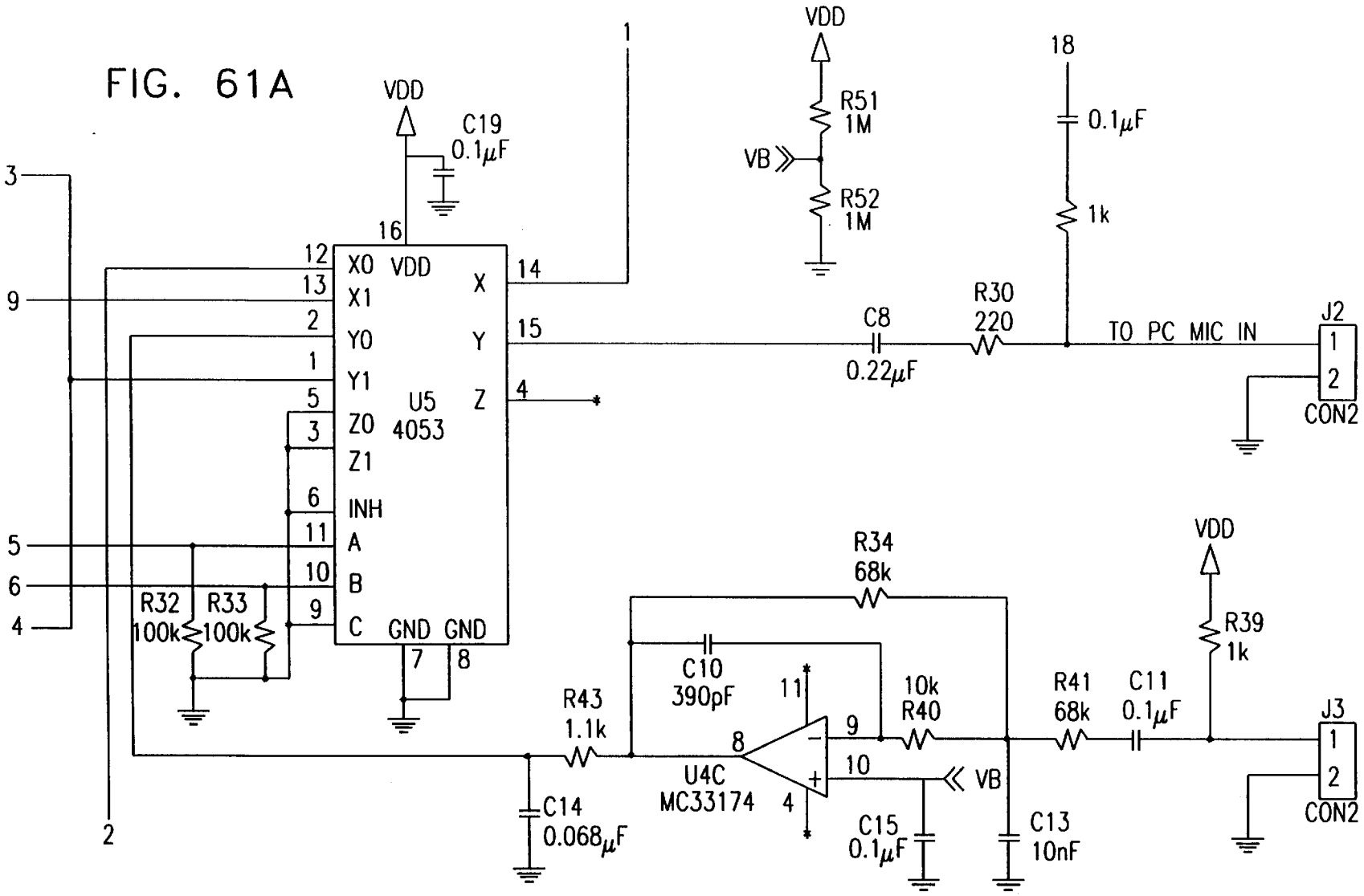
FIGS. 61A–61E, taken together, comprise a detailed electronic schematic diagram of a preferred implementation of the apparatus of FIG. 58.
Figure 61B:
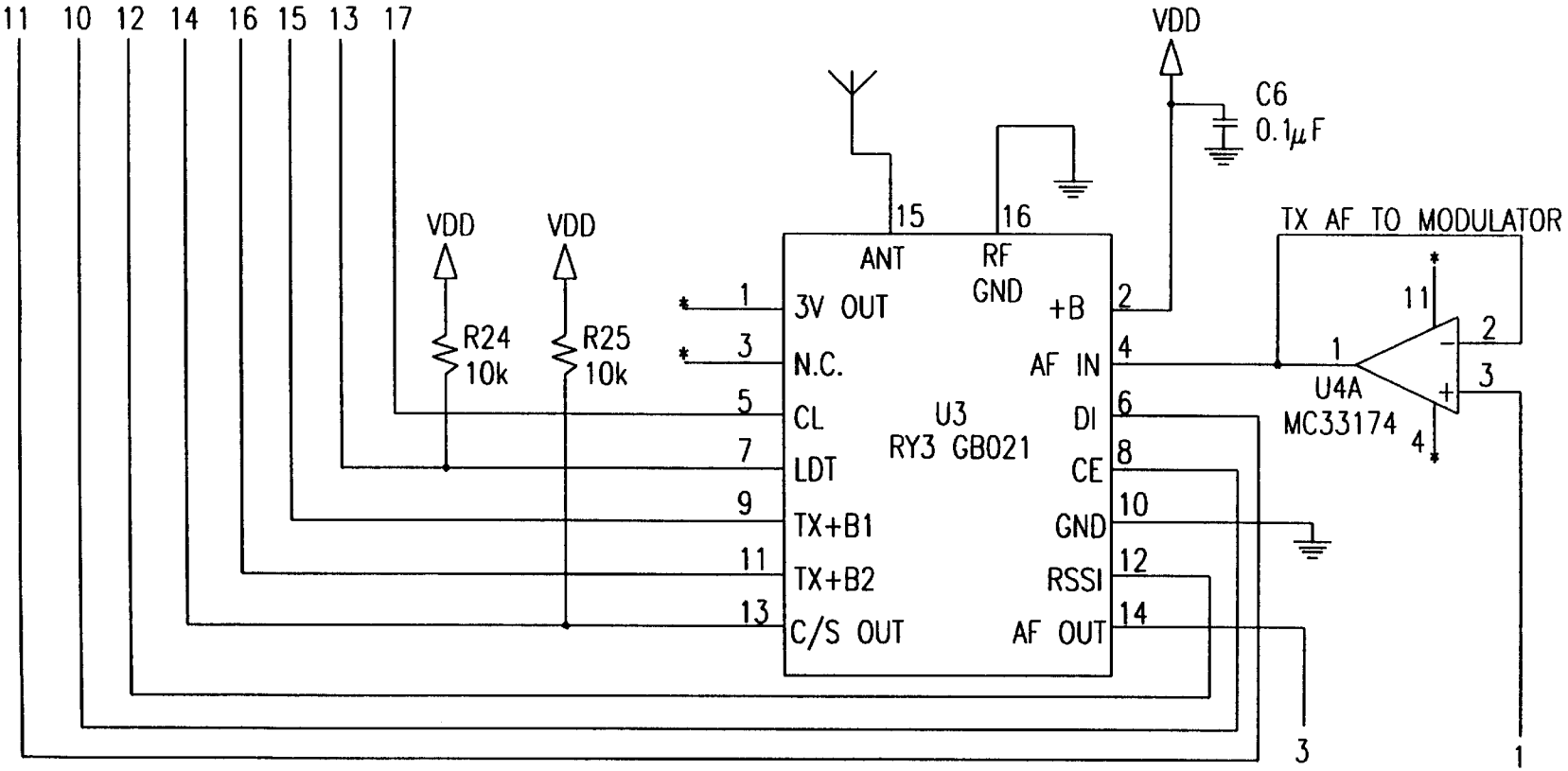
Figure 61C:
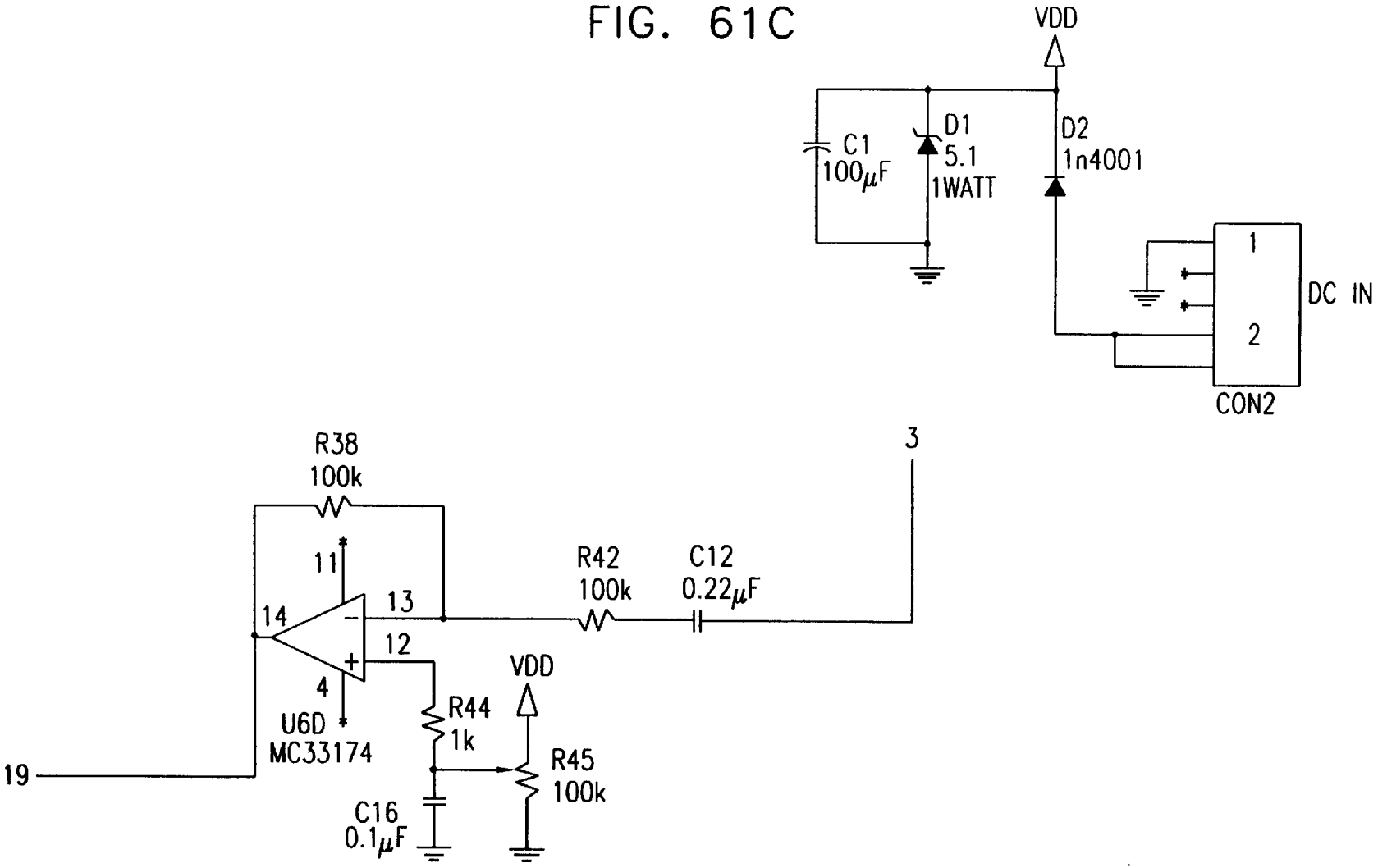
Figure 61D:
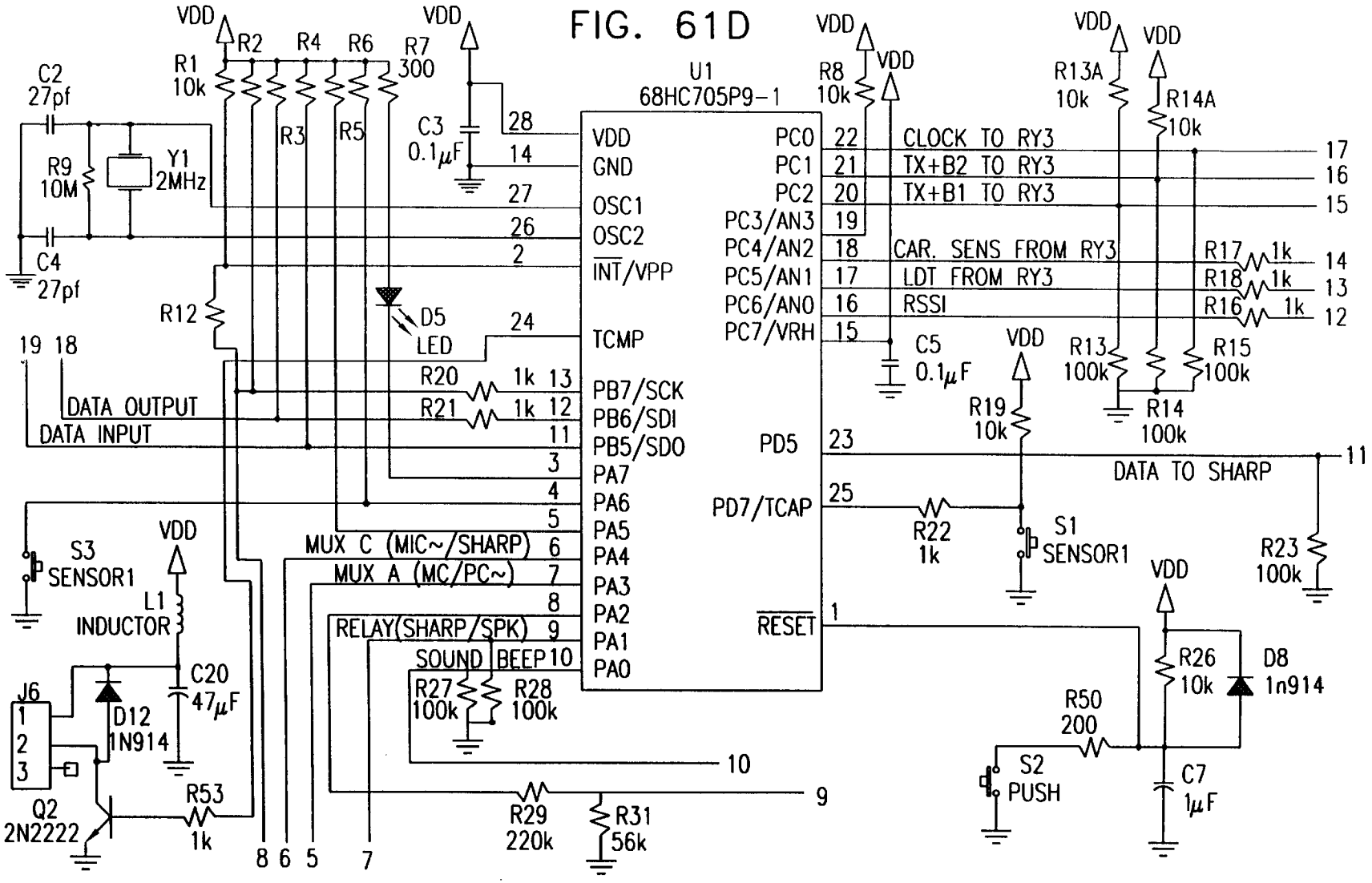
Figure 61E:
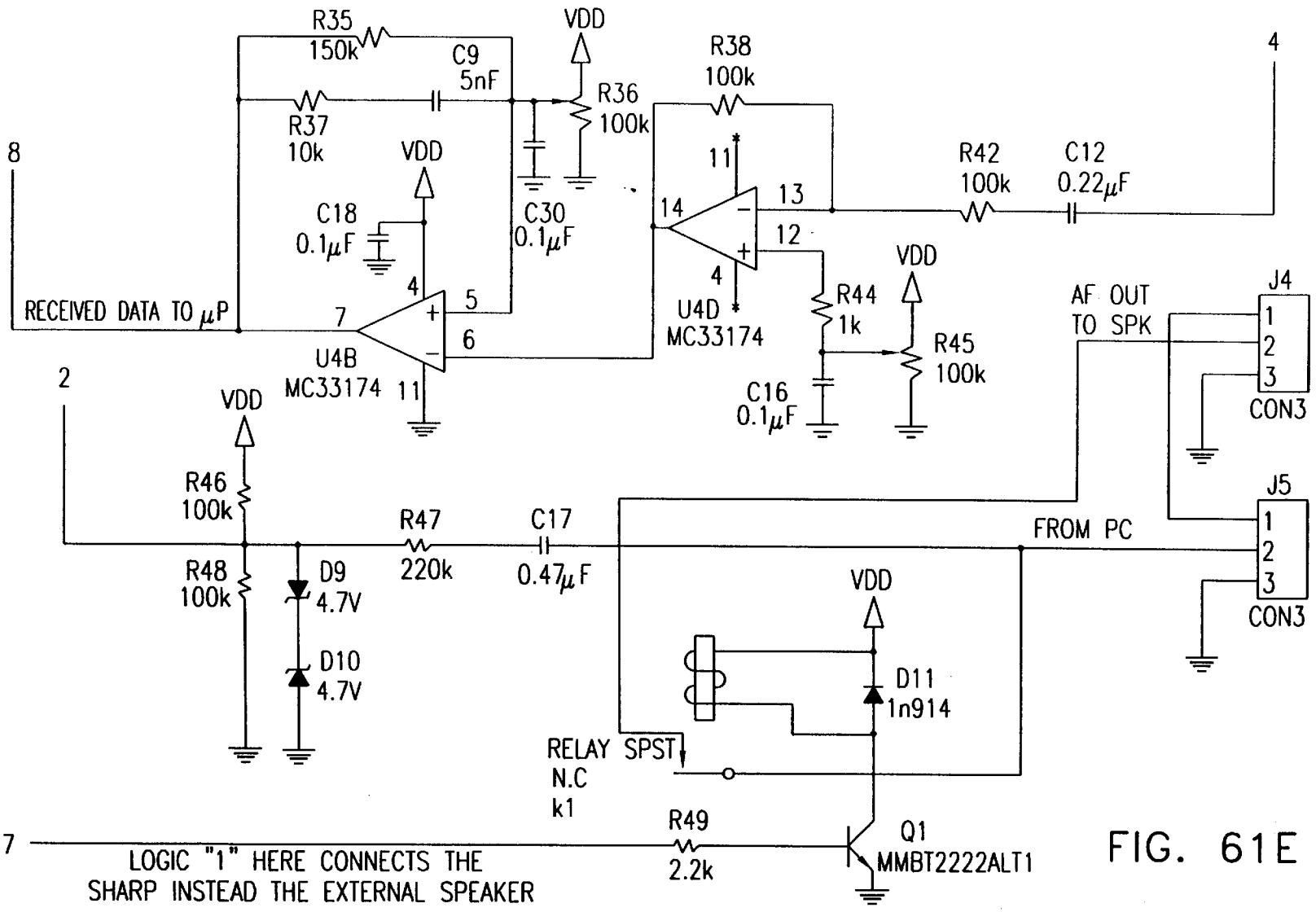

FIG. 60 is a diagram of analog and digital representations 2300 and 2310 respectively of the following signals: SYNC, SQ, zero-valued bit and one-valued bit.

The frequencies and time durations of each of the above signals are as follows:

| SIGNAL | FREQUENCY | TIME DURATION |
|---|---|---|
| SYNC | Hz | 0.5 msec |
| SQ | 500 Hz | 2 msec |
| zero | 1 Hz | 1 msec |
| one | 666 Hz | 1.5 msec |

Preferably more than one audio channel connects the sound board 2124 and the computer radio interface 2120, and typically a first audio channel transmits audio signals from the sound board to the computer radio interface and a second audio channel transmits audio signals in the opposite direction.

Figure 62:
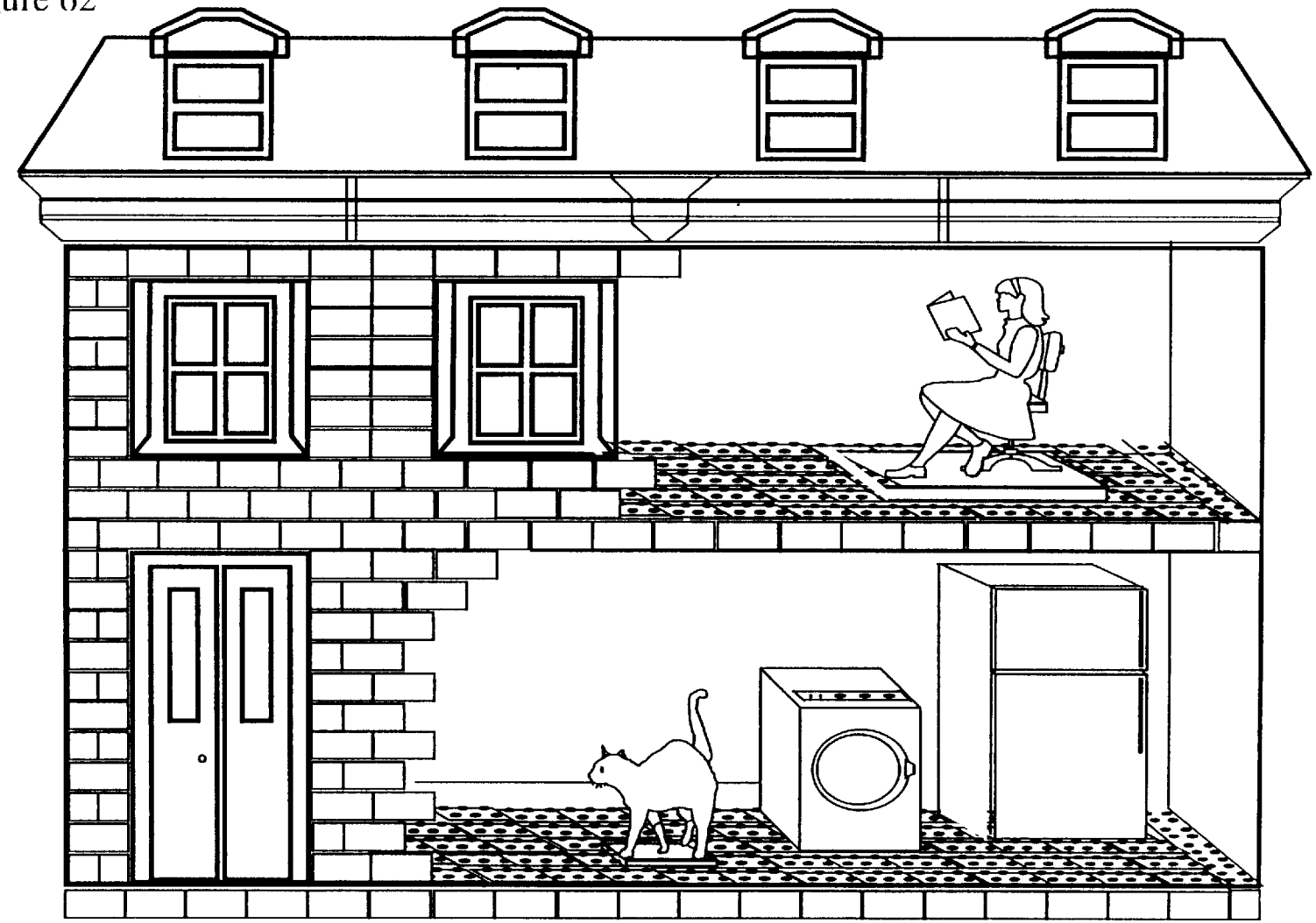

FIGS. 61A–61E, taken together, comprise a detailed electronic schematic diagram of a preferred implementation of the apparatus of FIG. 58, and Reference is now made to FIG. 62 which is a pictorial illustration of an assembleable toy house, built from interlocking bricks and including interior household item models fixedly mounted on stands which interlock with the structure of the house.

It is appreciated that, for users having a relatively low level of playing skill, the screen displays of FIGS. 48 and 51 may be eliminated if the toy structures employed by the user are configured in accordance with a pre-defined design. For example, in FIG. 33, an interlocking building block set may be purchased with assembly instructions explaining how to build a castle and a roaring duck of the configurations illustrated.

It is appreciated that the apparatus of the present invention is adaptable for any interlocking toy element having an electronically controlled functionality such as motion, sensing capabilities, illumination and sound generation. The pictorial illustrations of the interlocking toy element are not necessarily to scale.

It is appreciated that the software components of the present invention may, if desired, be implemented in ROM (read-only memory) form. The software components may, generally, be implemented in hardware, if desired, using conventional techniques.

It is appreciated that the particular embodiment described in the Appendices is intended only to provide an extremely detailed disclosure of the present invention and is not intended to be limiting.

It is appreciated that various features of the invention which are, for clarity, described in the contexts of separate embodiments may also be provided in combination in a single embodiment. Conversely various features of the invention which are, for brevity, described in the context of a single embodiment may also be provided separately or in any suitable subcombination.

It will be appreciated by persons skilled in the art that the present invention is not limited to what has been particularly shown and described hereinabove. Rather, the scope of the present invention is defined only by the claims that follow the appendices which are:

To generate a DLL (dynamic loading and linking) function library based on Appendices E - H, the following operations are performed:

1) Open Visual C++ 4.0

2) Go to File Menu

3) Choose New from File Menu

4) Choose Project Workspace

5) Choose Dynamic-Link Library

6) The Project Name is : DLL32.MDP

7) Press Create button

8) Go to File Menu

9) Choose New from File Menu

10) Choose Text File

11) Now write the Source

12) Write on the current page a file containing the contents of Appendix E

13) Press the mouse right button and choose: Insert File Into Project

14) Click on DLL32 project

15) On the save dialog write CREATOR.C

16) Press the OK button

17) Go to File Menu

18) Choose New from File Menu

19) Choose Text File

20) Write on this page a file containing the contents of Appendix F; 21) Go to File Menu 22) Press Save 23) On the save dialog write CRMIDI.H 24) Press the OK button 25) Go to File Menu 26) Choose New from File Menu 27) Choose Text File 28) Write on this page a file containing the contents of Appendix G;

29) Go to File Menu

30) Press Save

31) On the save dialog write a file CREATOR.H

32) Press the OK button

33) Go to File Menu

34) Choose New from File Menu

35) Choose Text File

36) Write on this page a file containing the contents of Appendix H;

37) Press the mouse right button and choose: Insert File Into Project

38) Click on DLL32 project

39) On the save dialog write CREATOR.DEF

40) Press the OK button

41) Go to Insert Menu

42) Press File Into Project...

43) On the List Files of Type: Choose Library Files (*.lib)

44) Go to the Visual C++ library directory and choose WINMM.LIB

45) Press the OK button

46) Go to the Build menu

47) Press Rebuild ALL

A description of the commands included in the DLL function library based on Appendices E - H now follows:

A. MIDI input functions 1 - 2:

1. Open MIDI input device

Syntax: long MIDIInOpen(long Device)

This function opens the MIDI device for input.

Return 0 for success, -1 otherwise.

Delphi Example:

```
Device:= 0;
if MIDIInOpen(Device) <> 0 Then
MessageDlg('Error opening MIDI input device', mtError, mbOk, 0);
```

2. Reset MIDI input device

Syntax: long MIDIInReset(void)

this function resets MIDI input device.

Return 0 for success, -1 otherwise.

Delphi Example:

```
if MIDIInRest <> 0 Then
MessageDlg('Error resetting MIDI input device', mtError, mbOk, 0);
```

B. MIDI output functions 3 - 6:

3. Close MIDI input device

Syntax: long MIDIInClose(void)

This function close MIDI input device.

Return 0 for success, -1 otherwise.

Delphi Example:

```
if MIDIInClose <> 0 Then
MessageDlg('Error closing MIDI input device', mtError, mbOk, 0);
```

4. Open MIDI output device

Syntax: long MIDIOutOpen(long Device)

This function opens MIDI output device.

Return 0 if success, -1 otherwise.

Delphi Example:

```
Device:= 0;
if MIDIOutOpen(Device) <> 0 Then
MessageDlg('Error opening MIDI output device', mtError, mbOk, 0);
```

5. Reset MIDI Output device

Syntax: long MIDIOutReset(void)

This function resets MIDI output device.

Return 0 if success, -1 otherwise.

Delphi Example:

```
if MIDIOutReset <> 0 Then
MessageDlg('Error resetting MIDI output device', mtError, mbOk, 0);
```

6. Close MIDI output device

Syntax: long MIDIOutClose(void)

This function close MIDI output device.

Return 0 if success, -1 otherwise.

Delphi Example:

```
Device:= 0;
if MIDIOutClose <> 0 Then
MessageDlg('Error opening MIDI output device', mtError, mbOk, 0);
```

C. General functions 7 - 10:

7. Send Data

Syntax: long SendData(long Data )

This function sends 4 bytes to toy card.

Currently used to send 144 for init toy card.

Return 0 if successful, -1 otherwise.

Delphi Example:

```
If SendData(144) <> 0 Then
MessageDlg('Error sending data to toy', mtError, mbOk, 0);
```

8. Send Message

Syntax: long SendMessage(char *Mess)

This function sends string to toy card.

Return 1 if successful, or errorcode otherwise.

Delphi Example:

```
Mess:= '00 01 00 00 00 00 00 05 00 00 00 01 00 03 00 01 00 00 00';
If SendMessage(Mess) <> 1 Then
MessageDlg('Error opening MIDI output device', mtError, mbOk, 0);
```

9. Check message

Syntax: long CheckMessage(void)

This function returns 0 if no message found from toy card.

Delphi Example:

```
If CheckMessage Then
Mess:= GetMessage;
```

10. Get Message

Syntax: char * GetMessage(char *Mess)

This function returns 20 chars toy message if present, or "Time Out" otherwise.

Delphi Example:

```
If GetMessage = "Time Out" Then
```

MessageDlg('No message received', mtError, mbOk, 0);

D. Toy control functions 11 -16:

11. Get Toy Number

Syntax: char * GetToyNumber(void)

This function returns Toy Number of last receiving message, or "00 00 00 00" if no message was received.

12. Get Sensor Number

Syntax: long GetSensorNumber(void)

This function returns Sensor Number of last receiving message, or 255 if no message was received.

13. Toy Reset

Syntax: long ToyReset(char *ToyNumber)

This function sends a reset string to toy.

Return 0 if successful, or -1 otherwise.

14. Toy Transceive

Syntax: char *ToyTranceive(char *ToyNumber,char *Mess)

This function sends message to toy and waits 3 sec to acknowledge.

Return "Ack. Ok" if received, or "Time Out" if not.

15. Prepare Toy Talk

Syntax: char *PrepareToyTalk(char *ToyNumber, char *WaveFile)

This function prepares toy card to generate sound using toy speaker.

After calling this function, WaveFile may be played and heard at toy speaker.

Return "Ack. Ok" if successful, or "Time Out" otherwise.

16. Go To Sleep Mode

Syntax: char *GoSleep(char *ToyNumber)

This function sends to toy the sleep command.

Return "Ack. Ok" if successful, or "Time Out" otherwise.

Appendices I - O, taken together, are computer listings of a second functions library which may be used to generate a variety of games for any of the computer control systems shown and described herein in conjunction with a Director 5.0 software package, marketed by Macromedia Inc., 600 Townsend St., San Francisco, CA, 94103.

To generate an XObject function library based on Appendices I - O, the following operations are performed:

1) Create a new directory : C:\XOBJECT\ by writing ( MD C:\XOBJECT\ )

2) Open Visual C++ 1.5

3) On the File menu choose NEW

4) Generate a file which contains the contents of Appendix I;

5) Choose Save As from the File Menu

6) Give the file generated in step (4) a name by punching C:\XOBJECT\CREATOR.MAK 7) Press the OK button 8) On the File menu choose NEW 9) Generate a file which contains the contents of Appendix J;

10) On the File menu choose Save As.

11) In the File Name: dialog, write C:\XOBJECT\CREATOR.C

12) Press the OK button

13) On the File menu choose NEW

14) Generate a file which contains the contents of Appendix K;

15) On the File menu choose Save As.

16) In the File Name: dialog write C:\XOBJECT\CREATOR.H

17) Press the OK button

18) On the File menu choose NEW

19) Generate a file which contains the contents of Appendix L;

20) On the File menu choose Save As.

21) In the File Name: dialog write C:\XOBJECT\CRMIDI.H

22) Press the OK button

23) On the File menu choose NEW

24) Generate a file which contains the contents of Appendix M;

25) On the File menu choose Save As.

26) In the File Name: dialog write C:\XOBJECT\XOBJECT.H

27) Press the OK button

28) On the File menu choose NEW

29) Generate a file which contains the contents of Appendix N;

30) On the File menu choose Save As.

31) In the File Name: dialog write C:\XOBJECT\CREATOR.DEF

32) Press the OK button

33) On the File menu choose NEW

34) Generate a file which contains the contents of Appendix O;

35) On the File menu choose Save As.

36) In the File Name: dialog write C:\XOBJECT\CREATOR.RC

37) Press the OK button

38) On the Project Menu choose Open

39) In the File Name dialog write C:\XOBJECT\CREATOR.MAK

40) Press Rebuild All from the Project Menu

A description of the commands included in the XObject function library based on Appendices I - O now follows:

A. MIDI input functions 1 - 3:

1. Open MIDI input device

Syntax: long MIDIInOpen(long Device)

This function opens the MIDI device for input.

Return 0 for success, -1 otherwise.

Delphi Example:

```
Device:= 0;
if MIDIInOpen(Device) <> 0 Then
MessageDlg('Error opening MIDI input device', mtError, mbOk, 0);
```

2. Reset MIDI input device

Syntax: long MIDIInReset(void)

This function resets MIDI input device.

Return 0 for success, -1 otherwise.

Delphi Example:

```
if MIDIInRest <> 0 Then
MessageDlg('Error resetting MIDI input device', mtError, mbOk, 0);
```

3. Close MIDI input device

Syntax: long MIDIInClose(void)

This function turns off MIDI input device.

Return 0 for success, -1 otherwise.

Delphi Example:

```
if MIDIInClose <> 0 Then
MessageDlg('Error closing MIDI input device', mtError, mbOk, 0);
```

B. MIDI output functions 4 - 6:

4. Open MIDI output device

Syntax: long MIDIOutOpen(long Device)

This function opens MIDI output device.

Return 0 if success, -1 otherwise.

Delphi Example:

```
Device:= 0;
if MIDIOutOpen(Device) <> 0 Then
MessageDlg('Error opening MIDI output device', mtError, mbOk, 0);
```

5. Reset MIDI Output device

Syntax: long MIDIOutReset(void)

This function resets MIDI output device.

Return 0 if success, -1 otherwise.

Delphi Example:

```
if MIDIOutReset <> 0 Then
MessageDlg('Error resetting MIDI output device', mtError, mbOk, 0);
```

6. Close MIDI output device

Syntax: long MIDIOutClose(void)

This function close MIDI output device.

Return 0 if success, -1 otherwise.

Delphi Example:

```
Device:= 0;
if MIDIOutClose <> 0 Then
MessageDlg('Error opening MIDI output device',
mtError, mbOk, 0);
```

C. General functions 7 - 11:

7. New

Syntax: Creator(mNew)

This function creates a new instance of the XObject

The result is 1 if successful, or error code otherwise.

Example:

```
openxlib "Creator.Dll"
Creator(mNew)
...
Creator(mDispose)
```

See also: Dispose

8. Dispose

Syntax: Creator(mNew)

This function disposes of XObject instance.

The result is 1 if successful, or error code otherwise.

Example:

```
openxlib "Creator.Dll"
Creator(mNew)
...
Creator(mDispose)
```

See also: New

9. Send Message

Syntax: long SendMessage(char *Mess)

This function sends string to toy card.

Return 1 if successful, or error code otherwise.

Delphi Example:

```
Mess:= '00 01 00 00 00 00 00 05 00 00 00 01 00 03 00 01 00 00 00';
If SendMessage(Mess) <> 1 Then
```

MessageDlg('Error opening MIDI output device', mtError, mbOk, 0);

10. Check message

Syntax: long CheckMessage(void)

This function returns 0 if no message found from toy card.

Delphi Example:

If CheckMessage Then

Mess:= GetMessage;

11. Get Toy Message

Syntax: GetToyMessage

This function receives message from toy.

The result is a message.

If during 3 sec there is no message, the result is "Time Out".

Example:

set message = GetToyMessage

If message = "Time Out" Then put "No message receiving"

End If

See also: Check for Message

D. Toy control functions 12 - 17:

12. Get Toy Number

Syntax: char * GetToyNumber(void)

This function returns Toy Number of last receiving message, or "00 00 00 00" if no message was received.

13. Get Sensor Number

Syntax: long GetSensorNumber(void)

This function returns Sensor Number of last receiving message, or 255 if no message was received.

14. Toy Reset

Syntax: long ToyReset(char *ToyNumber)

This function sends a reset string to toy.

Return 0 if successful, or -1 otherwise.

15. Toy Tranceive

Syntax: char *ToyTranceive(char *ToyNumber,char *Mess)

This function sends to toy message and waits 3 sec to acknowledge.

Return "Ack. Ok" if received, or "Time Out" if not.

16. Prepare Toy Talk

Syntax: char *PrepareToyTalk(char *ToyNumber, char *WaveFile)

This function prepares toy card to generate sound using from toy speaker.

After calling this function, WaveFile may be played and heard at toy speaker.

Return "Ack. Ok" if successful, or "Time Out" otherwise.

17. Go To Sleep Mode

Syntax: char *GoSleep(char *ToyNumber)

This function sends to toy the sleep command.

Return "Ack. Ok" if successful, or "Time Out" otherwise.

To use the XObject function library in conjunction with the Director, the following method may be employed:

1) Open Director Version 5.0 program

2) From File Menu, choose New

3) Press the Movie Option

4) Go to Windows menu and press Cast

5) Go to the first Script on the cast

6) On the Window menu choose Script

7) Write the script of the desired game.

8) Repeat from step 5 until all desired script(s) have been written. Press (Ctrl+Alt+P) to run the Application.

Appendices P - W, taken together, are computer listings of another preferred software implementation, alternative to the implementation of Appendices A - O.

To construct and operate the implementation of Appendices P - W, the following operations are performed:

1) Provide a computer capable of running the WINDOWS 95 operating system;

2) Prepare computer files for each of the files contained in Appendix P and place the computer files in a directory named "ocx";

3) Prepare a computer file for the file contained in Appendix Q, extract the compressed contents of the file using Winzip version 6.2 available from Nico Mak Computing, Inc. of Bristol, CT 06011 USA, and place the extracted computer files in the directory named "ocx";

4) Prepare computer files for each of the files contained in Appendix R and place the computer files in a directory named "player";

5) Prepare a computer file for the file contained in Appendix S, extract the compressed contents of the file using Winzip version 6.2, and place the extracted computer files in a subdirectory named "res" contained in the directory named "player";

6) Prepare computer files for each of the files contained in Appendices T and U and place the computer files in a directory named "xmidi5";

7) Prepare a computer file for the file contained in Appendix V, extract the compressed contents of the file using Winzip version 6.2, and place the extracted computer files in the directory named "xmidi5";

8) Prepare a computer file named NEWDEMO.CS the file contained in Appendix W and place the files in the directory named "player";

9) Install the Microsoft Development Studio Version 5.0 available from Microsoft Corporation, One Microsoft Way, Redmond, Washington USA;

10) Run the Microsoft Development Studio, select FILE/OPEN WORKSPACE from the menu, select the file \OCX\NEWSR.DSW, select BUILD from the menu, select BUILD NEWDEMO.OCX, select FILE/OPEN WORKSPACE from the menu, select the file \PLAYER\PLAYER.DSW, select BUILD from the menu, select BUILD PLAYER.EXE;

11) Compile \XMIDI5\XMIDI.DSW using Visual C++ Version 5.0 and run the OCX registration program REGSVR32.EXE with XMIDI5.OCX on the command line;

12) Install the "American English Text To Speech Software Development Kit" for WINDOWS 95/WINDOWS NT from Lernout & Hauspie Speech Products, Sint-Krispisnstraat 7, 8900 Leper, Belgium;

13) Run PLAYER.EXE in DOS mode from the \PLAYER directory by invoking "player newdemo.cs".

Reference is now made to Fig. 16 which is a simplified flowchart illustration of a preferred method of operation of a computer radio interface (CRI) 110 operative to service an individual computer 100 of Fig. 1A without interfering with other computers or being interfered with by the other computers, each of which is similarly serviced by a similar CRI. Typically, the method of Fig. 16 is implemented in software on the computer 100 of Fig. 1A.

The CRI includes a conventional radio transceiver (260 of Fig. 4) which may, for example, comprise an RY3 GB021 having 40 channels which are divided into 20 pairs of channels. Typically, 16 of the channel pairs are assigned to information communication and the remaining 4 channel pairs are designated as control channels.

In the method of Fig. 16, one of the 4 control channel pairs is selected by the radio interface (step 810) as described in detail below in Fig. 17. The selected control channel pair i is monitored by a first transceiver (step 820) to detect the appearance of a new toy which is signaled by arrival of a toy availability command from the new toy (step 816). When the new toy is detected, an

We claim:

1. A programmable assembly toy system comprising:

a personal computer;

a multiplicity of toy elements which are joinable to define a player selectable structure, the multiplicity of toy elements including:

a plurality of controllable toy elements; and at least one controller;

wherein the at least one controller has a data flow relationship with the personal computer, thereby to provide indirect control of said controllable toy elements by the personal computer, and wherein said at least one controller is remote from said computer and is operative to receive a logic command from the computer and to convert said logic command into an output signal actuating at least one of the plurality of controllable toy elements.

2. A programmable assembly toy according to claim 1 and also comprising a toy application generator useful with said player programmable control system for enabling a player to program said player programmable control system.

3. A programmable assembly toy according to claim 2 and wherein said toy application generator provides multiple levels of programming ease so as to be suitable for use by players of different ages and skill levels.

4. A programmable assembly toy according to claim 1 and wherein said multiplicity of toy elements comprises interlocking building blocks.

5. A programmable assembly toy according to claim 1 wherein said player programmable control system is wirelessly associated with at least one of said multiplicity of toy elements.

6. A toy according to claim 1 wherein said player programmable control system comprises a computer;

and wherein said multiplicity of toy elements includes:

a first toy element having a radio transceiver/controller; and a second toy element associated by wire with said computer and including:

a radio transceiver operative to provide radio communication between said computer and said first toy element; and a controller operative to control said second toy element.

7. A toy according to claim 1 wherein said player programmable control system comprises:

a computer;

a computer radio interface communicating commands to the player selectable structure; and a sound board device having at least one audio channel over which commands from the computer are transmitted to the computer radio interface over the at least one audio channel.

8. A toy according to claim 7 and also comprising an audio channel from the computer radio interface to the sound board device over which digital information arriving from the player selectable structure is transmitted to the computer.

9. A toy according to claim 1 wherein said multiplicity of toy elements comprise at least one microphone and wherein said control system comprises a speech recognition unit operative to recognize speech sensed by said at least one microphone and an speech-driven operation controller for controlling the operation of the plurality of controllable toy elements at least partly in accordance with contents of said speech.

10. A system according to claim 1 wherein said at least one controller comprises a microprocessor.

11. A system according to claim 1 wherein said at least one controller has a data receiving relationship with the computer.

12. A system according to claim 1 wherein said at least one controller has a data feeding relationship with the computer.

13. A system according to claim 11 wherein said at least one controller has a data feeding relationship with the computer.

14. A system according to claim 1 wherein at least one of the controllable toy elements comprises an electrical device.

15. A system according to claim 1 wherein said toy elements interlock to define the player selectable structure and said controllable toy elements are interlockable by the player with the selectable structure and at least one of said controllers is interlockable to individual ones of said multiplicity of toy elements.

16. A system according to claim 1 wherein said at least one controller comprise a plurality of controllers.

17. A system according to claim 1 wherein said plurality of controllable toy elements comprises at least one actuator.

18. A system according to claim 1 wherein said plurality of controllable toy elements comprises at least one sensor.

19. A system according to claim 1 wherein the data flow relationship between the computer and said at least one controller is provided by a wireless communication link.

20. A system according to claim 1 wherein the data flow relationship between the computer and said at least one controller is provided by a wired communication link.

21. A system according to claim 1 wherein the personal computer sends at least one command to the controller which includes a sequence of actions to be performed.

22. A toy control method comprising:

providing a multiplicity of toy elements joinable to define a player selectable structure including a plurality of controllable toy elements and at least one controller joinable to individual ones of said multiplicity of toy elements;

programming a personal computer to indirectly control the operation of the plurality of controllable toy elements including providing a data flow relationship between the computer and at least one of said controllers; and using said controllers and the computer, once programmed, to control the operation of the plurality of controllable toy elements;

and wherein said at least one controller is remote from said computer and is operative to receive a logic command from the computer and to convert said logic command into an output signal actuating at least one of the plurality of controllable toy elements.

23. A programmable assembly toy system comprising:

a personal computer;

a multiplicity of toy elements which are joined to define a player selectable structure, the multiplicity of toy elements including:

a plurality of controllable toy elements; and at least one controller;

wherein the at least one controller has a data flow relationship with the personal computer, thereby to provide indirect control of said controllable toy elements by the personal computer, and wherein said at least one controller is remote from said computer and is operative to receive a logic command from the computer and to convert said logic command into an output signal actuating at least one of the plurality of controllable toy elements.

24. A programmable assembly toy system operative in conjunction with a personal computer and comprising:

a multiplicity of toy elements which are joined to define a player selectable structure, the multiplicity of toy elements including:

a plurality of controllable toy elements; and at least one controller;

wherein the at least one controller has a data flow relationship with the personal computer, thereby to provide indirect control of said controllable toy elements by the personal computer, and wherein said at least one controller is remote from said computer and is operative to receive a logic command from the computer and to convert said logic command into an output signal actuating at least one of the plurality of controllable toy elements.

25. A programmable assembly toy system operative in conjunction with a personal computer and comprising:

a multiplicity of toy elements which are joinable to define a player selectable structure, the multiplicity of toy elements including:

a plurality of controllable toy elements; and at least one controller;

wherein the at least one controller has a data flow relationship with the personal computer, thereby to provide indirect control of said controllable toy elements by the personal computer, and wherein said at least one controller is remote from said computer and is operative to receive a logic command from the computer and to convert said logic command into an output signal actuating at least one of the plurality of controllable toy elements.

26. A system according to claim 24 wherein said multiplicity of toy elements are joined to define a plurality of player selectable structures each including at least one controllable toy element.

27. A system according to claim 26 and wherein the at least one controller comprises a corresponding plurality of controllers having a wireless data flow relationship with the personal computer, each controller being disposed within an individual one of the plurality of player selectable structures and having a wired data relationship with controllable toy elements within said individual player selectable structure.

* * * * *